US005175563A

United States Patent [19]

Fushimoto et al.

[11] Patent Number: 5,175,563

[45] Date of Patent: Dec. 29, 1992

[54] IMAGE RECORDING APPARATUS AND INK SHEET CASSETTE USABLE IN THE IMAGE RECORDING APPARATUS

[75] Inventors: Hideo Fushimoto, Tokyo; Kazuyoshi Odagawa, Koshigaya; Noboru Shimoyama, Yokohama; Osamu Asakura, Tokyo; Yoshio Uchikata, Yokohama; Kenji Kawazoe, Kawasaki; Akihiko Sukigara; Yoshikazu Shibamiya, both of Tokyo; Shigeru Mizoguchi, Kawasaki; Toshihide Wada; Ko Hasegawa, both of Yokohama; Tadashi Hanabusa, Zushi; Katsuhiro Watanabe, Yokohama; Yuichi Watanabe, Machida, all of Japan

[73] Assignee: Canon Kabushiki Kaisha, Tokyo, Japan

[21] Appl. No.: 714,354

[22] Filed: Jun. 12, 1991

Related U.S. Application Data

[63] Continuation of Ser. No. 123,851, Dec. 2, 1987, abandoned.

[30] Foreign Application Priority Data

| | | | |
|---|---|---|---|
| Feb. 3, 1986 | [JP] | Japan | 61-20053 |
| Feb. 3, 1986 | [JP] | Japan | 61-20054 |
| Feb. 3, 1986 | [JP] | Japan | 61-20055 |
| Feb. 5, 1986 | [JP] | Japan | 61-22057 |
| Feb. 6, 1986 | [JP] | Japan | 61-23026 |
| Feb. 21, 1986 | [JP] | Japan | 61-35016 |
| Mar. 4, 1986 | [JP] | Japan | 61-45243 |
| Mar. 24, 1986 | [JP] | Japan | 61-63997 |

(List continued on next page.)

[51] Int. Cl.[5] ..... B41J 2/325; B41J 32/00

[52] U.S. Cl. ..... 346/76 PH; 400/120; 400/208

[58] Field of Search ..... 346/76 PH; 400/120, 400/208

[56] References Cited

U.S. PATENT DOCUMENTS

| | | | |
|---|---|---|---|
| 3,974,906 | 8/1976 | Lee et al. | 197/168 |
| 4,280,767 | 7/1981 | Heath | 400/216.2 |
| 4,384,797 | 5/1983 | Anderson et al. | 400/696 |
| 4,407,593 | 10/1983 | Haftmann | 400/208 |
| 4,428,695 | 1/1984 | Jamieson | 400/249 |
| 4,545,693 | 10/1985 | Bartlett et al. | 400/120 |
| 4,572,687 | 2/1986 | Croley et al. | 400/696 |
| 4,672,393 | 6/1987 | Uchikata et al. | 346/76 PH |
| 4,750,007 | 6/1988 | Suzuki | 346/76 PH |
| 4,880,324 | 11/1989 | Sato et al. | 400/241 |
| 4,880,686 | 11/1989 | Yaegashi et al. | 428/212 |

FOREIGN PATENT DOCUMENTS

| | | |
|---|---|---|
| 56-69187 | 2/1981 | Japan . |
| 56-162682 | 7/1981 | Japan . |
| 60-173358 | 4/1985 | Japan . |
| 61-144377 | 9/1986 | Japan . |
| 0295075 | 12/1986 | Japan . |

OTHER PUBLICATIONS

"Materials for Thermal Transfer Printing, 1984 Int'l Printing & Graphics Arts/Testing Conference".

*Primary Examiner*—Benjamin R. Fuller
*Assistant Examiner*—Huan Tran
*Attorney, Agent, or Firm*—Fitzpatrick, Cella, Harper & Scinto

[57] ABSTRACT

An image recording apparatus capable of recording an image in different color tones and an ink sheet cassette suitable for use in such an image recording apparatus. The image recording apparatus, when used in combination with the ink sheet cassette, is capable of producing clear image in different recording color tones. The recording color tone can be changed by changing, in accordance with the color tone data, the condition of separation of the ink sheet from the recording medium.

29 Claims, 75 Drawing Sheets

Foreign Application Priority Data

| | | | |
|---|---|---|---|
| Mar. 24, 1986 | [JP] | Japan | 61-65056 |
| Mar. 24, 1986 | [JP] | Japan | 61-65057 |
| Mar. 24, 1986 | [JP] | Japan | 61-65058 |
| Mar. 24, 1986 | [JP] | Japan | 61-65059 |
| Mar. 24, 1986 | [JP] | Japan | 61-65060 |
| Mar. 24, 1986 | [JP] | Japan | 61-65061 |
| Mar. 24, 1986 | [JP] | Japan | 61-65062 |
| Mar. 24, 1986 | [JP] | Japan | 61-65063 |
| Mar. 24, 1986 | [JP] | Japan | 61-65064 |
| Mar. 24, 1986 | [JP] | Japan | 61-65065 |
| Mar. 24, 1986 | [JP] | Japan | 61-65066 |
| Mar. 24, 1986 | [JP] | Japan | 61-65067 |
| Mar. 24, 1986 | [JP] | Japan | 61-65068 |
| Mar. 24, 1986 | [JP] | Japan | 61-65069 |
| Mar. 24, 1986 | [JP] | Japan | 61-65070 |
| Mar. 24, 1986 | [JP] | Japan | 61-65071 |
| Mar. 24, 1986 | [JP] | Japan | 61-65072 |
| Mar. 24, 1986 | [JP] | Japan | 61-65073 |
| Mar. 24, 1986 | [JP] | Japan | 61-65074 |
| Mar. 24, 1986 | [JP] | Japan | 61-65075 |
| Mar. 24, 1986 | [JP] | Japan | 61-65076 |
| Mar. 24, 1986 | [JP] | Japan | 61-65077 |
| Mar. 24, 1986 | [JP] | Japan | 61-65078 |
| Mar. 24, 1986 | [JP] | Japan | 61-65079 |
| Mar. 24, 1986 | [JP] | Japan | 61-65080 |
| Mar. 24, 1986 | [JP] | Japan | 61-65081 |
| Mar. 24, 1986 | [JP] | Japan | 61-65081 |
| Mar. 24, 1986 | [JP] | Japan | 61-65082 |
| Mar. 24, 1986 | [JP] | Japan | 61-65083 |

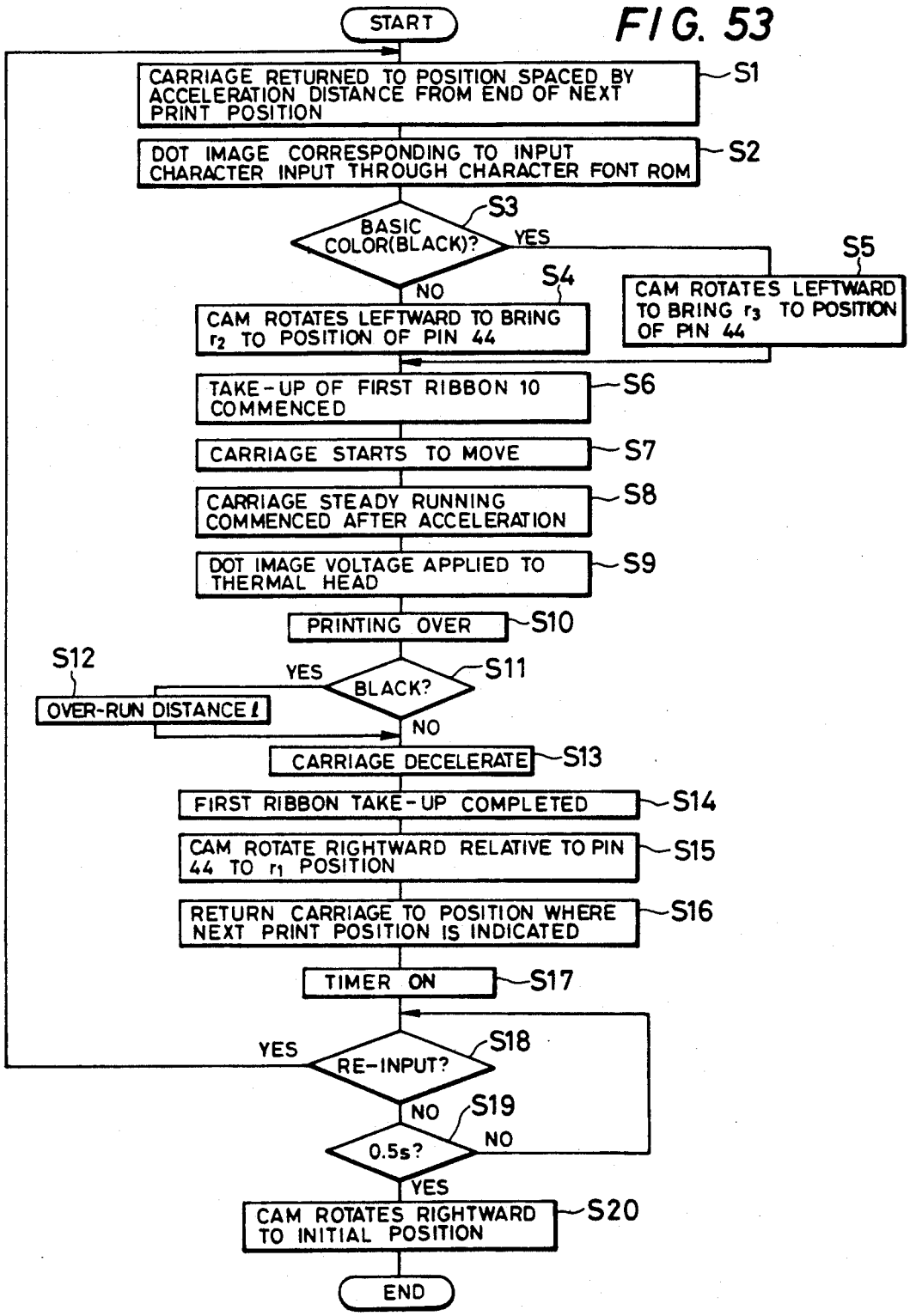
FIG. 53
START
CARRIAGE RETURNED TO POSITION SPACED BY ACCELERATION DISTANCE FROM END OF NEXT PRINT POSITION
S1
DOT IMAGE CORRESPONDING TO INPUT CHARACTER INPUT THROUGH CHARACTER FONT ROM
S2
BASIC COLOR(BLACK)?
S3
YES
NO
S4
CAM ROTATES LEFTWARD TO BRING r2 TO POSITION OF PIN 44
S5
CAM ROTATES LEFTWARD TO BRING r3 TO POSITION OF PIN 44
TAKE-UP OF FIRST RIBBON 10 COMMENCED
S6
CARRIAGE STARTS TO MOVE
S7
CARRIAGE STEADY RUNNING COMMENCED AFTER ACCELERATION
S8
DOT IMAGE VOLTAGE APPLIED TO THERMAL HEAD
S9
PRINTING OVER
S10
BLACK?
S11
YES
NO
S12
OVER-RUN DISTANCE ℓ
CARRIAGE DECELERATE
S13
FIRST RIBBON TAKE-UP COMPLETED
S14
CAM ROTATE RIGHTWARD RELATIVE TO PIN 44 TO r1 POSITION
S15
RETURN CARRIAGE TO POSITION WHERE NEXT PRINT POSITION IS INDICATED
S16
TIMER ON
S17
RE-INPUT?
S18
YES
NO
0.5s?
S19
NO
YES
CAM ROTATES RIGHTWARD TO INITIAL POSITION
S20
END CG ADDRESS MAP (36 x 40 dot)

IMAGE RECORDING APPARATUS AND INK SHEET CASSETTE USABLE IN THE IMAGE RECORDING APPARATUS

This application is a continuation of application Ser. No. 07/123,851 filed Dec. 2, 1987, now abandoned.

TECHNICAL FIELD

The present invention relates to an image recording apparatus suitable for use in various apparatus such as electronic typewriters, word processors, personal computers, printers and facsimiles. The invention also relates to an ink sheet cassette which is usable in such an image recording apparatus. More particularly, the present invention is concerned with an image recording apparatus which makes use of an ink sheet carrying an ink so as to record images with color tones corresponding to the color tones of an original, as well as an ink sheet cassette adaptable to the image recording apparatus.

BACKGROUND ART

Known image recording apparatus of the type mentioned above, capable of forming a color image record corresponding to given color data, generally require the use of a wide ribbon which is divided in the breadthwise directions into a plurality of regions carrying inks of different colors. In order to obtain multiple color images, therefore, it is necessary to shift the ribbon up and down so as to bring the tape region of the desired color to the recording section. Alternatively, an ink ribbon is used which is sectioned in the longitudinal direction into regions of different colors and the ribbon is driven forward, backward or stopped to bring and position the region of the desired color in the recording section.

Thus, the known apparatus of the kind described essentially requires a mechanism for shifting the tape up and down or back and forth, with the result that the size of the apparatus is impractically increased and the construction of the same is complicated undesirably.

Under this circumstance, the present inventors have developed a recording method and a recording medium which enable an image of a plurality of color tones with a simple arrangement, thereby overcoming the above-described problems of the prior art. The applicant has applied for Patents in Japan in a plurality of applications: Japanese Patent Application Nos. 260402/1984 (Application Date Dec. 12, 1984), 260403/1984 (Application Date Dec. 12, 1984), 136179/1985 (Application Date Jun. 24, 1985), 136180/1985 (Application Date Jun. 24, 1985), and 298831/1985 (Application Date Dec. 28, 1985). The applicant also has filed a patent application in the United States (Ser. No. 819,497 filed at the U.S. Patent Office on Jan. 16, 1986 now U.S. Pat. No. 4,880,324) and an EPC application (Application No. 86300322.4 EPC Application Date Jan. 17, 1986) claiming a Convention Priority on the later three of these Japanese Patent Applications.

The applicant also has obtained a Patent as Japanese Patent Application No. 260403/1984 which discloses a multi-color image recording technique making use of an ink tape or ribbon having first and second ink layers of different colors formed on a substrate tape one on the other. The printing is effected by applying heat from the reverse side and the substrate is on the carrier so as to transfer the ink to a recording medium. The time between the moment at which the heat is applied to and the moment at which the substrate is taken-off is varied so that the ink of the first layer or the second layer is selectively transferred to the recording medium thus enabling an image to be recorded in a plurality of colors.

The applicant also has obtained a Patent as Japanese Patent Application No. 298831/1985 which discloses a multi-color image recording technique making use of an ink sheet having at least two ink layers, i.e., first and second ink layers of different colors and an adhesive layer formed between the first and the second ink layer and/or between the first ink layer and the substrate. The printing is effected by keeping the ink sheet in contact with a recording medium applying heat energy to the ink sheet in accordance with recording information and the time between the moment at which the heat is applied to and the moment at which the substrate is taken-off is varied so that the ink of the desired layer is selectively transferred to the recording medium thus enabling an image to be recorded in selected color tones.

The present invention proposes a further improvement in the image recording apparatus of the type which are proposed in these preceding applications. The present invention enables the recording method or apparatus proposed in the preceding applications mentioned above to be carried out in a more effective manner.

DISCLOSURE OF THE INVENTION

According to the present invention, there is provided an image recording apparatus of the type adapted for recording an image on a recording medium by making use of an ink carried by an ink sheet, comprising: a mounting portion for mounting the ink sheet thereon; heating means for heating the ink sheet mounted on the mounting portion; and controlling means for controlling, in accordance with the color tone in which the recording is to be made on the recording medium, the condition of separation of the ink sheet from the recording medium after heating of the ink sheet by the heating means.

According to the invention, it is possible to form a clear image on the recording medium in color tones corresponding to the color tone information.

The term "condition of separation" in this specification is used to generally mean various conditions or factors such as timing, temperature and so forth at which the separation of the ink sheet from the recording medium is conducted. It is also to be understood that the term "color tone" generally includes various factors of colors such as type, intensity and density of colors. In this specification, the term "color tones" means not only different color tones but sometimes means the same color tone. It is also to be noted that the term "image" is used to generally mean letters, characters, numerals, figures and patterns.

BRIEF DESCRIPTION OF DRAWINGS

FIGS. 53 and 54 are illustrations of printing routine;

BEST MODE FOR CARRYING OUT THE INVENTION

Embodiments of the present invention will be described hereinunder with reference to the accompanying drawings. Although the following description specifically mentions two-color recording by way of example, it is to be understood that the invention does not exclude the use of an ink sheet in which a first ink layer and a second ink layer has the same color tone or an ink sheet which has one or more additional ink layers of different color(s) so as to realize a tri- or more-color recording. When the first ink layer and the second ink layer have the same color tone, the ink sheet can be used for recording of two portions in the same color tone.

A description will be made first as to the ink sheet used in the present invention. The ink sheet may be of the same type as those proposed in Japanese Patent Application Nos. 260403/1984 and 298831/1985.

Figure 1:
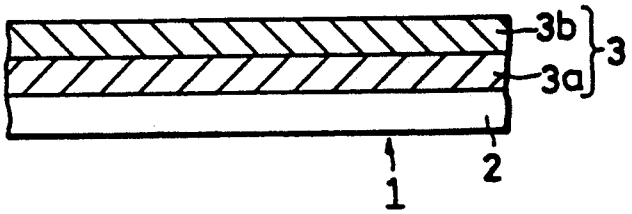
FIGS. 1 and 2 are thicknesswise sectional view of an ink ribbon suitable for use in an image recording apparatus carrying out the present invention.

FIG. 1 is a sectional view of an ink ribbon to which the present invention is applicable.

As will be seen from this Figure, the ink ribbon 1 has a sheet-like substrate 2 and a thermal transferable ink layer 3 formed on the substrate 2.

The thermal transferable layer 3 itself is composed of a plurality of layers: namely, a first ink layer 3*a* adjacent to the substrate 2 and a second ink layer 3*b* formed on the first ink layer 3*a*.

The substrate 2 may be made from a film or a sheet of a known material. Examples of such a material are films of plastics having comparatively high resistance to heat, such as polyester, polycarbonate, triacetyl, cellulose, nylon, polyimide and so forth, as well as cellophanes, parchment paper, capacitor paper and the like. When a thermal head is used as the source of heat used for transferring an image, the thickness of the substrate 2 preferably ranges between 1 and 15 μm. The thickness of the substrate 2, however, may be selected freely in the case where the heat source employed is one that can selectively heat one of the thermal transferable ink layers, for example a laser beam.

When a thermal head is used as the heat source, the surface of the substrate contacted by the thermal head is preferably coated by a heat-resistant protective layer formed of a suitable material such as a silicone resin, fluororesin, polyimide resin, melamine resin, nitrocellulose, and so forth, so that the substrate can exhibit higher resistance to heat. The provision of such a heat-resistant protective coating also affords a wider selection of the substrate material.

The first ink layer 3*a* is essentially required such that it can easily be separated from the second ink layer 3*b* when the ink ribbon is supplied with the heat energy. The first ink layer 3*a* also is required such that it can easily be separated from the substrate 2 when the separation of the substrate 2 from the recording medium is conducted after elapse of a comparatively long time from the supply of the heat energy, i.e., when the substrate of the ink ribbon which has been held in close contact with the recording medium is separated from the recording medium after the ink ribbon has been cooled appreciably as a result of moving away of the thermal head which has applied the heat energy to the ink ribbon 1.

To these ends, the first ink layer preferably contains at least 50% of a heat-meltable binder selected from the following groups: natural waxes such as whale wax, beewax, lanolin, carnauba wax, candelilla wax, montan wax, ceresin wax and so forth; petro-waxes such as paraffin wax, microcrystalline wax, and so forth; synthetic waxes such as oxidized wax, ester wax, low-molecular polyethylene, Fischer-Tropsch wax and so forth; higher fatty acids such as lauric acid, myristic acid, palmitic acid, stearic acid, behenic acid and so forth; higher alcohols such as stearyl alcohol, behenyl alcohol, and so forth; esters such as fatty acid esters of sucrose, fatty acid esters of sorbitan, and so forth; and amides such as oleyl amide. The first ink layer can further contain an elastomer selected from the group consisting of polyolefin resins, polyamide resins, polyester resins, epoxy resins, polyurethane resins, polyacrylic resins, polyvinyl chloride resins, cellulose resins, polyvinyl alcohol resins, petroleum resins, phenol resins, polyethylene resins, vinyl acetate resins, natural rubber, styrene butadiene rubber, isoprene rubber, chloroprene rubber, and so forth; as well as plasticizers, polyisobutylene, polybutene and an oil such as a mineral oil or a vegetable oil. The first ink layer can further contain a coloring agent and other additives. The first ink layer thus formed preferably has a melting point which ranges between 50 and 150° C., and a melting viscosity of about 500 cps at 150° C. as measured by a rotary viscometer.

The melting point in this embodiment is the temperature which is determined as follows. Namely, an apparent viscosity-temperature curve is drawn by testing an ink by means of Shimazu Flow-Tester CFT 500 under the load of 10 kg and at a temperature rising rate of 2° C./minute, and the point on this curve at which the ink starts to flow is determined as the melting pint.

On the other hand, the requisites for the second ink layer is that the second ink layer 3*b* can firmly deposit on the recording medium when molten and softened by the heat applied by a thermal head, and that the second ink layer 3*b* in the molten state can hardly mix with the first ink layer 3*a*. To these ends, the second ink layer preferably contains not less than 50% of the above-mentioned resin or resins as the heat-meltable binder, and also a wax, plasticizer, and an oil such as mineral oil or vegetable oil. The contents of these components are preferably selected such that the ink layer exhibits a melting point ranging between 60 and 150° C. and melting viscosity of 200 to 1,000,000 cps as measured by a rotary viscometer at such a melting point. It is of course possible to form the second ink layer 3b as a multiplicity of dots or to suitably roughen the surface of the second ink layer 3b, in order to improve the distinction of image formed by the second ink layer.

Preferably, the thermal transferable ink layer 3 has a total thickness which ranges between 2 and 20 μm. The thickness of the first ink layer 3a preferably ranges between 0.5 and 10 μm.

When the first ink layer 3a and the second ink layer 3b are required to have different color tones, it is preferred that the first ink layer 3a carries a darker color tone such as black, while the second ink layer 3b carries a brighter color tone such as yellow. When a color mixture of the first ink layer 3a and the second ink layer 3b is to be obtained, the arrangement may be such that the first and the second ink layers respectively have yellow and magenta color tones, so that the image can be recorded in magenta and red colors. It is thus possible to record an image in various combinations of two different colors, by varying the pigment concentrations and/or the thickness ratio of both ink layers.

Various dyestuffs and pigments, which are ordinarily used in the field of recording and printing, can be used as the coloring agent. The content of the coloring agent preferably ranges between 1 and 80% in each of the ink layers 3a and 3b. The ink layers 3a and 3b may contain, as desired, a dispersion agent or a filler such as fine metal powder, fine powder of inorganic matter, or metal oxide.

Preferably, the first and the second ink layers are made of materials which are not compatible with each other. It is to be understood, however, the separation of two ink layers is possible by virtue of the difference in the melting viscosity, even though the materials of two ink layers have compatibility with each other.

The ink ribbon suitable for use in this embodiment may be prepared by preparing an ink material for each of the ink layers 3a, 3b, in the form of a heat-meltable ink or a solution or a dispersion, by melting and blending the above-explained components such as the heat-meltable binder, coloring agent and additive or additives by making use of a dispersion device such as attritor, or, alternatively, kneading these components together with a suitable solvent, applying these ink materials to the substrate successively in layers such that the first ink layer underlies the second ink layer, and drying these ink materials as desired.

Another example of the ink ribbon 1 will be explained with reference to FIG. 2.

Figure 2:
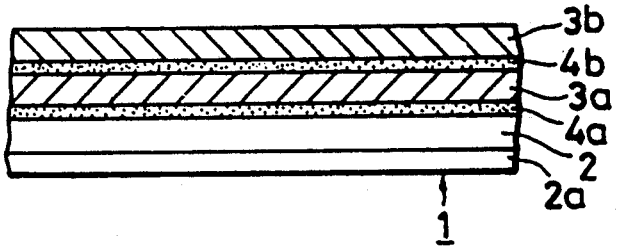

The ink ribbon 1 shown in FIG. 2 has a first adhesive layer 4a, a first ink layer 3a, a second adhesive layer 4b and a second ink layer 3b which are formed in the mentioned order on a substrate 2.

In this ink ribbon, the relationship between the adhesion force between the substrate 2 and the first ink layer 3a and the adhesion force between the first ink layer 3a and the second ink layer 3b is materially the same as that in the ink ribbon explained before in connection with FIG. 1. More specifically, the levels of the adhesion force between each adjacent layers vary in a manner shown in FIG. 4, assuming that the second adhesive layer 4b is made of an adhesive which drastically reduces its adhesion force as the temperature increases.

Figure 4:
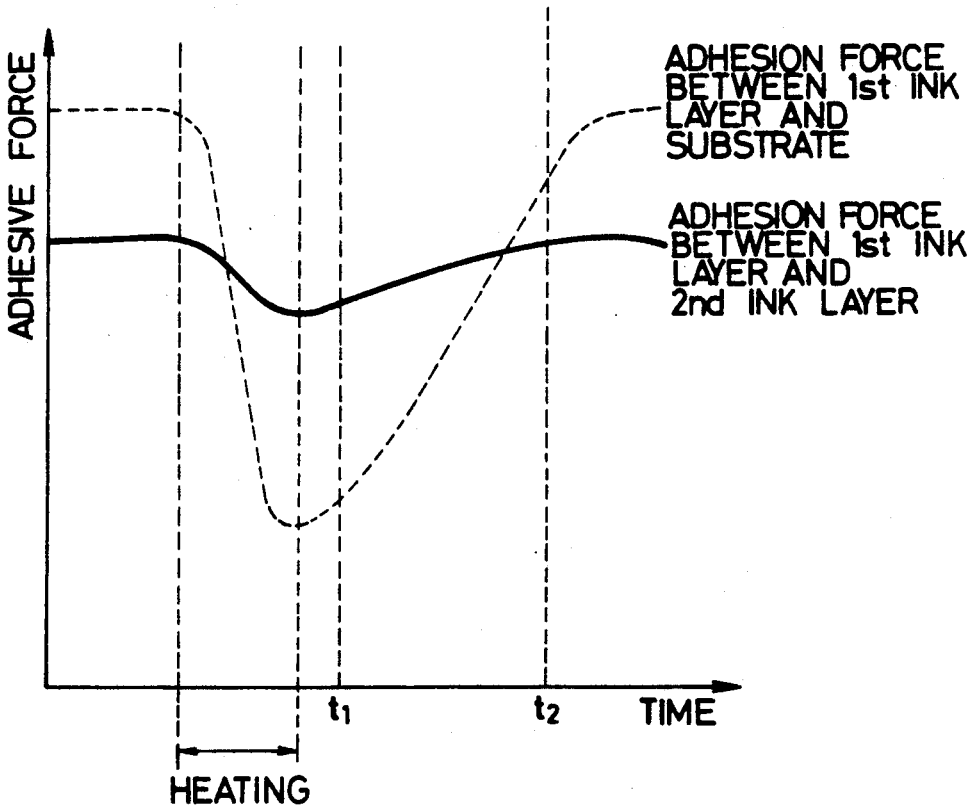

Further, when the change in the adhesion force of the first adhesive layer 4a is large and that of the second adhesive layer 4b is relatively small with respect to the temperature, the adhesion forces between the layers change as shown in FIG. 4.

The ink ribbon shown in FIG. 2 may have a heat-resistant protective layer 2a formed on the ribbon surface contactable with the thermal head. The heat-resistant protective layer 2a may be made from a suitable heat-resistant material such as a silicone resin, fluororesin, polyimide resin, melamine resin, nitrocellulose, and so forth. The use of such a heat-resistant protective layer improves the heat-resistance of the substrate 2 or, alternatively, makes it possible to use, as the substrate material 2, a material which has been considered as being unsuitable for the substrate material.

A description will be made hereinunder as an electronic typewriter, as an example of a recording apparatus capable of recording an image by means of an ink ribbon of the type explained above in multiple colors in accordance with color data.

The embodiment which will be described hereinunder is of the type in which heat energy is applied to an ink sheet and the separation of the ink sheet from a recording medium is conducted selectively either in a first mode in which the ink sheet is separated shortly after the application of heat and a second mode in which the ink sheet is separated after a suitable cooling period for cooling the ink sheet following the application of the heat, whereby the ink of one of a plurality of ink layers is selectively transferred to record the desired image in two colors.

Thus, the embodiment which will be described hereinbelow makes use of an ink ribbon 1 which has a first ink layer and a second ink layer formed on a substrate in the mentioned order, the first and the second ink layers having different color tones and less liable to be mixed with each other when heated, wherein the second ink layer being easily separable from the first ink layer in the state immediately after the application of heat and the first ink layer is easily separable when a suitable time has elapsed after the application of the heat. The ink ribbon 1 is superposed on a print paper such that the second ink layer contacts the print paper 12, and heat is applied to the ink ribbon 1 at the substrate. The timing of separation of the substrate from the print paper 12 is selected such that the separation takes place selectively between the second ink layer and the first ink layer or between the first ink layer and the substrate.

Figure 5:
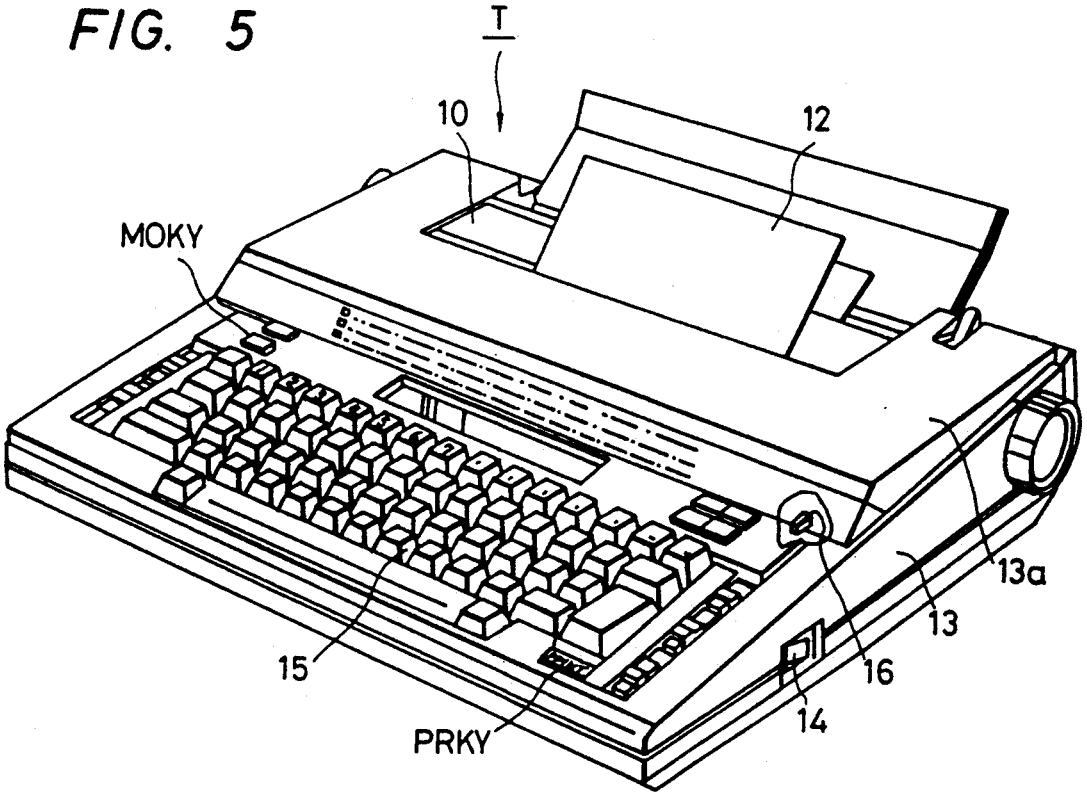
FIG. 5 is a perspective view of a typewriter to which an embodiment of the present invention is applied.

FIG. 5 is a perspective view of a typewriter T which is an embodiment of the recording apparatus of the invention suitable for carrying out the above-described recording method.

The typewriter T has a platen 10, a print paper 12, an outer structure 13, a power supply switch 14 and a keyboard 15. The outer structure 13 has a hood 13a which is associated with a hood switch 16 capable of producing an output signal upon sensing the opening of the hood 13a. This output signal is used as a signal for shifting a later-mentioned ink ribbon to a predetermined position and also as a signal for locking up the keyboard. The keyboard 15 has a mode key MOKY for setting various modes such as ribbon mode which will be explained later, and a printer command key PRKY. The typewriter T is comprised mainly of a printing section, input section, display section, control section and an external input/output interface section. The recording apparatus of the invention may be devoid of the input section and the display section.

Figure 6:
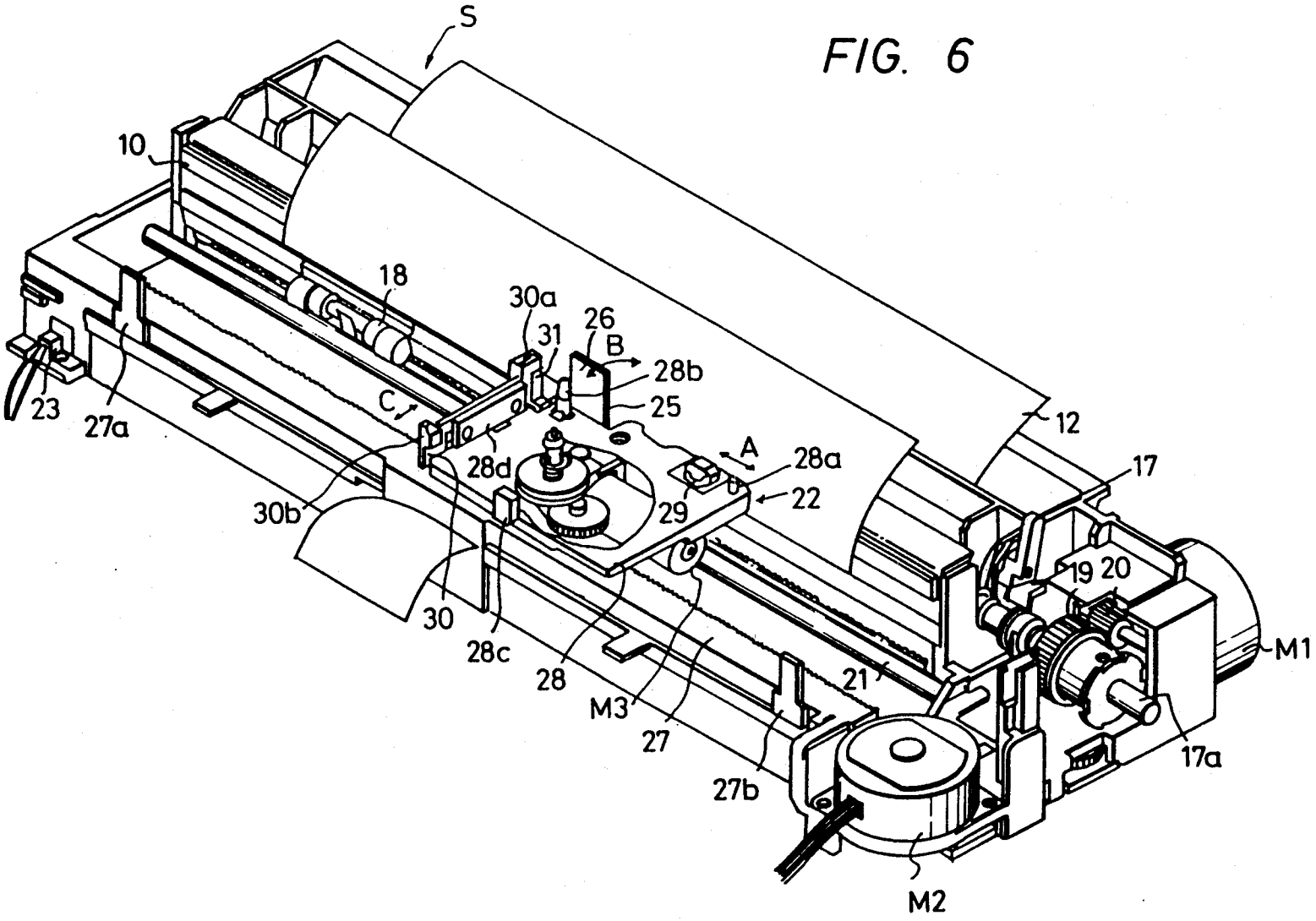
FIGS. 6 and 7 are perspective views of a recording section to which the present invention is applied.
Figure 7:
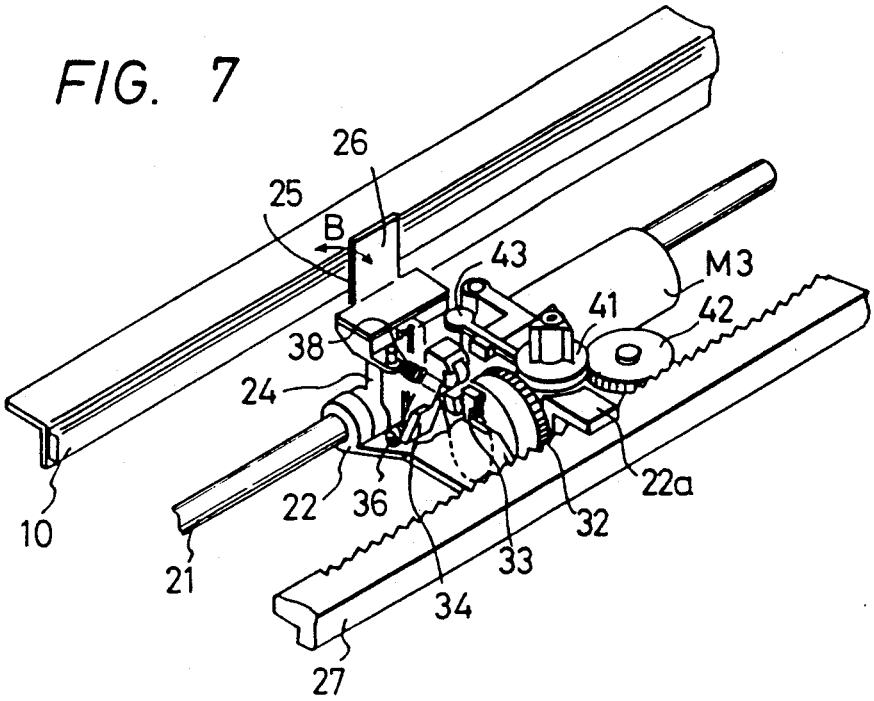

FIGS. 6 and 7 are perspective views of the recording section incorporated in this embodiment.

The print paper 12 is backed up by the platen 10 and is pressed by pinch rollers 18 onto rubber portions (not shown) of paper feed rollers 17. A gear 19 is fixed to the shaft 17*a* of the paper feed roller 17 and is drivingly connected to the output shaft of a paper feed motor M1 through a reduction gear 20 so that the paper feed rollers 17 rotate as the paper feed motor M operates so as to feed the print paper 12. The platen 10 keeps the print paper 12 at the instant position when the recording is conducted by a later-mentioned thermal head 25 adapted to contact with the print paper 12.

The typewriter T also has a carrier 22 which is adapted to move reciprocally in a manner explained hereinunder. A shaft 21 is disposed on the front side of the platen 10 so as to extend in parallel with the latter. The shaft 21 guides and supports the carrier 22 (see FIG. 7) such that the carrier 22 is movable along the shaft 21 in the directions of arrows A. Thus, the carrier 22 is movable in the directions perpendicular to the directions of feed of the recording paper 12 indicated at an arrow S.

A belt 23 is connected at both ends thereof to the carrier 22 and is stretched between a pair of pulleys (not shown). These pulleys are drivingly connected to a carrier motor M2 through suitable gear trains (not shown). The arrangement is such that, as the carrier motor M2 operates, the pulleys are rotated so as to drive the belt 23 thereby causing the carrier 22 to be moved reciprocally along the shaft 21 as indicated by the arrows A. At the same time, a limit sensor 23 for detecting the position of the carrier 22 is provided at a position near the home end of the stroke of the carrier 22.

The carrier 22 has a head holder 24 (see FIG. 7) which is guided for rotation about the shaft 21. A heat sink 26 with a thermal head attached thereto is attachable to the head holder 24. The carrier 22 has a guide portion 22*a* which is integral therewith and which is supported and guided by a rack 27. The rack 27 is provided on both ends thereof with projections 27*a* and 27*b*. The carrier 22 is provided with a carrier table 28 for mounting a later-mentioned ink ribbon cassette 50 (see FIG. 12) thereon. The table 28 has a sensor 29 adapted for sensing the presence or absence of the ink ribbon cassette 50, type of the ink ribbon cassette if any, and the end of the ink ribbon 1 on the cassette. The carrier table 28 supports a connector lever 30 which in turn is guided by a guide 22*a* for movement in a direction perpendicular to the axis of the platen 10, i.e., for movement in the directions indicated by arrows C. The lever 30 engages with a connecting member 31 which is secured to the heat sink 26. The arrangement is such that, as the heat sink 26 is swung towards and away from the platen 10 as indicated by arrow B, the lever 30 is moved towards and away from the platen 10 as indicated by the arrow C. The connecting lever 30 is provided with an index portion 30*a* so that the user can confirm the next print position. The connecting lever 30 is provided on the rear end thereof with an engaging portion 30*b* which acts, upon engagement with a switching lever 62 of a later-mentioned cassette 50, to push the lever 62 up towards the platen 10.

Thus, in this embodiment, the index 30*a* is provided on the connecting lever 30 provided in the vicinity of the thermal head 25 and contributes to the control of the separating condition. Therefore, when the recording is to be done at the position indicated by the index 30*a*, the thermal head is required only to move a short distance indicated by the index 30*a*, so that the recording speed is not lowered and the generation of noise is suppressed despite the provision of the index.

A description will be made hereinunder as to the case where a cassette 50 is detachably mounted on the carrier table 28. The carrier table 28 is provided on the upper surface thereof with pins 28*a* and 28*b* fixed thereto, and a resilient hook 28*c* provided on one side edge thereof. A cassette 50, which will be detailed later in connection with FIG. 13, has a lower cassette case 52 provided with openings 52*h* and 52*i* adapted to receive the pins 28*a* and 28*b* and also with a retaining portion 52*j* with which the hook portion 28*c* of the carrier table 28 resiliently engages, so that the cassette 50 can be freely mounted on and demounted from the carrier table 28. The carrier table 28 can carry not only two-color ribbon cassettes but also ordinary mono-color ribbon cassette in the same manner.

A description will be made hereinunder as to the mechanism for moving the thermal head 25 up and down.

FIGS. 8, 9, 10 and 11 show an example of the mechanism which drives the head 25 into pressure contact with the platen (down) and away from the platen (up) and which winds or takes up the ribbon in a controlled manner.

Figure 10:
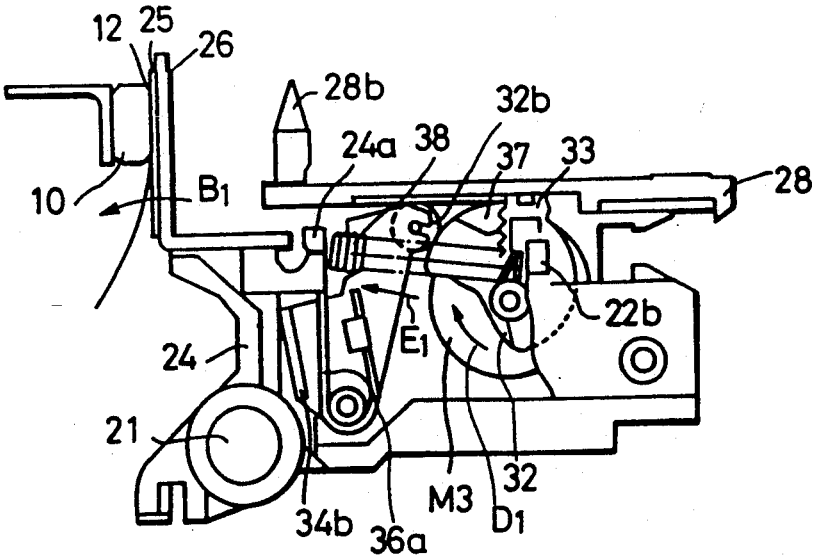
FIGS. 10 and 11 are side elevational views of the mechanisms.
Figure 11:
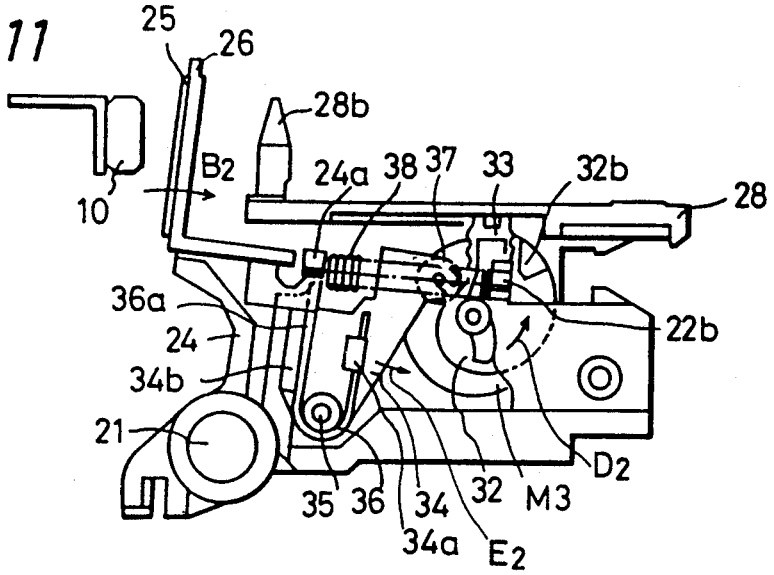

The carrier 22 carries an up/down motor M3 the power of which is transmitted to a gear 32*a* on a cam 32 through a motor gear (not shown) and a reduction gear 31 so as to cause the cam 32 to rotate. The cam 32 is provided with a cam projection 32*b* which is adapted for contacting with a stopper 33 provided on the carrier 22 when the cam 32 is rotated clockwise (direction of an arrow D1) as shown in FIG. 10 or counterclockwise (direction of arrow D2) as shown in FIG. 11, so as to limit the rotation of the cam 32. The stopper 33 is made of an elastic material such as rubber so as to damp any impact which will be caused when the same is collided by the cam 32.

An up/down lever 34 is mounted on the carrier 22 for rotation about a shaft 35 (see FIG. 11). A torsion coiled spring 36 is charged between protrusions 34*a* and 34*b* (see FIG. 11) of the up/down lever 34. A roller 37 is rotatably guided and supported by one end of the up/-down lever 34. A head reset spring 38 acts between spring retainers 24*a* and 22*b* which are provided on the head holder 24 and the carrier 22, respectively, so as to urge the head holder 24 away from the platen 10 as indicated by an arrow 2B in FIGS. 9 and 11. The urging force acting on the head reset spring 38 is transmitted from the pressing portion 24*b* of the head holder 24 to the arm portion 36*a* of the torsion coiled spring 36 and further to the up/down lever 34. In consequence, the up/down counter 34 is urged by the head reset spring 38 away from the platen 10 as indicated by an arrow E2 (see FIG. 11), whereby the roller 37 provided on the up/down counter 34 is pressed onto the cam 32.

Thus, the head 25 is rotatable towards and away from the platen 10 by the power of the motor M3.

A mechanism for taking up the ink ribbon 1 will be explained hereinunder. The carrier 22 is provided with a take-up shaft 39 which rotatably supports a take-up lever 40. The take-up lever 40 in turn supports at its upper portion a take-up clutch 41. The take-up lever 40 rotatably supports a take-up gear 42. The take-up clutch 41 is provided with a gear portion (not shown) which constitutes a sun gear of a planetary gear while the take-up gear 42 constitutes a planet gear of the planetary gear.

Figure 8:
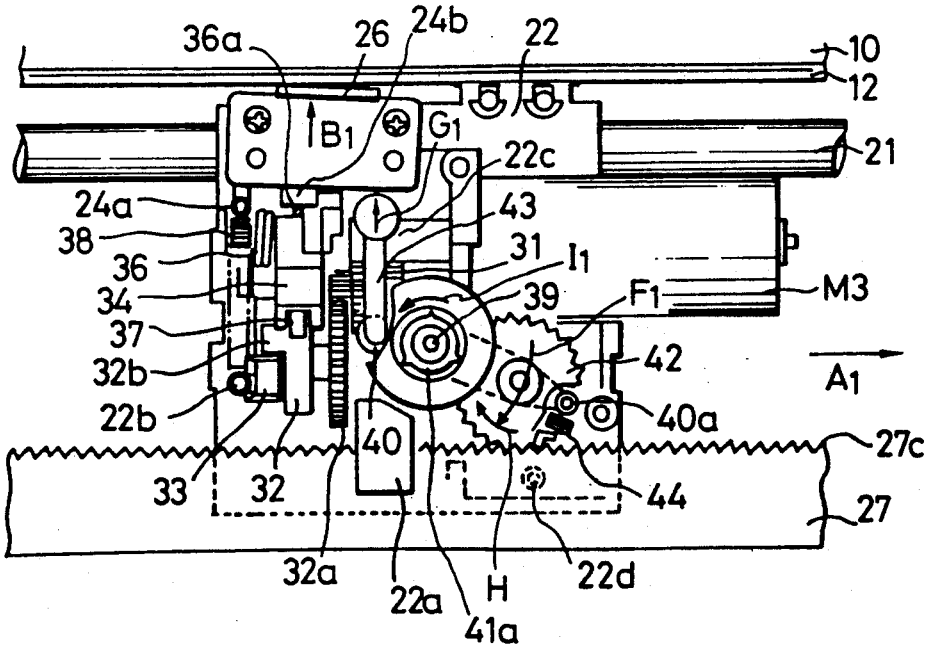
FIGS. 8 and 9 are plan views of mechanisms for rotating a head and for taking-up the ribbon.
Figure 9:
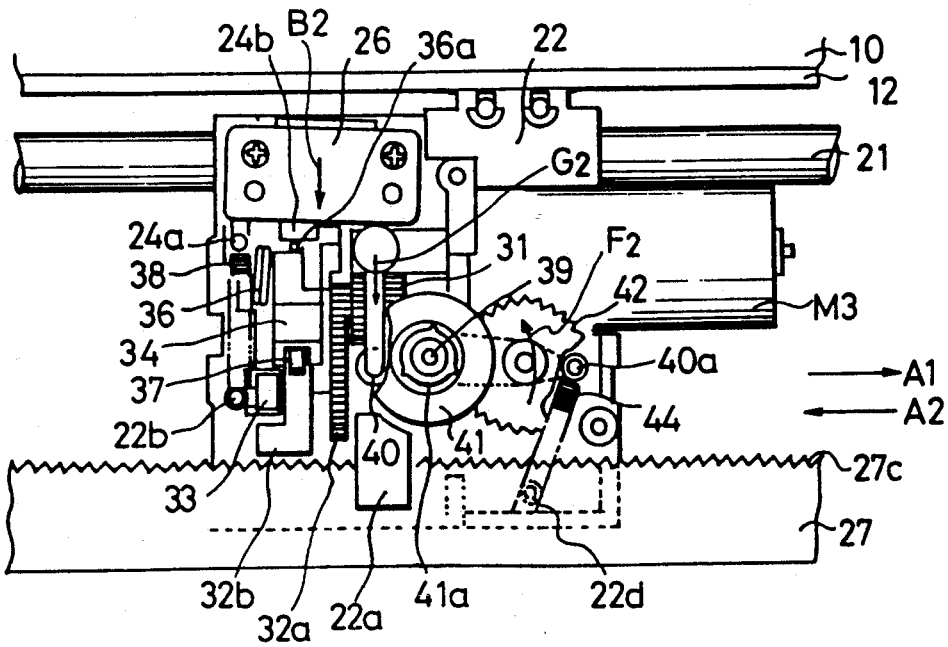

The carrier 22 is provided with a guide portion 22c which carries a take-up switching lever 43 for movement in the direction of an arrow G1 (FIG. 8) and an arrow G2 (FIG. 9). The take-up switching lever 43 has one end which is engageable with the take-up lever 40. A take-up lever pressing spring 44 acts between a spring retainer 22d provided on the carrier 22 and a spring retainer 40a on the take-up lever 40, so as to urge the take-up lever 40 in the direction of an arrow FI. The urging force produced by the take-up lever pressing spring 44 is transmitted through the take-up lever 40 to the take-up switching lever 43 thereby urging the take-up switching lever 43 in the direction of the arrow G1 into pressure contact with heat sink 26. The take-up clutch 41 is provided with a hub-receiving portion 41a so that a take-up hub can fit in the ink ribbon 1. A friction clutch (not shown) is disposed between the hub-receiving portion 41a of the take-up clutch 41 and a gear portion (not shown) so that the rotation of the gear (not shown) can be transmitted to the hub-receiving portion 41a.

The operation for moving the head into pressure contact with the platen (head down) and away from the platen (head up) and the operation for taking up the ribbon will be described hereinunder.

FIGS. 8 and 10 show the head contact (head down) condition and the condition for taking up the ribbon. As an up/down motor M3 is driven clockwise, the cam 32 is rotated through the reduction gear 31 in the direction of the arrow D1 (FIG. 9) so that the cam projection 32b on the cam 32 is brought into contact with the stopper 33. The rotation of the cam 32 in clockwise direction (arrow D1) (FIG. 9) causes the radius of rotation of the cam 32 at the point of contact between the cam 32 and the roller 37 provided on the up/down lever 34. In consequence, the up/down lever 34 is rotated counterclockwise (direction of arrow E1) (FIG. 10) against the urging force of the head reset spring 38. The force of the up/down lever 34 is transmitted from the arm 36a of the torsion coiled spring 36 provided on the up/down lever 34 so as to cause the head holder 24 to be rotated counterclockwise (direction of arrow B1) (FIG. 10), with the result that the thermal head 26 adhered to the heat sink 26 provided on the head holder 24 is pressed against the platen 10 through the print paper 12. Thus, during recording by means of the head 25, the head 25 contacts the print paper 12 so that the print paper 12 is kept at the instant position by means of the platen 10.

The radius of rotation of the cam 32 is increased even after the thermal head 25 has been brought into contact with the platen 10, so that the up/down lever 34 is further rotated counterclockwise (direction of arrow E1) (FIG. 10). In this state, however, the head holder 24 is prevented from moving because the thermal head 25 is stopped by the platen 10. This in turn limits the movement of the arm portion 36a of the torsion coiled spring 36 which contacts the pressing portion 24b of the head holder 24. Then, as the up/down lever 34 rotates counterclockwise (direction of arrow E1) (FIG. 10), the torsion coiled spring 36 leaves the protrusion of the up/down lever 34b so that the torsion coiled spring 36 is further charged up. Since the arm portion 36a of the torsion coiled spring 36 has left the protrusion 34b of the up/down lever 34, the force charged in the torsion coiled spring 36 is transmitted to the pressing portion 24b of the head holder 24, whereby the thermal head 25 is pressed onto the platen 10 through the print paper 12 placed therebetween.

When the cam projection 32b of the cam 32 shown in FIG. 10 is held in contact with the stopper 33, the thermal head 25 is pressed onto the platen 10 by a predetermined force.

A description will be made hereinunder as to the ribbon take-up mechanism.

The movement of the heat sink attached to the head holder 24 towards the platen 10 (direction of the arrow B1) causes the take-up switching lever 43 to move in the direction of the arrow G1 by the force of the take-up lever pressing spring 44. In consequence, the take-up lever 40 is rotated in the direction of the arrow Fl so that the take-up gear 42 provided on the take-up lever 40 meshes with the teeth 27c provided on the rack 27. When the thermal head 25 is pressed onto the platen 10, the action of the take-up lever 40 is limited by the position of contact between the take-up gear 42 and the rack 27 so that the take-up gear 42 is urged onto the rack 27. In this state, as the carrier 22 is moved in the recording direction shown by the arrow A1, the take-up gear 42 is rotated clockwise as indicated by an arrow H1 so that the rotation of the take-up gear 42 is transmitted to the take-up clutch 41 whereby the hub-receiving portion 41a is rotated counterclockwise as indicated by an arrow I1.

It is thus possible to take-up the ink ribbon 1 in the cassette 50, provided that the take-up hub 55 on the cassette 50 is correctly received in the hub-receiving portion 41a after the mounting of the cassette 50 on the carrier table 28.

The operation for moving the head 25 away from the platen 10 (head up) will be described hereinunder.

FIGS. 9 and 11 show the state in which the head 25 has been moved up away from the platen and the state in which the take-up of the ribbon has been ceased.

The up/down motor M3 is rotated counterclockwise, i.e., in the direction reverse to that for the head down operation. In consequence, the cam 32 is rotated through the reduction gear 31 in the direction of the arrow D2 (FIG. 11) so that the cam projection 32b of the cam 32 is brought into contact with the stopper 33. As a result of the rotation of the cam 32 in the direction of the arrow D2 (FIG. 11), the radius of rotation of the cam 32 at the point of contact between the cam 32 and the roller 37 on the up/down lever 34 is reduced. In consequence, the up/down lever 34 is rotated in the direction of the arrow E2 (FIG. 11) by the urging force of the reset spring 38, whereby the heat sink 26 and the thermal head 25 on the head holder 24 are moved away from the platen 10. Meanwhile, the movement of the heat sink 26 in the direction of the arrow B2 causes the take-up switching lever 43 to move in the direction of the arrow G2, so that the take-up switching lever 43 acts to rotate the take-up lever 43 in the direction of an arrow F2 against the force of the take-up lever pressing spring 44, thereby moving the take-up gear 42 away from the rack 27.

In the non-recording state of the apparatus in which the head 25 has been moved away from the platen 10 as described, the hub-receiving portion 41a of the take-up clutch 41 cannot rotate even though the carrier 22 is moved in the direction of the arrow A1 or A2 along the shaft 21, so that the ink ribbon 1 cannot be taken up. Therefore, the take-up of the ink ribbon 1 is not conducted even though a later-mentioned switching lever 62 and a separation roller 54 have been moved apart from the platen 10 in connection with the movement of the head 25 as will be explained later.

The urging force of the head reset spring 38 is not so strong as to be able to charge up the torsion coiled spring 36 but is large enough to resist the force produced by the take-up lever pressing spring. The positions of the thermal head 25 and the take-up gear 42 are determined by the radius of the cam 32.

The arrangement may be such that the up/down motor M3 is operated for a predetermined time which is long enough to enable the cam 32 through a required angle or such that the motor M3 is stopped upon detection of a lock current of the motor due to lock-up of the cam 32 by abutment of the cam projection **32*b* and the stopper 33. In this embodiment, the operation of the up/down motor M3 is controlled in accordance with the output from a sensor (not shown) capable of detecting the position of the cam 32**.

In this embodiment, the head 25 and other parts such as the switching lever and the separation roller interlocked with the head 25 are moved away from the platen 10 in accordance with the movement of the head 25, so that unnecessary take-up of the ink ribbon is prevented during returning of the carrier 22 to the home position, as well as when a gap of a size greater than a predetermined size, i.e., a skip, exists between images to be recorded or when only parts of the image are to be recorded, whereby wasteful consumption of the ink ribbon is avoided.

Figure 12:
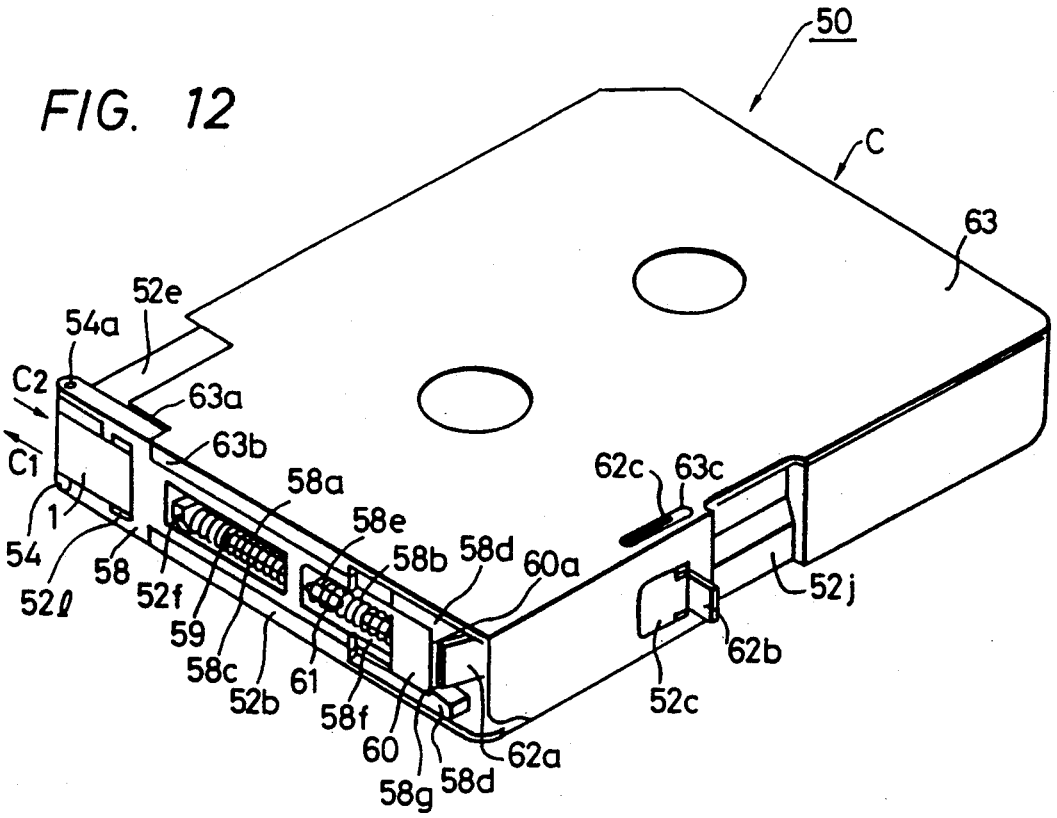
FIG. 12 is a perspective view of a two-colored ribbon cassette.

A description will be made hereinunder as to the ink ribbon cassette, with specific reference to FIGS. 12 and 13.

The ink ribbon cassette 50 mentioned before is constituted by a cassette lower case 52 and a cassette upper case 63 which in combination constitute a case c. With the ink ribbon 1 accommodated in the case c, the ink ribbon cassette 50 is detachably mounted on the carrier table 28.

Figure 13:
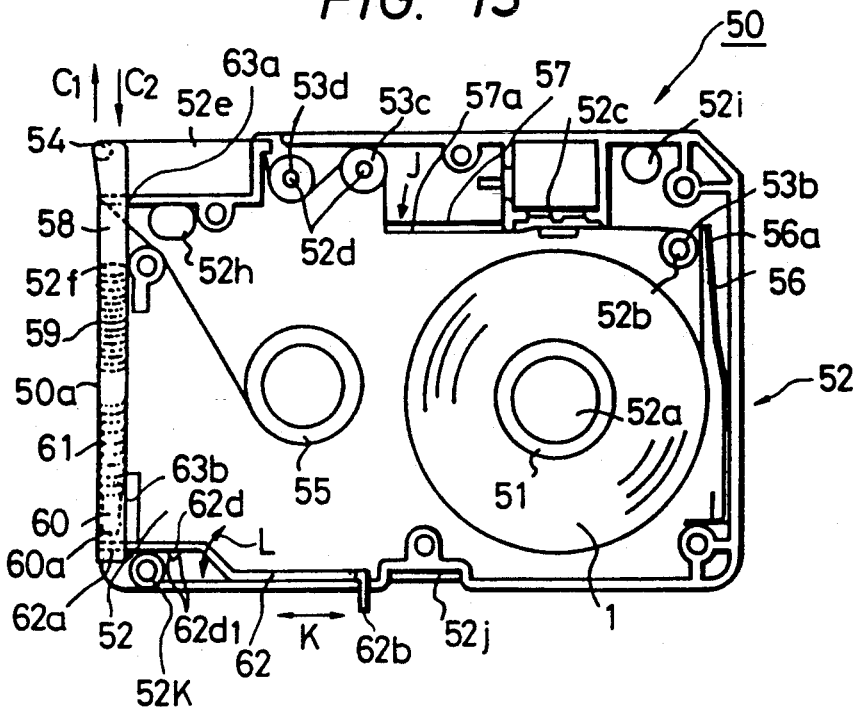
FIG. 13 is a plan view of the interior of the ribbon cassette shown in FIG. 12.

Referring to FIG. 13, the ink ribbon 1 is wound on a core 51 and fits around a projection **52*a* formed on the cassette lower case 52. The ink ribbon 1 is partly extracted through rollers 53*b*, 53*c* and 53*d* which are rotatably mounted on the projection 52*b* of the cassette lower case 52, ink ribbon detection window 52*c* and a projection 52*d* of the cassette lower case so as to be exposed to the outside of the case c and is then guided into the case c through an opening 52*l* after being guided by the separation roller 54, so as to be taken-up on the take-up hub 55**.

The arrangement is such that the opening **52*e* of the cassette correctly faces the head 25 on the main body of the apparatus when the cassette 50 has been set in the right position on the table 28, so that the portion of the ink ribbon exposed to the outside of the case c through this opening 52*e* can be heated by means of the thermal head 25 which generates heat in accordance with the recording information. The ink ribbon 1 is urged onto the roller 53*b* by means of the pressing spring 56 provided on the cassette lower case 52. A felt 56*a* adhered to the spring 56 prevents the ink ribbon 1 from being damaged by the spring 56 which acts on the ink ribbon 1**.

On the other hand, a tension spring 57 urges the ink ribbon 1 in the direction of the arrow J so as to take-up any slack of the ink ribbon 1. The tension spring 57 is provided on the cassette lower case 52 and is adapted for resiliently pressing the ink ribbon 1 at the upstream side of the roller **53*c*, 53*d* as viewed in the direction of take-up of the ink ribbon 1. When the separation roller 54 is displaced as a result of movement of a later-mentioned separation lever 58, the path of the ink ribbon 1 is changed tending to allow the ink ribbon 1 to slack. Such a slack, however, can be promptly taken-up by the resilient force produced by the tension spring, thus preventing the ink ribbon 1 from being kept in loosened state. The tension spring 57 also is provided with a felt 57*a* adhered to the portion thereof contactable with the ink ribbon 1, thereby protecting the ink ribbon 1. The protecting felt 57*a* may be substituted by a coating provided on the surface of the tension spring 57**.

The separation lever 58 mentioned before is disposed so as to be able to slide along the same side **50*a* of the cassette 50 as the opening 52*e*. During the sliding movement of the separation lever 58, the inner end portion of the lever 58 is guided by the end 63*a* of the cassette upper case 63, the guide 63*b*, the end (not shown) of the cassette lower case 52 and a guide (not shown), while the outer end of the lever 58 is guided by a downward bend 63*b* of the cassette upper case 63 and the upward bend of the cassette lower case 52. The aforementioned separation roller 54 is secured to the end of the lever 58 for rotation about a shaft 54*a*. The lever 58 is provided with an upper opening 58*a* and a lower opening 58*b*. The upper opening 58*a* receives a projection 52*f* of the lower case and a reset spring 59 is provided along a guide bar 58*c* so as to act between the projection 52*f* and the lever 58. In consequence, the lever 58 is urged downward by the resiliency of the spring 59 as indicated by an arrow C2. The lower opening 58*b* is provided with a slider 60 which is slidable with respect to the guide 58*d* along the guide 58*d*. Furthermore, a pressing spring 61 is provided such as to surround a guide bar 58*e* fixed to the lever 58 and a guide bar 58*f* fixed to the slider 60, so that the slider 60 is normally urged downward as indicated by an arrow C2 into contact with a stopper portion 58*g* of the guide 58*d***.

The switching lever 62 has an end **62*a* which engages with the lower end 60*a* of the slider 60. In this state, the switching lever 62 is disposed between the cassette lower case 52 and the cassette upper case 63 for sliding movement as indicated by an arrow K and for rotation as indicated by an arrow L. The rear end of the switching lever 62 is provided with a bent switching portion 62*b* which is engageable with the aforementioned projections 27*a*, 27*b* on the main part of the apparatus so as to cause the lever 62 to slide to the left and right as indicated by an arrow K. The stroke or range of movement of the lever 62 is limited by both ends of the opening 52*c*. The center or fulcrum of rotation of the lever 62 is constituted by a projection 62*c* of the lever 62 which engages with the lower case 52 and an elongated opening 63*c* formed in the upper case 63**.

The lever 62 is provided on its end with a projection **62*d* which prevents the lever from moving to the left and right unintentionally. The projection 62*d*, however, has a slant surface 62*dl* so as not to hinder the leftward and rightward movement of the lever 62*b* caused by the contact between the lever 62 and the projections 27*a*, 27*b* on the main part of the apparatus. Namely, when the lever 62 is moved, the roller 52*k* rolls under the projection 62*d* so that the movement of the lever 62** does not encounter any resistance.

With this arrangement of the cassette 50, when the switching portion **62*b* contacts the projection 27*b* on the main part of the apparatus, the lever 62 is moved to the left so that the end 62*a* projects beyond the side edge 50***a* of the cassette, and the thus projecting end 62*a* is brought to a position where it engages with the engaging portion 30*b* on the main body. Then, as the connecting lever 30 is moved towards the platen 10 as a result of operation of the motor M3, the engaging portion 30*b* engages with the end 62*a* so as to urge the lever 62 towards the platen 10. This movement of the lever 62 causes the lever 58 to move towards the platen 10, i.e., in the direction of the arrow C1, against the biasing force of the reset spring 59. After the lever 58 is pressed onto the platen 10 through the intermediary of the ink ribbon 1 and the print paper 12, the slider 60 is pressed towards the platen 10, i.e., in the direction of the arrow C1, against the force of the pressing spring 61. This operation is continued until the lever 58 is pressed onto the platen 10 by the force of the pressing spring 61.

Thus, the print paper 12 and the ink sheet 1 run in mutual contact down to the position of the separation roller 54 and are separated from each other as they pass the separation roller 54.

In this embodiment, the switching lever 62 is so arranged that the separation roller 54 is lightly pressed onto the platen 10 by the force of the spring 61. Since the separation roller 54 is stably held in contact with the platen 10 by virtue of the resiliency, it is possible to avoid unfavorable effects such as deterioration in the quality of the recorded image due to offset, as well as inferior feed such as wrinkling or slanting of the ink sheet.

Conversely, when the switching portion 62*b* has contacted the projection 27*a* on the main part of the apparatus, the lever 62 is moved to the right so that the end 62*a* thereof is retracted to the inner side of the side edge 50*a* of the cassette. In this state, the lever 62 is not pushed even though the connecting lever 30 on the main part of the apparatus is moved towards the platen 10 but is kept retracted away from the platen 10 by the force of the reset spring 59. In consequence, the separation roller 54 is kept away from the platen 10 so that the heated print paper 12 and the ink sheet 1 are separated from each other soon after they have left the end of the thermal head 25.

Figure 14:
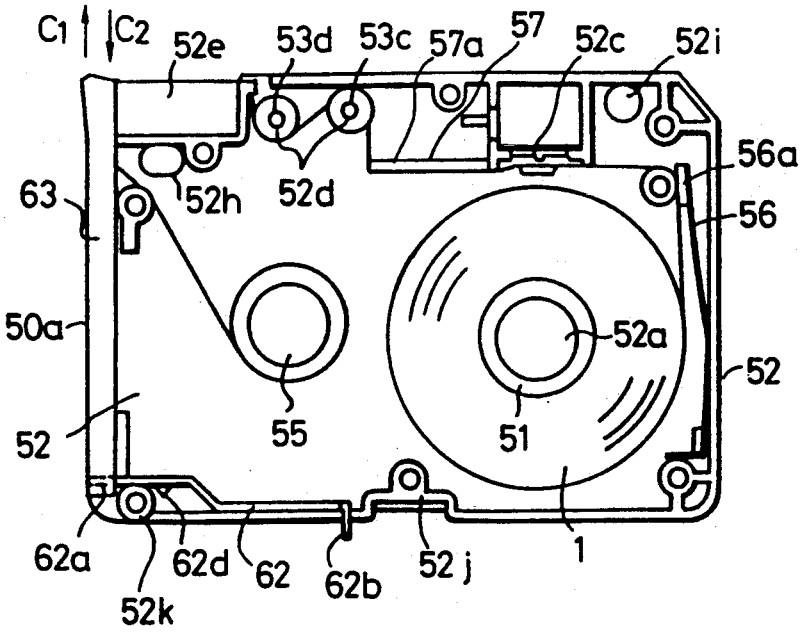
FIG. 14 is a perspective view of another embodiment of two-colored ribbon cassette.

FIG. 14 shows another example of the ink ribbon cassette. In this example, a single contact lever 63 is used to play the roles of the separation lever 58, separation roller 54, reset spring 59, slider 60 and the pressing spring 61 which are used in the example described before.

The contact lever 63 is guided by the cassette lower case 52 and the cassette upper case (not shown) for movement in the directions of arrows Cl and C2. The contact lever 63 is engageable with the switching lever 62 so that it is moved in the directions of the arrows Cl and C2 in response to the movement of the switching lever 62.

With this arrangement of the cassette, when the switching portion 62*b* contacts the projection 27*b* on the main part of the apparatus, the lever 62 is moved to the left so that the end 62*a* projects beyond the side edge 50*a* of the cassette, and the thus projecting end 62*a* is brought to a position where it engages with the engaging portion 30*b* on the main body. Then, as the connecting lever 30 is moved towards the platen 10 as a result of operation of the motor M3, the engaging portion 30*b* engages with the end 62*a* so as to urge the lever 62 towards the platen 10. This movement of the lever 62 causes the contact lever 63 to move to a position which is almost the same as the position where the thermal head 25 opposes the platen 10, and the contact lever 63 is stopped at a position in close proximity of the platen 10 or in contact with the platen 10.

Thus, the print paper 12 and the ink sheet 1 run in mutual contact down to the position of the separation roller 54 and are separated from each other as they pass the separation roller 54.

Conversely, when the switching portion 62*b* has contacted the projection 27*a* on the main part of the apparatus, the lever 62 is moved to the right so that the end 62*a* thereof is retracted to the inner side of the side edge 50*a* of the cassette. In this state, the lever 62 is not pushed even though the connecting lever 30 on the main part of the apparatus is moved towards the platen 10 but is kept retracted away from the platen 10 by the force of the reset spring 59. In consequence, the contact lever 63 is kept away from the platen 10 so that the heated print paper 12 and the ink sheet 1 are separated from each other soon after they have left the end of the thermal head 25.

A description will be made hereinunder as to the manner in which the image recording color is changed in this embodiment of the recording apparatus. Although red and black colors are specifically mentioned in the following description, these colors are only illustrative and the image can be recorded also in other colors equally well.

FIGS. 15 to 18 are plan views of the recording apparatus of the present invention illustrating the operation for recording an image in two colors. In these Figures, the recording apparatus is shown in a state ready for the recording with the ink ribbon cassette 50 mounted on the carrier table 28.

In this embodiment, an image is recorded by selective use of two colors, i.e., red and black, in accordance with the color information given externally, by making use of the ink ribbon cassette 50 of the type described hereinbefore.

The description will be commenced first with reference to the image recording in red color.

Figure 15:
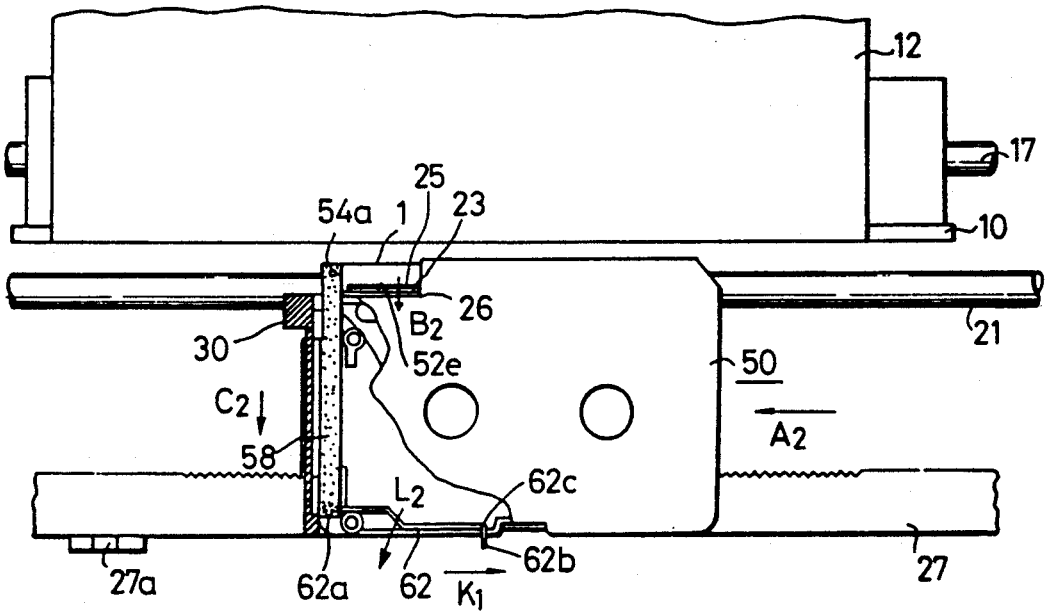
FIGS. 15 to 18 are plan views explanatory of the color change-over operation.
Figure 16:
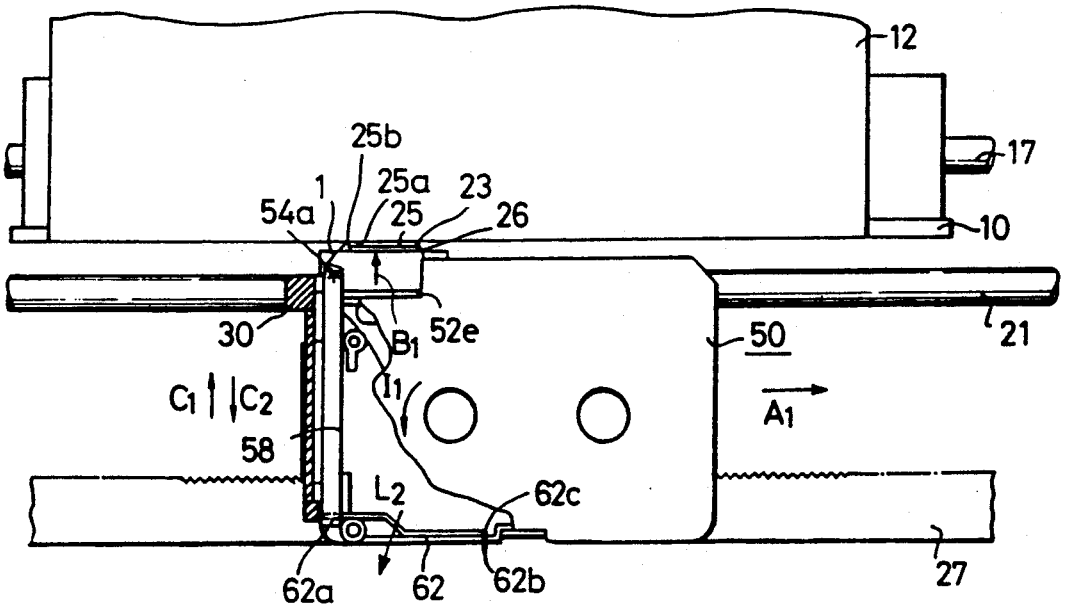

FIGS. 15 and 16 illustrate the operation for recording an image by making use of the second ink layer 3*b* (red) of a two-colored ink ribbon 1 of the type described before. FIG. 15 specifically shows the operation for switching the recording color.

Upon receipt of red color recording information in a manner which will be explained later, the up/down motor M3 (see FIG. 9) operates counterclockwise as described before so as to move the thermal head 25 in the direction of the arrow B2 away from the platen 10. Meanwhile, the connecting lever 30 is moved in the direction of the arrow C2. Then, the carrier motor M2 (see FIG. 6) operates to move the carrier 22 (see FIG. 9) to the left, i.e., in the direction of the arrow A2, so as to bring the switching portion 62*b* of the switching lever 62 into contact with the projection 27*a* of the rack 27, thereby moving the switching lever 62 to the right, i.e., in the direction of the arrow K1. As a result of the movement of the switching lever 62 in the direction of the arrow K1, the connecting portion 62*a* of the switching lever 62 is disengaged from the connecting lever 30. At the same time, the reset spring 59 urges the separation lever 58 downward (direction of the arrow C2) and the switching lever 62 counterclockwise (direction of the arrow L2), respectively. In this state, therefore, the separation roller 54 is kept sufficiently away from the platen 10.

In the state shown in FIG. 16, the apparatus is ready for recording an image by making use of the second ink layer 3*b* of a specific color, e.g., red, of the two-colored ribbon 1. This state is achieved by operating the up/-down motor M3 (see FIG. 9) clockwise from the state explained in connection with FIG. 15. As a result of the clockwise operation of the up/down motor M3, the thermal head 25 is rotated towards the platen 10 as indicated by the arrow B1 thereby pressing the thermal head 25 onto the platen 10 through the intermediaries of the print paper 12 and the two-color ink ribbon 1. This operation is accompanied by the movement of the heat sink 26 in the direction of the arrow B1 which in turn causes the connection lever 30 to move towards the platen 10 as indicated by an arrow C1. In this state, however, the separation lever 58 and the switching lever 62 have been urged downward (direction of the arrow C2) and counterclockwise (direction of the arrow L2), respectively, by the reset spring 59, so that the separation lever 58 has been sufficiently spaced from the print paper 12. Therefore, the carrier 22 can be moved in the recording direction (direction of the arrow Al). After moving the carrier 22, the heat generating portion 25*a* of the thermal head 25 is supplied with electric power in accordance with recording information so as to generate heat thereby heating the two-colored ink ribbon 1. In consequence, the heated portions of the second ink layer 3*b* are transferred to the print paper 12 thereby forming an image in red color. Immediately after the heating, the ink ribbon 1 leaves the end 25*b* of the thermal head 25 and is retracted by the take-up force which is produced as a result of rotation of the take-up clutch 41 in the direction of the arrow 11, whereby the ink ribbon 1 is separated from the print paper 12. The two-colored ribbon 1 is then taken-up by the take-up core 55.

Figure 17:
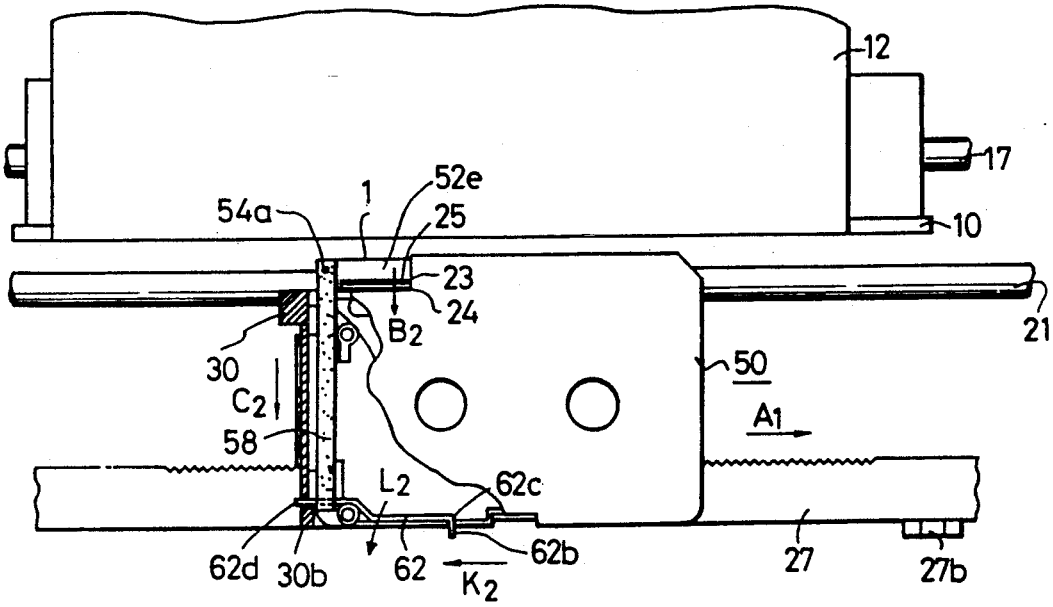
Figure 18:
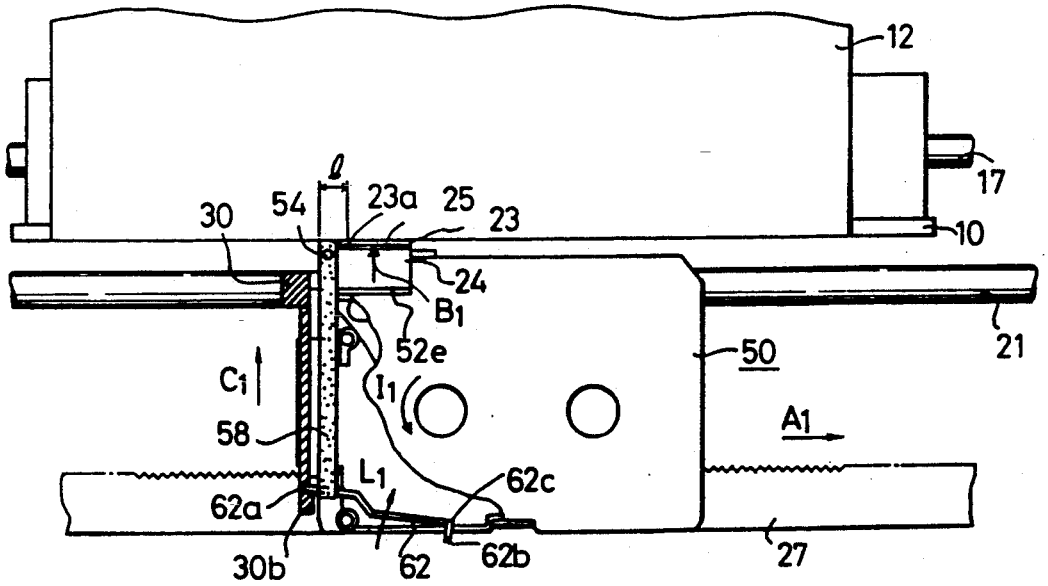

A description will be made hereinunder as to the recording operation for recording an image in black color. FIGS. 17 and 18 illustrate the apparatus which is ready for recording an image by making use of both the first ink layer 3*a* and the second ink layer 3*b* of the two-colored ink ribbon 1. FIG. 17 specifically shows the operation for changing the recording color.

Recording information for recording an image in black color is received in a manner which will be explained later. In response to the recording information, the up/down motor M3 (see FIG. 9) operates counterclockwise so as to move the thermal head 25 in the direction of the arrow B2 away from the platen 10. At the same time, the connection lever 30 is moved in the direction of the arrow C2. Subsequently, the carrier motor M2 (see FIG. 6) operates so as to move the carrier 22 (see FIG. 9) to the right as indicated by the arrow A1, thereby bringing the switching portion 62*b* of the switching lever 62 into contact with the projection 27*b* of the rack 27, thus shifting the change-over lever 62 to the left, i.e., in the direction of the arrow K2. As a result of the movement of the switching lever 62 in the direction of the arrow K2, the connecting portion 62*a* of the switching lever 62 is brought into engagement with the connection lever 30. Meanwhile, the separation lever 58 has been moved downward (direction of the arrow C2) and the switching lever 62 has been urged counterclockwise (direction of the arrow L2), respectively, by the force of the reset spring 59, while the separation lever 58 has been spaced apart from the print paper 12.

FIG. 17 shows the state in which the apparatus is ready for transferring both the first ink layer 3*a* (black) and the second ink layer 3*b* of the two-colored ink ribbon so as to effect recording in black color. This state is achieved as follows. As the up/down motor M3 (see FIG. 9) operates clockwise from the state explained with reference to FIG. 16, the thermal head 25 is rotated towards the platen 10, i.e., in the direction of the arrow B1, so as to press the platen 10 through the intermediaries of the print paper 12 and the two-colored ink ribbon 1. This operation is accompanied by the movement of the heat sink 26 in the direction of the arrow B1, which in turn causes the engaging portion 30*b* of the connection lever 30 to push up the connecting portion 62*a* of the switching lever 62 thereby rotating the switching lever 62 clockwise (direction of the arrow L1) against the force of the reset spring 59. As a result of the rotation of the switching lever 62 in the direction of the arrow L1, the separation lever 58 is moved upward as indicated by the arrow C1 so as to contact the print paper 12 through the ribbon 1. The connection lever is further moved in the direction of the arrow C1 thereby to rotate the switching lever 62 in the direction of the arrow L1. A further rotation of the switching lever 62 in the direction of the arrow L1 causes the slider 60 to move in the direction of the arrow C1 against the forces of the reset spring 59 and the pressing spring 61. The pressing spring 61 produces a reactional force which acts to press the separation roller 54 of the separation lever 58 into contact with the print paper 12 through the ink ribbon 1 or to position the separation roller 54 in the vicinity of the print paper 12.

In this state, the carrier 22 is moved to the right in the recording direction, i.e., in the direction of the arrow A1, and the heat generating portion 25*a* of the thermal head 25 is supplied with electric power in accordance with the recording information thereby heating the two-colored ink ribbon 1. Then, as the ink ribbon and the print paper superposed on each other are moved to the position of the separation roller 54 on the separation lever 58, which position being spaced from the heat generating portion 25*a* by a distance l, the ink ribbon is tracted retracted by the take-up force which is produced as a result of rotation of the take-up clutch 41 in the direction of the arrow 11, so that the ink ribbon is separated from the print paper 12, whereby the first ink layer 3*a* together with the second ink layer 3*b* is selectively transferred to the print paper so as to record an image in black color on the print paper 12. Then, the two-colored ribbon 1 is taken-up by the core 55.

The states of recording of images in red and black colors respectively will be explained hereinunder with specific reference to FIGS. 19 and 20 which are enlarged schematic illustrations of the recording in red color and FIGS. 21 and 22 which are enlarged schematic illustrations of the recording in black color.

Figure 19:
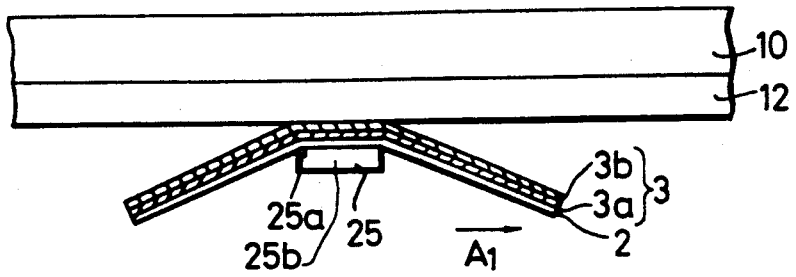
FIGS. 19 and 20 and FIGS. 21 and 22 are schematic enlarged views of a recording section in an apparatus embodying the present invention.
Figure 20:
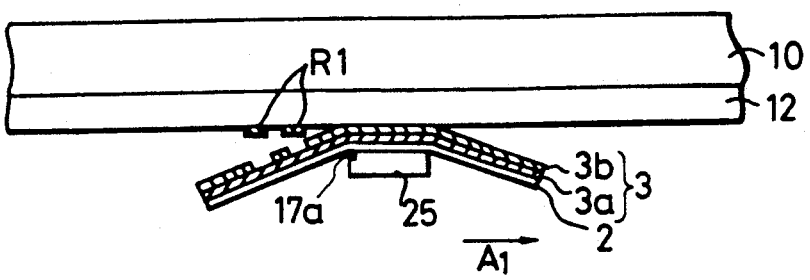

In the state shown in FIGS. 19 and 20, the recording is effected by the ink on the second ink layer which, in this case, is intended for recording in red color.

Referring to these Figures, the thermal head 25 is pressed onto the platen 10 through the intermediary of two-colored ink ribbon 1 and the print paper 12. The heat generation portion 25*a* of the thermal head 25 is supplied with electric power in accordance with the recording information so as to generate heat in a controlled manner while the thermal head 25 runs in the direction of the arrow A1, thereby heating the two-colored ink ribbon 1. As a result of the heating, the heated portions of the second ink layer 3*b* of red color on the two-colored ink ribbon 1 attach to the print paper 12.

As the thermal head 25 is further moved in the direction of the arrow A1, the ink ribbon is deflected at the edge 25*b* of the thermal head 25 so that the take-up force is applied to the ink ribbon 1 so as to separate the same from the print paper 12, within a very short time t1 after the heating, i.e., before the ink ribbon 1 becomes cooled. In this connection, a reference shall be made to FIG. 2 which shows the characteristics of two-colored ink ribbon.

Figure 3:
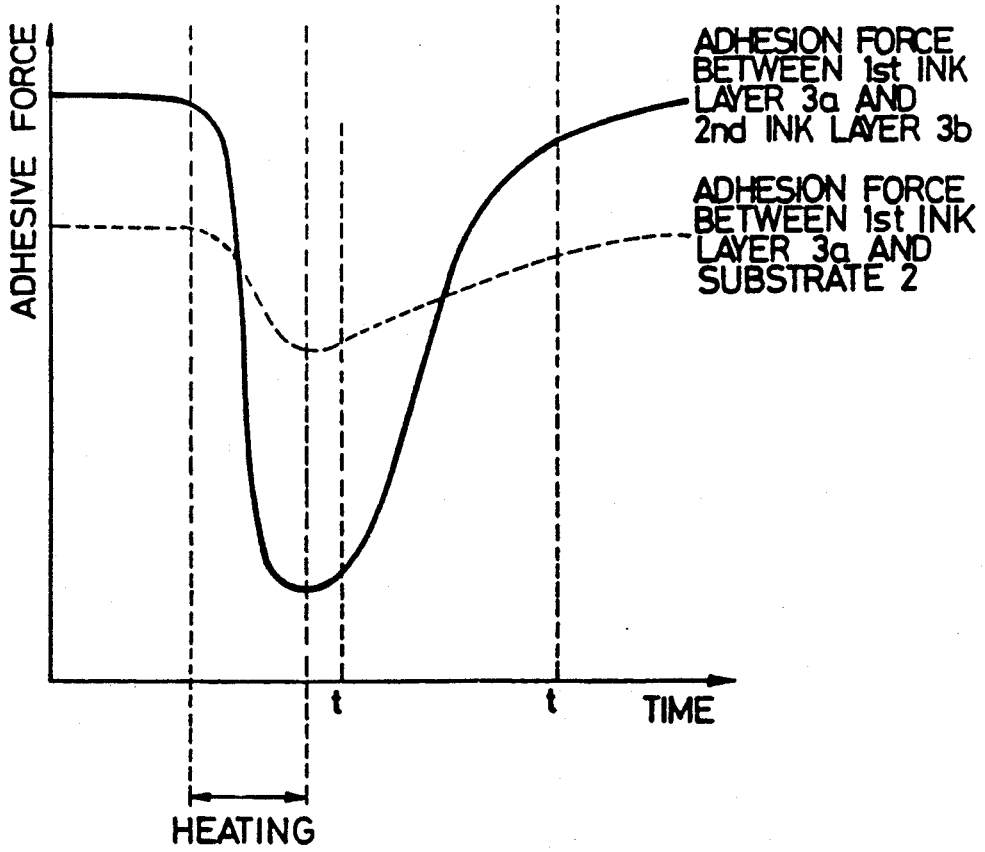
FIGS. 3 and 4 are graphs illustrating the change in the adhesion force between the respective adjacent layers of the ink ribbon in relation to time.

As will be seen from FIG. 3, the relationships between the adhesion forces acting between adjacent layers of the two-colored ink ribbon 2 at the moment of the above-mentioned separation is that the adhesion force acting between the substrate 2 and the first ink layer 3*a* is greater than the adhesion force between the first ink layer 3*a* and the second ink layer 3*b*. On the other hand, a large adhesion force is generated between the second ink layer 3*b* and the print paper 12, so that the ink layer 3 is delaminated at the boundary between the first ink layer 3*a* and the second ink layer 3*b* where the adhesion force is the smallest. In consequence, only the second ink layer 3*b* which in this case carries red color is transferred to the print paper 12 thereby forming a record R1 of image in red color on the print paper 12.

In contrast, the recording of an image in black color is conducted in a manner which will be explained hereinunder.

Figure 21:
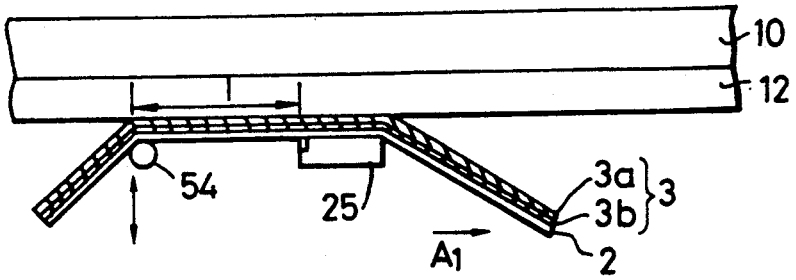
Figure 22:
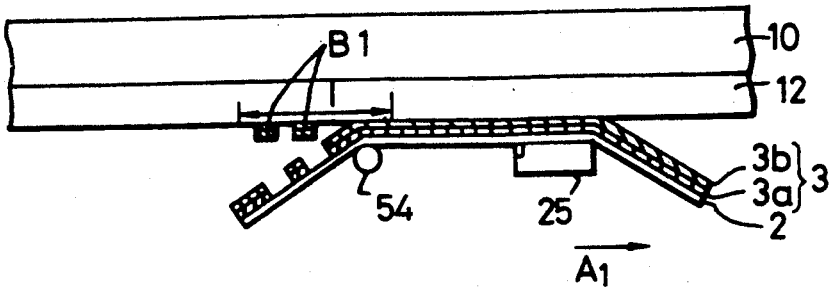

FIGS. 21 and 22 show the recording of the first ink layer 3*a* and the second ink layer 3*b*.

The thermal head 25 is pressed onto the platen 10 through the intermediaries of the two-colored ink ribbon 1 and the print paper 12, in the same manner as that in the image recording in red color. The heat generating portion 25*a* of the thermal head 25 is supplied with electric power in accordance with the recording information so as to generate heat thereby heating the two-colored ink ribbon 1. As a result of the heating, the second ink layer 3*b* of the two-colored ink ribbon 1 attaches to the print paper 12. The two-colored ink ribbon 1 is pressed by the separation roller 54 onto the print paper 12 by the separation roller 54 which is spaced from the heat generating portion 25*a* by a distance l in the direction opposite to the direction indicated by the arrow Al. The separation roller 54 is moved as a unit with the thermal head 25 so that the distance l is always maintained between the separation roller 54 and the heat generating portion 25*a*. When a comparatively long time t2 has passed after the moment of heating, the heated portion of the two-colored ink ribbon 1 clears the separation roller 54. The time t2 is long enough to allow the heated ink ribbon to become substantially cooled, as shown in FIG. 2 which shows the characteristics of the two-colored ink ribbon. As soon as the ink ribbon 1 clears the separation roller 54, it receives the take-up force so as to be separated from the print paper 12. The time length t2 can be varied as desired by changing the distance l.

As shown in FIG. 3, at the moment of separation mentioned above, the relationships between the adhesion forces between adjacent layers of the ink ribbon 1 is such that the adhesion force between the substrate 2 and the first ink layer 3*a* is smaller than the adhesion force between the first ink layer 3*a* and the second ink layer 3*b*. At the same time, the adhesion force between the second ink layer 3*b* and the print paper 12 has been increased as a result of heating by the thermal head 25. In consequence, delamination takes place at the boundary between the substrate 2 and the first ink layer 3*a* where the adhesion force is smallest, so that both the first ink layer 3*a* and the second ink layer 3*b* are transferred to the print paper 12 thus forming a record B1 of the image in black color.

As will be understood from the foregoing description, in this embodiment of the recording apparatus of the present invention, the second ink layer 3*b* solely or the first and the second ink layers 3*a*, 3*b* together are selectively transferred to the print paper 12, thus enabling an image to be recorded in two colors. This remarkable effect is produced by selectively adopting a mode in which the ink ribbon is separated from the print paper immediately after the heating by the thermal head edge and a mode in which the separation of the ink ribbon is conducted at a position which is spaced by the distance l from the thermal head after the travel by the distance l (overrun).

Block Diagram

Figure 23:
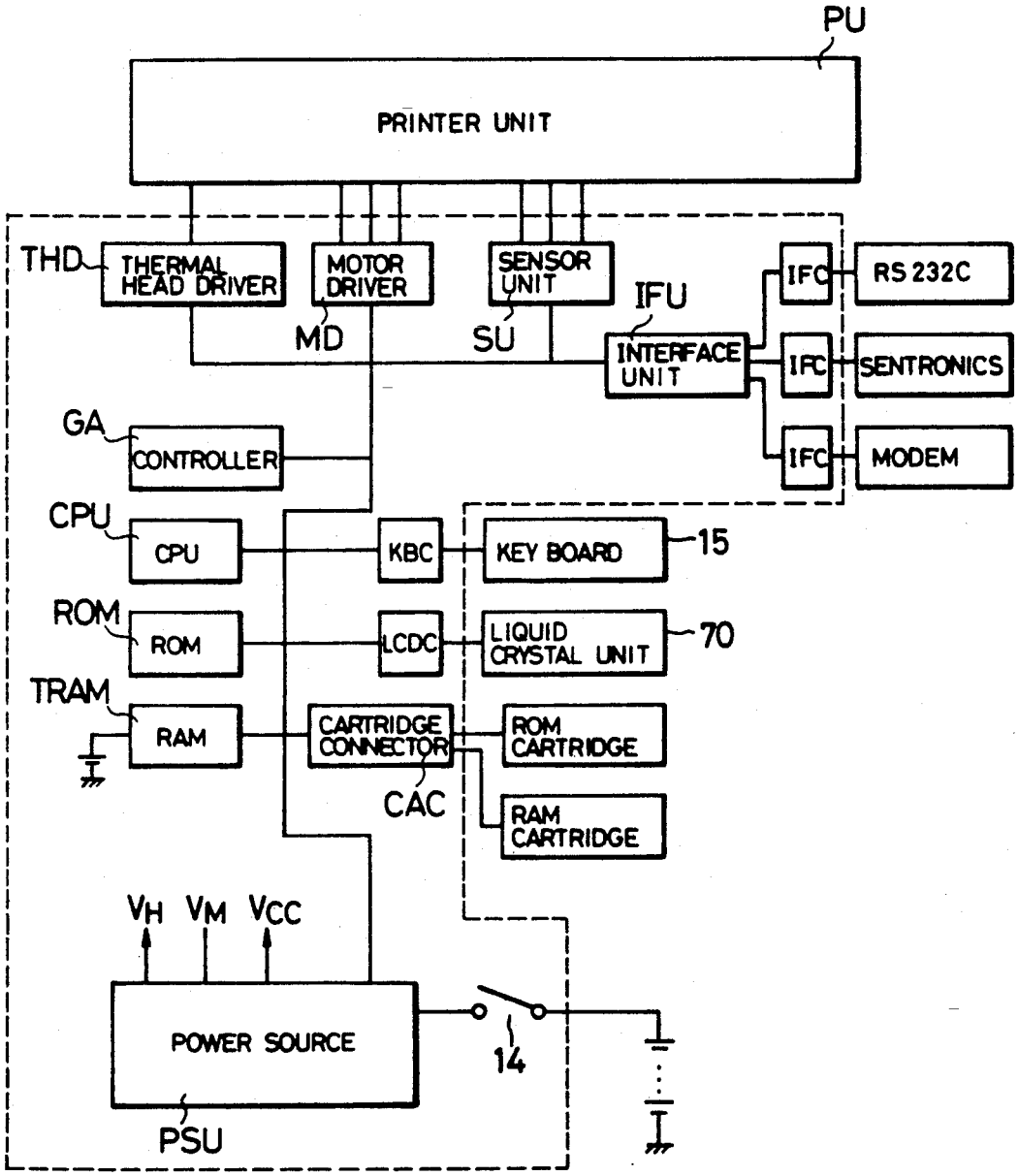
FIG. 23 is a block diagram of an output device.

FIG. 23 is a block diagram showing the construction of the above-described output device. This block diagram shows only the connection between the associated blocks and control lines and other details are omitted. The portion surrounded by broken lines shows a central processing unit (CPU).

The CPU is adapted to read various programs and data from a later-mentioned read only memory (ROM), and conducts various arithmetic operations and judgments, as well as control of various parts of the apparatus. It is possible to employ a plurality of such CPUs. The ROM stores various programs for enabling the CPU to operate, character codes and dot patterns (character generator CG), as well as various data necessary for the printing. A read/write memory TRAM has a plurality of areas such as a working area for temporarily storing the data and the result of computation which is being processed or executed by the CPU, a buffer area for storing various data input from the keyboard 15 and external interface portion IFu which will be explained later, and a text area for storing documents. The TRAM is backed up by a battery power supply so that it can hold the data even though the power supply from the main part of the apparatus is ceased due to turning off of the power switch 14.

The CPU is connected to a printer unit PU through a thermal head driver THD, motor driver MD and a sensing unit SU.

The thermal head driver THD is provided on the printer unit PU and operates under the control of the CPU, so as to drive the thermal head 25. The motor driver MD controls the operation of various motors such as the paper feed motor M1, carrier motor M2 and the up/down motor M3, under the control of the CPU.

The sensing unit SU is provided on the printer unit PU and is adapted to deliver data obtained through the limit sensor 23 and the sensor 29 to the CPU.

A power supply unit PSU supplies various kinds of electric power such as the power VH for driving the thermal head 25, the power VM for driving the paper feed motor M1, carrier motor M2 and the up/down motor M3, and the power Vcc for various logic circuits.

A controller GA is adapted for performing various operations such as the control of voltage and current of the electric power VH supplied to the thermal head 25 and control of heating time and duty ratio of the power supplied to the thermal head 25, and so forth, under the control of the CPU.

The keyboard 15 mentioned before is connected to CPU through a keyboard connector KBC so as to enable various data required for printing and edition to CPU.

A liquid crystal display unit 70 is connected to CPU through an LCD connector LCDC so that it can display various data and information input through the keyboard 15.

The liquid crystal display 70 may be substituted by a CRT or other type of display.

For the purpose of an external control of the recording apparatus or for the purpose of communication between the recording apparatus and external devices, interfaces such as RS232C, centro-interface, MODEM or the like may be connected to the CPU.

It is also possible to connect to the CPU, through a cartridge connector CAC, various accessories such as ROM cartridge for various special functions and printing in different styles of type and a RAM cartridge having an extended memory for storing texts and data.

Although not shown, the recording apparatus may have an acoustic output device such as a buzzer.

Power-On Sequence

Figure 24:
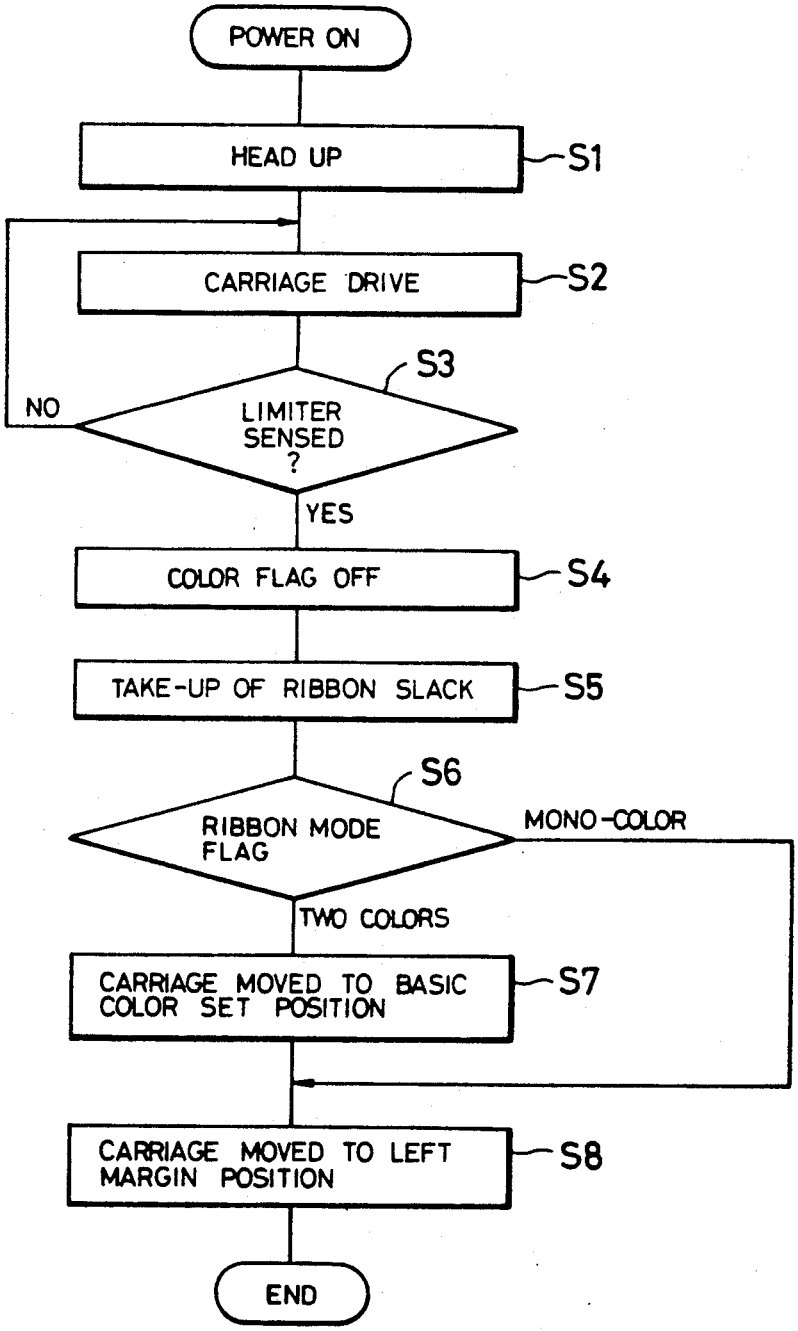
FIG. 24 is a flow chart illustrating the power-on sequence of an output device.

A description will be made hereinunder as to the manner in which the recording apparatus is controlled in accordance with programs stored in the ROM mentioned above. FIG. 24 is a flow chart showing the power-on sequence of the recording apparatus in accordance with the present invention. As explained before, the recording apparatus has a thermal printer capable of performing printing in two different colors. Namely, the thermal printer is operable either with a monocolor ribbon or two-color ribbon. When two-color ribbon is used, the printer is capable of switching the printing color between two colors so as to print characters or other data in the desired one of two colors.

In this embodiment, the color tone information may be given in the form of a ribbon discrimination signal or a color appointing signal which is input through the keyboard.

As the power supply of the apparatus is turned on, the head-up operation is conducted to raise the thermal head away from the platen 10 in Step S1. In the next step S2, the carrier 22 is moved towards the limit sensor 23 so as to detect the absolute position of the carriage. As the carrier is detected by the limit sensor 23 in Step S3, the process proceeds to Step S4 in which a color flag stored in the TRAM is turned off so as to enable the printing to be conducted in a basic color, e.g., black, when the ribbon used is a two-colored ribbon. Thus, the basic color is the standard mode which is automatically selected when the power is turned on. It is possible to provide a suitable means indicative of the fact that the standard mode has been selected. In order to ensure a uniform quality of the print, an operation is conducted for the purpose of taking up any slack of the ribbon in Step S5. The manner in which the slack is taken up will be described later. In the next step S6, an examination is conducted to ascertain whether the ribbon 1 which has been mounted already or which is to be mounted is a mono-color ribbon or a two-colored ribbon. This examination is conducted by checking the state of a ribbon mode flag which also is stored in the above-mentioned TRAM. The arrangement may be such that the ribbon mode flag is set by means of a sensor 29 which is capable of discriminating the type of the ribbon or the ribbon cassette or, alternatively, by the operator through the key input or voice input. When the flag has been set in mono-color ribbon mode, the process proceeds to Step S8, whereas, when the flag has been set in two-colored ribbon mode, the carriage is moved to a basic color set position so as to enable the printing to be conducted in the basic color of these two colors, as shown in FIGS. 16 and 17. In Step S8, when the selected mode is the mono-color ribbon mode, the carriage is moved to the left margin LM1 for mono-color ribbon mode, whereas, if the selected mode is the two-colored ribbon mode, the carriage is moved to the left margin LM2 for the two-colored ribbon mode. These left margins will be explained later in more detail with specific reference to FIG. 25. It is to be noted that the ribbon mode flag is backed up by a back-up power supply even if the main power has been turned off, so that the ribbon mode which has been selected at the time of turning off of the main power can be maintained. The ribbon identified at the time of turning on of the power may be different from that stored since the last turning off of the power. Such a situation may be caused by an erroneous input by the operator, e.g., an input operation for two-colored ribbon mode despite the fact that a mono-color ribbon has been set actually in the apparatus. In order to inform the operator of such a wrong input, the apparatus maybe provided with suitable warning means such as a buzzer or a message output device.

Figure 25:
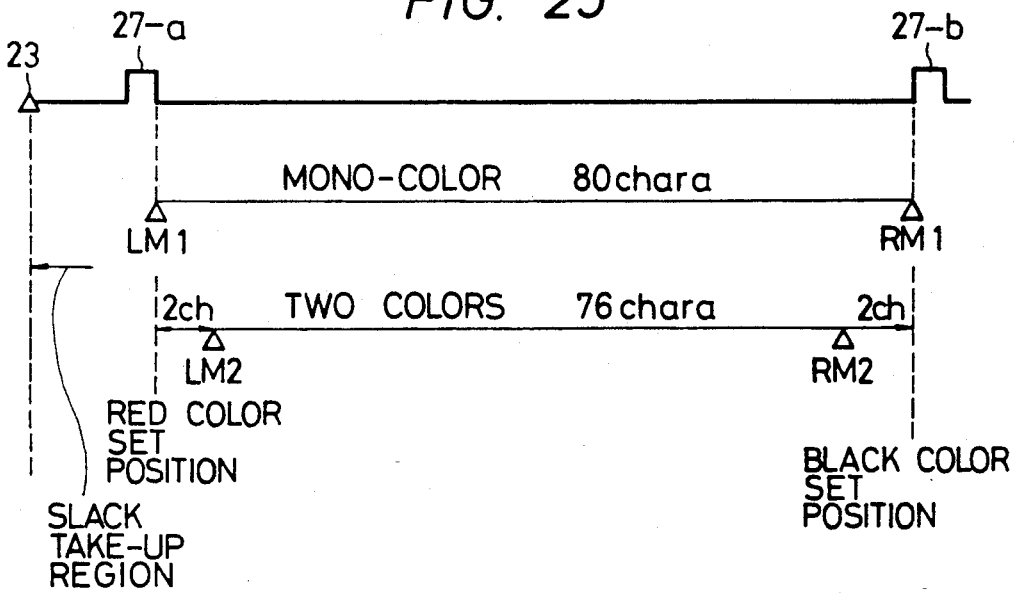
FIG. 25 is an illustration of output ranges corresponding to ribbons.

A description will be made hereinunder as to the margin, i.e., the range of stroking of the carriage, in each of the mono-color ribbon mode and the two-colored ribbon mode, with specific reference to FIG. 25. When the mono-color ribbon mode has been selected, the stroke of the carriage and, hence, the printable range are determined by the left margin LM1 mentioned before and a right margin RM1. In this embodiment, the printing can be conducted over 80 characters at the maximum. When the two-colored ribbon mode has been selected, the stroke of the carriage is limited by the aforementioned left margin LM2 and a right margin RM2. In this case, printing is possible both in black and red colors selectively over 76 characters. The space corresponding to two characters on the outer side of the stroke end or left margin LM1 is preserved for enabling the switching of color at the red color set position where the change of color is effected by the aforementioned projection **27*a*, whereas the space corresponding to two characters on the outer side of the stroke end or right margin RM1 is preserved for enabling the switching of color at the red color set position where the change of color is effected by the aforementioned projection 27*b*. The region between the position where the sensor 23** is located and the end of the region where the printing is possible is utilized for the purpose of taking up any slack of the ribbon. This region has a length corresponding to, for example, one character.

Key Input Sequence

Figure 26:
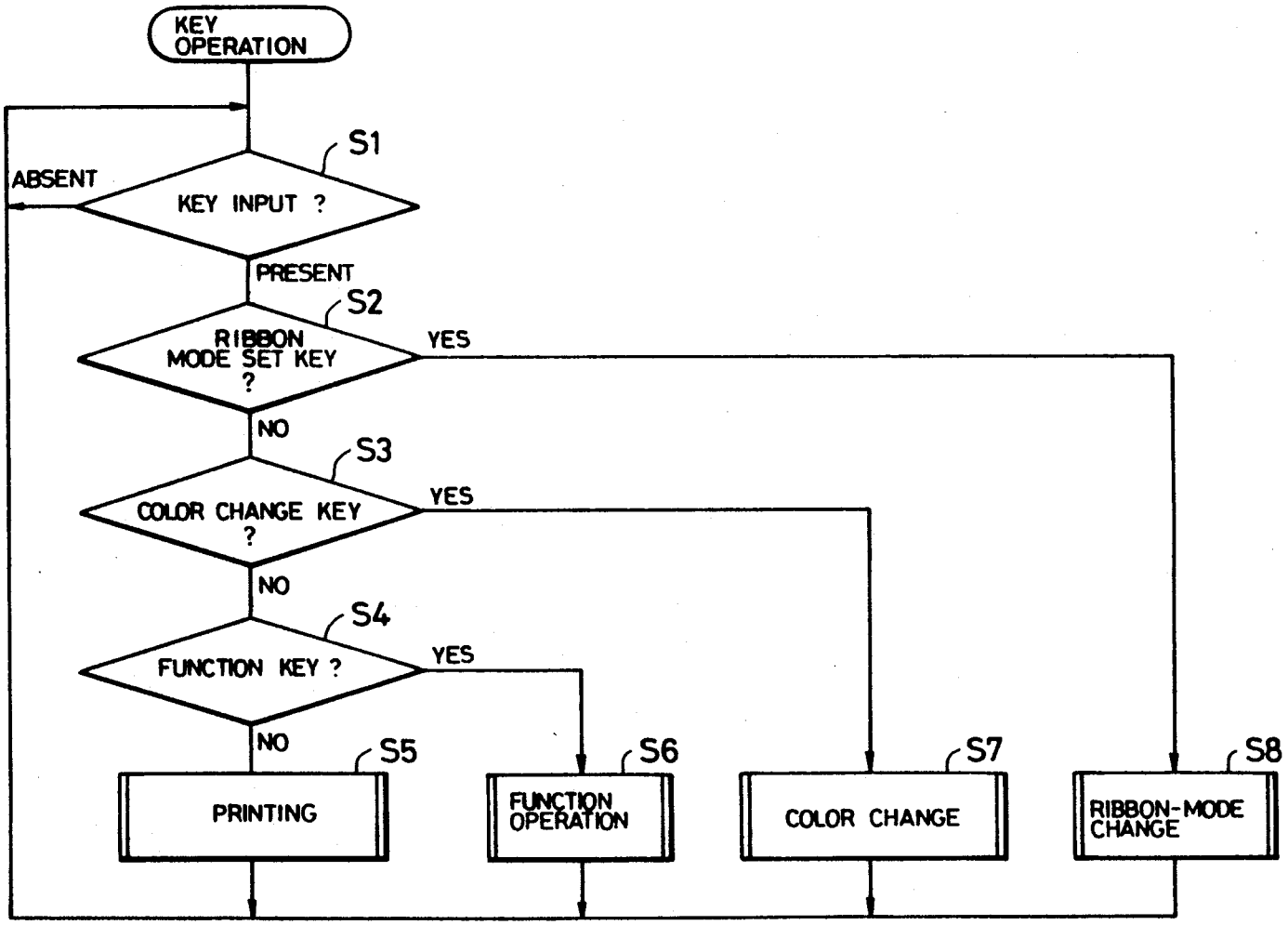
FIG. 26 is a flow chart illustrating the key operation.

FIG. 26 is a flow chart which illustrates a process for controlling the key-input operation conducted by the operator. When there is any key-input in Step S1, the process proceeds to Step S2 in which a judgment is conducted as to whether a ribbon mode setting key has been pressed down. If the answer is YES, the process proceeds to Step S8 in which a ribbon mode change program is commenced. However, if the answer is NO, the process proceeds to Step S3. The ribbon mode setting key RMKY may be, for example, a combination between the mode key MOKY and a numeral key ① shown in FIG. 5. That is, the ribbon mode can be set by simultaneously pressing both the mode key MOKY and the numeral key ①. In Step S3, a judgment is conducted as to whether a color change key CCKY has been pressed down. If the answer is YES, the process proceeds to Step S7 in which a color change program is commenced. The color change key CCKY may be, for example, a combination between the mode key MOKY and a numeral key ② shown in FIG. 5. That is, the color change instruction can be input by simultaneously pressing both the mode key MOKY and the numeral key ②. The color change instruction is for altering the printing color from the presently used color to the other of two colors. If the answer to the question posed in Step S3 is NO, the process proceeds to Step S4. If any one of function keys such as a return key, tab key, centering key, or a left margin set key has been pressed, such a key operation is detected in Step S4 so that the process proceeds to Step S6 in which the selected function is performed.

Conversely, if the answer in Step S4 is NO, the CPU judges that the operated key is a printing key PRKY and advances the process to Step S5 for starting a print control program. After completion of execution of these steps, the process returns to Step S1 to wait for the next key input. Although in the foregoing description the data is input through the keyboard, it will be clear that the data may be given as a command from a stored text or may be an externally given command from an external controller such as a host computer.

Take-Up of Slack of Ribbon

Figure 27:
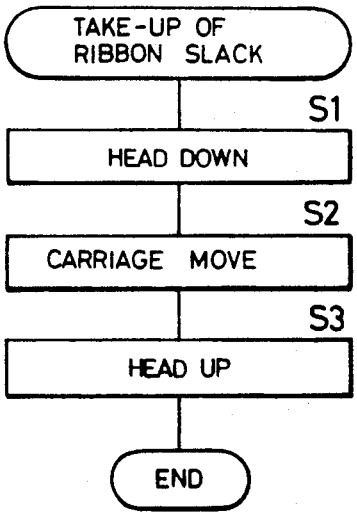
FIG. 27 is a flow chart illustrating an operation for taking up any slack of the ribbon.

A description will be made hereinunder as to the operation for taking up slack of the ribbon executed in Step S5 of the process shown in FIG. 24. FIG. 27 shows the flow control for taking-up any slack of the ribbon. In Step S1, head-down operation is conducted to lower the thermal head 25 so as to allow the ribbon in the cassette to be taken up (see FIGS. 8 to 11). In the next step S2, the carriage is moved in the direction of the arrow Al without heating the head 25 by a distance corresponding to one character and then head-up operation is conducted to raise the head in Step S3. In consequence, a suitable tension is applied to the ribbon thereby taking up the slack of the ribbon.

Ribbon Mode Change

Figure 28:
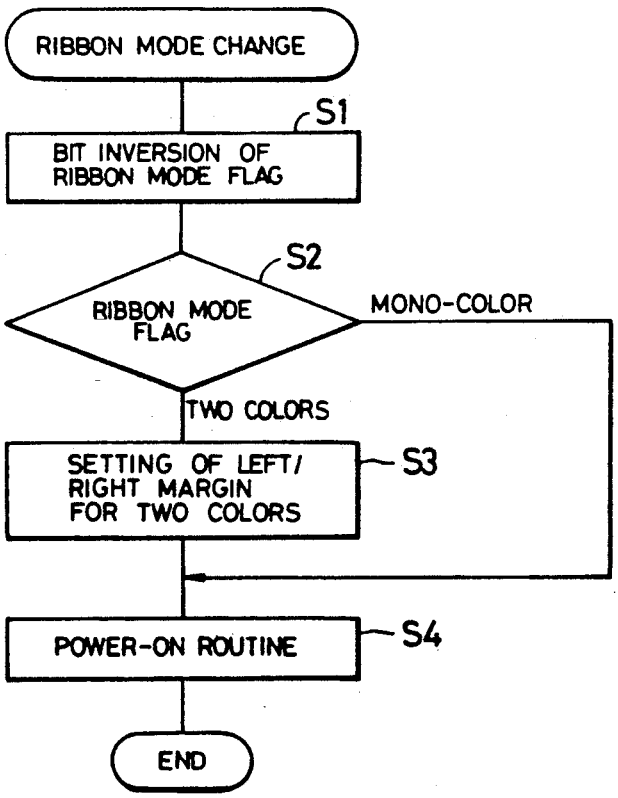
FIG. 28 is a flow chart illustrating an operation for changing ribbon mode.

A description will be made hereinunder as to the operation for changing the ribbon mode explained before in connection with Step S8 in the process shown in FIG. 26. As a ribbon mode setting command is input through the ribbon mode setting key RMKY, the bit of the ribbon mode flag stored in the TRAM is inverted in Step S1 of a process shown in FIG. 28 from mono-color ribbon mode to the two-colored ribbon mode or vice versa. Then, a judgment is conducted in Step S2 as to which mode the ribbon mode flag has been inverted. If the mode has been inverted to the mono-color ribbon mode, the process proceeds to Step S4 so that the power-on routine shown in FIG. 24 is commenced. However, if the present mode is judged to be the two-colored ribbon mode in Step S2, the process proceeds to Step S3 in which the positions of the left and right margins LM2 and RM2 for two-colored ribbon mode, which were explained before in connection with FIG. 25, are set in the memory of the TRAM. It will be understood that margins LM1 and RM1 for mono-color ribbon mode are normally set in the TRAM. The process then proceeds to power-on routine in Step S4. As the power-on routine is commenced, an operation is conducted to take-up any slack of the ribbon and the carriage is moved to the left margin LM1 or LM2 depending on whether the present mode is the mono-color ribbon mode or the two-colored ribbon mode. The arrangement may be such that the carriage is moved to a margin which has been set by the operator. The ribbon mode may be set in accordance with the mode command input through the keyboard as described or may be automatically set to commence the routine shown in FIG. 28 in accordance with the output from the sensor 29 explained before in connection with FIG. 6. The provision of two different print ranges, i.e., one for mono-color printing and the other for two-color printing, may cause confusion on the operator with the result that the operator may erroneously input the margin positions. It is possible to provide a suitable warning means which will inform the operator of such an erroneous input or the arrangement may be such that the carriage is automatically set at the margin position LM1 or LM2 neglecting the position input by the operator.

Color Change

A description will be made hereinunder as to a color changing operation which is executed in Step S7 of the process shown in FIG. 26.

Figure 29:
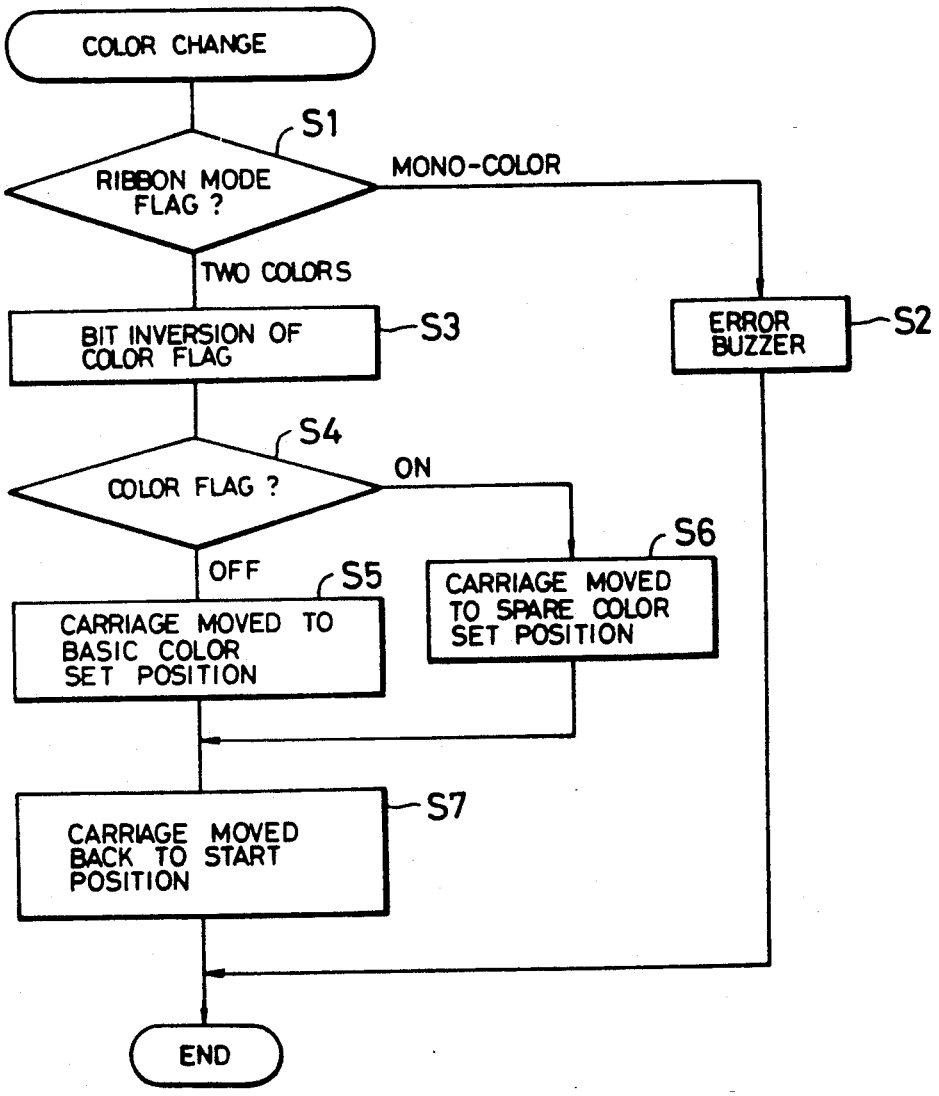
FIG. 29 is a flow chart illustrating an operation for changing color change.

The color changing operation essentially requires that the ribbon cassette which is presently mounted is the two-colored ribbon cassette. Therefore, if the check of the ribbon mode flag in Step S1 has proved that the presently used ribbon cassette is a mono-color ribbon cassette, any color change command input to the apparatus is judged as being invalid and warning is given through a buzzer, display or voice in Step S2. However, if the judgment in Step S1 has proved that the presently used ribbon cassette is a two-colored ribbon cassette, the process proceeds to Step S3 in which the bit of the color flag stored in TRAM is inverted so as to change the color to be output. Namely, if the black (basic) color has been selected, the bit of the color flag is inverted so as to enable the red (spare color) to be output, and vice versa. Meanwhile, the present position of the carriage is stored in TRAM. In the next step S4, the color flag after the inversion is judged. If the color flag is off (black), the process proceeds to Step S5 so that the carriage (carrier) is moved to the position for setting the apparatus for printing in the basic color (black). Conversely, if the flag has been turned on (red) in Step S3, the carriage is moved to the position for setting the apparatus for printing in the spare color (red) in Step S6. As to this setting operation, a reference shall be made to FIGS. 17 and 18. In Step S7, the carriage is moved to the position at which the carriage has been placed before it is moved in Step S5 or S6 or to the printing position which is next to the above-mentioned position. In this example, no specific operation is conducted for taking up any slack of the ribbon simultaneously with the color changing operation. The arrangement, however, may be such that a slack take-up operation is executed in response to the color changing command by providing a specific step for taking-up the slack after Step S7 in the process shown in FIG. 29.

Printing Sequence

A description will be made hereinunder with specific reference to FIG. 30 as to the printing sequence which is executed in Step S5 of the process shown in FIG. 26. The data or information recorded by the described embodiment of the recording apparatus may be any form such as letters, patterns, images, symbols or combinations thereof. The Step S5 of the process shown in FIG. 26 is commenced when a printing command is input through the printing command key PTKY. The printing command may be generated in response to input of each character or may be generated in response to input of a group of characters corresponding to one word or one line. The movement of the carriage and other movable parts is commanded by the motor driver MD shown in FIG. 23. The operation of each motor, however is not described here for the purpose of simplification of explanation.

Figure 30:
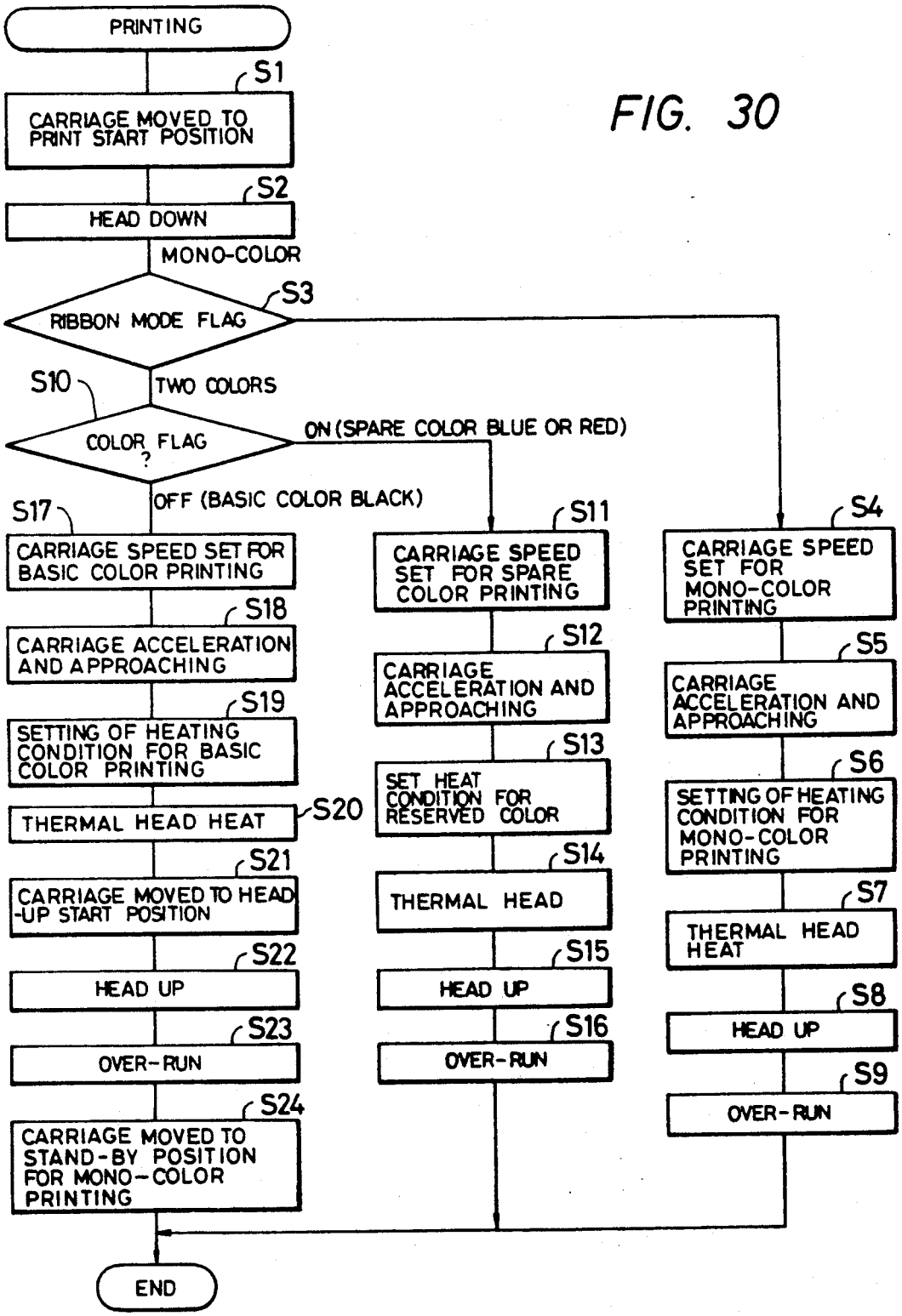
FIG. 30 is a flow chart of a printing sequence.

Referring to FIG. 30, the carriage is moved to the print start position in Step S1. In the next step S2, head-down operation is executed to lower the thermal head 25. In Step S3, the ribbon mode flag is examined. If the ribbon mode flag representing the mono-color ribbon mode is found in Step S3, the process proceeds to Step S4 in which carriage speed for mono-color printing is set upon consultation with a speed table on ROM, and the carriage is accelerated in Step S5 to run at a predetermined preparatory speed which is, for example, 18 characters per second. Conditions for heating the ribbon in the mono-color ribbon mode is set in Step S6, by delivering a command to the controller so as to cause the voltage and the current to be adjusted. In this step S6, an operation is also made for setting the heating time suitable for printing operation in mono-color ribbon mode. In Step S7, the thermal head is made to generate heat in accordance with the conditions set in the preceding Step S6, thereby to print the input data. The process then proceeds to Step S8 in which head-up operation is conducted to raise the thermal head 25, followed by Step S9 in which the carriage is made to over-run a predetermined distance, thereby to enable the operator to visually check the printed data and to allow the index 30*a* to indicate the character which is to be printed next, thus completing the process. In this state, the carriage is stopped at a position which is the printing stand-by position for the printing in mono-color ribbon mode.

Conversely, if the ribbon mode flag is confirmed to be two-colored ribbon mode in Step S3, the process proceeds to Step S10 in which the color flag is examined. If the flag is on, i.e., if the flag has been set for the spare color (red), the process proceeds to Step S11 in which a carriage speed suitable for printing in two-colored ribbon mode is set upon consultation with the speed table in ROM and, in the next step S12, the carriage is accelerated and made to run at a predetermined preparatory speed which is, for example, 18 characters per second. In Step S13, conditions for heating suitable for printing in the spare color are set such as the voltage, current and the heating time. The heating time for printing in the spare color is set at 1.1 m sec for example. In Step S14, the thermal head is heated to print the input data. In the subsequent step S15, head-up operation is conducted to raise the thermal head, followed by an over-running operation in Step S16, thus completing a series of operation.

Figure 31:
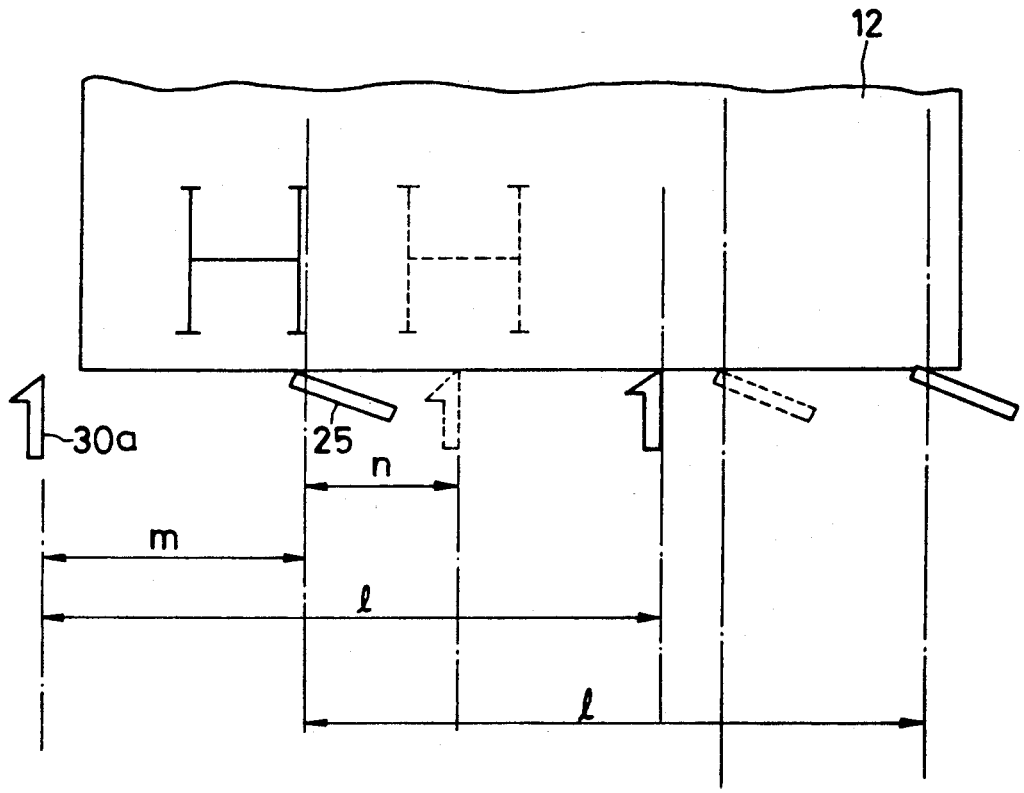
FIG. 31 is an illustration of the relationship between the printing position and the head and index.

The process then returns to Step S10 in which the state of the color flag is examined. If the color flag is off, i.e., if the basic color has been selected, the process proceeds to Step S17 for setting the carriage speed suitable for printing in the basic color. In Step S18, the carriage is accelerated to run at the set speed which is, for example, 10 characters per second. In Step S19, conditions are set for the heating of the thermal head in the basic color printing mode, in accordance with which the thermal head is supplied with electric power so as to generate heat, thereby printing. The heating time is, for example, 0.8 m sec. It will be seen that different carriage speed heating time is employed in the printing in the basic color from those in other modes. Such different carriage speed and heating time are adopted for the purpose of ensuring that the printing in the basic color may be conducted without fail. In Step S21, the carrier is moved by the distance l (see FIG. 31) down to the head-up start position so as to change the position for separating the ribbon. As a result, both the first and second ink layers are transferred together, thereby effecting printing in black color. Then, in Step S22, head-up operation is conducted and over-running operation is executed in Step S23 as in the case of printing in the mono-color ribbon mode or in the spare color in two-colored ribbon printing mode. In the case of the printing in mono-color ribbon mode or the printing in the spare color in two-colored ribbon mode, the index is allowed to indicate the next printing position as the result of the over-run conducted in Step S9 or S16. In contrast, in the case of printing in the basic color, the index cannot indicate the next character to be printed because the carriage is stopped at a position different from that where it stops in the printing in mono-color ribbon mode, due to the fact that the carriage has been moved by the distance l in Step S21. In this case, therefore, a backward feed is effected by an amount which corresponds to 64 pulses which in turn correspond to the amount of feed of the carriage in Step S 21, thereby enabling the carriage to stop at the position at which it stops in mono-color ribbon mode. Thus, the carriage is moved to the position where the index 30*a* is positioned at the next printing position, regardless of the ribbon mode and printing color.

The relationships between the index 30*a*, head 25 and the print character explained above are shown in FIG. 31. A symbol "H" shown by solid lines indicates a character which has already been printed, while a symbol "H" in broken lines shows the position where the next character is to be printed. A symbol m represents the distance between the index 30*a* and the head 25. Obviously, this distance l is constant regardless of the ribbon mode and the printing color (see FIG. 6). The index drawn by broken lines shows the desired next printing position, where the index shown by thick lines shows the position where the head-up operation is conducted after the printing in the basic color. A symbol n represents the distance between the position of the after completion of the printing and the center of the next character to be printed. Thus, an over-run by a distance corresponding to m +n is necessary in the case of printing in the mono-color ribbon printing and in the case of printing in the spare color in the two-colored ribbon mode, as explained before in connection with Steps S9 and S16 in the process shown in FIG. 30. In the case of printing in the basis color, however, the carriage has been moved ahead by the distance l for example in the state shown in FIG. 31, as explained before in connection with Step S21 in FIG. 30. Whether the distance m is greater or, smaller than the distance n does not matter. In the illustrated case, the Steps S21, S23 and S24 are executed such that the carriage is moved ahead by the distance l in Step S21 and then by the distance m+n in Step S23, followed by backward movement by the distance l in Step S24. This, however, is not exclusive and the arrangement may be such that the carriage is moved by the distance l in Step S21 followed by backward movement by an amount l−(m+n) in a subsequent step. In this embodiment, the heating time is used as the variable factor for the purpose of control. This, however, is only illustrative and the control may be effected by varying the voltage, through a suitable control of the electric power supplied to the thermal head.

It is also to be understood that, although the foregoing description specifically mentions ink ribbons as examples of the ink sheet, the invention can be carried out equally well by the use of a wide tape-like sheet which is commonly used in line printers.

It is also possible to use, as the recording medium, a transparent plastic sheet for use in overhead projectors (OHP) as the recording medium, although the described embodiment employs a print paper as the recording medium.

Furthermore, the thermal head used as the heating means for heating the ink sheet can be substituted by other suitable heating means such as infrared rays or laser beams.

In addition, the described embodiment can be applied to so-called full-line type printer in which heating means such as a thermal head is provided over the entire length of the print line, although a so-called serial-type printer having a thermal head reciprocatable along the print paper has been specifically mentioned in the foregoing description.

It will be clear to those skilled in the art also that the described recording apparatus may use an ink sheet wound on reels or in the form of a roll directly mounted on the apparatus, although the described embodiment makes use of an ink ribbon cassette which has a case accommodating the ink ribbon and which is detachably mounted on the apparatus.

It is also possible to arrange such that the ink ribbon cassette is kept stationary during printing, unlike the described embodiment in which the ink ribbon cassette moves reciprocatingly.

It will be understood also that the described embodiment can be applied to recording of an image in three or more colors, although two-color printing is specifically mentioned in the foregoing description. It is also possible to use an ink sheet having a plurality of ink layers of the same color. With such an ink sheet, it is possible to conduct mono-color printing with the life of the ink sheet extended two, three or more times.

The ink sheet used in the described embodiment is only illustrative and other types of ink sheet can be used equally well.

The separation timing control member such as the separation roller may be provided on the main part of the apparatus, although it is provided on the cassette in the described embodiment.

In the described embodiment, the cooling of the heated ink sheet relies upon natural cooling by delaying the timing of separation of the ink sheet from the print paper. The invention, however, does not exclude the use of forcible cooling means. Such forcible cooling means may be realized by, for example, causing a metal member such as iron or aluminum to contact or be placed in the vicinity of the ink sheet so as to absorb heat, or by blowing chilled air from a nozzle onto the ink sheet.

As will be fully understood from the foregoing description, according to the invention, it is possible to obtain a clear image recorded on a recording medium in color tones corresponding to the color tone data input to the apparatus.

Another embodiment of the recording apparatus in accordance with the present invention will be described hereinunder with reference to FIGS. 32 to 70. This embodiment of the recording apparatus has a first mounting portion for mounting a mono-color ink ribbon or a multi-color ink ribbon, and a second mounting portion for mounting a correction ink ribbon.

In this embodiment, the separation member is provided on the main part of the recording apparatus, more particularly on the carriage, so that projection or retraction of the separation member can be conducted regardless of the position of the carriage in its recording stroke.

In recent years, there have been proposed various types of printing ribbons such as multi-color printing ribbons and correctable ribbons which enable the printed characters to be erased by lift off. This embodiment is an electronic typewriter which can operate with such types of printing ribbon.

Figure 32:
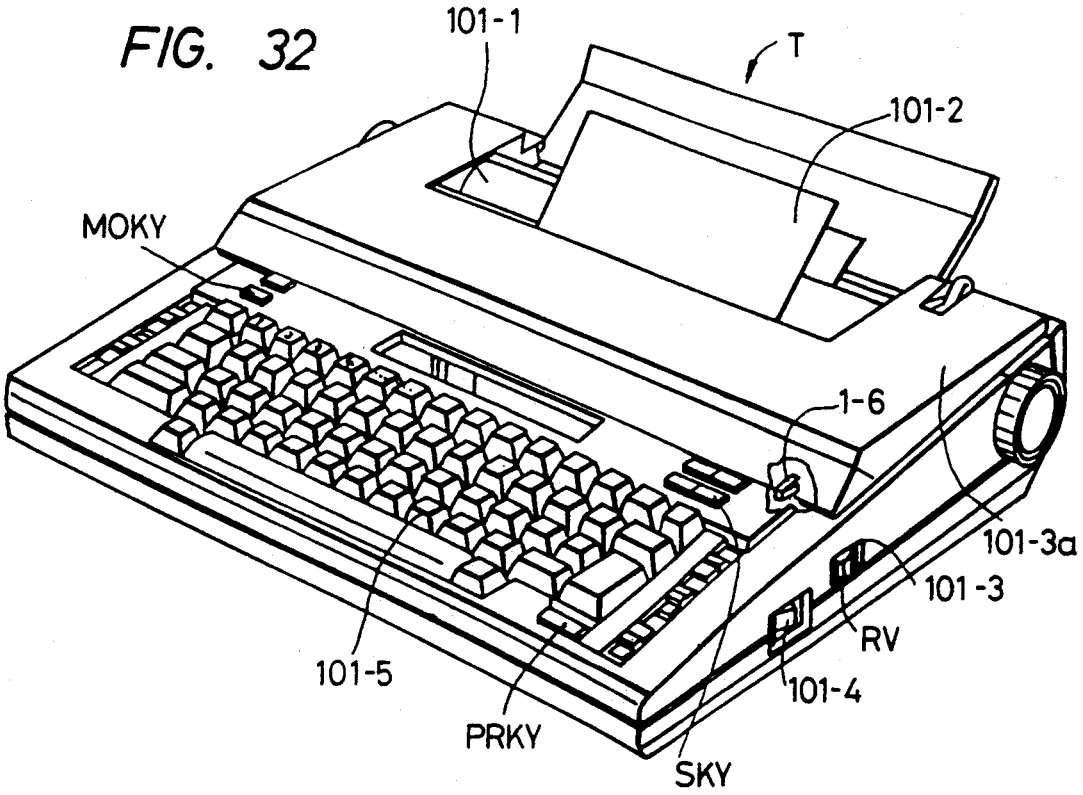
FIG. 32 is perspective view of an output device carrying out another embodiment of the present invention.

FIG. 32 is a perspective view of an electronic typewriter T embodying the present invention.

Referring to this Figure, the typewriter T has a platen 100-1, a print paper 100-2, outer structure 100-3, a power switch 100-4 for turning the power supply on and off, and a keyboard 100-5. A reference numeral 100-6 designates a hood switch which is adapted to be turned on and off in accordance with opening and closing of a hood 100-3*a*. The hood switch 100-3*a* produces, upon sensing opening of the hood 100-3*a*, a signal for shifting a later-mentioned ink ribbon to a predetermined position. This signal also is used for the purpose of locking the keyboard. A mode key MOKY is provided for setting various modes of operation such as ribbon modes which will be detailed later. A symbol PRKY represents a print command key. A density volume key RV is used for the purpose of setting data as parameters of the printing or erasing operation which will be described later. A key SKY is a key through which an erasion command is input. The typewriter T has a printing section, input section, display section, control section and an external input/output interface section. The described embodiment may be devoid of the input section and the display section. It is also possible to construct the input section and the display section as units separate from the main part and to connect these units to the main part as desired. The data to be recorded may be letters, symbols, patterns, images and combinations thereof. In the following description, therefore, these data are generally referred to as "letter" or "letters".

Figure 33:
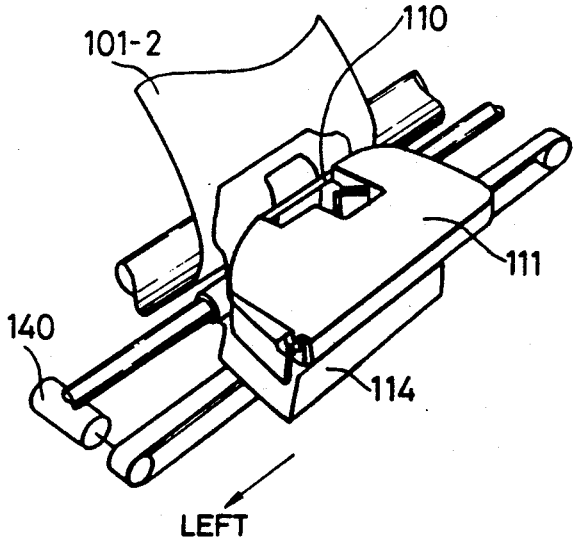
FIGS. 33 to 35 are illustrations of a carriage.
Figure 34:
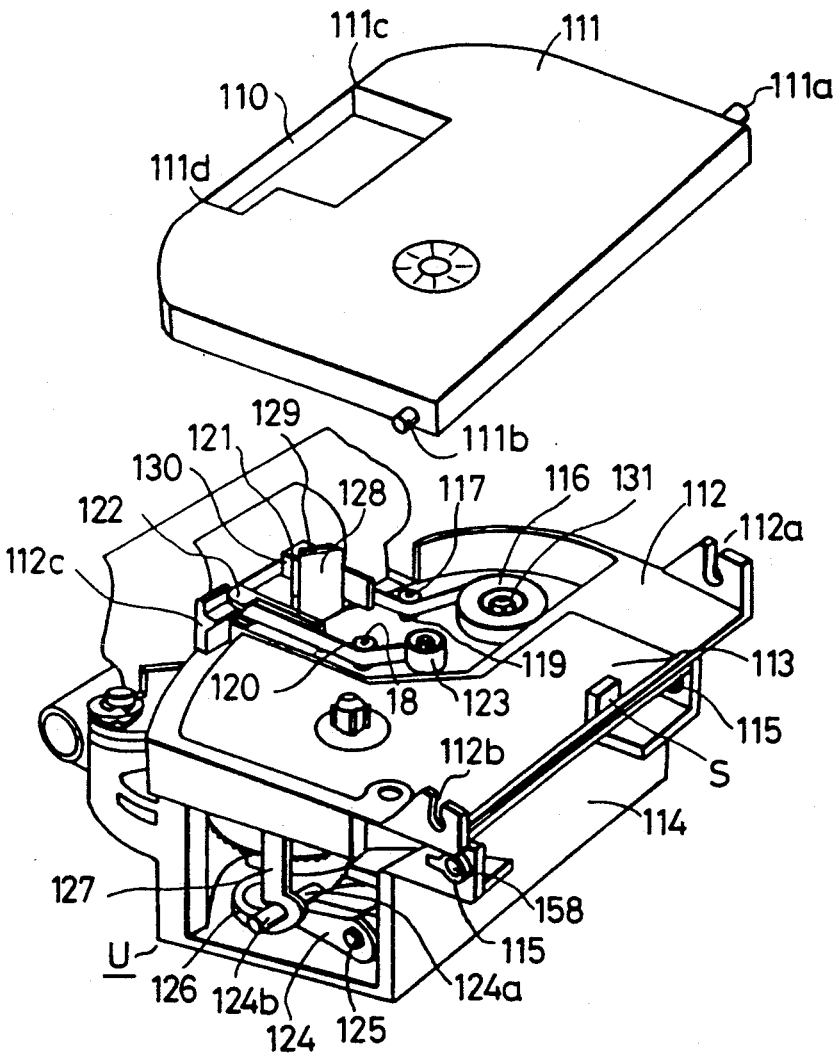

FIG. 33 is a schematic illustration of the carriage of the above-mentioned typewriter T. FIG. 34 is an enlarged view of the carriage of the typewriter T. A cassette 111 accommodates a first ribbon 110 which may be a mono-color ink ribbon or a multi-color ink ribbon. The cassette 111 has portions 111-*a* and 111-*b* which can fit portions 112-*a* and 112-*b* of a ribbon plate 112 on the main part of the apparatus. A metallic plate 113 is for allowing electrostatic charges generated in the cassette 111 to leak therethrough. The ribbon plate 112 is connected to the body 114 (carriage) by means of the holder 115. A symbol S represents a sensor which is adapted for sensing presence or absence of a cassette 111 on the plate 112 or the type of the ink ribbon mounted on the plate 112. A numeral 116 denotes a second ribbon (correction ribbon) which is adapted to be taken-up by the take-up core 123 through pulleys 119, 120 on the shafts 117, 118 and ribbon guides 121, 122. These parts for the second ribbon may be mounted on a common plate so as to constitute a unit. The arm guide 124 fits on a shaft 125 extending from the body 114. One end 124*a* of the arm guide 124 rests on the cam surface 126*a* of the cam 126, while the other end 124*b* is loosely engaged by an arm 127 connected to the ribbon plate.

The head arm 128 is a member which supports the thermal head 129. A reference numeral 130 designates a separation member (second member) which is adapted to be pressed onto the platen 101-1. The head lever 128, thermal head 129 and the separation member 130 are disposed between a ribbon extraction opening 111-*c* and a ribbon retraction opening 111*d* which are formed in the cassette 111 accommodating the first ribbon 110. The separation member 130 has a drum-like configuration and is movable towards and away from the platen 101-1 by a mechanism which will be described later. Thus, the ribbon cassette 111 accommodates the first ribbon 110 with a portion of the latter exposed through the extraction opening and retraction opening 111-*c* and 111*d* formed in the cassette 111. The thermal head 129 is adapted for heating this exposed portion of the ribbon 110. Thus, the thermal head 129 and the separation member are positioned between the extraction opening 111-*c* and the retraction opening 111-*d* formed in the cassette 111 when the cassette 111 is mounted on the ribbon plate 112.

As will be explained later, the separation member 130 has a function for controlling the timing at which the ink ribbon 110 after heating by the thermal head 129 is separated from the print paper 101-2. A spring 131 is interposed between the head pressure arm 145 and a head arm 128, and is adapted to exert a force with which the thermal head 129 supported by the head arm 128 is pressed onto the platen. Another spring 132 is intended for resetting the head arm 128 and the head pressure arm 145 to initial positions.

The thermal head may be substituted by, for example, a laser head which is capable of printing by means of a laser.

Figure 35:
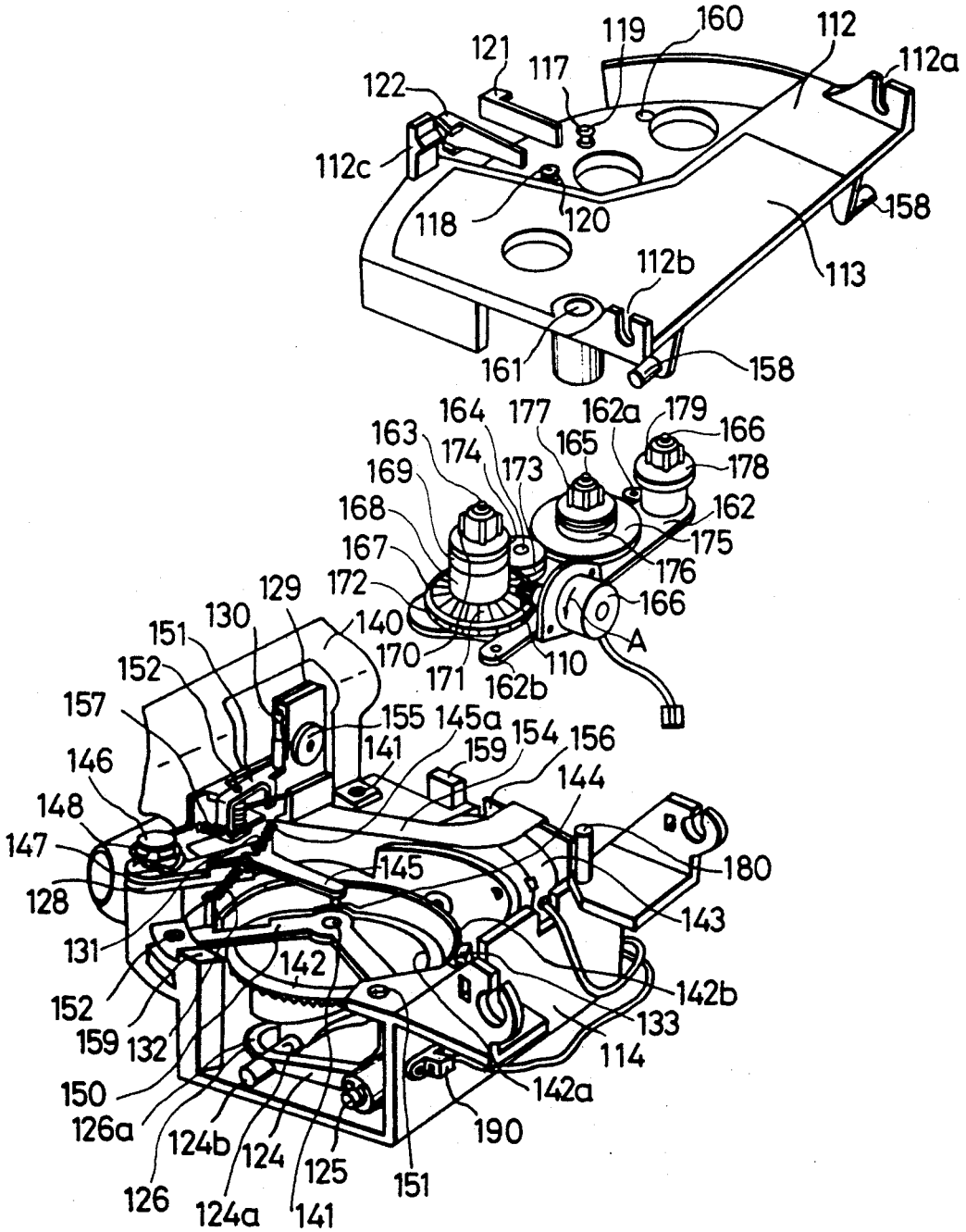

FIG. 35 is an illustration of the mechanism for taking up the first ribbon and the second ribbon, and a mechanism for operating the head arm 128.

Referring to these Figures, a reference numeral 140 designates a card holder which is fastened to the body 114 by means of small screws 141. The cam 142 is provided on the reverse side thereof with bevel gear teeth so that it can be driven by a motor 143. The cam 142 is provided with a cam track 142*a* which receives a pin 144 serving as a cam follower. As the cam 142 rotates, the pin 144 is moved along the cam track 142*a* so that the head pressure lever 145 is oscillated about a shift shaft 146. The head arm 128 loosely fits on the shift shaft 146. The head pressure lever 145 and the head arm 128 are prevented from coming off the shift shaft 146 by a stopper ring 148 fitting on the shaft 146 and cooperating with a spring washer 147.

The cams 126 and 142 loosely fit on a shaft 149 projecting from the body 114 and are prevented from coming off by a plate member 150 which is placed above the cam 142. The plate member 150 is fastened to the body 114 by means of small screws 151 and 152.

An arm 151 for supporting the separation member 130 and a shaft 152 carrying the arm 151 for rotation are provided on the head arm 128. The head arm 128 also carries a connector 153 which is electrically connected to the thermal head 129. The connector 153 also is electrically connected to terminals 156 through a flexible base plate 154.

A shaft 180 projecting from the body 114 is adapted to be received in an elongated hole formed in the underside of the ribbon plate 112 an extending perpendicularly to the platen 101-1, thereby locating the ribbon plate 112 in the left and right directions. A ribbon take-up unit is placed under the ribbon plate 112. This unit is coupled to portions 162*a*, 162*b* of a ribbon plate base 162 through apertures 160, 161. The ribbon plate base 112 carries shafts 163, 164, 165 and 166. The shaft 166 constitutes the output shaft of a ribbon take-up motor and is drivingly connected to a gear 167 on the shaft 163 through a bevel gear 171. A one-way clutch 168 which is capable of transmitting torque only in one direction is provided on the bevel gear 171. A friction clutch 169 capable of transmitting a torque below a predetermined level is placed on the one-way clutch 168. The head 170 of the friction clutch 169 fits in a take-up core in the first ribbon cassette 111.

A spur gear 170 formed on the periphery of the bevel gear 171 meshes with a wheel 173 which loosely fits on the shaft 164. A one-way clutch 174 capable of transmitting torque only in the same direction as the one-way clutch 168 is provided on the wheel 173. The one-way clutch 174 is provided with a peripheral spur gear meshing with a gear 175 which loosely fits on the shaft 165. A friction clutch 176 capable of transmitting a limited torque is provided on the gear 175. The friction clutch 176 has a head 177 which fits in a second ribbon take-up core 123. A tension pulley 178 carried by the shaft 166 is adapted to produce a predetermined resistance torque when rotating in one direction but produces only a very small resistance torque when rotating in the opposite direction. The tension pulley 178 has a head 179 which fits in a second ribbon supply core 131.

With this arrangement, it is possible to take-up the first ribbon 110 by forward operation of the motor 166 and to take-up the second ribbon 116 by backward operation of the same motor 166.

A sensor 190 serves as a left limiter which determines the position of the carriage with respect to the frame.

The operation of the cams will be explained hereinunder with reference to FIG. 36.

Figure 36:
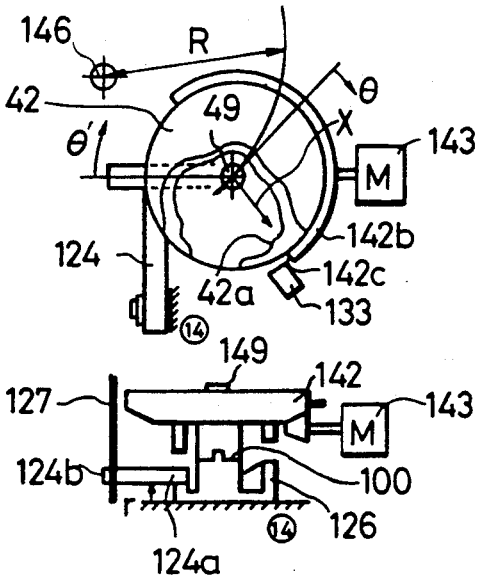
FIG. 36 is an illustration of a cam.
Figure 46:
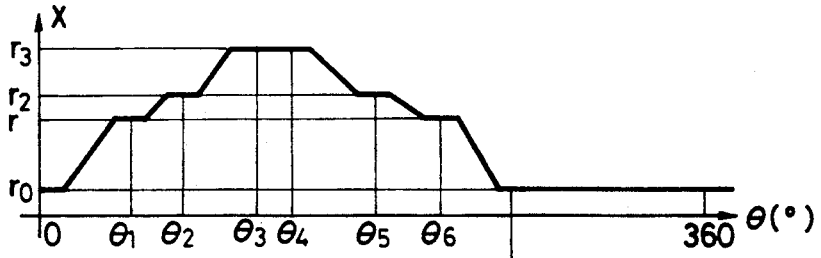
FIGS. 46 and 47 are illustrations of the distance between a head and a platen.
Figure 47:
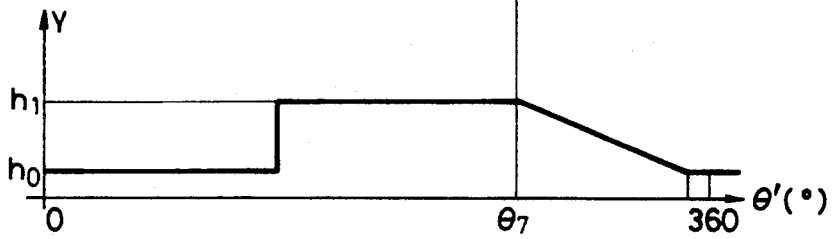

1) Roles of Cams:

Referring to FIG. 36, a pin 144 connected to the head pressure arm 145 moves along an arcuate path of a radius R which is centered at the shift shaft 146 and which includes the center of the shaft 149. The movement of the head arm 128 supporting the thermal head 129 is ruled by the cam track 142*a*, so that the head arm 128 is located with respect to an edge 142*c* of a peripheral shield plate 142*b* on the cam 142 by means of a sensor 133 when the power is turned on. A parameter angle $\theta$ is determined as illustrated, setting 0° at the point of intersection between an arc of a radius R and the cam track 142*a*. Then, the displacement or distance X between the center of the shaft 149 and the track 142*a* varies in relation to the parameter angle $\theta'$ along a curve which is shown in FIG. 46. Another parameter angle $\theta'$ is determined as illustrated, setting 0° at the radial line on which one end 124a of the arm guide 124 is located in the rotational phase represented by $\theta=0°$. The vertical height Y of the cam surface 126a varies in relation to the parameter angle $\theta'$ along a curve which is shown in FIG. 47. The other end 124b of the arm guide loosely engages with the arm 127 which is connected to the ribbon plate 112. Therefore, the change in the height of the cam surface 126a as a result of the rotation of the cam 126 is transmitted to the arm 127 through the arm guides 124a, 124b, thereby causing the ribbon plate 112 to move up and down. Since the cam 126 and the cam 142 are coupled to the shaft 149 through a common key 200, the distance X and the height Y are varied simultaneously in relation to change in the angles $\theta$ and $\theta'$ which are the same.

2) Printing by First Ribbon 110

Figure 48:
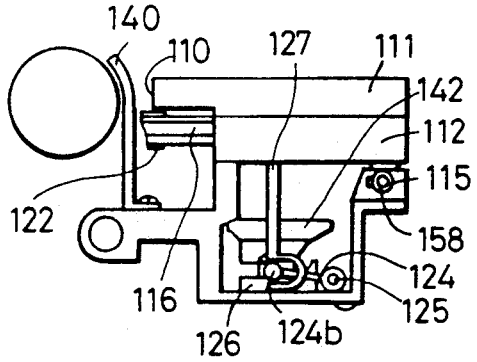
FIGS. 48 and 49 are illustrations showing the positional relationship between a platen and a carriage and the ribbon.
Figure 49:
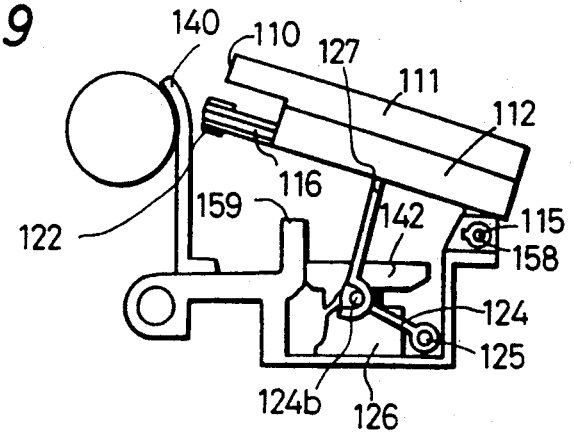

Printing by, for example, a multi-color ribbon:

When the cam 142 is in the initial rotational position, angles $\theta$ and $\theta'$ in FIGS. 46 and 47 are respectively zero, i.e., $\theta=\theta'=0°$. In this state, the cam surface 126a presents the smallest height so that the ribbon plate has been lowered so as to position the first ribbon 110 in front of the thermal head 129 as shown in FIG. 48. In this state, the pin 144 also is in the lowermost position along the cam track, and the pressing portion 128a of the head arm 128 is held in contact with the contact portion 145b of the head pressure arm 145 by means of the spring 131. The position occupied by the thermal head 129 in this state is the initial position of the thermal head 129. A subsequent operation will be commenced as the cam 142 rotates in the + (plus) direction which is in this case counterclockwise direction.

i) Stand-by Position:

The cam 142 rotates through an angle $\theta_1$ as indicated by an arrow in FIG. 36 by the operation of the motor 143. As a result, the pin 144 is brought to a point $r_1$ along the cam track 142a, as will be located by $\theta=\theta_1$ in FIG. 46. As a result of this rotation, the head pressure arm 145 and, hence, the head arm 128 pulled by the arm 145 through the spring 131 are made to rotate about the axis of the shift shaft 146. The point $r_1$ is set such that the head 129 is stationed immediately in front of the print paper 101-2 on the platen 101-1. This position therefore will be referred to as "stand-by position", hereinunder. When the thermal head 129 is moved apart from the print paper 101-2 out of a later-mentioned printing position, the thermal head is temporarily stopped at this stand-by position and, when a printing command is input while the thermal head is stationed at this stand-by position, the thermal head is directly moved to the printing position. However, if the printing command is not received in this period, the thermal head 129 is returned to the initial position by the operation of the motor 143 through the angle $-\theta_1$.

Figure 40:
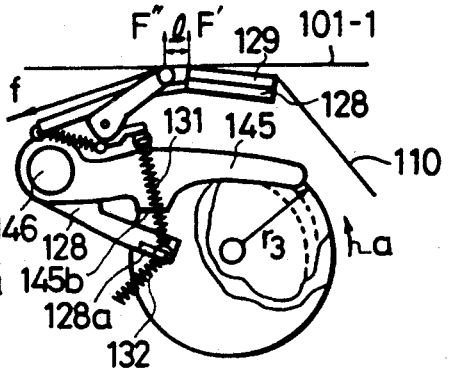
Figure 41:
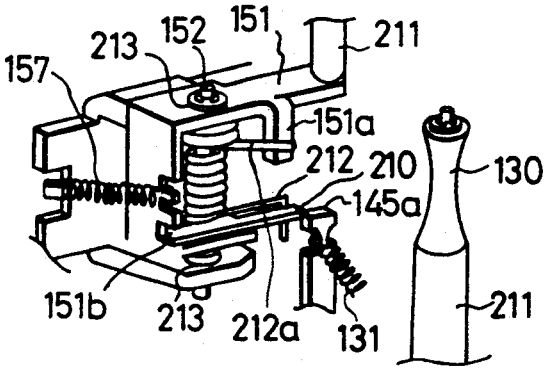
FIG. 41 is a perspective view of a driving mechanism for driving a separating member.
Figure 42:
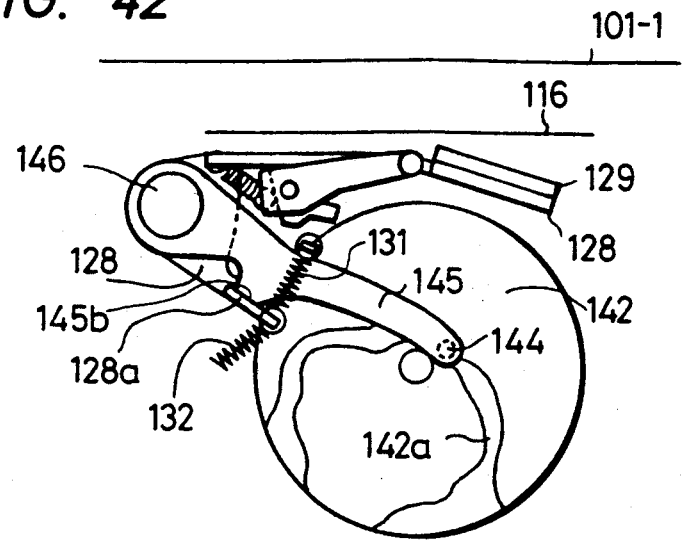
FIGS. 42 to 45 are illustrations of operation of the cam in the erasing operation.
Figure 43:
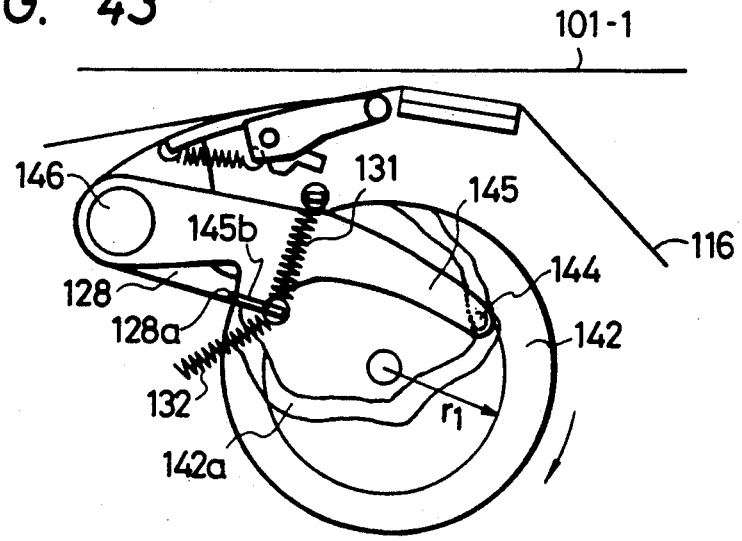
Figure 44:
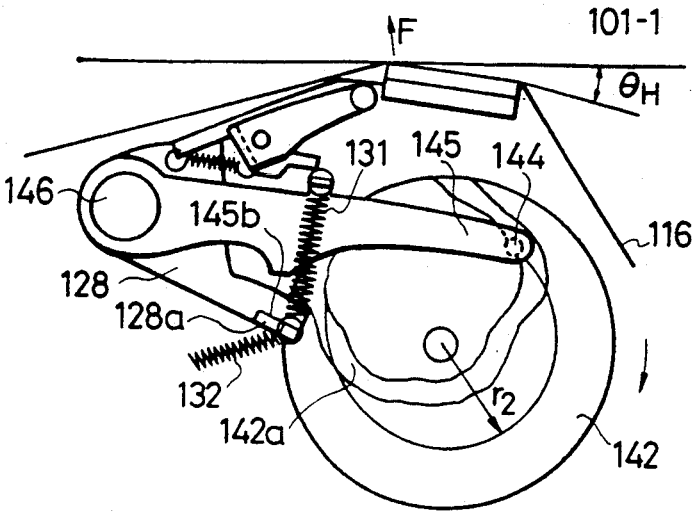
Figure 45:
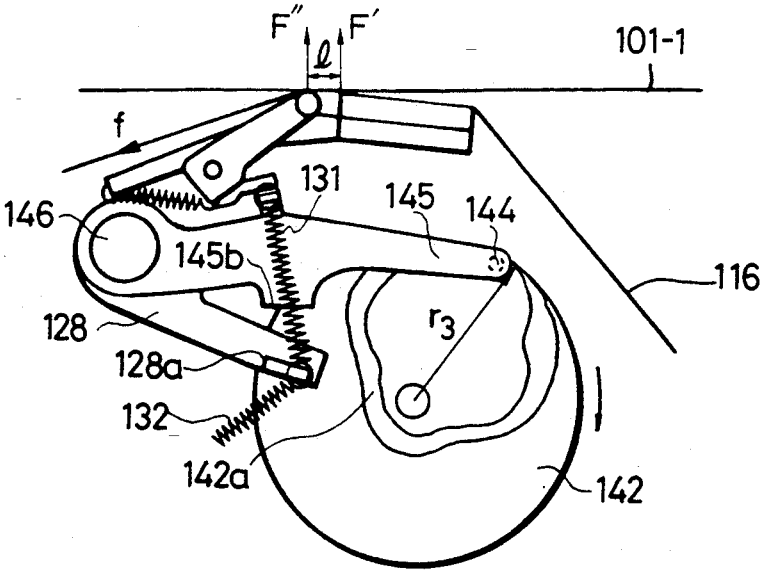

Therefore, if a printing command is input when the thermal head 129 is in the initial position, the thermal head 129 is rotated through $\theta_1+\theta_2$ directly to the printing position, without making stop at the stand-by position.

ii) First Stage Printing Position:

When printing is conducted, the cam 142 is further rotated by the motor 143 to a position which is angularly spaced by $\theta_2$ from the initial position, as shown in FIG. 40. The arrangement is such that the thermal head 129 contacts, through the intermediary of the print paper 101-2 and the first ribbon 110, with the platen 101-1 at an angle $\theta_H$ (see FIG. 39) when the cam has been rotated through a predetermined angle $\theta_X$ which is selected to meet the condition of $\theta_1<\theta_X<\theta_2$. The rotation of the head arm 128 stops to rotate when the thermal head 129 starts to contact with the platen 101-1 and the head pressure arm 145 alone continues to rotate along the cam track 142a, so that the spring 131 between both arms is charged to resiliently press the thermal head 129 onto the platen 101-1 with a pressing force F (see FIG. 39).

iii) Second Stage Printing Position:

The cam 142 is further rotated by the motor 143 in the direction of arrow to a position which is spaced by $\theta_3$ from the initial position, as shown in FIG. 40. In consequence, the distance is increased to $r_3$ as will be located by $\theta=\theta_3$ in FIG. 46. Then, the head pressure arm 145 further rotates until the radius distance $r_3-r_2$ is developed, so that the spring 131 is further stretched so as to exert an increased force F' with which the thermal head 129 is pressed onto the platen 101-1. Then, a bent rising portion (contact portion) 145a of the head pressure arm 145 becomes to press the arm 210 as shown in FIG. 41. This arm 210 is held for rotation about the shaft 152 so that it pushes one end of a coiled spring 212 when pressed at its one end by the bent rising portion 145a of the head pressure arm 145. In consequence, the shaft 211 which is coupled to the arm 151 is rotated towards the platen 101-1. As a result, the second member (separation member) 130 which is rotatably carried by the end of the shaft 211 is brought into contact with the platen 101-2 through the first ribbon 110 with a contact force F''. The force F'' is greater than the ribbon tension f which serves to retract the first ribbon into the cassette.

With this arrangement, it is possible to delay the timing of separation of the ribbon 110 from the print paper on the platen 101-1 by the amount l. This delay enables the apparatus to adapt to various types of ribbons including multi-color ribbons. Namely, it is possible to record an image through a selective use of different colors, e.g., black and red, by controlling the operation of the motor 143 in the manner described above. For instance, when the two-colored ink ribbon of the same type as that described before is used, recording in black color can be conducted by putting the separation member 130 into effect so as to delay the timing of separation, whereas recording in red color can be attained by prohibiting the operation of the separation member 130. Other color tones can be used by suitably selecting the coloring agents which are to be contained in the inks in the ink layers of the ribbon.

vi) The operation which has been described hereinbefore is executed in reverse order, after the completion of the printing operation. Namely, the motor 143 operates to rotate the cam 142 through $-(\theta_3-\theta_2)$, so that the arm 210 is released from the bent rising portion 145a of the head pressure arm 145, so that it is allowed to rotate about the shaft 152 by the resetting force of the coiled spring until it is contacted by the portion 151b of the arm 151. In addition, the arm 151 is rotated away from the platen 101-1 about the shaft 152 by the force of the spring 157, back to the initial state. A further rotation of the cam 142 through $-(\theta_2-\theta_1)$ by the motor 143 causes the thermal head to move away from the platen, so that the head arm 128 and the head pressure arm 145 are rotated until they contact with each other at their portions 128b and 145b, by the force produced by the spring 131, whereby the thermal head is set at the stand-by position as shown in the lower part of FIG. 36. The thermal head is then rest in the initial position as a result of further rotation of the motor 143 through $-\theta$.

Meanwhile, the cam 126 rotates together with the cam 142 but the ribbon plate 112 does not move because the level of the cam surface contacted by the end 124*a* of the arm guide 124 is kept constant at $h_0$ when the angle $\theta'$ is between 0 and $\theta_3$.

3) Print Correction by Second Ribbon 116

Correction of Typing Error by Correction Ribbon, for example:

In order to correct any error such as typing error by means of the second ribbon 116, it is necessary that the second ribbon 116 be raised to the position in front of the thermal head 129 in place of the first ribbon 110. To this end, the motor 143 operates in the backward direction so as to rotate the cams 142 and 126 from the initial positions in the direction reverse to that in the printing with the first ribbon back to an angular position $\theta_7$ shown in FIG. 47. Since the radius of the cam track of the cam 142 is constantly maintained at $r_0$, the head pressure arm 145, head arm 128 and other members carried by these arms do not move during the rotation of the cam 142 to the angular position $\theta_7$. Meanwhile, however, the level of the cam surface 126*a* of the cam 126 is raised from $h_0$ to $h_1$ as shown in FIG. 47. This increase in the height causes the arm 127 to move through the arm guide 124, so that the ribbon plate 112 is rotated about the shaft 158 thereby bringing the second ribbon 116 to a position where it faces the front side of the thermal head 129.

Thereafter, the rotational angle of the cam 142 is controlled in the same manner as that in the printing sequence explained before, as shown below.

$$0 \rightarrow \theta_1 \rightarrow \theta_7 \rightarrow \theta_6$$

$$\theta_1 \rightarrow \theta_2 \rightarrow \theta_6 \rightarrow \theta_5$$

$$\theta_2 \rightarrow \theta_3 \rightarrow \theta_5 \rightarrow \theta_4$$

The rotation of the cam 142 is accompanied by the rotation of the cam 126 to the angle $\theta_4$ but the ribbon 110 is not moved because the level of the cam surface 126*a* is constantly maintained at $h_1$ during this rotation. It is, therefore, possible to effect the correction by the second ribbon 116 when the timing of separation of the ribbon 116 from the print paper is delayed by functioning of the separation member 130.

As has been described, in this embodiment, the motor 143 operates to selectively effect both the movement of the second ribbon 116 on the ribbon plate 112 between the heating position where it is heated by the thermal head and a retracted position retracted from the heating position, and the movement of the thermal head 129 between a contact position where it contacts with the ink ribbon 10 or the correction ribbon 116 and a retracted position retracted from the contact position.

In the described embodiment, a control is conducted also to vary the pressure of contact between the thermal head 129 and the ribbon 110, 116 in relation to the movement of the separation member 130. Namely, when the separation member 130 contacts the ink ribbon 110, the thermal head is pressed onto the ribbon with a force which is greater than that obtain when the separation member 130 is out of contact with the ink ribbon.

Thus, the described embodiment of the recording apparatus of the invention is capable of selectively executing multi-color printing and error correction.

Block Diagram

A description will be made hereinunder as to the operation of the described embodiment of the recording apparatus.

Figure 50:
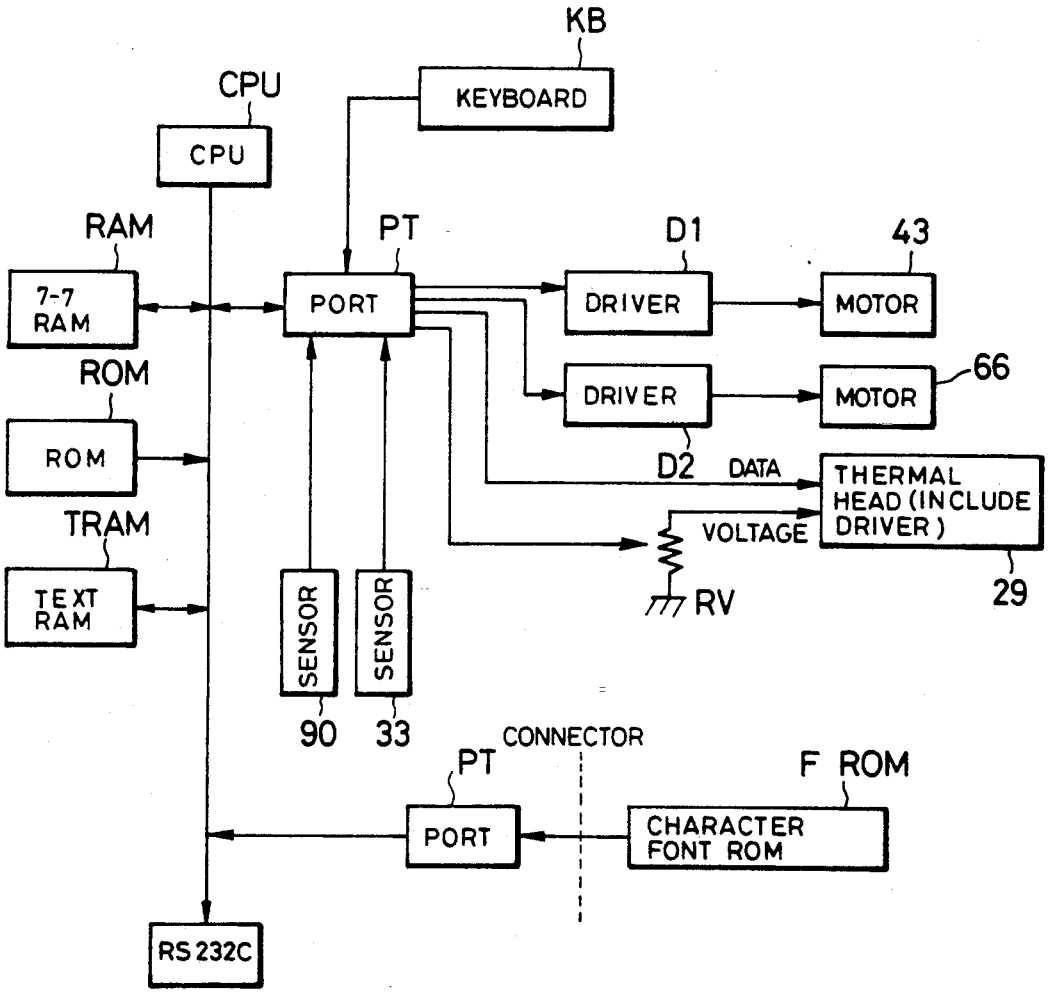
FIG. 50 is a block diagram of this embodiment.

FIG. 50 is a block diagram of the described embodiment of the recording apparatus. The recording apparatus has a central processing unit (CPU) adapted for conducting various kinds of control, a keyboard KB, a random access memory (RAM) adapted for conducting various arithmetic operations, a read only memory (ROM) for storing programs of later-mentioned control program, and a read/write memory (TRAM) which stores text data to be output, e.g., documents. The CPU controls the operation of the aforementioned motor 143 and the motor 166 for taking up the second ribbon, through the port PT and drivers D1 and D2. The control of generation of heat in the thermal head 129 is conducted through data lines DATA, and also by a control of voltage applied to the thermal head 129. The CPU can communicate with external devices such as a font ROM (FROM) storing fonts of characters to be recorded and other devices through a communication interface, RS232C and centronics interface. A density setting volume RV is adapted to vary heating current, voltage and time so as to deliver to the CPU various data as parameters for controlling the printing density and erasing operation which will be detailed later.

Power-On Sequence

Figure 51:
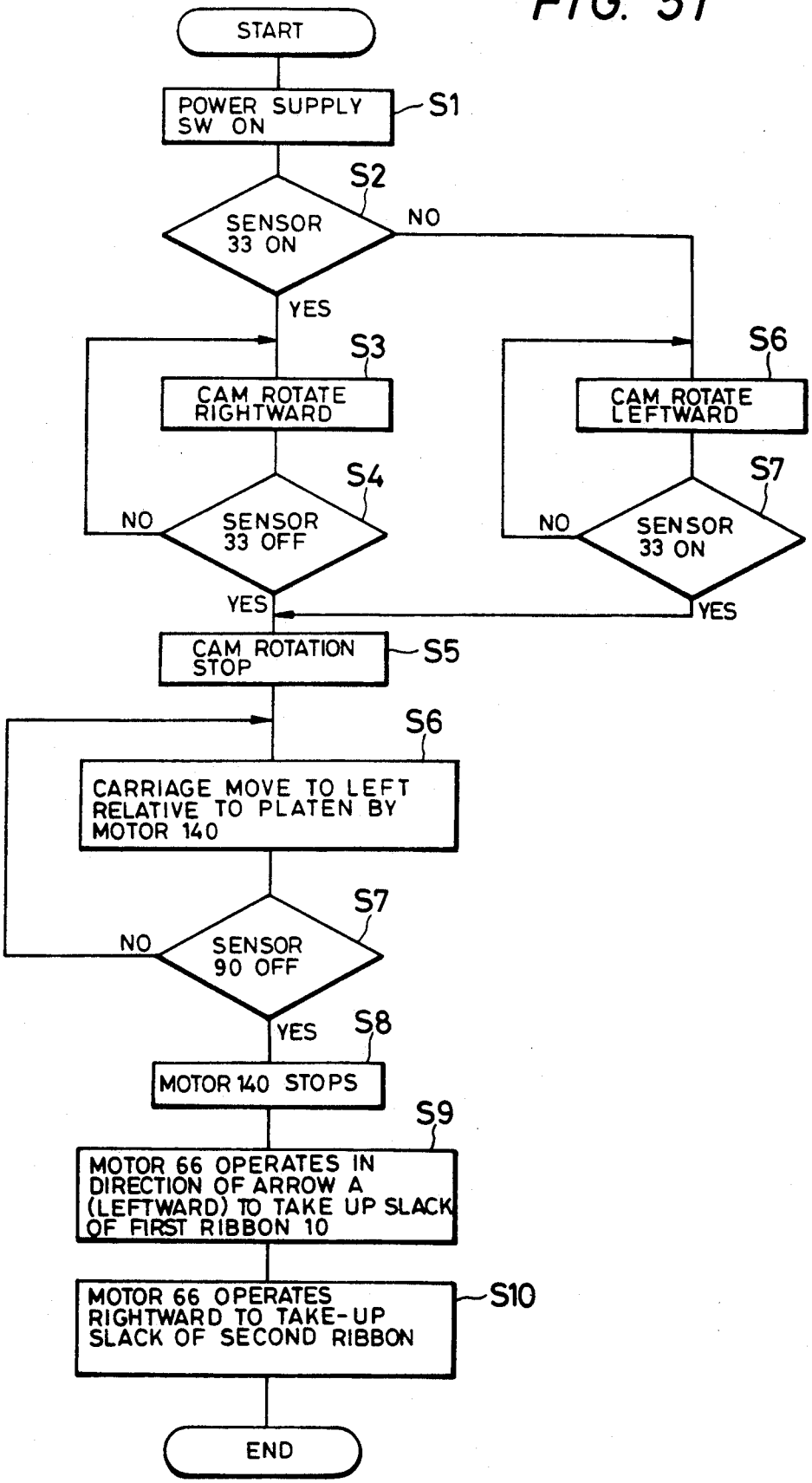
FIG. 51 is an illustration of a power-on sequence.
Figure 52:
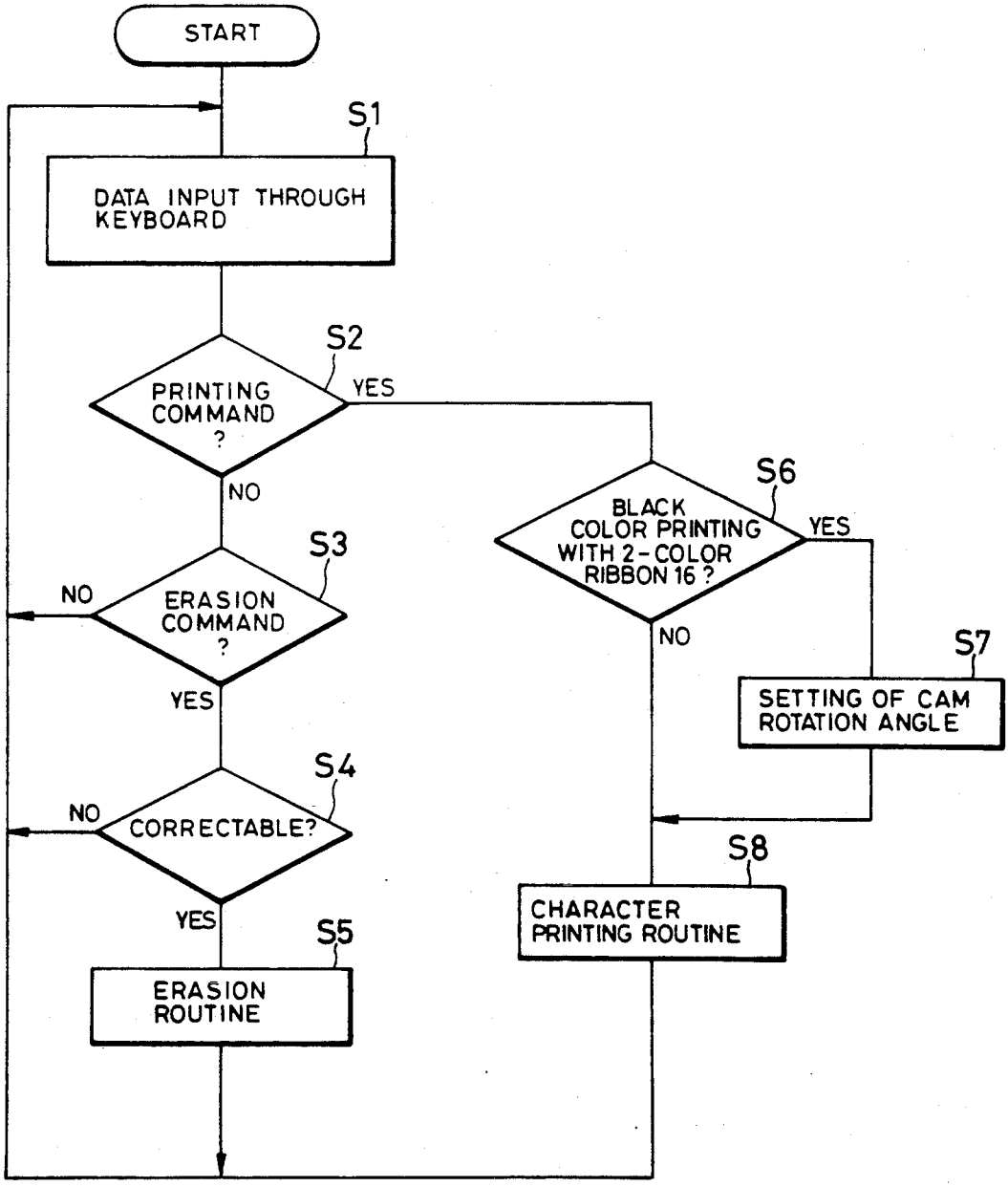
FIG. 52 is an illustration of key-input routine.

The power-on sequence will be described with reference to the flow chart shown in FIG. 51. The power is turned on in Step S1 and a judgment is conducted in Step S2 as to whether the sensor 133 explained before in connection with FIG. 36 is on or off. The fact that the sensor 133 is on means that the shield plate 42*b* is not detected by the sensor 133. If the answer given in Step S2 is YES, the process proceeds to Step S3 in which the cam 142 is rotated to the right as viewed in FIG. 36. This rotation is continued until the shield plate 142*b* is sensed by the sensor 133 in Step S4. Upon detection of the shield plate 142*b*, the sensor 133 is turned off and the process proceeds to Step S5.

Conversely, when the sensor senses the shield plate 142*b*, i.e., when the shield plate 142*b* interrupts the light between the light-emitting portion and the light-receiving portion of the sensor 133, the sensor 133 is turned off so that an answer NO is given to the question in Step S2. In such a case, the process proceeds to Step S6 and the cam 142 is rotated to the left as viewed in FIG. 36. This rotation of the cam 142 is stopped when the sensor is turned on in Step S7, i.e., at the rotational position shown in FIG. 36. The process then proceeds to Step S5 and then to Step S6 in which the motor 240 is operated to cause the carriage 114 to move to the left as viewed in FIG. 33 with respect to the platen. This movement is conducted until the sensor 190 (limit sensor) is turned off in Step S7 so as to determine the absolute position of the carriage 114. If the answer to the question in Step S7 is YES, i.e., if the sensor 190 has been turned off, the carriage 114 is stopped at the instant position in Step S8.

In Step S9, the motor 166 shown in FIG. 35 operates in the direction of an arrow A, i.e., to the left, thereby to tense and tighten the first ribbon 110. Subsequently, the motor 166 is made to operate rightward so as to tense and tighten the second ribbon 116. The power-on sequence is thus completed. For the purpose of simplification of description, explanation concerning motors as the power source will be omitted from the following description.

Key-Input Sequence

A description will be made hereinunder as to the key-input sequence. Data DATA is input in Step S1 through the keyboard. In the next step S2, a judgment is conducted as to whether the input data is a printing command or not. If the answer is NO, the process proceeds to Step S3 in which a judgment is conducted as to whether the input data is in erasion command or not. If the answer is NO, the process proceeds to other functions which are not detailed here. If the answer to the question posed in Step S3 is YES, i.e., if the input data is an erasion command, the process proceeds to Step S4 in which a judgment is conducted as to whether the presently mounted first ribbon 110 is a correctable ribbon. If the answer is NO, the process returns to Step S1. However, if the answer is YES, the process proceeds to Step S5 in which an erasing routine is started as will be detailed later.

When the judgment conducted in Step S2 has proved that the input data DATA is a printing command, the process proceeds to Step S6 in which a judgment is conducted as to whether the presently mounted ribbon is a two-colored ribbon and as to whether the printing command is commanding printing in black color. If the answer is affirmative, the cam is set at rotational position for commencing printing in black color with two-colored ribbon. Conversely, if the answer is negative, the process proceeds to Step S8 in which the printing routine is commenced.

Printing Routine (Control of Cams)

The printing routine will be described hereinunder with specific reference to FIGS. 53 and 54. In order to facilitate the understanding, control of cams will be described with reference to FIGS. 53 and the control of the whole part of the apparatus will be made with reference to FIG. 70.

In Step S1, the carriage 114 is moved back to a position which is spaced from the leading end of the next print position by a distance necessary for acceleration. In the next step S2, the dot image corresponding to the input character is read out of the character font ROM (FROM) and is stored in a work RAM (RAM). The process then proceeds to Step S3 in which a judgment is conducted as to whether the presently mounted ribbon is a two-colored ribbon and also as to whether the presently input printing command is for printing in the basic color (black). If the answer is YES, the process proceeds to Step S5 in which the cam 142 is rotated to the left as indicated by arrow a in FIGS. 37 to 40 until the pin 144 is moved to the position where the radius or the distance between the shaft 149 and the pin 144 becomes equal to $r_3$. Conversely, when the answer to the question in Step S3 is NO, i.e., if the presently mounted ribbon is a mono-color printing ribbon or if the presently input printing command is for printing in the spare color (red) of the two-colored ribbon, the cam 142 is rotated to the left until the pin is brought to the position $r_2$ on the cam 142.

In Steps S6 and S7, operation is started for taking up the first ribbon 110, as well as for starting the movement of the carriage 114. In Step S8, the acceleration of the carriage 114 is finished and the carriage 114 starts to run at a predetermined low speed. In Step S9, a voltage corresponding to the dot image is applied to the thermal head 129 so as to conduct the printing. After application of a predetermined level of energy in Step S10, a judgment is conducted in Step S11 as to whether the printed data has been printed correctly in the basis color. If the answer is YES, the process proceeds to Step S12 so as to cause the carriage to over-run a distance l. If the answer to the question posed in Step S11 is NO, the process directly proceeds to Step S13 in which the carriage 14 is decelerated. Then, in Step S15, the cam is rotated to the right as viewed in FIG. 38 to the rotational position where the position of the pin 144 is represented by $r_1$, whereby the thermal head is returned to the stand-by position. Then, in the next step S16, the carriage 114 is returned to the position where the index indicates the next printing position. In Step S17, the timer is turned on. In Step S19, a judgment is conducted as to whether 0.5 second has passed from the turning on of the timer. In the meantime, a judgment is conducted in Step S18 as to whether the next data has been input. If the answer to the question posed in Step S18 is YES, the process returns to Step S1 to commence the next cycle of printing operation. When no data is input during the set period of 0.5 second, answers NO and YES are obtained, respectively, in Steps S18 and S19. In such a case, the process proceeds to Step S20 in which the cam 142 is rotated to the right to the initial position shown in FIG. 37, thus completing the printing sequence.

Figure 54:
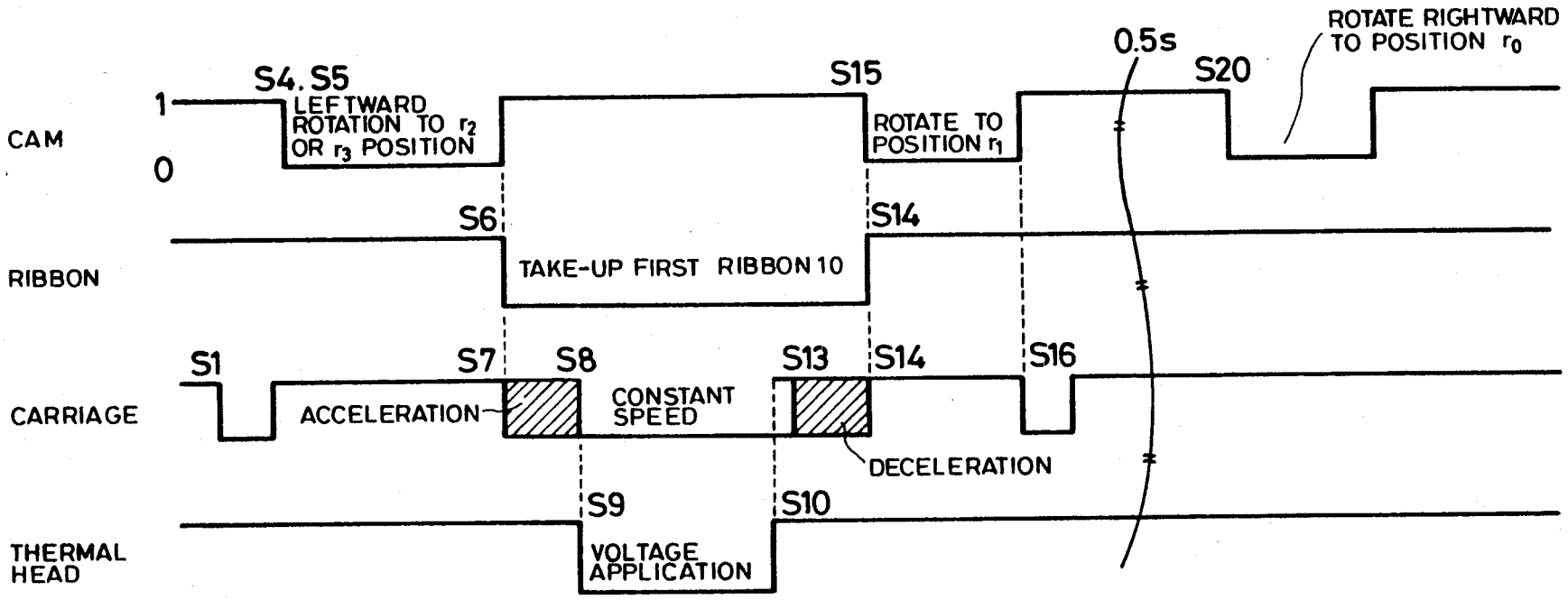

FIG. 54 is a time chart of the printing sequence. The steps shown in this time chart correspond to the respective steps of the printing sequence explained in connection with FIG. 53. The axis of abscissa represents time, while the axis of ordinate represents the level which is "0" or "1". In this embodiment, the low lever (0) corresponds to active state.

Erasion Routine

Figure 55:
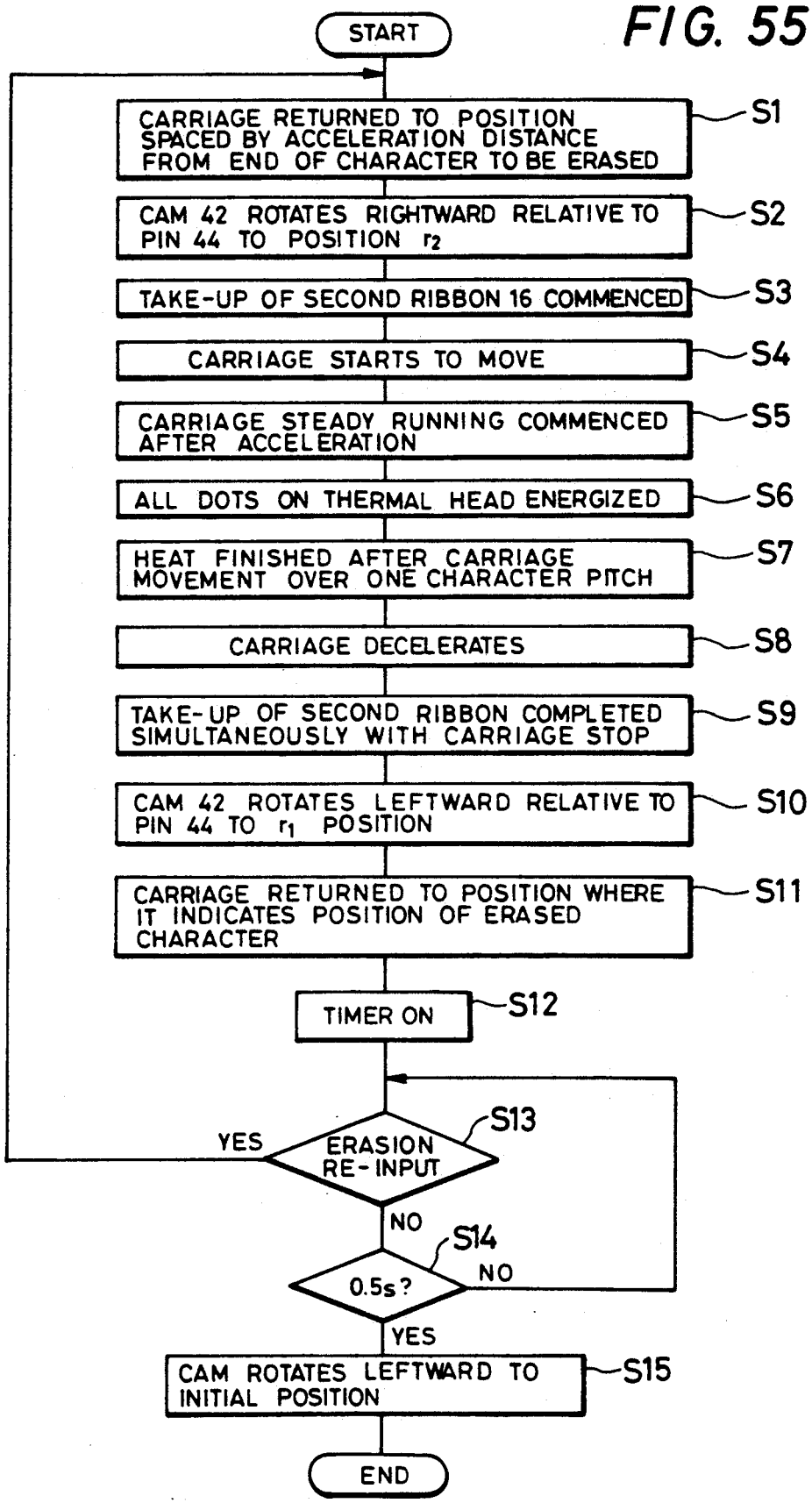
FIGS. 55 and 56 are illustrations of erasing routine.

A description will be made hereinunder as to the erasion routine. FIG. 55 is a flow chart showing the erasion routine. In Step S1, the carriage 114 is moved back to a position which is spaced from the leading end of the characters to be erased by a distance necessary for the acceleration. In the next step S2, the cam 142 is rotated to the right (see FIG. 44) to the rotational position where the position of the pin 144 is represented by $r_2$. The take-up of the second ribbon (erasing ribbon) 116 and the movement of the carriage 114 are started in Steps S3 and S4, respectively. In Step S5, the carriage 114 is accelerated and then commences to run at a constant speed. In order to erase the recorded data, all the dots on the thermal head 129 are energized and the carriage 114 is moved by a distance corresponding to one character, thereby erasing the recorded character. The heating is then finished. The carriage is then decelerated and stopped in Step S9 in which the second ribbon is taken-up. Subsequently, the cam 142 is rotated to the left to the rotational position where the position of the pin 144 is represented by $r_1$, i.e, to the stand-by position. In Step S11, the carriage 114 is returned to the position where the index indicates the erased character. In the subsequent Steps S12, S13 and S14, a judgment is conducted as to whether the next data has been input within the period of 0.5 second after the completion of the erasion. If there is no input of data within this period, the process proceeds to Step S15 in which the cam is rotated to the left to the initial position shown in FIG. 42, thus completing the erasion routine. However, if the input of next data is confirmed in Step S13, the process returns to Step S1.

FIG. 54 is a time chart of the erasion routine shown in FIG. 55. The steps shown in this time chart correspond to the respective steps of the erasion routine explained in connection with FIG. 55. The axis of abscissa represents time, while the axis of ordinate represents the level which is "0" or "1". In this embodiment, the low level (0) corresponds to the active state.

Another Example of Erasion Means

An application of the above-described erasion sequence will be explained hereinunder with reference to the accompanying drawings.

In this case, an erasion ribbon used as the second ribbon has a base film such as of polyester film and a heat-sensitive adhesive material applied to the side of the polyester film adjacent to the print paper.

Figure 57:
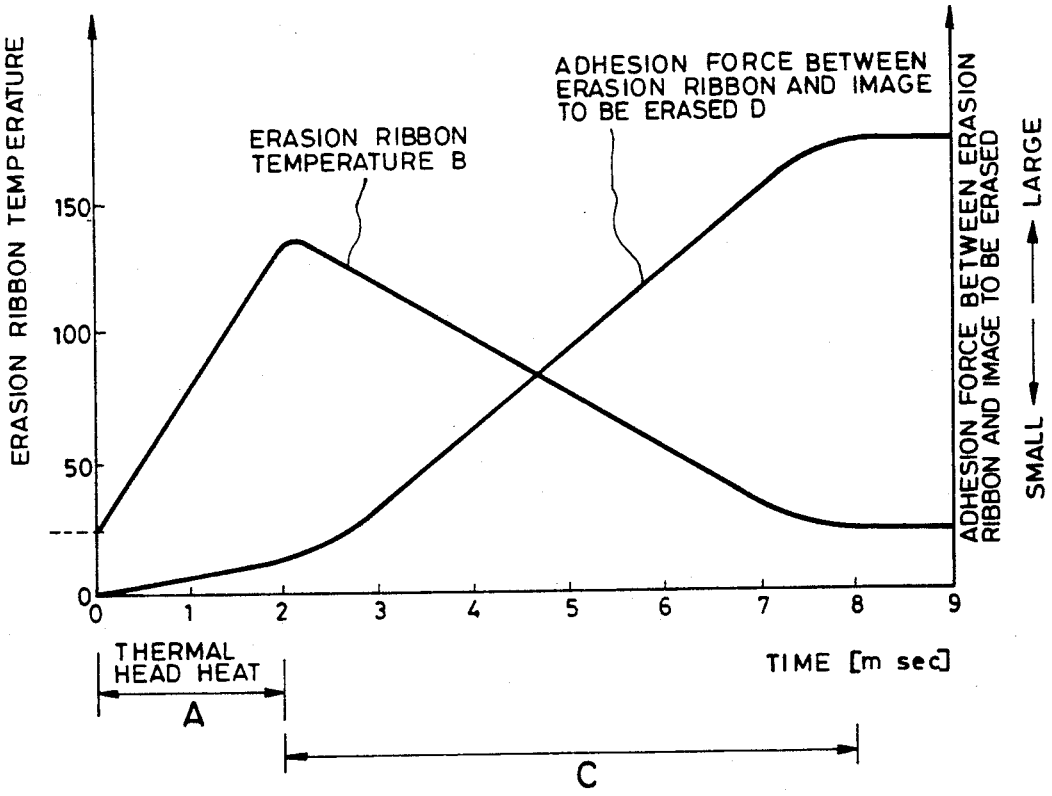
FIG. 57 is an illustration of a change in the adhesion force between an erasing ribbon and an image to be erased and a change in the erasing ribbon in relation to time.

FIG. 57 is a graph showing the manner in which the adhesion force between the image to be erased and the erasion ribbon which is heated and pressed by the thermal head 129 onto this image, as well as change in the temperature of the erasion ribbon, in relation to time. The values shown in this graph have been obtained through experiments and computation is conducted by the present inventors and, hence, are only illustrative. Thus, these values are shown by way of example, and are variable depending on conditions such as the thickness of the base film to be used, level of energy supplied to the thermal head 129, material of the recording ribbon, and so forth.

Referring to FIG. 57, the erasion ribbon is heated by the thermal head 129 for a predetermined thermal head heating time A which is 2 m sec in the arrangement shown in FIG. 57. In consequence, the temperature of the erasion ribbon is increased along a curve B and is lowered substantially to the room temperature by the time indicated at C.

This change in the temperature causes a change in the adhesion force between the erasion ribbon and the image to be erased as shown by a curve D. Namely, the adhesion force is substantially zero, i.e., the ink sticks to the paper, before the heat is input. The erasion tape, however, starts to become sticky as a result of heating. The stickiness or adhesion force is increased as the ribbon temperature falls along the curve B after the heating is finished, and is maximized when the erasion ribbon has been cooled down to the room temperature. The time required for the ribbon to be cooled down to the room temperature is about 6 m sec after the finish of the heating in the case of the embodiment shown in FIG. 57. This value has been obtained through experiments and computations conducted by the inventors and, therefore, varies depending on conditions of the apparatus and the erasion ribbon employed.

In order that the erasion is effected ideally without leaving any trace of the print on the print paper 102, it is necessary that the recorded image is lifted off by the erasion ribbon after the elapse of the time C from the moment at which the heating by the thermal head is completed. The erasion, however, may be done even before the elapse of the time C, provided that the recording density is low, i.e., if the adhesion force between the paper and the characters to be erased is low.

Figure 59:
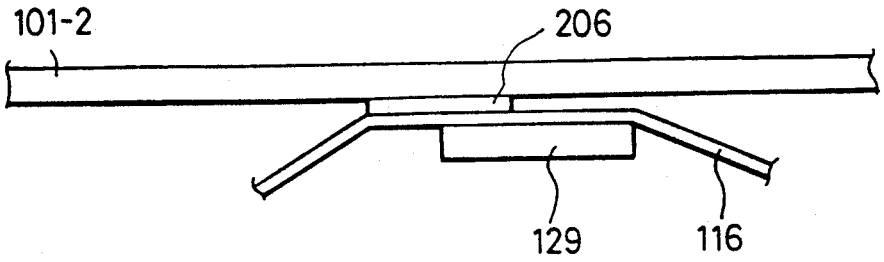
FIG. 59 to 61, 63 and 65 are illustrations of lift-off operation effected by the erasing ribbon.

FIG. 59 shows a flow chart illustrating the process of the erasing operation explained above.

This erasion routine is different from the erasion routine shown in FIG. 55 in that a Step S0.5 is executed in which a judgment is conducted as to whether the value set by the density setting volume Rv exceeds a predetermined level or not and a time $T_1$ or $T_2$ is set in a timer in accordance with the result of the judgment. Namely, the time $T_1$ is set in the timer when the value set by the volume Rv exceeds a predetermined value, whereas, when the value set by the volume Rv is below the predetermined level, the time $T_2$ is set in the timer. The time $T_1$ and the time $T_2$ are so selected as to meet the condition of $T_1 > T_2$. In Step S6, the timer is turned on simultaneously with the completion of heating and, in Step S9, the carriage is stopped. Thereafter, a judgment is conducted in Step S10 as to whether the time set in the timer has been elapsed. This time corresponds to the time C and, hence, is 6 m sec at the maximum in the example shown in FIG. 57. The ribbon is wound up only after the elapse of this time is confirmed. The behavior of the erasion ribbon and the image to be erased will be described hereinunder with specific reference to FIGS. 59 to 61.

Figure 58:
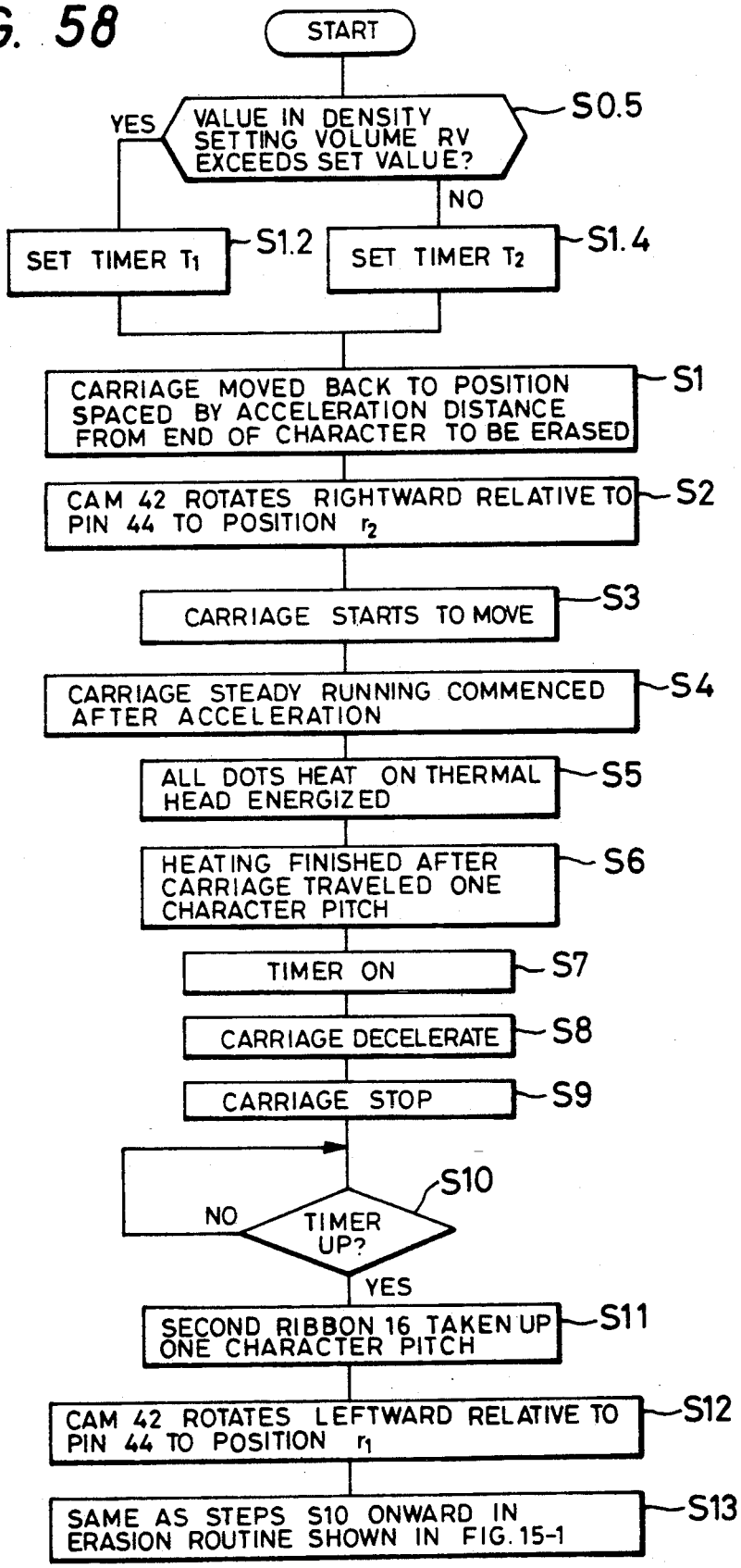
FIGS. 58, 62 and 64 are flow charts of a control of operation for ensuring complete erasion of an image.
Figure 60:
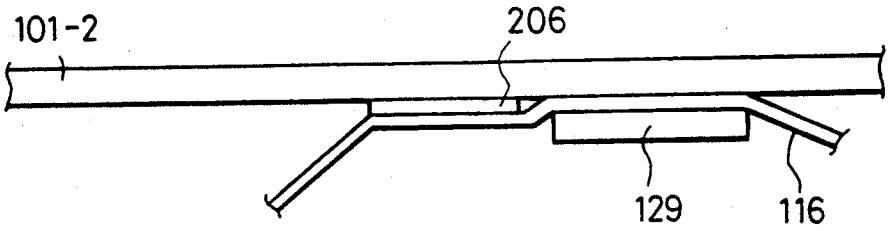
Figure 61:
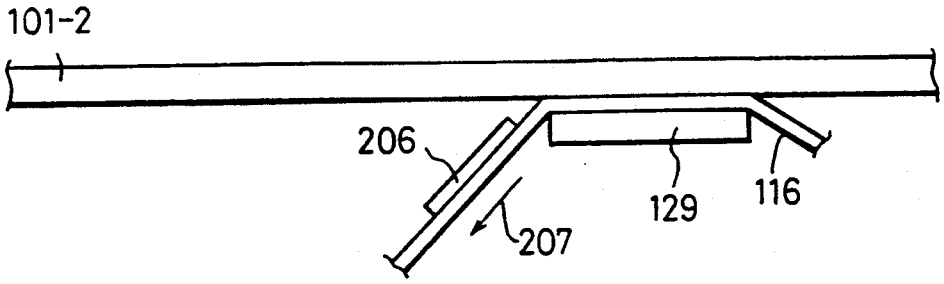

FIG. 59 illustrates an operation which is executed between Steps S4 and S6 in the process shown in FIG. 58. FIG. 60 shows the step S9 of the process shown in FIG. 58. Since the erasion ribbon 116 has not been wound yet, it still sticks to the image 206 to be erased. Then, if the judgment in Step S10 of the process shown in FIG. 58 has proved that the time $T_1$ or $T_2$ set in the timer has elapsed, the erasion ribbon 116 is wound up in Step S11 of the process shown in FIG. 58 in the direction of an arrow 207 by a length corresponding to one character, whereby a state as shown in FIG. 61 is attained. Thus, the image 206 sticks to the erasion ribbon 116 so as to be lifted off the print paper 102 by the ribbon 116.

It will be understood that the lift-off of the image 206 from the print paper 102 is conducted only after the adhesion force between the image 206 to be erased and the erasion ribbon 116 has been maximized, i.e., only when the time set in the timer has elapsed after the completion of the erasion ribbon 116. It is not essential that the time $T_1$ or $T_2$ set in the timer is equal to or longer than the time C shown in FIG. 57. Namely, the set time may be shorter provided that the adhesion force between the erasion ribbon and the image is greater than that between the image and the print paper. Steps S12 onward in the process shown in FIG. 58 are materially the same as the steps S10 onward in the process shown in FIG. 55.

Figure 62:
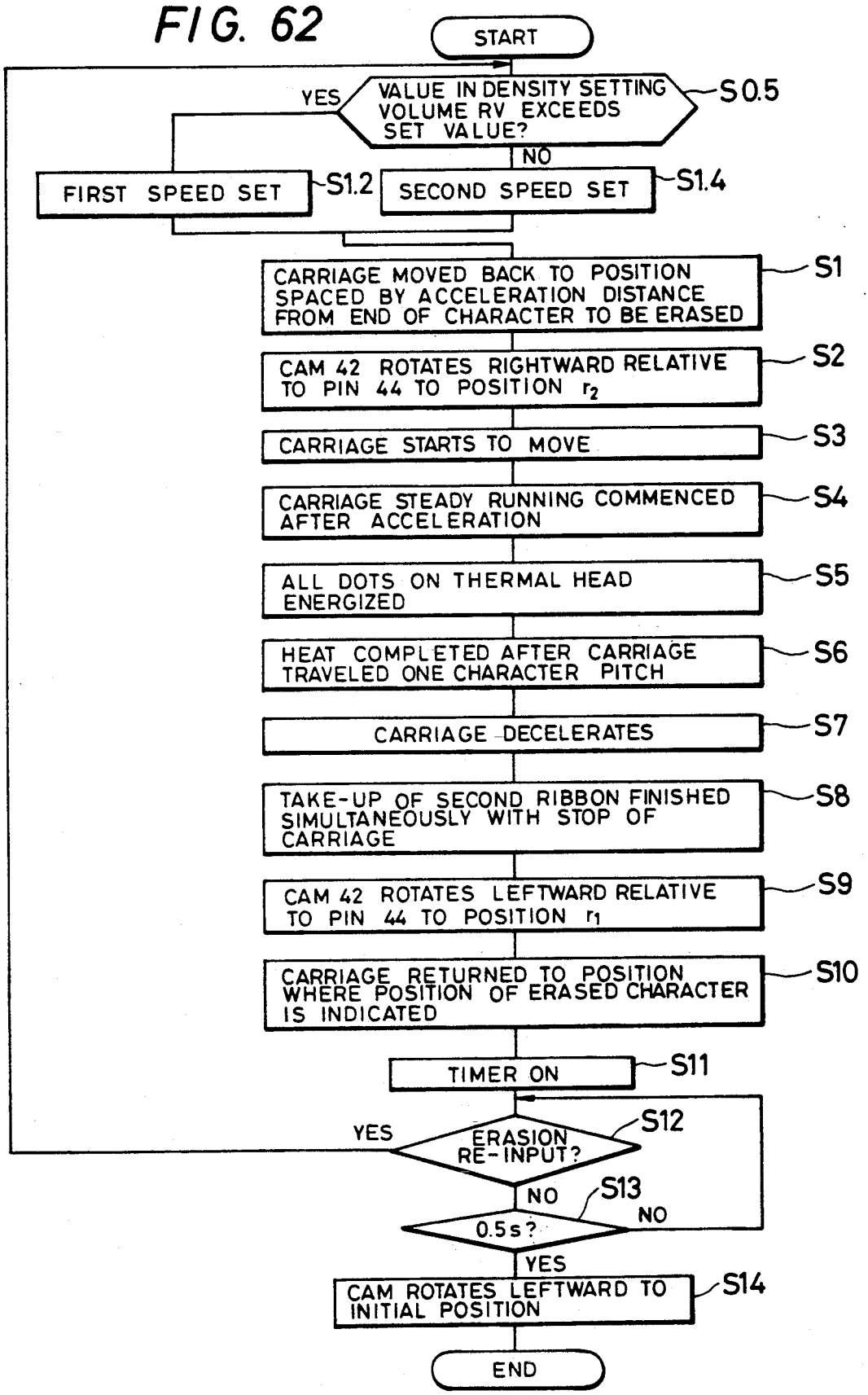
Figure 63:
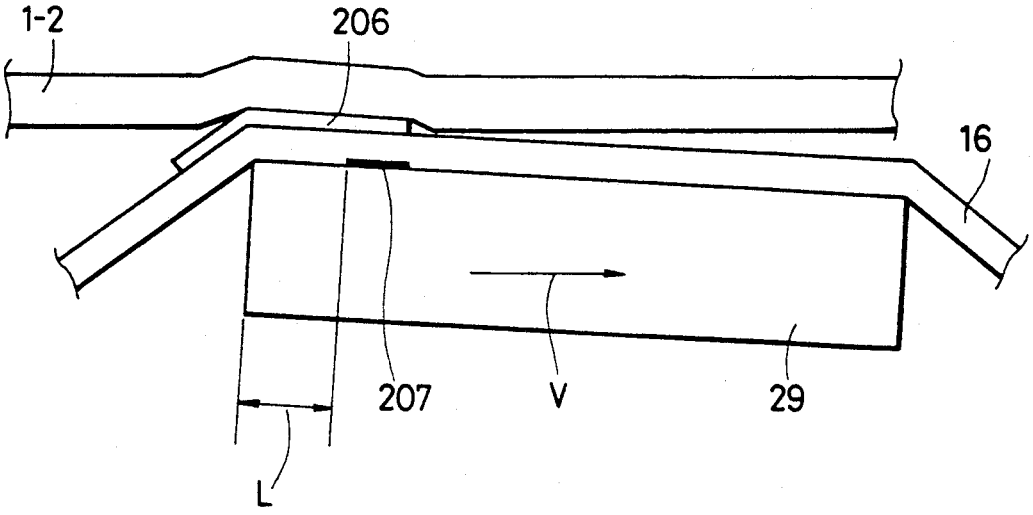

A description will be made hereinunder as to another example of the erasing operation. In this example, the running speed during the erasion is set to be lower than the normal running speed at which the carriage runs during printing, in order to ensure the safe erasion of the recorded data. FIG. 62 shows the erasion routine of this example. This erasion routine is similar to that shown in FIG. 55 but the steps S1 to S5 are altered from those in the routine shown in FIG. 55. The description will be made with reference to FIG. 62. FIG. 63 is an illustration of operation in which the running speed is changed to facilitate the erasion as described above. In FIG. 63, a reference numeral 207 designates a heat generating member provided on the thermal head 129, while a symbol L represents the distance between the end surface of the thermal head 129 and the heat generating member 207. A symbol V represents the running speed of the carriage, i.e., the running speed of the thermal head 129. As will be clear from FIG. 63, the separation of the image 206 from the print paper 101-2 to be erased by the erasion ribbon 116 is conducted when the erasion ribbon 116 has run the distance L at the speed V after it is heated by the heat generating member 207. Thus, the separation of the image is commenced after elapse of a time T which is given as $L(mm)/V(mm/sec)\times 1000=T(m/sec)$. The distance L is determined in accordance with the characteristic of the thermal head 129, so that a predetermined constant value $L_0$ may be imparted for a given thermal head. Therefore, in this example, the speed V is determined such that the time T (m sec) mentioned above takes a value which is greater than the time 204 (see FIG. 57) mentioned before, i.e., such that the condition of $L_0V=T_0>204$ is met. The fact that this condition is met means that the separation takes place only after the temperature of the erasion ribbon has been lowered sufficiently, so that erasion can be conducted in good order as explained before in connection with FIG. 57.

In regard to the recording or printing, there is an increasing demand for higher recording speed. In order to cope with this demand, there is a trend for higher running speed V' of the carriage 114. Thus, the carriage speed in ordinary thermal transfer printers generally ranges between 50 mm/sec to 150 mm/sec at the present stage.

For the purpose of stably obtaining the time C shown in FIG. 57 with such a high carriage speed, a considerably long running distance L is required. For instance, if the time C is set at 10 m sec, the running distance L has to be at least 0.5 mm. Such a long running distance inevitably lowers the ribbon temperature when the ribbon is separated after the printing, resulting in a degraded quality of printing.

In order to attain a higher erasion performance without adversely affecting the quality of printing, it is necessary that the running speed V of the carriage 114 during erasing is set to be lower than the running speed V' of carriage during printing, i.e., that the condition of $V<V'$ is met. The reduced carriage running speed will cause the erasion speed to be reduced correspondingly.

The reduction in the erasion speed, however, is negligible because the time spent for the erasion is usually much shorter than the time spent for printing. It is thus possible to effect the erasion efficiently and stably by allowing the carriage running speed to vary such as to enable the control of the erasion time through the control of the carriage running speed.

It will be clear to those skilled in the art that the time length till the separation need not always be greater than C shown in FIG. 57. Namely, this time may be shorter than the time C provided that the adhesion force between the image 206 to be erased and the erasion ribbon is greater than the adhesion force between the image 206 and the print paper 101-2 at the moment of separation.

Referring again to FIG. 62, a judgment is conducted in Step S0.5 as to whether the value set by the density volume exceeds a predetermined set value. The steady running speed, which is attained in Step S4, is set at a first speed if the value set by the density volume exceeds the predetermined value. Conversely, if the value set by the density volume is smaller than the predetermined value, a second speed is used as the steady running speed which is set in Step S4. The first speed is smaller than the second speed. Once the steady running speed is set, steps which are the same as Step 6 onward in FIG. 55 are executed. This operation ensures that the erasion can be effected without fail in accordance with the recording density. In Step S1.2 or S1.4 in the process shown in FIG. 62, the heat voltage of the head is set in the memory (work RAM) so as to enable the heat driving voltage (heat energy) in accordance with the recording density, thereby assuring complete erasion regardless of the recording density.

A description will be made hereinunder as to still another example of the erasion means which ensures complete erasion of recorded data.

In this example, in order to make sure that the erasion can be effected completely, the separation of the erasion ribbon 116 from the print paper 101-2 is conducted by making use of the separation member 130.

Figure 64:
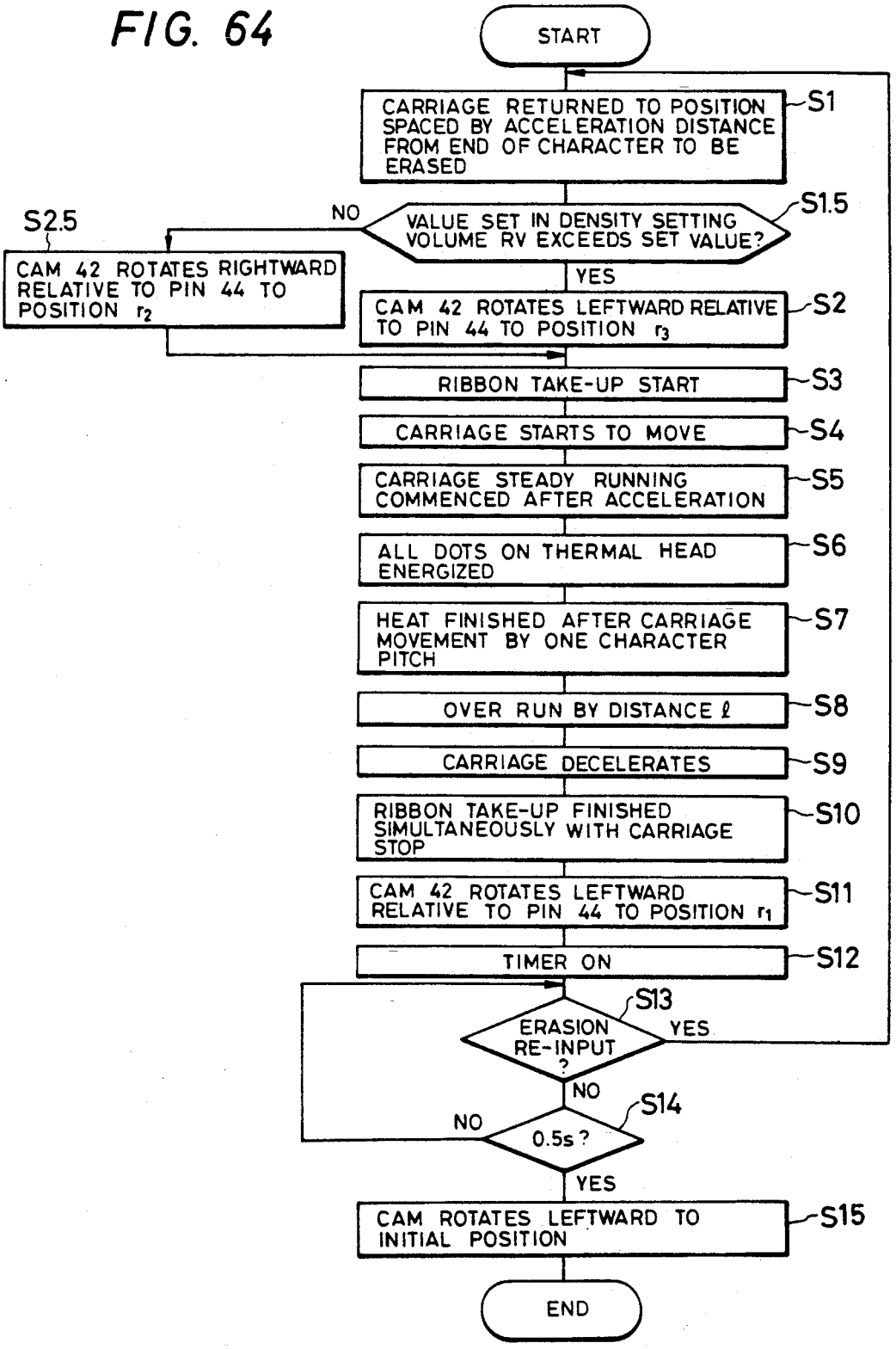

The erasing process will be explained with reference to a flow chart shown in FIG. 64.

In Step S1.5, the value set by the density volume is examined. If this set value is greater than a predetermined value, the cam 142 is rotated to the rotational position $r_3$ in Step S2, whereas, if not, the cam 142 is rotated to the position $r_2$ in Step S2.5. By rotating the cam 142 to the rotational position $r_3$ in Step S2, it becomes possible to utilize the separation member 130 in the erasing operation. Namely, the carriage is made to over-run the distance l to the position of the separation member, whereby the erasion ribbon can be separated from the print paper 101-2 without fail at the left side of the separation member 130, thus ensuring complete erasion regardless of the recording density. Other steps of this erasion routine are materially the same as those of the routine shown in FIG. 55. Thus, the steps S11 onward in the process shown in FIG. 64 are the same as the steps S11 onward in the routine shown in FIG. 55.

The manner in which the erasion in the vicinity of the thermal head 129 will be explained with reference to FIG. 65.

Figure 65:
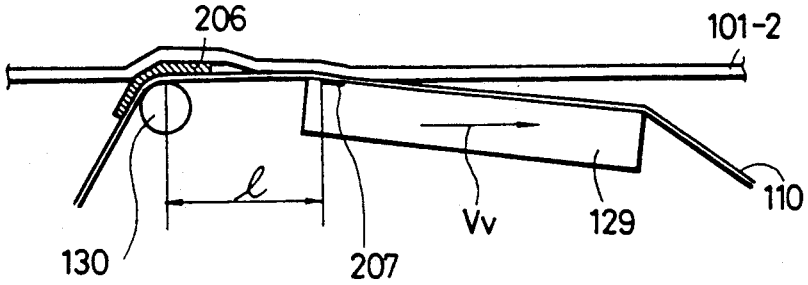

In FIG. 65, the image to be erased by the erasion ribbon 116 is represented by 206. The erasion is conducted by the heat generated by a heat generating member 207 provided on the thermal head 129. The running speed of the carriage and, hence, of the thermal head 129 in the direction of the arrow is represented by Vv.

Due to the presence of the separation member 130, the erasion ribbon 116 lifts the image 206 off the print paper 101-2 at a moment which is delayed after the heating by the heat generating member 207 of the thermal head by a time length which is required for the thermal head to run the distance l. With this arrangement, it is possible to easily obtain the time delay C which is necessary for maximizing the adhesion force between the erasion ribbon 116 and the image 206 to be erased as explained before in connection with FIG. 57.

It is not essential that the length of time until the separation is greater than the time C shown in FIG. 57. Namely, the separation may be conducted in a time which is shorter than the time c. provided that the adhesion force between the erasion ribbon and the image to be erased is greater than the adhesion force between the image and the print paper at the moment of separation.

The separating condition maybe set by making use of one of the parameters such as the time, running speed and the lever or by making use of two or more of these parameters simultaneously.

Example of Printing

Figure 66:
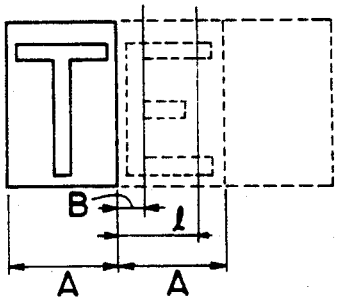
FIG. 66 is an illustration of the relationship between the recorded image and the amount of movement of the head.

A detailed description will be made hereinunder as to the manner in which the characters are printed. FIG. 66 shows a character actually printed in a print paper, as well as the movement of the center of the heat generating member on the thermal head. In this Figure, a symbol A represents the stroke of the head corresponding to one character, while a symbol B represents the amount of over-run of the head after the printing of a character in the spare color (red) with a two-colored ribbon. Similarly, the amount of over-run after printing in the basic color (black) with the two-colored ribbon is represented by l.

Figure 67:
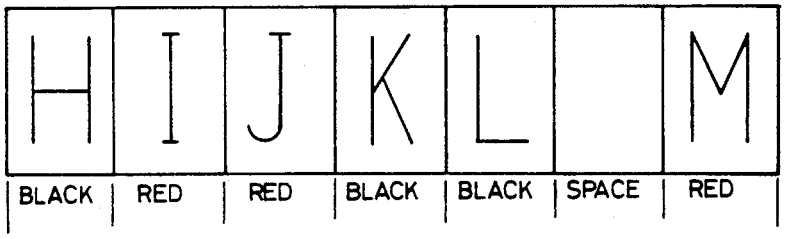
FIGS. 67, 68 and 69 are illustrations of one line image recorded on the recording medium and the movement of the head for each character or a character ahead or back of each character.
Figure 68:
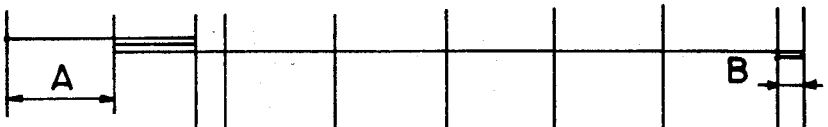
Figure 69:
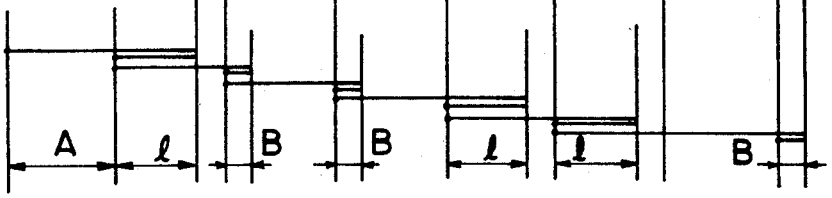

FIG. 67 to 69 show an example of printing of one line of characters conducted in accordance with text data including spaces and stored in a text RAM. The text data is stored in the form of, for example, code dot data. As shown in FIG. 67, characters H I J K L and M are printed in black, red, red, black, black and red, respectively, with a space left between L and M.

FIGS. 68 and 69 represent the movement of the thermal head during printing of one line of characters shown in FIG. 67. The head is moved in accordance with the data successively read from the memory. It will be seen that backward feed of the head is conducted only when printing in red color is to be conducted after printing in black color. FIG. 69 shows the movement of the head for each character. It will be seen that the printing of each character is followed by an over-run in the amount B or l so that the head is fed backward by a distance corresponding to the over-run B or l before the next character is printed. Actually, however, the head is fed back by an amount greater than the amount of over-run, in order to provide a sufficiently long distance for the acceleration of the head. Such a backward feed for the purpose of preserving the distance for acceleration is neglected in order to simplify the explanation. In FIGS. 68 and 69, the head is fed back by an amount B so as to prepare for the printing of the next character.

Printing Routine

Figure 70:
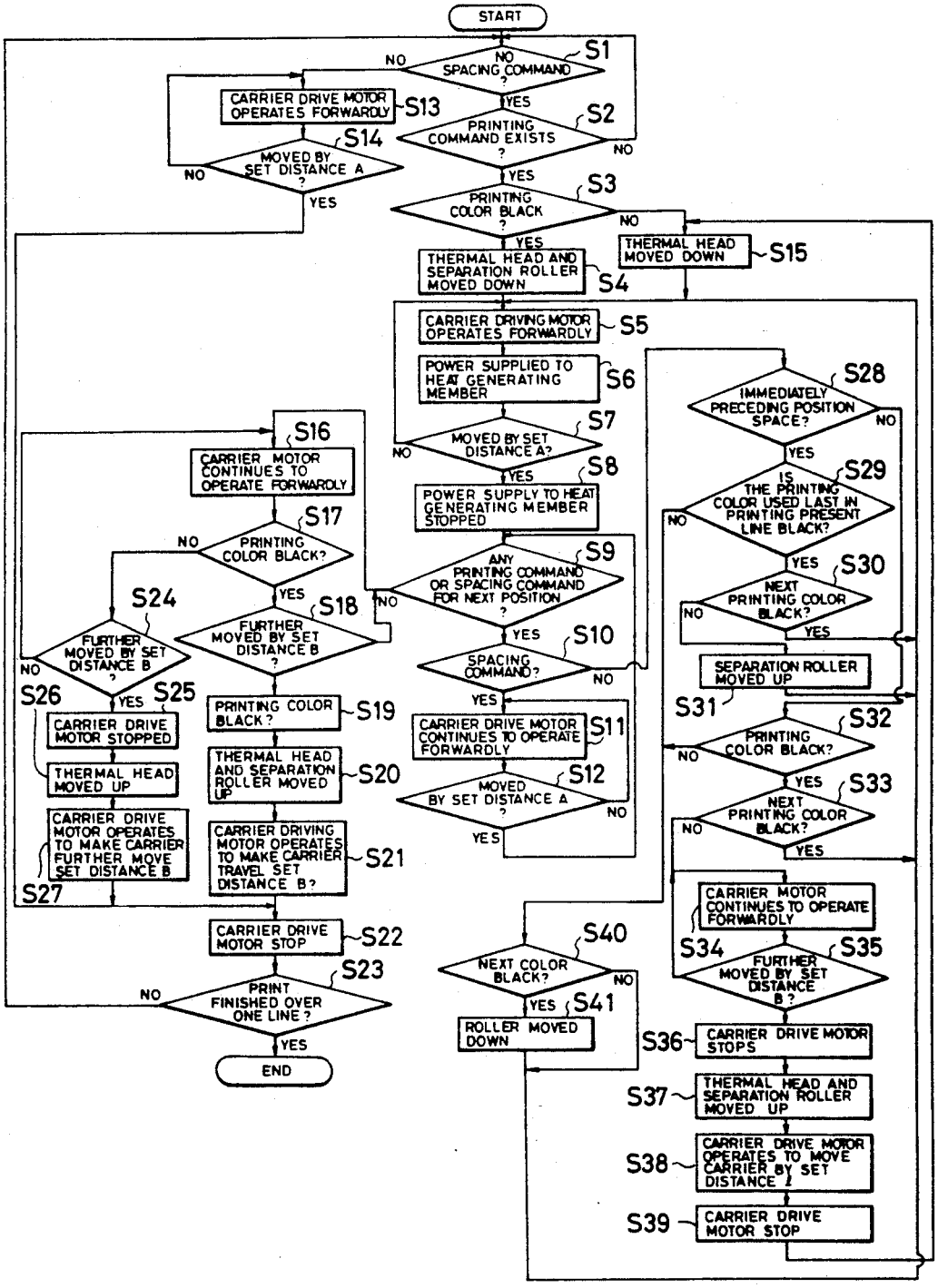
FIG. 70 is a flow chart illustrating the control of recording of a series of characters contained in one line as shown in FIG. 68.

The printing routine will be described hereinunder with reference to FIG. 70. The description will be mainly focused on the movement of the head, i.e., the movement of the carriage or carrier.

Upon confirmation of absence of an spacing command in Step S1, the process proceeds to Step S2. When the text data as shown in FIG. 67 is to be printed, a printing command for printing H i black color exists so that the process proceeds to Step S3. Since the selected printing color is black, the motor is operated in Step S4 so as to lower the thermal head 129 and the separation roller. In the next step S5, the carrier driving motor 240 operates forwardly so as to move the carrier in the printing direction and, in Step S6, electric power is supplied to the heat generating member thereby to conduct the printing. In Step S7, a judgment is conducted as to whether the head has traveled the stroke corresponding to one character, i.e., the distance A. If the answer is YES, the supply of power to the heat generating member is ceased in Step S8. The distance A may be varied according to the character, i.e., the letter. In this state, there is a printing command for printing the next character I in red color. The process therefore proceeds to Step S10 and further to Step S28 because the present command is a printing command rather than a spacing command.

In Step S28, a judgment is conducted as to whether a space has been formed immediately before the character to be printed next. In this case, NO is the answer because the character H has been printed immediately before the character I which is going to be printed, so that the process proceeds to Step S32. In Step S32, a judgment is conducted as to whether the printing color which has been selected is black. In this example, the immediately preceding character H is printed in black so that black has been selected. Therefore, an answer YES is obtained to the question posed in Step S32 so that the process proceeds to Step S33 in which a question is asked as to whether the printing color to be used for the character which is going to be printed is black. Since the next character I is to be printed in red, an answer NO is given to this question so that the process proceeds to Step S34 in which the carrier driving motor is operated forwardly to move the carrier to the position where the last printed character H clears the separation roller so as to be separated from the ink ribbon. The movement of the carrier to this position is confirmed in Step S35 and, thereafter, the carrier is stopped in Step S36. In the next step S37, the thermal head and the separation roller are raised and the carrier driving motor is reversed in Step S38 so as to cause the carrier to move backward to the position for printing the next character I. Thus, backward feed by the distance l is effected in Step S38. After completion of this backward feed, the carrier is stopped in Step S39. The process then returns to Step S15 in which the thermal head is lowered so as to commence the printing of the next character I in red color. The process then follows Steps S5, S6, S7, S8 and S9 as in the case of the printing in black color. Since the printing command for the next character J appoints red, the process proceeds from Step S10 to Step S28. Since the character printed last is I rather than a space, the process proceeds to Step S32. In this case, red has been selected as the printing color so that an answer NO is given to the question posed in Step S32 thereby proceeding the process to Step S40. Since the color appointed for the printing of the next character J is red, the process returns to Step S5. Then, Steps S5, S6, S7, S8, S9, S10, S28, S32 and S40 are followed in the same manner as that in the printing of the preceding character I. The printing command for the next character K appoints black as the printing color. The process therefore proceeds to Step S41 in which the separation roller is lowered and then the process returns to Step S5. Then, Steps S5, S6, S7, S8, S9, S10, S28 and S32 are followed as in the case of the preceding printing operation. Since the presently selected color is black, an answer YES is given to the question in Step S32 so that the process proceeds to Step S33. Then, the process returns to Step S5 because the printing of the next character L is to be done in black color. Consequently, Steps S5, S6, S7, S8, S9 and S10 are followed in the same manner as the preceding printing cycle. In this case, however, an answer YES is given to the question posed in Step S10 because the next command is a spacing command, so that the process proceeds to Step S11 in which the carrier is fed forward by a distance corresponding to one character. This forward feed of the carrier is confirmed in Step S12 and then the process returns to Step S9 and further to Step S10. The process then skips to Step S28 because in this case the printing command for printing the next character M appoints red as the printing color. In this case, since the space is the character which is immediately before the character M which is going to be printed, an answer YES is given to the question in Step S28 so that the process proceeds to Step S29. In Step S29, a judgment is conducted whether the color used for the printing of the last character is black or not. In this case, since the character L immediately before the space has been printed in black, an affirmative answer is obtained so that the process proceeds to Step S30. Then Step S31 is followed because the color appointed for the printing of the next character M is red. After raising the separation roller in Step S31, the process returns to Step S5 and follows Steps S6, S7, S8 and S9. Where there is no next command, the process skips from Step S9 to Step S16 and proceeds to Step S17. Since the presently selected printing color is red, the process proceeds to Step S24 in which the carrier is made to over-run a distance necessary for the printing in red color, i.e., the predetermined distance B, thereby allowing the separation of the ink ribbon. Then, the carrier driving motor is stopped in Step S25 and the thermal head is raised in Step S26. In the subsequent Step S27, the carrier driving motor is reversed to feed the carrier backward by the predetermined distance B, thereby stopping the carrier at the next printing position in Step S22. The process then proceeds to Step S23 in which a judgment is conducted as to whether the printing on one printing line is over, thus completing the printing routine.

The multi-color ribbon used in this embodiment may be a ribbon which has a plurality of ink layers of the same color, as well as a ribbon having a plurality of ink layers of different colors.

Thus, the described embodiment of the recording apparatus enables the recorded characters to be erased without fail, even when the apparatus is of the type which conducts the recording by means of a thermal head.

In addition, the described embodiment can also be applied to the apparatus of the type in which the printing is effected by applying heat to an ink sheet, in such a manner as to enable a multi-color ink sheet capable of printing in a plurality of colors and a correctable ink sheet to be selectively mounted on the same position of the apparatus.

Furthermore, the described embodiment, when applied to an apparatus of the type in which the printing is conducted by applying heat to an ink sheet, can ensure that the erasion can be effected without fail by allowing the condition of separation of the ink sheet from the recording medium to be varied. This can be achieved by, for example, controlling the timing of separation after the printing through controlling the slack of the ink sheet by take-up operation of a motor, controlling the recording speed by varying the speed of movement of the thermal head, or through controlling the movement of a separation member such as the separation roller. It is possible to obtain the optimum separating condition by suitably combining these parameters of separating operation.

It will also be understood that the described embodiment, when applied to an apparatus of the type in which the printing is effected by applying heat to an ink sheet, makes it possible to utilize the printhead intended for printing purpose as well as for the purpose of erasing the printed characters. In such a case, it is possible to erase the recorded characters without fail by heating the entire area of a region of an erasion sheet covering the entire region of dots constituting the character to be erased.

In addition, the described embodiment enables the printing color to be altered a plurality of times during printing of one line of characters, when applied to an apparatus of the type in which the printing relies upon application of heat to an ink sheet.

It is also to be noted that the described embodiment, when applied to a recording apparatus which makes use of a multi-color ink sheet, enables various actions necessary for the alteration of printing color to be executed in relation to the actions for recording such as spacing action, thereby attaining a high efficiency of multi-color recording.

It is also to be noted that the described embodiment, when applied to an apparatus of the type in which the printing relies upon application of heat to an ink sheet, enables the amount of relative movement between the sheet and the heating position to be varied according to the printing color during printing along each printing line.

When applied to an apparatus which is capable of performing multi-color printing by applying heat to an ink sheet, the described embodiment offers an advantage in that, during changing of the print color from one color to another color and vice versa, the separation of the ink sheet after the printing of a character in the first color and the operation for printing the next character in the second color are conducted in a suitably controlled manner, thereby attaining a high efficiency of multi-color printing.

Furthermore, it is possible to attain a high quality of print by varying the force with which the thermal head is pressed onto the ink sheet in accordance with the color appointed by the multi-color printing command.

In addition, when a correctable sheet is used for the purpose of printing, the force with which the head is pressed during erasion may be varied from the head pressing force during printing, thereby to conduct the erasion under optimum condition.

Moreover, it is possible to attain higher efficiency and reliability of erasion by controlling, in accordance with the condition of recording such as recording density, one or more of various factors of erasing operation such as the running speed of carriage, timing of take-up of the erasing sheet, position of the separation lever and the level of the erasing energy.

It is to be understood also that, change of the printing color can be effected in response to a color changing command without requiring suspension of movement of the carriage, even during returning, spacing or skipping operation of the carriage.

The described embodiment, when applied to a recording apparatus of the type which conducts printing by applying heat to an ink sheet, offers an advantage in that a member for effecting the separation of the ink sheet from the print paper can be disposed in the space between the supply end and take-up end of the ink sheet, thus offering an efficient use of the space.

The described embodiment enables a correctable ink sheet and a multi-color printing ink sheet to be used selectively in a recording apparatus of the type in which the printing is effected by applying heat to the ink sheet. In such a case, a separation lever which operates during printing in basic color with the multi-color printing ink sheet can be used also in the erasing operation for erasing characters which have been printed with a correctable ink sheet.

The described embodiment also makes it possible to realize a recording apparatus of the type in which printing is effected by applying heat to an ink sheet, wherein the apparatus is capable of mounting both a correctable ink sheet or a multi-color printing ink sheet capable of selectively providing different printing colors at the same printing position and an erasion sheet which is used for erasing the characters which have been printed with the correctable ink sheet.

The described embodiment also makes it possible to realize a recording apparatus in which a single control member can control both the printing operation conducted with a correctable ink sheet or a multi-color printing ink sheet and the erasing operation for erasing characters which have been printed with the correctable ribbon.

Finally, it is to be noted that the described embodiment makes it possible to obtain a recording apparatus of the type in which printing is effected by applying heat to a demountable ink sheet, wherein the member for separating the ink sheet is provided on the main part of the apparatus rather than as a demountable member such as an ink cassette, so that the construction of the demountable member can be simplified advantageously.

A description will be made hereinunder as to a different embodiment in which the means for varying the timing of separation between the multi-color ink ribbon and the recording medium is provided on the demountable member such as a case or ribbon cassette accommodating the ink ribbon and demountable from the main part of the apparatus. Construction of such an embodiment will be described hereinunder with reference to FIGS. 71 to 73.

Figure 71:
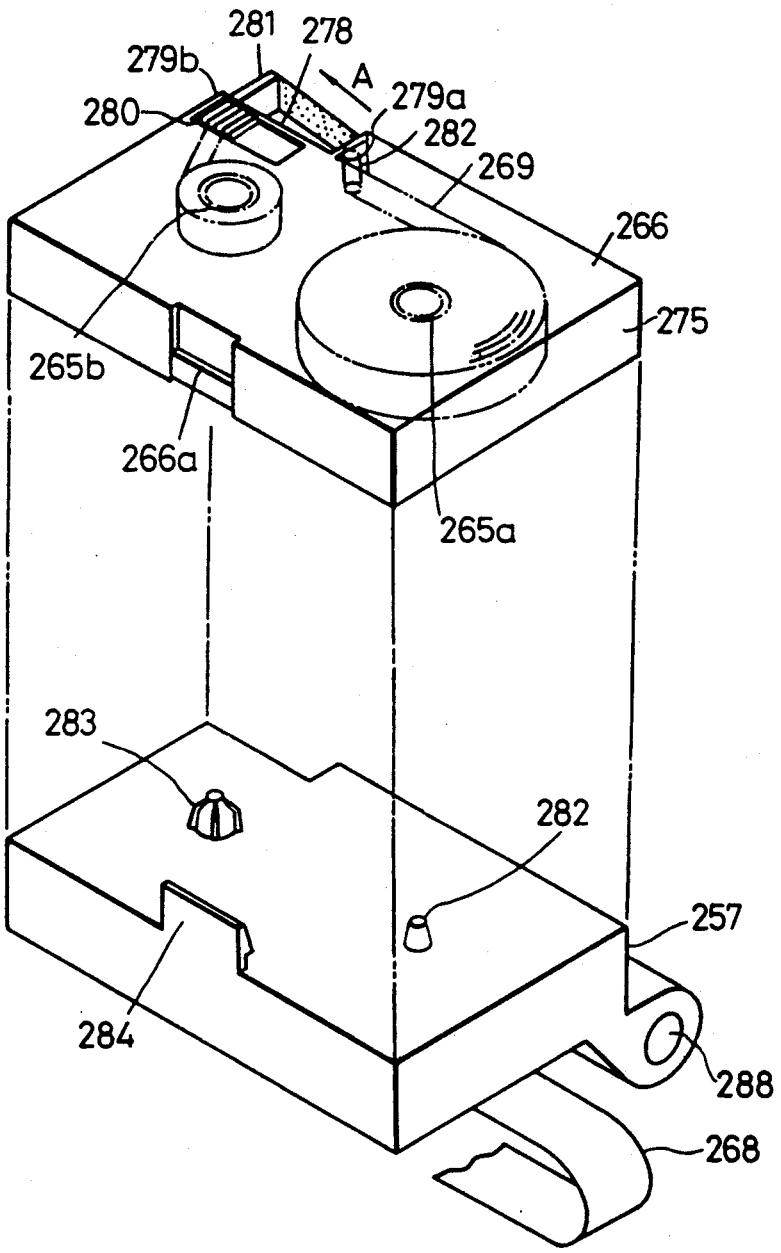
FIG. 71 is a perspective view of another embodiment of the ribbon cassette in accordance with the present invention.

FIG. 71 is a perspective view of a ribbon cassette as an embodiment of the present invention. The ribbon cassette generally denoted by 266 accommodates a continuous belt-like thermal transferable member 269 which is, in this case, a two-colored ink ribbon of the type explained before. The thermal transferable member 269 is connected at its one end to a rotatable supply reel 265*a* and wound on this reel, while the other end of the thermal transferable member 269 is connected to and wound on a rotatable take-up reel 265*b*. The take-up reel 265*b* is adapted to be driven to rotate counter-clockwise thereby tracting the thermal transferable member 269 in the direction of an arrow A.

The ribbon cassette 266 is notched at its left upper corner as viewed in FIG. 71 so as to form a vacancy or cut-out 278. The thermal transferable member 269 is extracted from the cassette through an end opening 279*a* of the cut-out 278 so as to appear to the exterior and is retracted into the cassette 266 to disappear through the other end opening 279*b* of the cut-out 278. The space behind the extracted thermal transferable member 269 afforded by the cut-out 278 is capable of receiving a thermal head 267 which is adapted for applying heat energy to the thermal transferable member 269. The cassette also has a slide 280 as a manipulation member and is capable of sliding to the left and right. The slide 280 is formed as a unit with a tape guide 281 which projects into the cut-out 278. The tape guide 281 corresponds to the aforementioned guide member 274. The arrangement, therefore, is such that the tape guide 281 moves to the left and right as the slide 280 is manipulated to slide to the left and right. Thus, the tape guide 281 has a function to vary the location at which the thermal transferable member 269 starts to be retracted into the case 275 through the opening 279*b*. When the slide 280 is in the position shown in FIG. 73, the thermal transferable member 269 starts to be retracted into the case 275 of the ribbon cassette 266 at a location which is near the left end surface of the case 275. In contrast, when the slide 280 is moved to and set at the position indicated at RED in FIG. 71, the tape guide 281 also is moved to the right so that the thermal transferable member 269 starts to be retracted into the ribbon cassette 266 at a location which is substantially the center of the cut-out 278 as viewed in the direction of movement of the ribbon.

The ribbon cassette 266 is adapted to be demountably mounted on the carriage 257 of a thermal transfer printer (not shown).

More specifically, the carriage 257 is provided with a supply reel 265*a* for rotatably carrying the supply reel 265*a* and a take-up shaft 283 for fitting in the take-up reel 265*b* so as to drive the latter. The take-up shaft 283 is adapted to be driven by a driving mechanism which is not shown.

The carriage 257 is provided at a portion thereof with a catch 284 made of a resilient material and adapted for engagement with a step 266*a* so as to secure the ribbon cassette 266 onto the carriage 257.

The slide 280 will be able to keep the instant position provided that the friction between the slide 280 and the ribbon cassette 266 is large enough to restrain the slide 280 from moving. However, if the friction is small, it is advisable to provide suitable means such as a click mechanism to enable the slide 280 to maintain the instant position. The carriage 257 is movable along a shaft 288. A reference numeral 254 denotes a platen, while reference numeral 268 designates a flexible conductor plate for transmitting signals to the thermal head 267.

A description will be made hereinunder as to the printing operation conducted with the ribbon cassette having the described construction.

Figure 72:
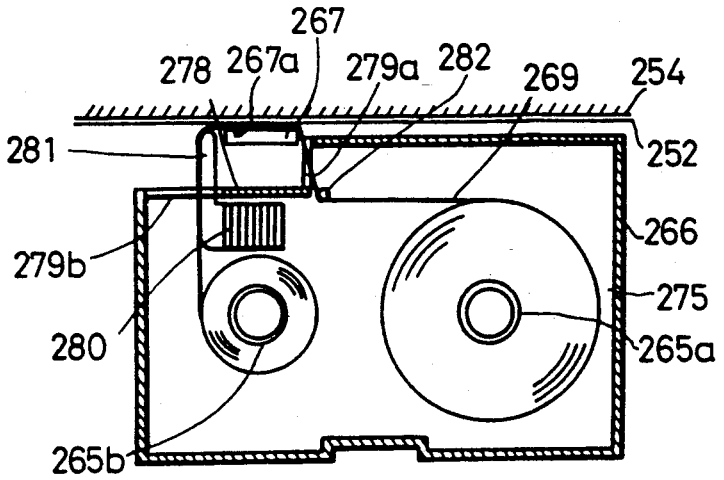
FIGS. 72 and 73 are cross-sectional views of the ribbon cassette shown in FIG. 71.

FIG. 72 schematically depicts the recording section of a recording apparatus which makes use of the above-described ribbon cassette, wherein the apparatus is set for operation in a mode in which data is transferred to a print paper 252 only from a second ink layer of the ink ribbon or thermal transferable member 269.

In operation, the unused portion of the thermal transferable member 269 is led to the space defined by the cut-out 278 through the opening 279*a* by the operation of a pinch roller 282, and is made to move along a path formed between the thermal head 267 and the print paper 252. The thermal transferable member is then made to change its running direction along the left side surface of the tape guide 281 which is set in the vicinity of the left end of the thermal head 267, so as to be retracted into the ribbon cassette 266 and taken-up by the take-up reel 265*b*.

In the state shown in FIG. 72, the slide 280 is on the left end of its stroke, so that the tape guide 281 is placed in the vicinity of the thermal head 267. In such a case, the thermal transferable member 269 starts to come off the print paper 252 immediately after the application of heat thereto by a heater 267*a* of the thermal head. It is thus possible to cause only the second ink layer to be transferred to the print paper 252.

Figure 73:
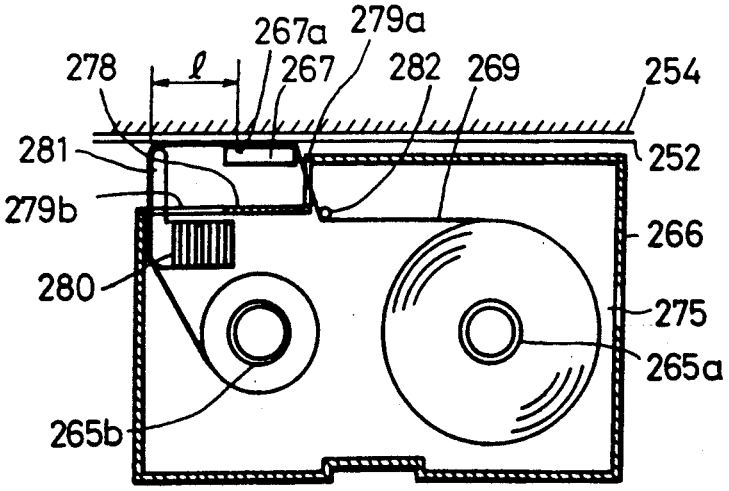

FIG. 73 shows the apparatus set for operation in a mode in which both the first and the second ink layers of the thermal transferable member 269 are transferred to the print paper 252. In this case, the slide 280 is on the left end of its stroke, so that the tape guide 281 is spaced far from the thermal head and positioned adjacent to the left end of the ribbon cassette 266. In this state, therefore, the changing of running direction of the thermal transferable member 269 for retraction into the ribbon cassette 266 through the opening 279*b* is commenced only after the thermal transferable member 269 has run a predetermined distance l after passing the thermal head 267. Thus, the thermal transferable member 269 is allowed to run in contact with the print paper 252 over the distance l after it is heated by the heater 267*a* of the thermal head 267 and is then separated from the print paper. In consequence, both the first and the second ink layers of the thermal transferable member 269 are transferred, whereby an image is recorded on the print paper 252 so as to exhibit a color tone presented by the first ink layer.

The first and second ink layers of the thermal transferable member 269 have, for example, black and red color tones, respectively. When the slide 280 of the ribbon cassette 269 is set at the right end of its stroke, the thermal transferable member 269 is separated from the print paper 252 immediately after it is heated by the heat produced by the thermal head 267. In consequence, only the second ink layer is transferred to the print paper, thus forming a record in red color. Conversely, when the slider 280 is set at the left end of its stroke, the thermal transferable member 269 is separated from the print paper 252 when a predetermined time has elapsed after the heating, so that both the first and second ink layers are transferred to the print paper 252 thus recording data in black color.

Although a ribbon-shaped thermal transferable member is used in the described embodiment, this is not exclusive and the thermal transferable member may be a wide sheet member which is stored in the form of a roll. In such a case, a case member is used in place of the ribbon cassette. The thermal transferable material on the sheet need not always be an ink but a heat sublimatable material or other suitable chemical material can be used equally. It is also to be noted that the recording apparatus of this invention can be designed such that the platen moves relative to the carriage which is held stationary, unlike the described embodiment in which the carriage moves along the platen which is held stationary.

As will be understood from the foregoing description, a thermal transferable member is provided with ink layers carrying inks or other suitable materials which do not mix with each other when heated, and is wound on two reels within a case. In operation, the timing of separation of the thermal transferable member from the print paper is controlled by varying the position of a guide member which is slidably mounted on the case. With this arrangement, it is possible to obtain a clear image recorded in two colors by a simple operation without requiring a large amount of application of heat.

A further embodiment of the present invention will be described hereinafter with reference to FIGS. 74 to 78. The embodiment described hereinbelow is adapted for varying the running speed of a thermal head as the transfer heat source with respect to the recording medium in accordance with the color tone in which the image is to be printed, and the voltage applied to the thermal head is varied in accordance with the running speed of the thermal head. In addition, in order to maximize the effect of variation of the thermal head running speed, the heat generating member is provided on the trailing end of the thermal head as viewed in the direction of feed of the thermal transferable member.

In this embodiment, therefore, it is possible to vary the time until separation of the substrate of the thermal transferable member from the recording medium after application of heat energy by varying the speed of movement of the thermal head with respect to the recording medium, so that the recording can be conducted in different color tones depending on the carriage running speed.

It is also possible to uniformly heat the thermal head by controlling the voltage applied to the thermal head in accordance with the thermal head running speed in such a manner that higher voltage is applied to the thermal head when the thermal head is moving at higher speed. With such an arrangement, it is possible to obtain a high recording quality by virtue of uniform heating of the thermal head.

A general description will be made first as to the construction of the thermal transfer type recording apparatus.

Figure 74:
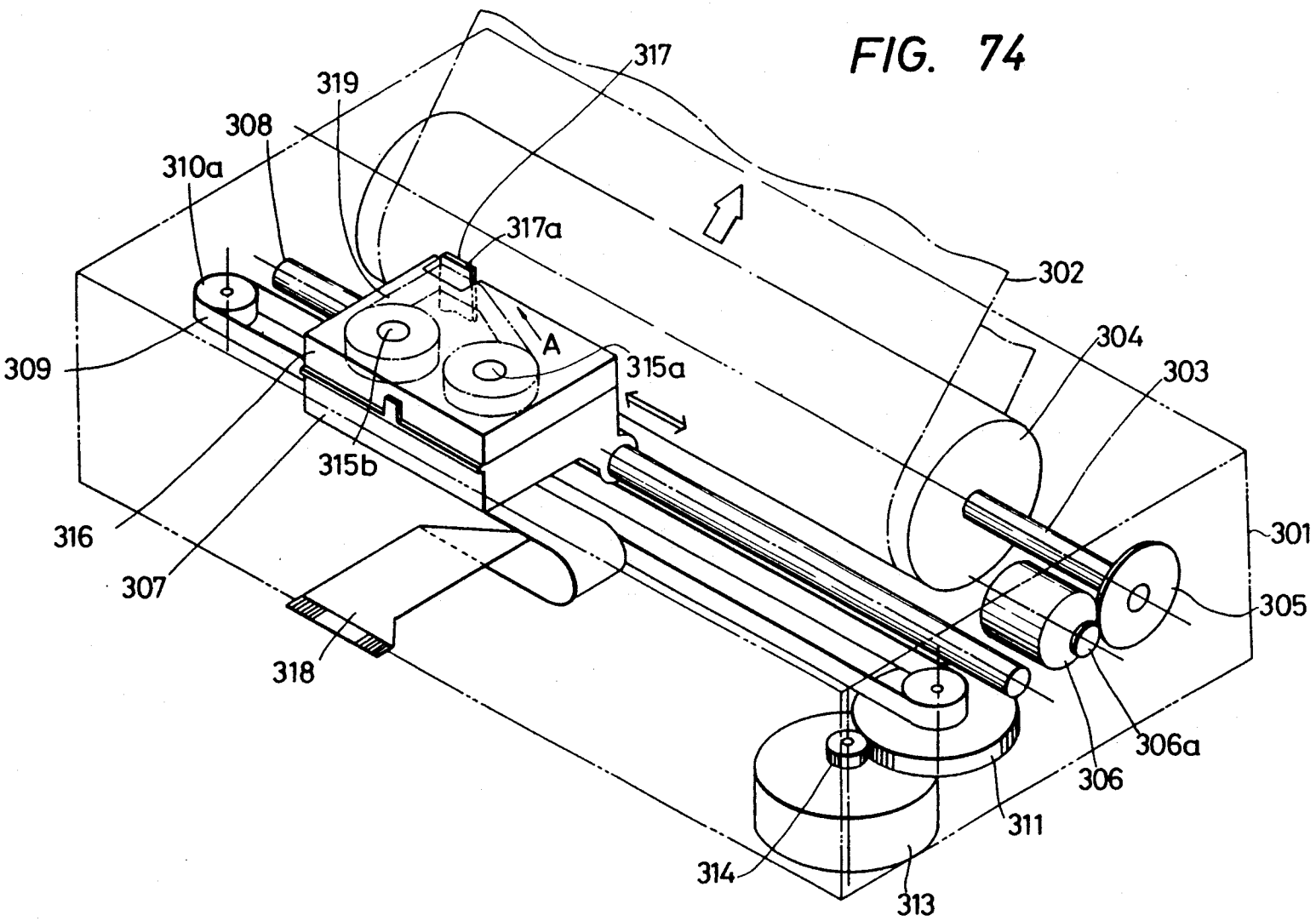
FIG. 74 is a perspective view of a thermal recording apparatus which is still another embodiment of the image recording apparatus in accordance with the invention.

FIG. 74 shows the appearance of the thermal transfer type recording apparatus which will be referred to as "thermal transfer printer" hereinafter. The thermal transfer printer 301 has the following construction.

A sheet of print paper 302 as the recording medium is wound on a platen 304 which is constituted by an elastic cylindrical member made of an elastic material such as neoprene rubber and formed as a unit with a shaft 303, so as to be fed in accordance with the rotation of the platen 304. The shaft 303 is provided at its one end with a paper feed gear 305 meshing with a drive gear 306*a* on the shaft of a paper feed pulse motor 306. The rotor of the pulse motor 306 and, hence, the drive gear 306*a* are adapted to be rotated in response to driving pulses supplied to the pulse motor 306 so as to rotate the platen 304 either in the forward direction or in the backward direction, so as to feed the print paper 302 forward and backward by a desired length. Thus, the line change operation is effected by the paper feed pulse motor 306.

A carriage 307 is slidably mounted on a shaft 308 so as to be able to slide to the left and right as viewed in the drawing. The carriage 307 is connected to a timing belt 309 which is stretched around pulleys 310, 310*a* and 310*b* so that it can run by the power transmitted through a paper feed gear 311 integral with the pulley 310*b*.

A column feed gear 311 meshes with the drive gear 314 of the pulse motor 313 so that the carriage 307 is driven to the left and right through the timing belt 309 in accordance with the operation of the column feed pulse motor 313.

The carriage 307 detachably carries a ribbon cassette 316 having a supply reel 315*a* and a take-up reel 315*b* between which is stretched a two-colored ink ribbon 319 of the same type as that explained before.

The carriage 307 is provided with a thermal head 317 which is adapted to apply heat to the ink ribbon 319 from the rear side thereof. A reference numeral 318 denotes a flexible print board through which signals are delivered to the thermal head 317. The thermal head 317 is provided with a heat generating member 317*b* which is offset from the center of the thermal head towards the upstream side as viewed in the direction of feed of the ink ribbon 319, as will be seen from FIG. 75.

The outline of the printing operation performed by this embodiment will be described hereinunder.

As a predetermining printing command is issued from a control means which is not shown, the column feed pulse motor 313 is excited and starts to rotate. As a result, the carriage 307 which has been stationed at the home position, i.e., left end portion of its stroke, starts to move to the right as viewed in the drawings. As a printing signal is delivered to the thermal head 317 through the flexible print board 318, the heat generating member 317*b* on the surface of the thermal head 317 generates heat so that the thermal transferable ink on the ink ribbon 315 is molten and transferred to the print paper 302 thereby transferring an image.

This operation is repeated a plurality of times until the printing is finished with one line. When the printing is completed over one line, the column feed motor 313 is reversed so that the carriage 307 is moved to the left as viewed in the drawings. At the same time, the paper feed pulse motor 306 is excited so as to rotate the platen 304 thereby effecting a line feed in the upward direction by a predetermined length.

When the carriage 307 is moved to the right, the ink ribbon 319 in the ribbon cassette 316 is fed in the direction of the arrow A so that the thermal head is always faced by a new portion of the ink ribbon while the used portion of the ink ribbon is retracted into the ribbon cassette 316.

It is thus possible to print characters and similar images to an ordinary paper by a thermal transfer type printer.

A description will be made hereinunder as to the practical method of conducting printing in two colors. In this embodiment, the timing of separation of the thermal transferable member 319 is controlled by varying the speed of running of the thermal head in the lateral direction. Namely, when it is desired to transfer only the second ink layer 323 to the print paper 302, the thermal head 317 is moved at an increased speed so that the thermal transferable member 319 may be separated from the print paper immediately after the application of heat thereto. When both the first and second ink layers are to be transferred to the print paper 302, the speed of movement of the thermal head 317 is reduced so that the thermal transferable member 319 may be separated from the print paper 302 only when a predetermined time has elapsed after application of heat energy to the thermal transferable member 319.

Figure 75:
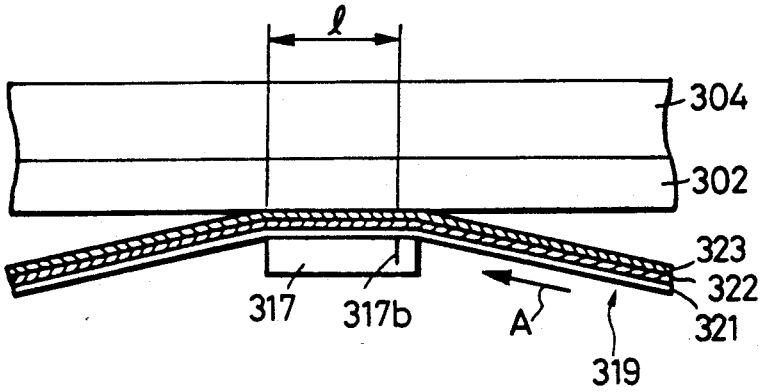
FIG. 75 is an illustration of a thermal transfer recording method.

In order to maximize the effect of the speed control mentioned above, the heat generating portion 317*b* of the thermal head 317 in this embodiment is positioned near the right end of the thermal head 317 as shown in FIG. 75. This is because, if the heat generating portion 317*b* is provided near the left end of the thermal head, the distance between the heat generating portion 317*b* and the separating position is too small to realize a distinctive difference in the separation timing by the difference in the thermal head running speed solely. Thus, in this embodiment, the position of the heat generating portion 317*b* on the thermal head 317 is offset with respect to the center of the thermal head 317 so as to develop a distinctive difference in the timing of separation for a given amount of change in the running speed of the thermal head. Such a location of the heat generating member, however, is not essential.

Figure 76:
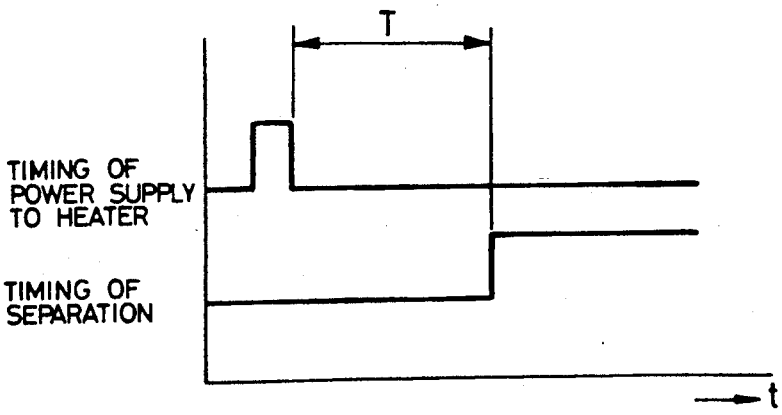
FIG. 76 is a timing chart illustrating the recording operation in the thermal transfer recording method.

FIG. 76 shows a timing chart which illustrates the timing of application of heat energy to the thermal transferable member 319 by the heat generating portion 317*b* and the timing of separation of the thermal transferable member 319 from the print paper 302. It will be seen that the running speed of the thermal head 317 rules the length of time T between the moment at which the heat energy is applied to the thermal transferable member 319 and the moment at which the substrate 321 of the thermal transferable member is separated from the ink layer or layers left on the print paper. The thermal head 317 is provided on the carriage 307 the speed of which is determined by the speed of operation of the column feed motor 314 which drives the carriage 307 through the timing belt 309.

A command for appointing one of the two printing modes, i.e., whether only the second ink layer 323 of the thermal transferable member 319 or both the first and the second ink layers 322, 323 are to be transferred, is given by the operator through a suitable input means such as a keyboard (not shown), and the control means operates to vary the speed of the column feed pulse motor 314 in accordance with such a command.

More specifically, when it is desired to transfer only the second ink layer 323, the operation speed of the column feed pulse motor is increased so as to shorten the time T. Conversely, for the purpose of transferring both the first and the second ink layers 322 and 323, the speed of the column feed pulse motor 314 is reduced so as to increase the length of time T.

In order to maintain the level of the heat energy supplied to the thermal head at a constant level so as to ensure a constant quality of the print, the voltage of the electric power supplied to the heat generating portion 317*b* of the thermal head 317 of this embodiment may be controlled in accordance with the change in the running speed of the thermal head, i.e., the change in the length of time T, such that the voltage is increased when the length of time T is reduced and decreased when the length of time T is increased.

In order to realize such a control of the voltage of the electric power supplied to the thermal head, two sets of tables each containing data concerning the pulse rate of the driving pulse signal to be applied to the pulse motor 313 and the voltage of the electric power to be supplied to the heat generating portion 317*b* of the thermal head 317 are set up in a read only memory ROM in the central processing unit (not shown) for controlling the thermal transfer printer 301. Obviously, one of these tables is referred to when the printing is to be conducted through the transfer of the second ink layer solely, while the other is used when the printing is to be conducted by the transfer of both the first and the second ink layers.

In operation, one of these tables in the ROM is selected in accordance with a selection signal which is input through an external input means such as a keyboard, and the thermal transfer printer 301 is controlled in accordance with data read from the selected table, so that the color tone of the recording of image can easily be changed.

Figure 77:
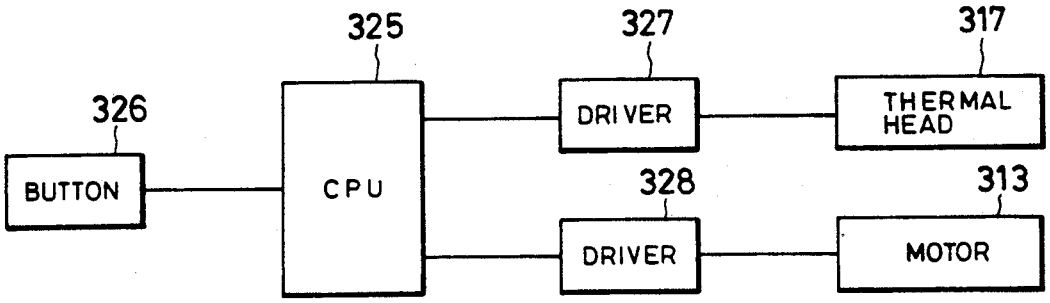
FIG. 77 is a block diagram of a control circuit.

FIG. 77 is a block diagram of a circuit for conducting the above-explained control of the recording operation. The control circuit has a central processing unit (CPU) which is connected to a color tone changing button 326 through which a command for changing the printing color tone is input.

The thermal head 317 is connected to the CPU 325 through a driver 327. The motor 313 also is connected to the CPU 325 through a driver 328.

The color changing button 326 is so designed that it appoints the color tone which is used most frequently but appoints another color when pressed down. This button then appoints the first-mentioned color when it is pressed once more.

Figure 78:
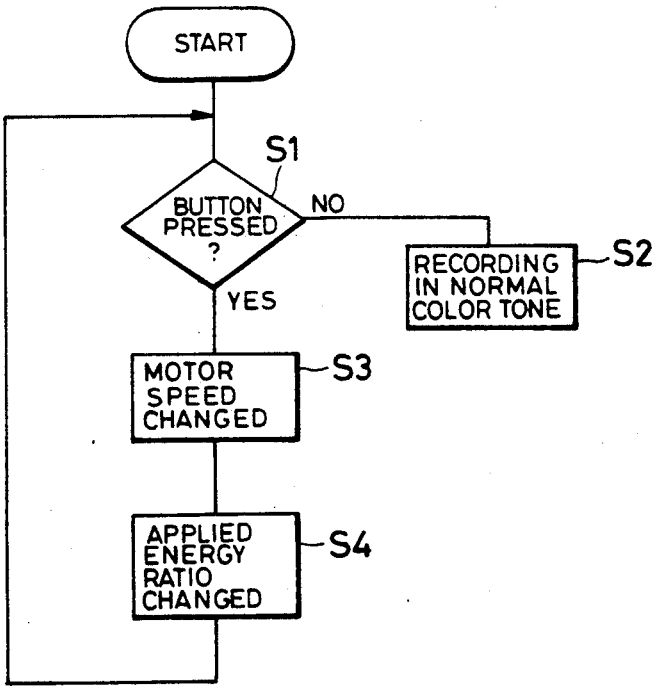
FIG. 78 is a flow chart illustrating the control operation performed by the control circuit.

The control circuit having the described construction is capable of conducting a control operation as shown in FIG. 78.

As the operation mode of the apparatus is changed to the recording mode, a judgment is conducted in Step S1 as to whether the color changing button 326 has been pressed. If the answer is NO, the recording operation is commenced in Step S2 to print the input data in the normal color tone which is used most frequently.

However, if the color changing button has been pressed, the CPU 325 operates in Step S3 to change the speed of the motor 313 through the drive 328 and to vary the level of energy supplied by the thermal head 317 in Step S4.

This operation is repeated so that the printing is conducted by selectively using two colors.

As will be understood from the foregoing description, this embodiment employs a thermal transferable member having a plurality of ink layers which are not liable to mix with each other when heat is applied thereto, and incorporates means for changing the speed of movement of the thermal head as the means for varying the separation of the transferable member from the recording medium. It is therefore possible to obtain clear image recorded in two colors without requiring additional provision of any specific complicated mechanism. The above-mentioned effect is increased by the fact that the heat generating member of the thermal head is disposed adjacent to the trailing end of the thermal transferable member as viewed in the direction of running of the thermal transferable member.

Obviously, the use of the ribbon-type thermal transferable member is not exclusive and the described embodiment may be carried out with a wide sheet-like transferable member in the form of a roll. In such a case, a case member is used in place of the ribbon cassette.

It will also be clear that the recording apparatus may be of the type in which the platen is moved relative to the carriage which is kept stationary, although in the described embodiment the carriage moves along the platen which is kept stationary.

A further embodiment will be described hereinunder with reference to FIGS. 79 to 83. This embodiment is characterized in that a first heat generating member and a second heat generating member are provided on the thermal head at a predetermined distance from each other in the direction of running of the thermal transferable member.

With this arrangement, it is possible to vary the length of time between the moment at which the heat energy is supplied to the thermal transferable member and the moment at which the carrier of the thermal transferable member is separated from the recording medium so as to enable an image to be recorded in different color tones, by selectively energizing the first and the second heat generating members.

A practical form of this embodiment will be described hereinunder.

FIGS. 79 to 83 illustrate a practical form of this embodiment. In this embodiment, first and second heater portions (heat generating members) 376*a* and 376*b* are provided on the thermal head 376 for applying heat to the thermal transferable member 369 which is the aforementioned two-color ribbon.

The first and second heater portions 376*a* and 376*b* are spaced from each other in the direction of running or take-up of the thermal transferable member 369 by a predetermined distance.

With this arrangement, it is possible to attain the recording operation as described hereinunder.

When it is desired to transfer only the second ink layer 373, only the first heater portion 376*a* is energized to generate heat. Since the first heater portion 376*a* is provided on the leading portion of the thermal head 376 as viewed in the direction of running of the thermal transferable member 369, the thermal transferable member 369 is separated from the print paper 352 immediately after application of the heat, so that only the melt 373*a* of the second ink layer 373 is left on the print paper 352, whereby an image is recorded in the color tone of the second ink layer 373.

On the other hand, when it is desired to record an image in the color tone of the first ink layer 372, only the second heater portion 376*b* is energized to generate heat.

Figure 79:
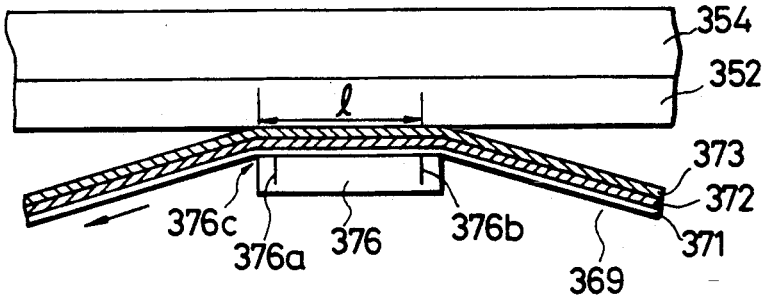
Figure 80:
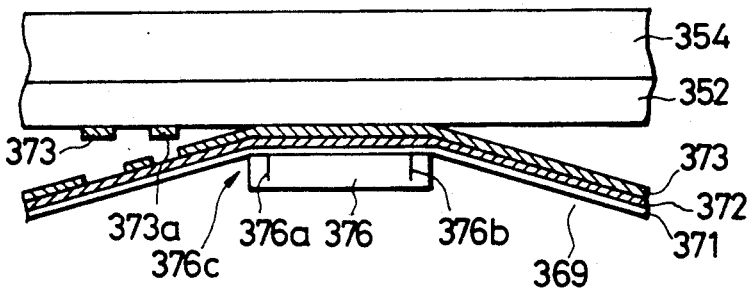
FIGS. 80 and 81 are plan views of an essential portion of the recording apparatus, illustrating the manner in which the recording is executed.
Figure 81:
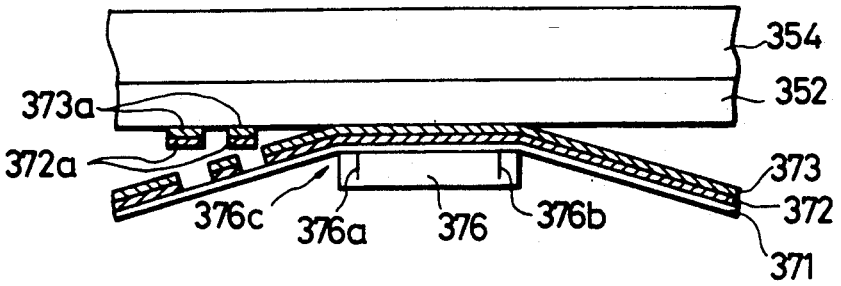

The second heater portion 376*b* is provided on the trailing portion of the thermal head 376 as viewed in the direction of running of the thermal transferable member 369. Therefore, the thermal transferable member 369 leaves the thermal head 376 upon running the distance l after the application of the heat energy (FIG. 79).

This means that the substrate 371 of the thermal transferable member is separated from the print paper 352 only when a predetermined time has elapsed after application of heat. In consequence, both the first and second ink layers 372, 373 are transferred to the print paper 352. In this state, only the melt 372*a* of the first ink layer 272 is visible, so that image formed exhibits the color tone of the first ink layer 372.

It is thus possible to conduct recording in different color tones by selectively energizing the first and the second heater portions 376*a* and 376*b* which are spaced from each other by a predetermined distance, so as to vary the timing at which the thermal transferable member 369 is separated from the print paper 352 after the heating.

In this embodiment, the first and the second heat generating members are spaced from each other in the direction of running of the thermal transferable member and these two heat generating members are selectively energized to enable an image to be recorded in two different color tones. However, the position at which the thermal transferable member is separated from the print paper is constant regardless of the change in the recording color tone. Namely, in both cases, the thermally transferable member 369 is separated by the force of the take-up means (not shown) from the print paper 352 when it leaves the edge 376*c* of the thermal head.

This inevitably causes an offset or deviation in the recording pitch depending on which one of the first and the second heat generating members 376*a* and 376*b* is used.

Practically, therefore, the recording pitch is determined using the position of the first heat generating member 376*a* as the standard position and a suitable correction of the recording pitch is effected when the recording is conducted by means of the second heat generating member 376*b*.

This correction is conveniently effected by returning the carriage (not shown).

Figure 82:
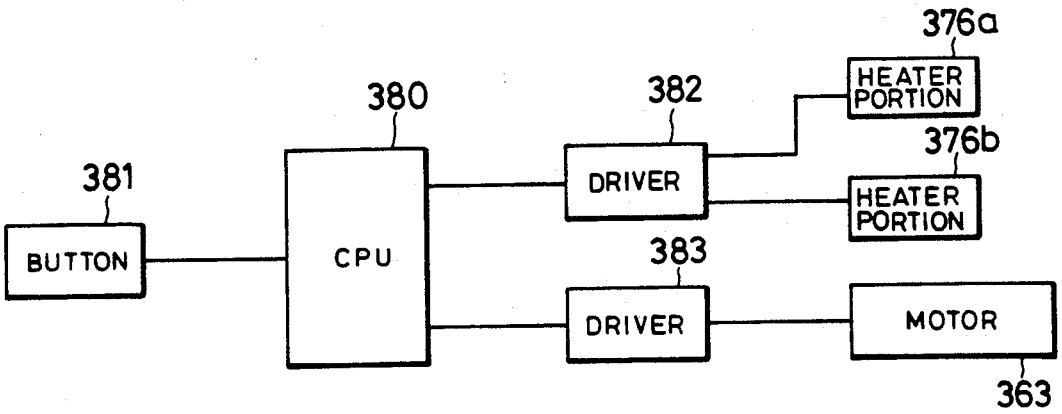
FIG. 82 is a block diagram of a control circuit.

A control circuit as shown in FIG. 82 may be used for the purpose of effecting such a correction.

Referring to FIG. 82, the control circuit has a CPU (Central Processing Unit) denoted by reference numbered 380. A color changing button 81 is connected to the CPU 380. The color changing button 381 is adapted for switching the color tone of recording. The arrangement is such that, when the color changing button 381 has not been pressed, the control circuit selects the basic color which is used most frequently, e.g., black, whereas, when this button has been pressed, the recording is conducted in the other color tone, e.g., red.

The heater portions 376*a* and 376*a* constituting the first and second heat generating members are connected to the CPU 380 through a driver 382.

Furthermore, a carriage driving motor 363 is connected to the CPU 380 through a driver 383.

Figure 83:
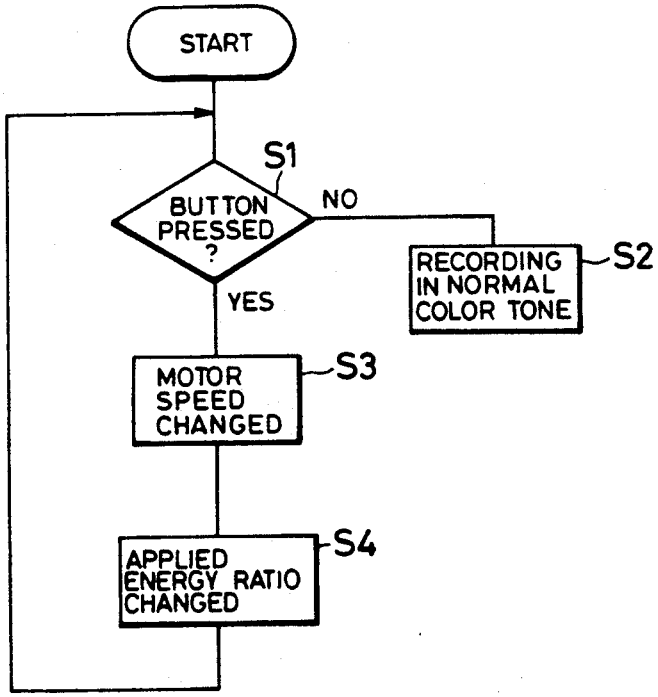
FIG. 83 is a flow chart illustrating control operation.

The control circuit having the above-described circuit arrangement conducts a control which will be explained hereinunder with reference to FIG. 83.

As the control is commenced, a judgment is conducted in Step S1 as to whether the color changing button 381 has been pressed. If the answer to this question is "NO", the process proceeds to Step S2 in which an operation is started for recording in the basic color which is used most frequently, by means of the first heat generating member 376*a*.

Conversely, when the color changing button 381 has been pressed, the motor 363 is driven in Step S3 through the driver 383 and, after the carriage is returned, an operation is commenced in Step S4 for recording in the other color tone.

These steps are repeatedly followed so that the recording is conducted by selectively using two color tones. A reference numeral 354 denotes a platen.

The embodiment described hereinabove employs a pair of heat generating members. This, however, is not exclusive and the apparatus of this embodiment may employ two or more heat generating members together with a thermal transferable member having two or more transferable layers, thus effecting recording in two or more colors.

It is also possible to conduct recording in two or more colors by using a thermal transferable member with a plurality of transferable layers while selectively varying the levels of the energy applied to two heat generating members.

It is also to be noted that a wide sheet-like transferable member may be used in place of the ribbon-like thermal transferable member used in the described embodiment. In such a case, the ribbon cassette used in the described embodiment is substituted by a case.

Furthermore, the transferable material, inks in the described embodiment, may be a sublimatable chemical substance.

In addition, the recording apparatus to which this embodiment is applied may be of the type in which the platen is movable, although in the foregoing description mentions a recording apparatus of the type in which the carriage is movable.

As will be understood from the foregoing description, this embodiment employs at least two heat generating members which are spaced from each other, in combination with a thermal transferable member having a plurality of laminated layers of transferable materials of different color tones. By selectively energizing these heat generating members, the length of time between the application of heat and the separation of the thermal transferable member from the print paper is changed, thereby conducting recording in two different color tones.

It is also possible to effect multi-color recording by selectively varying the amounts of heat applied by the heat generating members of the thermal head.

A further embodiment of the present invention will be described with reference to FIGS. 84 to 90.

This embodiment provides an output apparatus employing an ink sheet adapted to be heated and capable of outputting an image onto a recording medium selectively in different colors at the same output position, the apparatus comprising: memory means storing data to be output; heating means for heating the ink sheet; a carriage carrying the heating means and the ink sheet; carriage driving means for driving the carriage; sheet driving means for driving the ink sheet; recording medium driving means for driving and feeding the recording medium; lever driving means for moving a lever for separating the ink sheet in accordance with data concerning the color tone stored in the memory means; and control means for controlling the driving means.

This embodiment will be described in more detail hereinunder with reference to the accompanying drawings. This embodiment can be applied to the typewriter T shown in FIG. 5 which is usable as an output apparatus.

Figure 84:
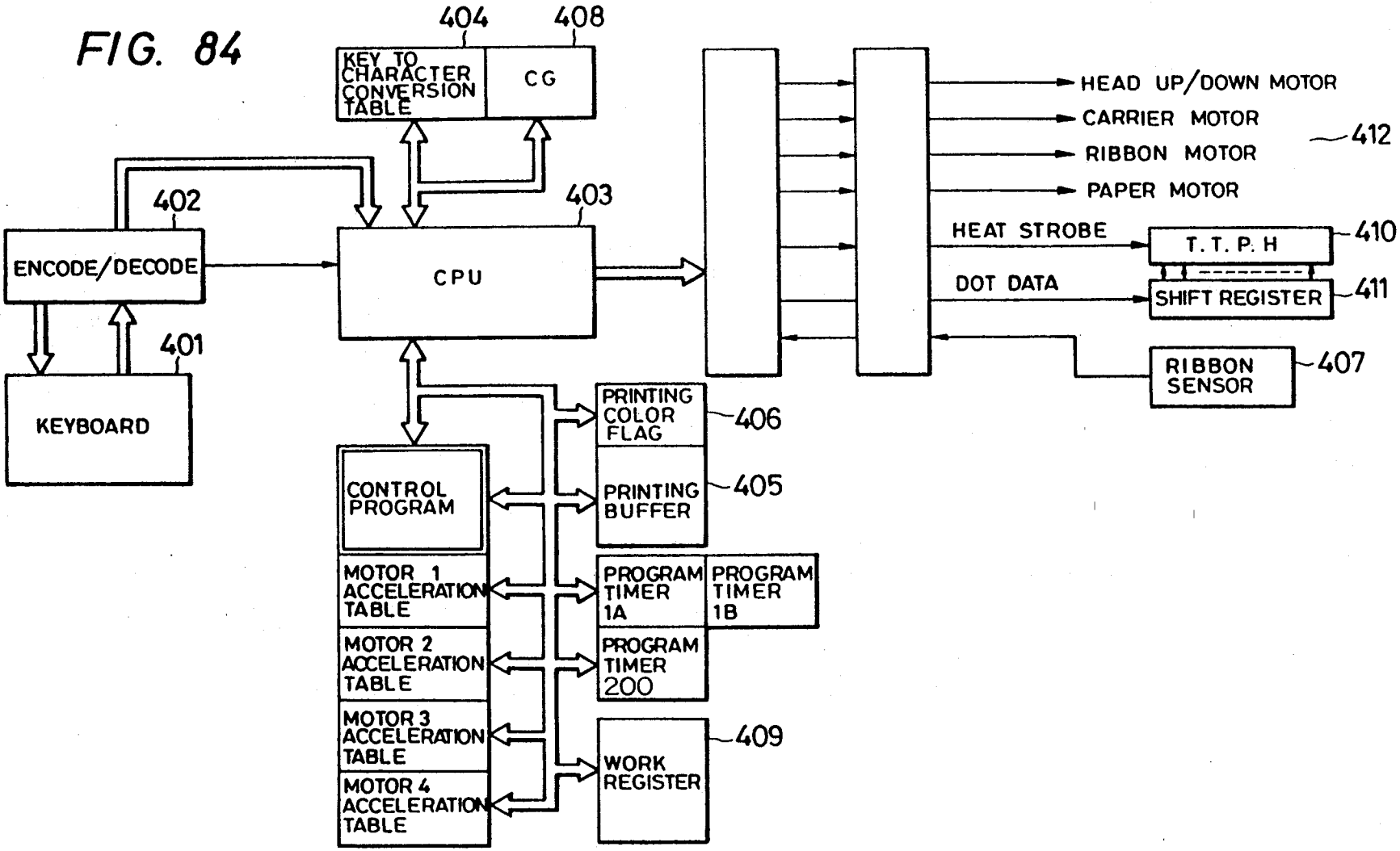
FIG. 84 is a block diagram of a control system of an output device to which a further embodiment of the present invention is applied.
Figure 90:
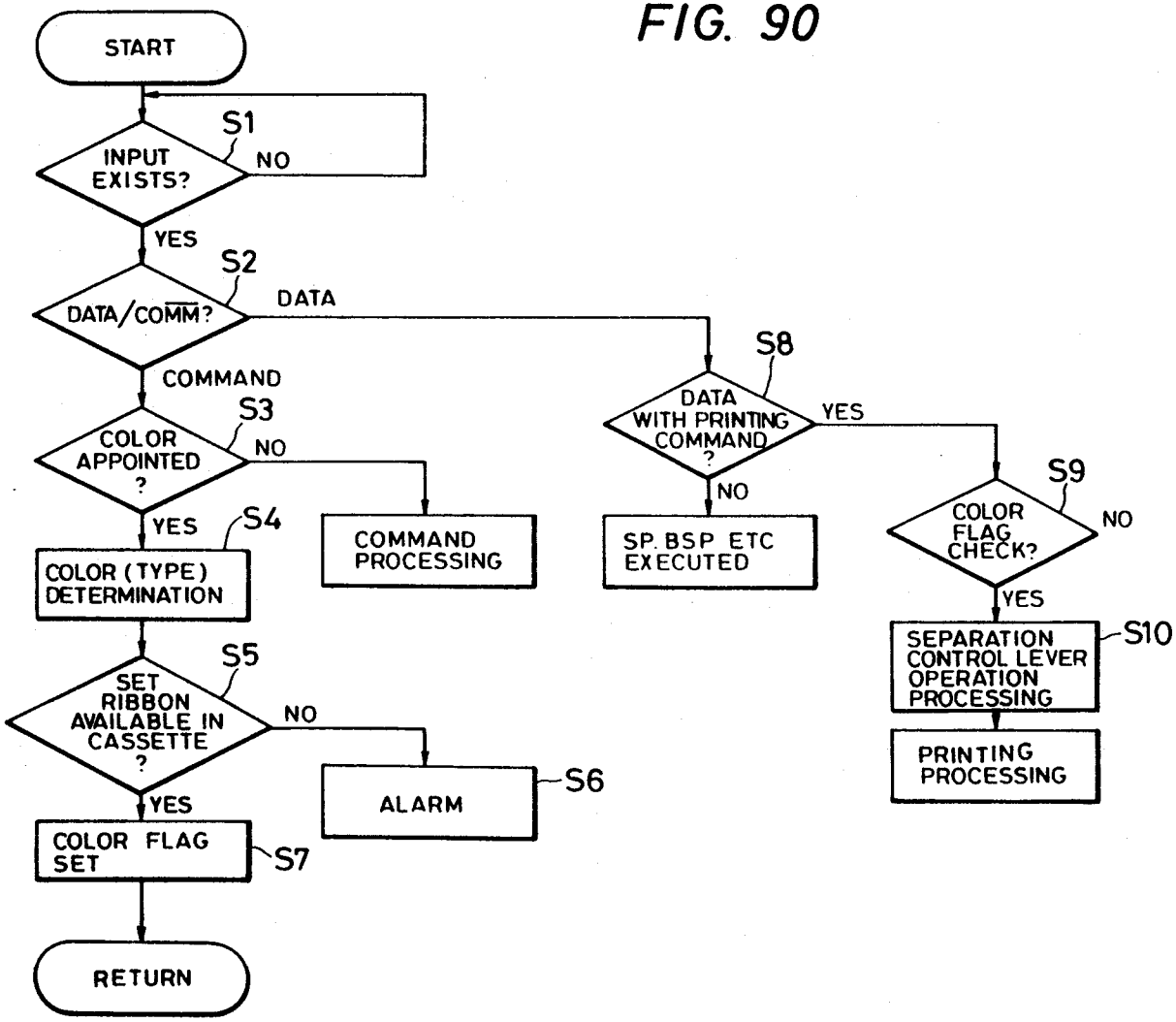
FIG. 90 is a flow chart illustrating the process for controlling the output.

FIG. 84 shows a control block diagram of a typewriter T incorporating a thermal transfer type printer of this embodiment. This embodiment will be explained hereinunder with reference to this block diagram. FIG. 90 shows the flow of control conducted in this embodiment.

In operation, the operator inputs a desired character or a command such as a printing color command through a keyboard 401. The input command is converted into a key code by an SIKey Encoder/Decoder 402 shown in FIG. 84. At the same time, an interruption is input to the CPU 403.

In response to the interruption, the CPU conducts Read of the output buffer of the Key Encoder/Decoder 402, and converts the key code into character code in accordance with a conversion table 404 which has been formed in a ROM. When a character code is obtained as a result of the conversion, the print character code is stored in a printing buffer 405 in the form of a RAM. On the other hand, when the input command is a command such as, for example, a printing color command for appointing the printing color, the process proceeds to Step S3 in the flow shown in FIG. 90. It is assumed here that the ribbon has a first color layer of an ordinary color such as black and a second color layer of a second color such as red, yellow or magenta. The operator, to print in red, presses the CONTROL key together with R key. The CPU judges the input through the R key together with the input through the CONTROL key as a command for printing the subsequent characters in red. The CPU 403 then sets a printing color flag 406 in the form of a RAM so as to store the above-mentioned command for appointing red as the printing color. The CPU 403 can recognize the type of the ribbon, i.e., the combination of the colors carried by the ribbon which is mounted on the printer, by the output from a ribbon sensor 407. Therefore, the CPU judges whether the color appointed by the input printing color command is available on the ribbon which is mounted on the printer. The process proceeds to the next step if the ribbon mounted on the printer has the color appointed by the printing color command which is in this case red. If not, the CPU activates an alarm to inform the operator so as to request replacement of the ribbon. The alarm may be given in any suitable form such as a visible message on a display device (not shown) or an audible means such as a buzzer. The operator then opens a printer cover and replaces the ribbon cassette with a new cassette which is capable of printing in red color. Then, as the printer cover is closed, the CPU reads the output from the ribbon sensor 407 so as to confirm that the ribbon carrying red color has been mounted. These operation is conducted in Steps S4 to S7 in the flow shown in FIG. 90.

Upon completion of a series of operations explained above, the CPU commences operation for conducting printing in Step S2 or S8 in the flow shown in FIG. 90.

In order to commence the edition of the dot data corresponding to the character code stored in the printing buffer 405, an access is made to the directory portion of a character generator 408 so as to read the initial and final addresses of the dot data in the character generator 408. Then, the addresses are successively accessed from the initial address down to the final address and the thus obtained dot data is primarily stored in a work register 409.

Figure 85:
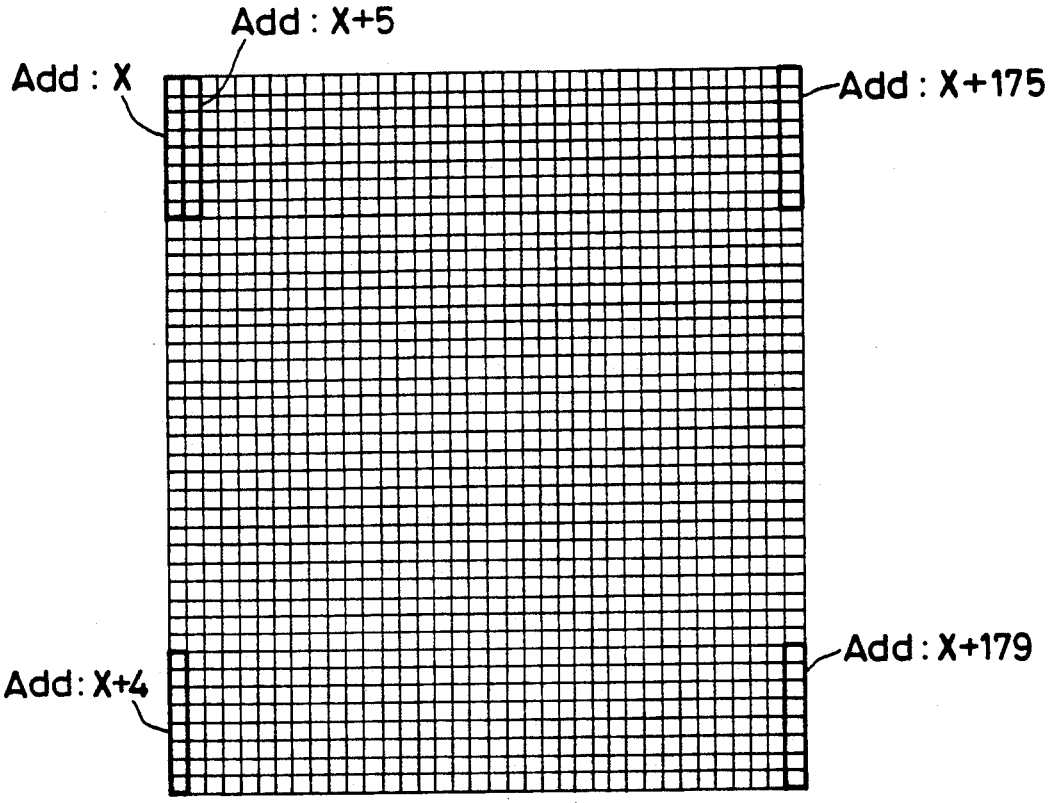
FIG. 85 is an illustration of a CG address map.

FIG. 85 shows, by way of example, an address map used when the printing font is constituted by 40 horizontal lines of dots, each horizontal line including 36 dots.

In order to carry out the operation with the CPU in which one byte is constituted by 8 bits, the access is commenced from the first address x and is made to successive addresses such as x+2, x+3, . . . , x+178 (dec), and x+179 (dec), where by dot data corresponding to 180 bytes in total is primarily stored in the register 409.

Figure 86:
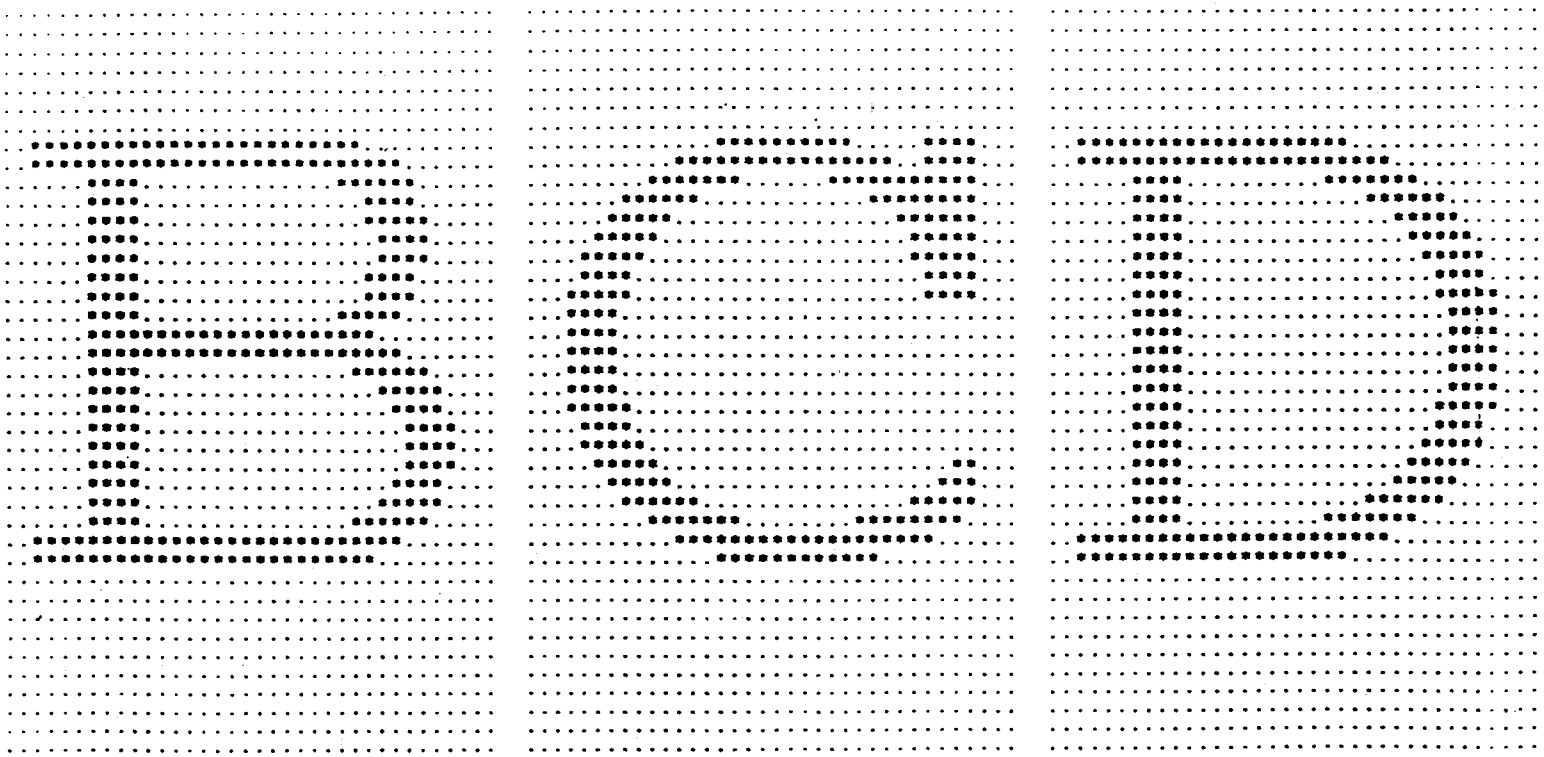
FIG. 86 is an illustration of a bit map of an example of record.

FIG. 86 shows, by way of example, bit maps for printing characters B, C and D. In each map, the dots contained in the first to fifth lines from the top and the first to tenth lines from the bottom do not carry any information. A portion of such black areas, therefore, may be compressed. The method of compression, however, is not described because it does not constitute any critical portion of this embodiment.

Thus, the dot data thus formed is transmitted from the character generator 408 to the work register 409. Then, the CPU 403 conducts a serial transfer of the dot data from the work register 409 to a shift register 411 which is adapted for driving a 40-dot thermal transfer serial printhead 410. The process for this transfer will be detailed later. It is to be understood, however, that the transfer of the dot data is conducted in synchronism with the position of a carrier motor 412, i.e., the position of the carrier. For instance, when the carrier is in the first position, the dot data in the first column or vertical row, corresponding to 5 bytes including the addresses X, X+1, ,,,,, X+4, is transferred. When the carrier is in the next position, the dot data in the second column is transferred. Similarly, when the carrier is in the final position, the data in the 36th column, corresponding to 5 bytes including x+175(dec), x+176(dec), . . . x+179(dec) is transferred. By transferring printing data corresponding to 5 bytes at each carrier position, it is possible to form the desired character pattern to be printed.

A description will be made hereinunder as to the control of other printer elements which are to be controlled simultaneously with the control of the thermal transfer serial printhead 410.

Figure 87:
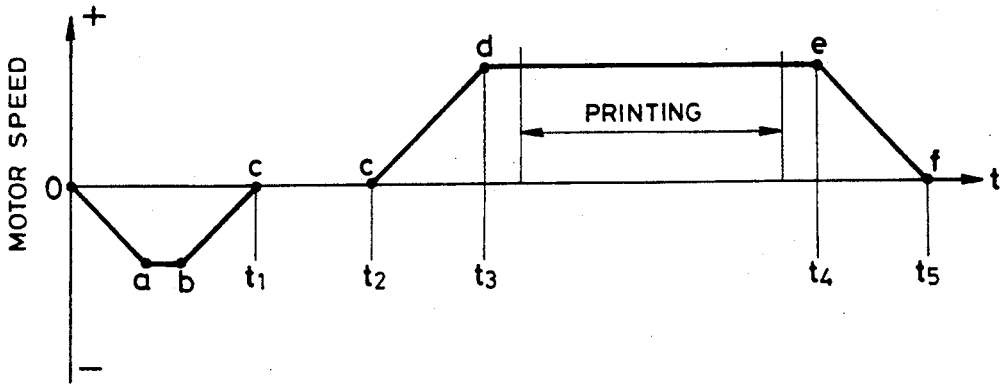
FIG. 87 is a time chart illustrating the operation of a motor during recording.

In the case where the printing is effected in the character base, i.e., in a character-by-character fashion, the speed of operation of the carrier motor 412 is traced as shown in FIG. 87.

Referring to FIG. 87, the carrier is positioned at the center of the next printing position at the moment t=0. When a printing command is input, therefore, the carrier first moves to the left so as to prepare for the printing, assuming here that the carrier travels 1/360 inch in response to each driving pulse, i.e., 1/10 inch per 36 consecutive driving pulses. This preparatory operation is necessary for the purpose of enabling the thermal transfer printhead to be pressed onto the platen through the print paper and the ribbon, and for providing an approaching area which enables the carrier to be accelerated so that the carrier may run at a constant velocity when the printing is commenced.

Thus, the carrier position c shown in FIG. 87 is offset to the left by 1/10 inch from the center of the printing position and makes a temporary stop at this position. Then, the carrier is driven forwardly and the acceleration is completed at a point d. Thereafter, the carrier starts to run at a constant velocity.

Simultaneously with the above-described operation of the carrier, the thermal transfer printhead, separation control solenoid and the ribbon operate in a manner which will be explained hereinunder with reference to FIG. 88.

Figure 88:
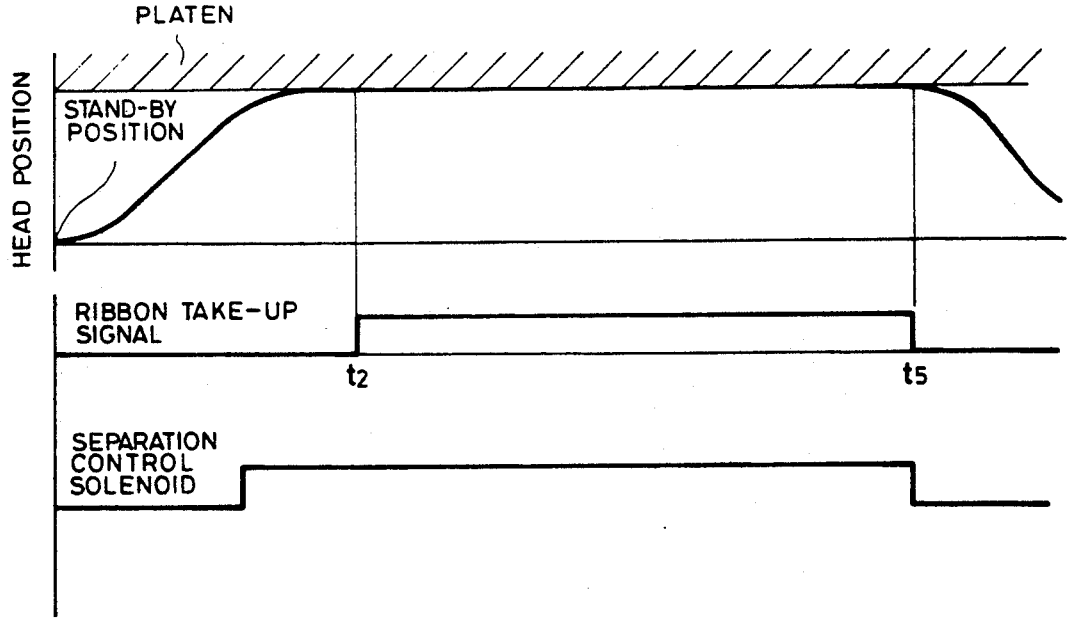
FIG. 88 is an illustration of the head and a separation member.

In FIG. 88, moments t1, t2, . . . ,t5 correspond to those appearing in FIG. 87. As the head motor operates, the end of the thermal transfer printhead reaches the platen at a moment intermediate between the moments t1 and t2 so as to press the print paper and the ribbon onto the platen. The rightward acceleration of the carrier is then commenced at the moment t2. A ribbon take-up signal is delivered simultaneously with the start of movement of the carrier so that the ribbon is taken up by an amount equal to the amount of displacement of the carrier. Meanwhile, the separation control solenoid is energized so as to cause the ribbon guide to approach the platen, the ribbon guide being provided for allowing the ribbon to be separated at the second ink layer of the different color, e.g., red, rather than at the ink layer of the ordinary color, e.g., black. This operation of the separation control solenoid is commenced in Step S10 of the process shown in FIG. 90. Preferably, the energization of the separation control solenoid is commenced at a moment around the moment t1 as shown in FIGS. 87 and 88.

The solenoid may be substituted by a motor. It is also possible to use the head motor also for the purpose of driving the separation member.

A description will be made hereinunder as to the driving circuits for driving various elements of the printer.

The thermal transfer printer is mainly constituted by a thermal transfer printhead, carrier motor, head up/-down motor, paper feed motor, and a ribbon motor. In this embodiment, it is assumed that all these motors are 4-phase pulse motors.

This embodiment essentially features that the printing is conducted selectively in different colors. To this end, the printer has a ribbon sensor for enabling the CPU to recognize the combination of colors, i.e., colors available on the ribbon set in the ribbon cassette. The printer also has the separation control solenoid which operates when it is desired to transfer the color of the second layer on the ribbon. The manner in which the data to be delivered to the thermal transfer printhead is edited has been described already. A description therefore will be made as to the manner in which the printer is driven in response to the data supplied to the printhead. Heating portions of the printhead are indicated by suffixes #1 to #40. The edited data is transmitted to the shift register SR in synchronism with the clock pulse CLK. The shift register SR is adapted for shifting the data in a bit-by-bit manner at each rise of the clock CLK. When 40-bit data has been completed, the CPU delivers a latch signal LATCH. The content of the shift register is taken at once into the latch LTH each time the pulse LATCH rises. Then, in synchronization with the stepping of the carrier motor, the strobe a high level so that heating power is supplied for a predetermined period only to the dots carrying data of high level amongst the dots TR1 to TR40.

When the strobe is being generated, the CPU edits the heat data which is to be printed at the next step or position of the carrier, and transmits the thus edited data to the shift register SR.

A description will be made hereinunder as to the operation of the pulse motors. Each of the four pulse motors has its own acceleration/deceleration pulse table in the form of a ROM in relation to the amount of rotation thereof, as will be seen from the block diagram shown in FIG. 84. The CPU reads values from the respective tables and load the thus read values on a program hard timers so as to determine the phase excitation times for the respective motors. More specifically, the carrier motor is controlled by a program timer 1A. Similarly, program timer 1B is used for the control of the head up/down motor. The ribbon motor and the paper motor are controlled by a program timer 200.

Each program timer counts the clocks up from the loaded value. When the content of the counter reaches a predetermined value, the counter overflows so as to effect an interruption on the CPU. The CPU then reads the values necessary for the next phase excitation from the respective tables and re-loads the thus read values on the timers. This operation is then conducted repeatedly.

Referring back to FIG. 89, the driving circuits for the respective motors are successively operated by the time-controlled phase excitation signals so as to drive the respective motors.

In this case, all the pulse motors are driven by a two-phase excitation method.

Figure 89:
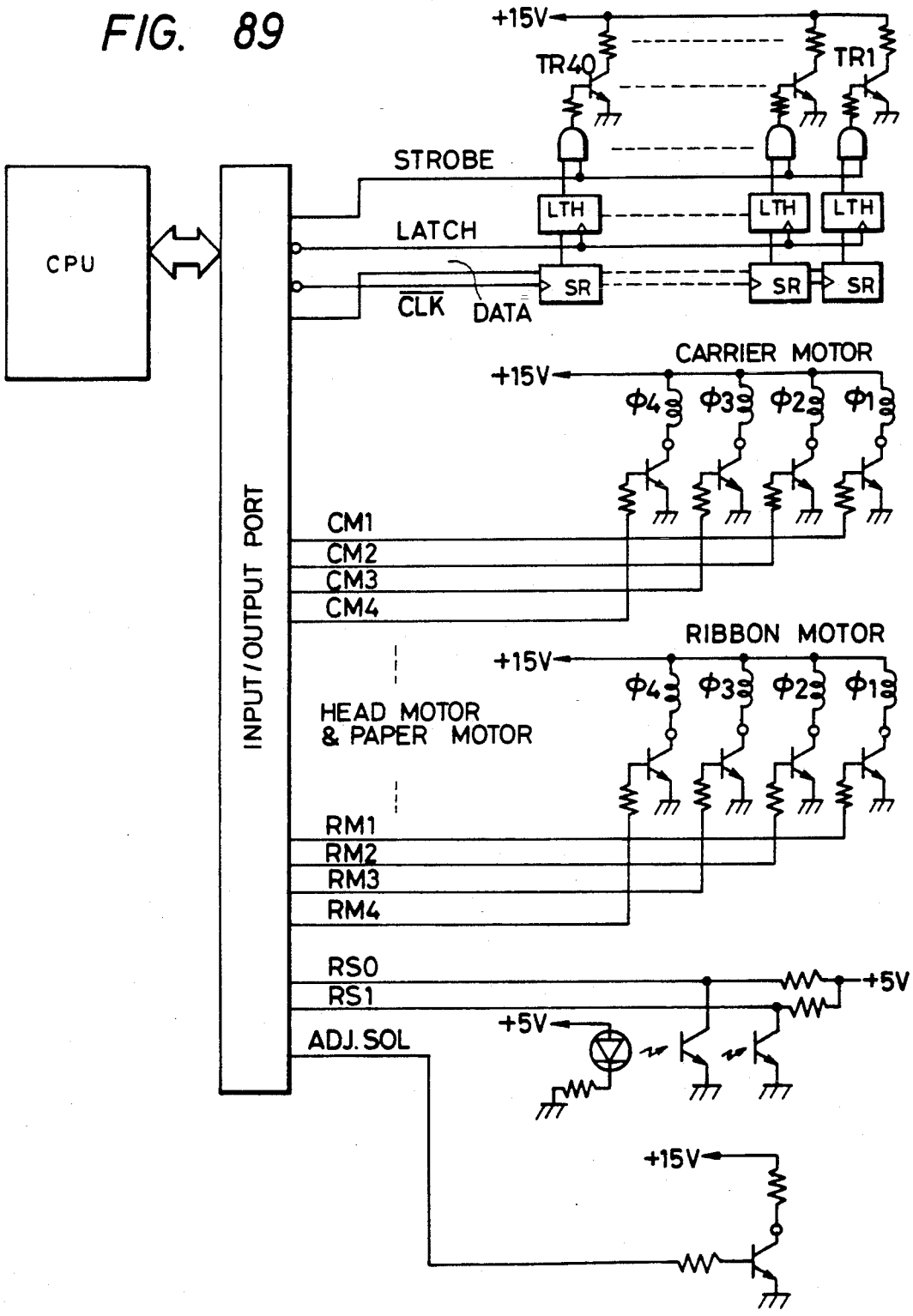
FIG. 89 is an illustration of driving circuits for driving various components of the recording apparatus.

Referring to FIG. 89, when the separation control solenoid driving signal ADJSOL is active, the separation of the ribbon from the print paper after the application of heat is delayed so that the ribbon is separated to leave the second ink layer on the print paper, thus effecting printing in red.

As will be understood from the foregoing description, this embodiment provides an output apparatus employing an ink sheet adapted to be heated and capable of outputting an image onto a recording medium selectively in different colors at the same output position, the apparatus comprising: memory means storing data to be output; heating means for heating the ink sheet; a carriage carrying the heating means and the ink sheet; carriage driving means for driving the carriage; sheet driving means for driving the ink sheet; recording medium driving means for driving and feeding the recording medium; lever driving means for moving a lever for separating the ink sheet in accordance with data concerning the color tone stored in the memory means; and control means for controlling the driving means.

Different embodiments (Different Embodiments 1 to 4) will be described hereinunder with reference to FIGS. 91 to 122.

In each of these embodiments, a guide member which constitutes means for varying the timing of separation of the thermal transferable member from the print paper is driven by the driving means which is intended for driving the thermal head up and down. With this arrangement, the guide member is driven by the force of the head up/down driving means in accordance with the printing color to be obtained, so as to vary the position at which the thermal transferable member is separated from the recording medium, i.e., the length of time until the separation after the heating.

Each of the different embodiments will be described in detail with reference to the drawings.

Different Embodiment 1

For the purpose of simplification of the explanation, an assumption is made here that the recording is conducted in two printing colors selectively.

FIGS. 91 to 96 illustrate a practical embodiment of the present invention. In these Figures, the same reference numerals are used to denote the same portions or the portions having the same functions, and detailed description of such portions is omitted.

Figure 91:
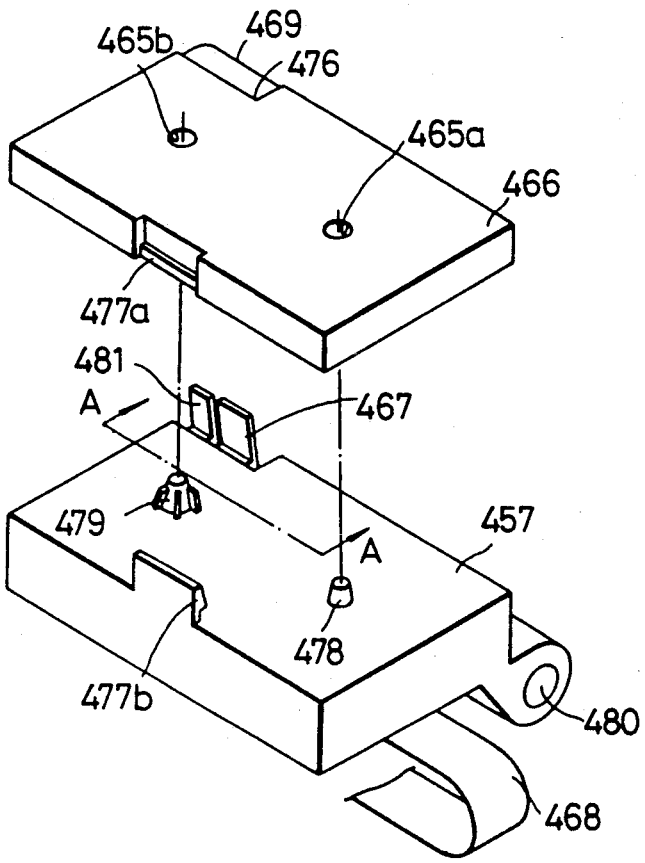
FIG. 91 is an exploded perspective view of a ribbon cassette and a carriage incorporated in a further embodiment of the present invention.

FIG. 91 shows the appearance of a ribbon cassette 466 accommodating a thermal transferable member and a carriage 457 on which the ribbon cassette is detachably mounted. The thermal transferable member 469 is wound on a pair of pulleys 465*a*, 465*b* in the ribbon cassette 466, with its portion exposed to the outside through a cut-out 476 formed in the left upper end of the ribbon cassette 466. A reference numeral 477*a* denotes a retaining step adapted for engagement with a retaining catch 477*b* which is formed integrally with the carriage 457 so as to retain the ribbon cassette 466 on the carriage 457.

The carriage 457 has a support shaft 478 adapted to fit in the pulley 465*a* mentioned before and a drive shaft 479 adapted to fit in the pulley 465*b* and driven by a driving power source (not shown) provided on the carriage 457. The arrangement is such that, as the drive shaft 479 rotates, the unused portion of the thermal transferable member 469 is fed to appear through the cut-out 476 of the ribbon cassette 466 mounted on the carriage 457, while the used portion of the thermal transferable member 469 is taken-up by the pulley 465*b*. A reference numeral 480 designates a slide bore for receiving a shaft 458 along which the carriage 457 slides to the left and right.

The thermal head 467 is swingable towards the print paper 452. A guide member 481 which also plays the role of a pressing member 474 can swing towards and away from the print paper 452 in the same manner as the thermal head 467. A flexible board 468 provides paths for signals such as the printing signals to be supplied to the thermal head 467 and signals for controlling the internal driving source in the carriage 467, as well as electric driving power.

The mechanism for operating the thermal head 467 and the guiding member 481 will be described hereinunder.

Figure 92:
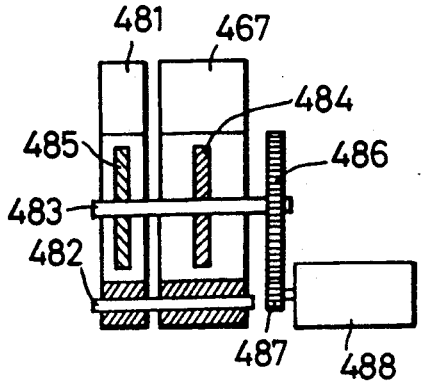
FIG. 92 is a sectional view taken along the line A—A of FIG. 91.

FIG. 92 is a sectional view taken along the line A—A of FIG. 91. The thermal head 467 and the guide member 481 are rotatable on a shaft 482 but their phases are offset from each other. The thermal head 467 and the guide member 481 are rotationally urged away from the print paper 452 by a spring (not shown) such as a torsion coiled spring.

The thermal head 467 and the guide member 481 are adapted to be forcibly rotated towards the print paper 452 by the action of cams 484 and 485, respectively. These arms 484 and 485 are fixed to a shaft 483.

A gear 486 fixed to the end of the shaft 483 meshes with a drive gear 487 which is fixed to the end of the output shaft of a head pulse motor 488. As the pulse motor 488 is excited, the shaft 483 is rotated so that the thermal head 467 and the guide member 481 are operated by the respective cams 484 and 485 in accordance with a later-mentioned sequence.

The operation of the cams 484 and 485 will be described in detail with specific reference to FIGS. 93 to 95.

Figure 93:
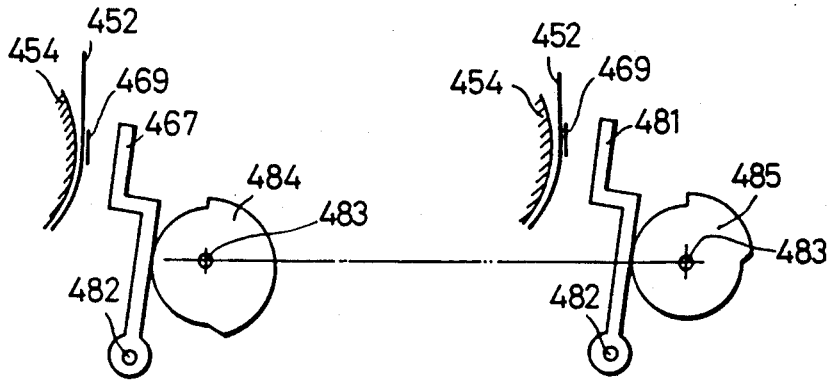
FIGS. 93, 94 and 95 are illustrations of operation of a thermal head section and a pressing plate section.

FIG. 93 illustrates the thermal head 467 and the guide member 481 in the initial state. In this state, the thermal head 467 and the guide member 481 are kept away from the platen 454 by the force of the spring (not shown) so as to free the thermal transferable member 469 and the print paper 452. In this state, therefore, returning of the carriage 457 and the rotation of the platen 454 can be conducted without being hindered by the thermal head and the guide member.

Figure 94:
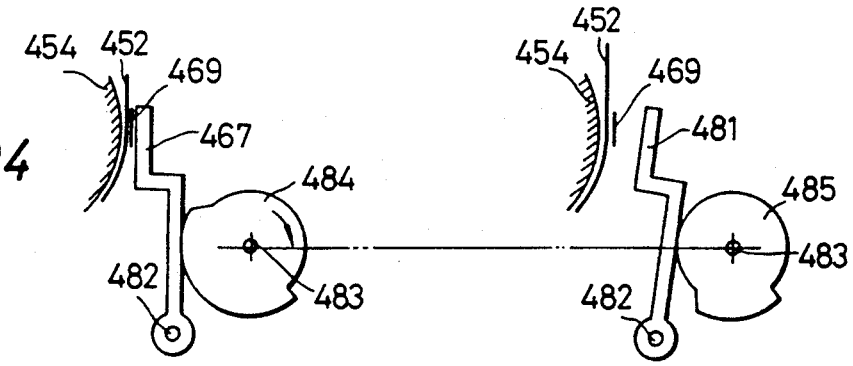

FIG. 94 shows the state in which the shaft 483 has been rotated through a predetermined angle in the direction of the arrow, i.e., in the clockwise direction. As a result, the thermal head 467 contacts the large-diameter portion of the cam 484 so as to be pushed by the cam 484, so that it is swung about the shaft 482 into a substantially upright position where it presses the thermal transferable member 469 and the print paper 452 onto the platen 454.

Meanwhile, the cam 485 rotates through the same angle but the large-diameter portion of this cam is still out of contact with the guide member because of the phase difference between the two cams. In consequence, the guide member 485 is kept in the inclined position away from the thermal transferable member 469.

Figure 95:
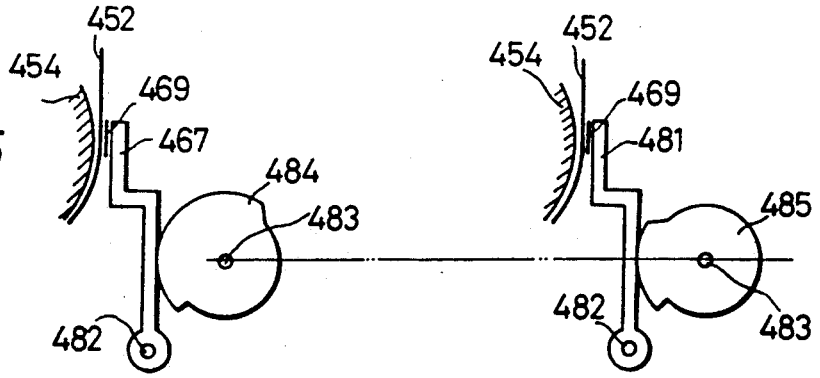

FIG. 95 shows the state in which the shaft 483 has been further rotated from the position shown in FIG. 94. In this state, the thermal head 467 is still in the upright position because it is pressed by the large-diameter portion of the cam 484 despite the further rotation of the cam 484. Meanwhile, the guide member 481 is contacted and pressed by the large-diameter portion of the cam 485 so as to be urged to a substantially upright position where it presses the thermal transferable member 469 and the print paper 452 onto the platen 454.

The release of the thermal transferable member 469 and the print paper 452 from the pressing forces exerted by the thermal head 467 and the guide member 481 is achieved by reversing the pulse motor 488 and, hence, the shaft 483 until the cams 484 and 485 take the rotational positions as shown in FIG. 93 where the thermal head 467 and the guide member 481 are held in the inclined positions by the force of the spring (not shown).

Figure 96:
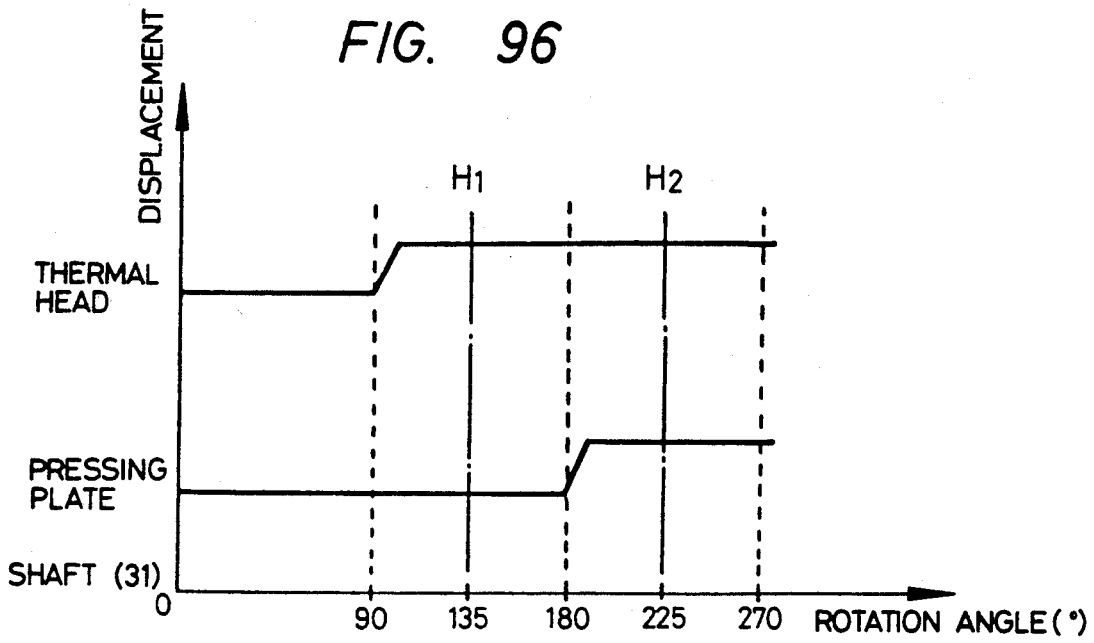
FIG. 96 is a timing chart illustrating an operation.
Figure 97:
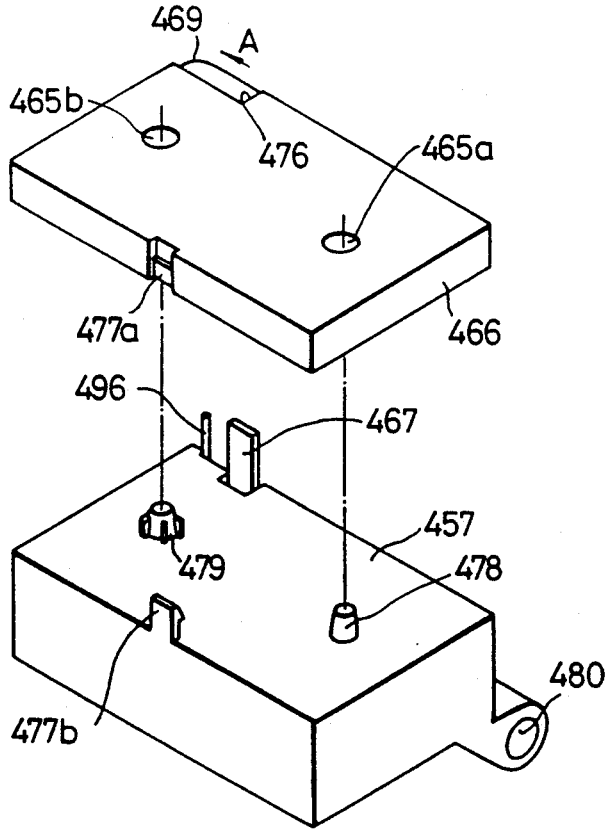
FIG. 97 is an exploded perspective view of a ribbon cassette and a carriage portion.
Figure 98:
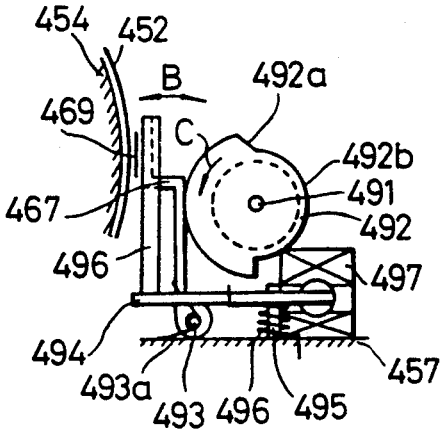
FIG. 98 is a side elevational view of an essential portion.

The above-described operation of the cams will be more clearly understood when reference is made to the chart shown in FIG. 96. The angle of rotation of the shaft 483 varies as the pulse motor 488 is excited. The effective diameter of the cam 484 starts to change thereby to commence swinging of the thermal head 467 when the shaft 483 has been rotated through 90° from the initial position. The pulse motor 488 is held (Hi) when the shaft 483 has been rotated through 135° so that the thermal transferable member 469 and the print paper 452 are completely pressed onto the platen 454.

When the shaft 483 has been rotated through 180° from the initial position as a result of continuous excitation of the pulse motor 488, the cam 485 starts to push at its large-diameter portion the guide member 481 so that the guide member 481 starts to swing about the shaft 482. When the shaft 483 has been rotated through 225° from the initial position, the pulse motor 488 is held (Hi) so that the thermal transferable member 469 and the print paper 452 are completely pressed onto the platen 454 by the guide member 481. Meanwhile, the thermal head 467 is kept still because it is pressed by the large-diameter portion of the cam 484.

By changing the excitation phase, i.e., the number of steps, of the pulse motor 488 in the described manner, it is possible to selectively swing the thermal head 467 solely or both the thermal head 467 and the guide member 481.

When it is desired to transfer only the second ink layer of the thermal transferable member 467 (two-colored ink ribbon) onto the print paper 452, a command is given to excite the pulse motor 488 so as to cause the shaft 483 to rotate through 125° from the initial position. In consequence, the thermal head 467 alone is rotated so as to press the thermal transferable member 469 onto the platen 454 through the print paper 454. In this case, therefore, the thermal transferable member is allowed to leave the print paper 452 immediately after the application of heat to the thermal transferable member 469 from the heater portion 467*a*, so that the second ink layer solely is transferred to the print paper 452 thus recording an image in the color tone peculiar to the second ink layer.

Conversely, when it is desired to transfer both the first ink layer and the second ink layer simultaneously, a command is given to excite the pulse motor 488 so as to cause the shaft 483 to rotate through 225°, thereby swinging both the thermal head 467 and the guide member 481 simultaneously. In this case, since the guide member 481 presses the thermal transferable member 469 into contact with the print paper 452, the thermal transferable member 469 is allowed to be separated from the print paper 452 only after traveling a predetermined distance in contact with the print paper 452 after application of heat by the heater portion 467*a* of the thermal head 467. In consequence, both the first and second ink layers are transferred to the print paper 452 so that the recorded data exhibits a color tone peculiar to the first ink layer.

In this embodiment, therefore, it is possible to selectively change the rotational position of the guide member 481 even during printing of one line so that the recording color tone can be changed even in each printing line.

It is to be noted that this effect can be achieved with an extremely simple mechanism because the rotation or swinging of the guide member 481 is caused by the power derived from a mechanism which is intended for driving the thermal head up and down.

Although a ribbon-type thermal transferable member is used in the described embodiment, this is not exclusive and a wide sheet-like thermal transferable member stored in the form of a roll may be used equally well. In such a case, a suitable case is used in place of the described ribbon cassette.

It is also to be understood that the transferable material, inks of different colors in the described embodiment, may be substituted by suitable chemical substances such as heat-sublimatable substances.

Furthermore, the described embodiment may be applied to an apparatus of the type in which the platen is moved with respect to a stationary carriage, though the described embodiment employs a carriage which is movable with respect to a stationary platen.

As will be understood from the foregoing description, this embodiment provides a recording apparatus of the type in which recording is effected by applying heat to a thermal transferable member by a thermal head, wherein both the thermal head and the guide member are swung by a common power source through respective cams carried by a common shaft at a predetermined phase difference. It is therefore possible to selectively attain either a mode in which the thermal head alone is pressed onto the platen or a mode in which both the thermal head and the guide member are pressed onto the platen, by changing the rotational or angular position of the common shaft driven by the power source, whereby recording in two colors can be realized by a simple mechanism and through a simple control.

Different Embodiment 2

FIGS. 97 to 101 show the second different embodiment. In these Figures, the same reference numerals are used to denote the same parts or members as those used in the first different embodiment described before, and description of such parts or members is omitted.

This embodiment makes use of a solenoid and a link mechanism. In these Figures, a reference numeral 490 denotes a motor which serves as the source of the driving power. The motor 490 has an output shaft 491 which in turn carries at its end a cam 492.

The cam 492 has large-diameter and small-diameter portions 492*a* and 492*b* which extend over predetermined angles about the shaft carrying this cam.

Therefore, as the cam 492 is rotated by the operation of the motor 490 to bring the large-diameter portion 492*a* into contact with the adjacent surface of the thermal head 467, the thermal head 467 is urged against the force of the torsion coiled spring 493*a* so as to press the print paper 452 through the thermal transferable member 469, thus attaining the recording state.

In this state, heat energy is supplied in accordance with the recording command thereby to record the data.

Conversely, when the small-diameter portion 492*b* of the cam 492 contacts the thermal head 467, the thermal head is urged by the force of the torsion coiled spring 493*a* away from the thermal transferable member 469, thus attaining non-recording state.

The thermal head 467 is disposed so as to face the cam 492 and is swingably carried by the carriage through the shaft 493. The above-mentioned torsion coiled spring 493*a* is wound on the shaft 493 so as to impart a tendency for the thermal head 467 to swing away from the platen 454.

A rotational lever 494, which is disposed in a side-by-side relation to the thermal head 467, is rotatably supported at its intermediate portion by the shaft 495.

Figure 99:
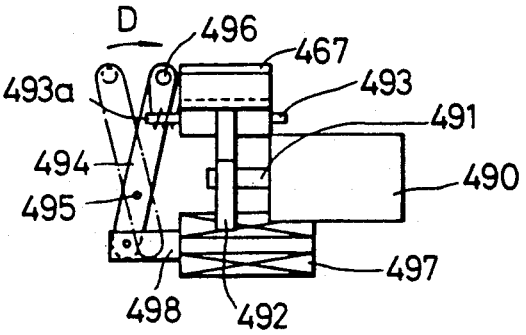
FIG. 99 is a plan view of an essential portion.

A torsion coiled spring 496 is wound on the shaft 495 so as to rotationally urge the rotational lever 494 counterclockwise as viewed in FIG. 99.

A guide member 496 is provided on the end of the rotational lever 494 adjacent to the thermal head 467 so as to stand upright therefrom.

The height of the guide member 496 is substantially the same as that of the thermal head 467.

A solenoid 497, which is mounted in a side-by-side relation to the motor 490, has a rod 498 to the end of which is pivotally connected the rear end of the rotational lever 494.

The operation of this embodiment having the described arrangement will be explained hereinunder.

In the case where the recording is to be conducted in the color tone of the second ink layer, the apparatus operates with the solenoid 497 kept de-energized.

In this case, therefore, the rotational lever 494 is rotated clockwise as viewed in FIG. 99 by the force of the torsion coiled spring 496, and the rod 498 is held in the extended position, while the guide member 496 is positioned in the vicinity of the thermal head 467.

Figure 100:
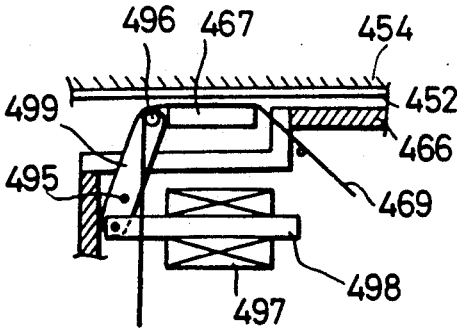
FIGS. 100 and 101 are illustrations of operation.

This state of the apparatus is shown in FIG. 100.

In this state, the thermal transferable member 469, is forcibly separated from the print paper 452 immediately after the heating, because the guide member 496 in this case is positioned in the vicinity of the thermal head 467.

In consequence, the melt of the second ink layer alone is transferred to the print paper 452, thus attaining recording in the color tone peculiar to the second ink layer.

Conversely, when it is desired to effect the recording in the color tone of the first ink layer, the apparatus operates with the solenoid 497 energized.

Figure 101:
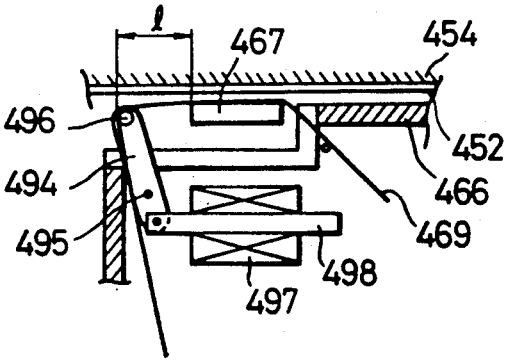

In consequence, the rod 498 is retracted so that the lever 494 is rotated counterclockwise as shown in FIG. 101, so that the guide member 496 is moved away from the thermal head 467 to provide the distance l which is necessary for the thermal transferable member to be cooled.

When the thermal head 467 is activated in this state, the first and the second ink layers are not separated from each other but the melts of the first and the second ink layers are together transferred to the print paper 452, thus effecting recording in the color tone possessed by the first ink layer.

Different Embodiment 3

FIGS. 102 to 112 show the third different embodiment, in which the guide member is driven by the power derived from the power source for activating the head up/down driving mechanism.

Referring to these Figures, a motor 500 has an output shaft to which is fixed a drive gear 501. The drive gear 501 meshes with a gear 503 fixed to one end of a shaft 502 which is rotatably and horizontally mounted on the carriage.

A cam 504 is fixed to the mid portion of the shaft 502. The cam 504 has a large-diameter portion 504*a* and a small-diameter portion 504*b*.

The thermal head 467 is disposed to oppose the cam 504 and is swingably mounted on the carriage 457 through a shaft 505 provided on the lower end thereof.

A torsion coiled spring (not shown) is secured to the shaft 505 so as to urge the thermal head 467 away from the platen 454.

In operation, the cam 504 is rotated in accordance with the operation of the motor 500 so that the large-diameter portion 504*a* of the cam 504 is brought into contact with the adjacent surface of the thermal head 467, thereby urging the thermal head 467 into contact with the thermal transferable member 469.

The shaft 502 also carries a bevel gear 506 fixed to the other end thereof. The bevel gear 506 lacks the teeth over a predetermined angular range as indicated at 506*a*.

A shaft 507 orthogonal to the shaft 502 is fixed to the carriage 457. A gear rotatably carried by the upper end of the shaft 507 has a bevel gear 508 which meshes with the aforementioned bevel gear 509.

A shaft 510 is rotatably mounted on a portion of the carriage 457 closer to the platen than the shaft 507.

A pinion gear 511 meshing with the gear 509 is fixed to an intermediate portion of the shaft 510. An arm 512 is fixed at its one end to the upper end of the shaft 510.

A guide member 513 is fixed to the upper face of the other end of the shaft 512 in upright posture.

The height of the guide member 513 is substantially the same as the height of the thermal head 467.

Figure 102:
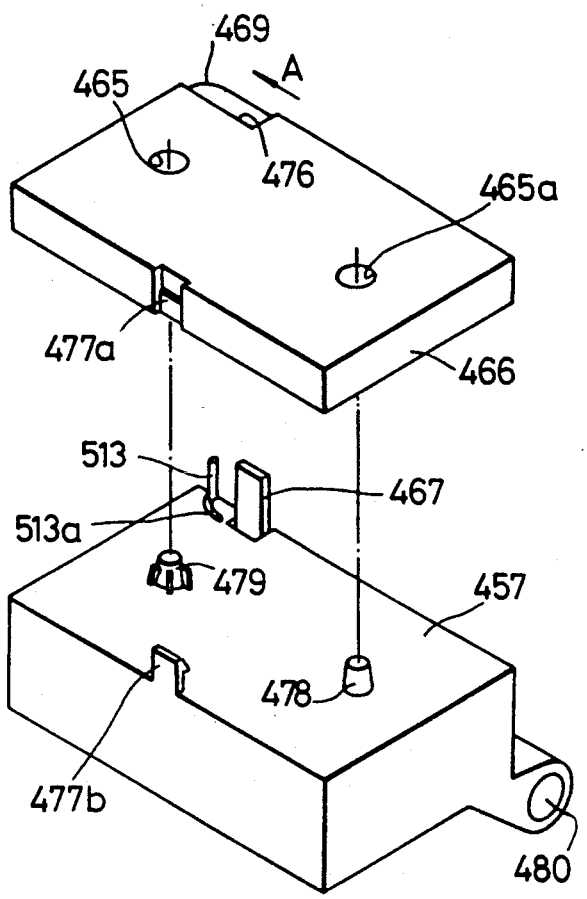
FIG. 102 is an exploded perspective view of a ribbon cassette and a carriage section.

The guide member 513 is slidably received in an arcuate guide groove 513*a* which is formed in the portion of the carriage 457 near the thermal head 467, as shown in FIG. 102.

The operation of this embodiment having the described construction will be explained hereinunder.

When the apparatus is in the non-recording state, the large diameter portion 504*a* of the cam 504 is spaced from the thermal head 467 so that the non-toothed portion 506*a* devoid of the teeth faces the bevel gear 508.

Figure 111:
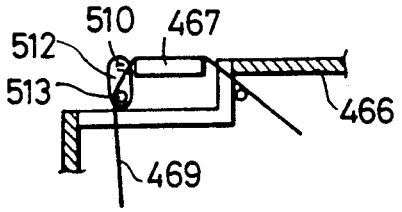
FIGS. 111 and 112 are illustrations of operation.

Therefore, the thermal head 467 is spaced most from the platen 454 and the guide member 513 is retracted into the ribbon cassette 466 as shown in FIG. 111.

Figure 103:
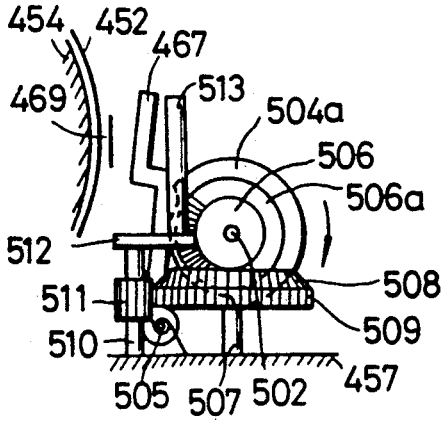
FIGS. 103 to 108 are side elevational views and front elevational views illustrating the operation.
Figure 104:
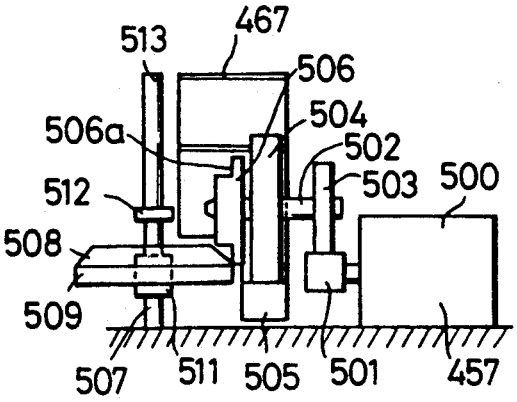

In the case where the recording is to be conducted in the color tone of the second ink layer, the cam 504 is rotated by the motor 500 from the state shown in FIGS. 103 and 104.

Figure 110:
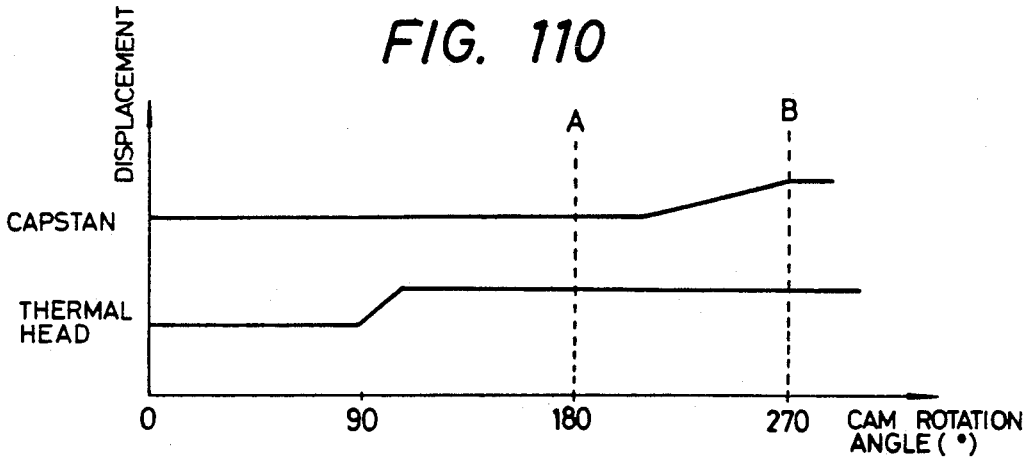
FIG. 110 is a timing chart illustrating the operation.

When the cam 504 has been rotated through 90°, the large-diameter portion 504*a* starts to contact with the thermal head 467 so that the thermal head 467 commences its movement towards the platen 454 as shown in FIG. 110.

Figure 105:
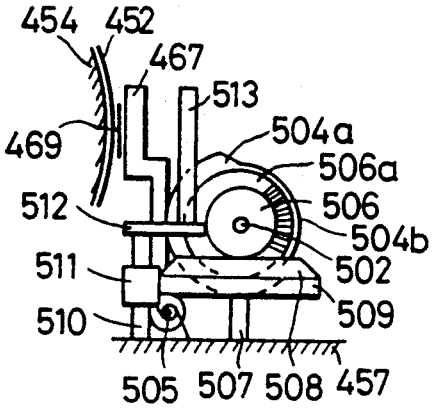
Figure 106:
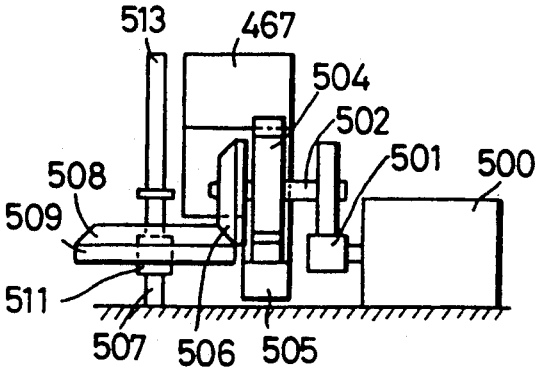
Figure 107:
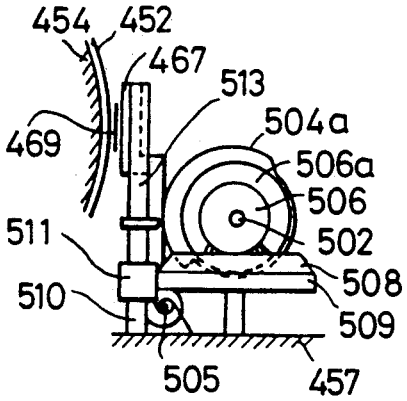
Figure 108:
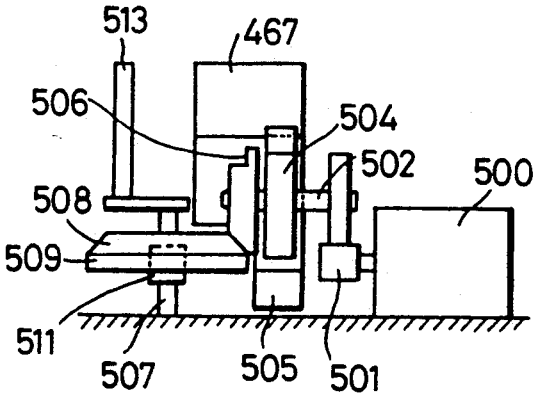
Figure 109:
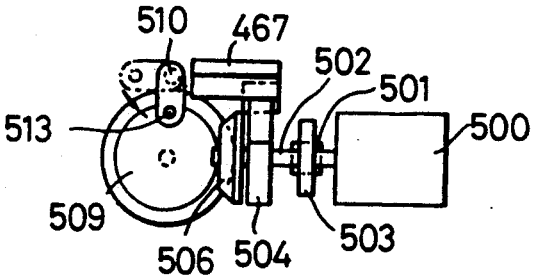
FIG. 109 is a plan view of an essential portion.

Then, when the cam 504 has been rotated through 180° to the position indicated by A in FIG. 110, the motor 500 is stopped. In this state, as shown in FIGS. 105, 106 and 111, the thermal head 467 is pressed onto the print paper 452 through the thermal transferable member 469.

The thermal head 467 is then supplied with electric power in accordance with the recording command. In this case, the thermal transferable member is allowed to be separated from the print paper immediately after the heating, i.e., as soon as it leaves the edge of the thermal head 467, and the thus separated thermal transferable member 469 is retracted into the ribbon cassette 466 along the guide member 513.

In consequence, the melt of the second ink layer alone is left on the print paper 452, thus effecting recording in the color tone of the second ink layer.

Figure 112:
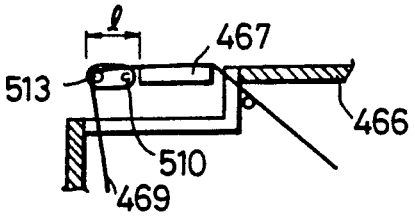
Figure 113:
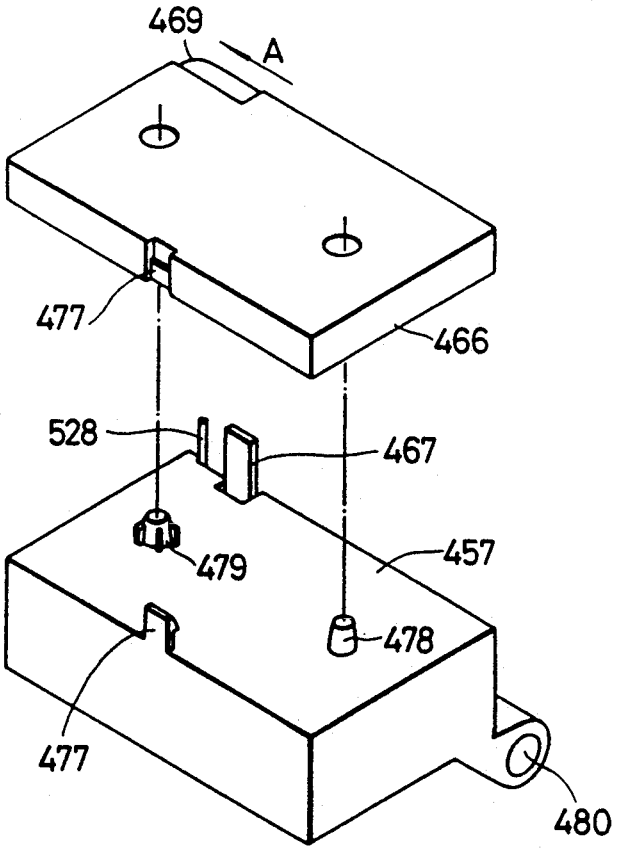
FIG. 113 is an exploded perspective view of a cassette and a carriage.
Figure 114:
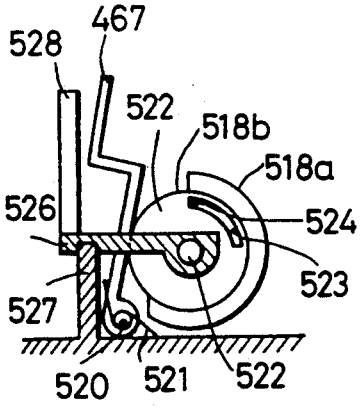
FIGS. 114 to 119 are side elevational views and front elevational views explanatory of operation.
Figure 115:
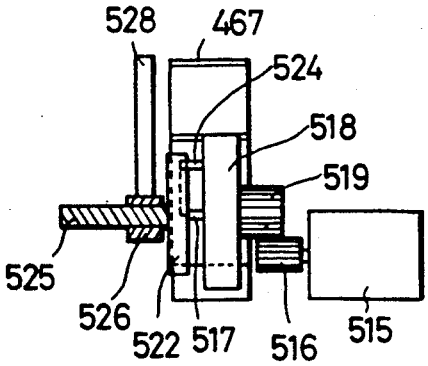

On the other hand, when it is desired to effect the recording in the color tone of the first ink layer, the cam 504 is further rotated from the position mentioned above, so that the thermal head 467 is continuously urged by the large-diameter portion 504*a*. Meanwhile, the bevel gear 506 also rotates so that the teeth of this bevel gear start to engage with the bevel gear 508, with the result that the arm 512 is rotated through the action of the pinion gear 511 clockwise as shown in FIG. 112, whereby the arm 512 comes to extend in the same direction as the thermal head 467, thus positioning the guide member 513 at a location which is spaced from the thermal head 467 by a distance l necessary for the thermal transferable member to be cooled.

This state is obtained when the cam has been rotated through 370° as indicated by B in FIG. 110. The rotation of the motor is stopped in this state and the thermal head 467 is supplied with the electric power, so that the thermal transfer member 469 is separated from the print paper only after running the above-mentioned distance l, so that the melts of the first and the second ink layers are together transferred to the print paper, thereby effecting recording in the color tone possessed by the first ink layer.

Different Embodiment 4

FIGS. 113 to 122 show a fourth different embodiment of the invention. This embodiment also makes use of the mechanism for driving the thermal head up and down.

Referring to these Figures, a motor 515 has an output shaft to which is fixed a drive gear 516 meshing with a pinion gear 519 integral with a cam 518 which is rotatably carried by the platen 517 through the shaft 517.

The cam 518 has a large diameter portion 518*a* and a small-diameter portion 518*b*.

The thermal head 467 is disposed such as to oppose the cam 518.

The thermal head is swingably supported at its lower end by the shaft 520. A torsion coiled spring 521 is wound on the shaft 520 so as to impart a tendency for the thermal head 467 to swing clockwise as viewed in FIG. 114.

On the other hand, a disk-shaped intermediate plate 522 is rotatably carried by the shaft 517.

The intermediate plate 522 is supported for rotation independently of the cam 517. An arcuate guide groove 523 is formed in the side surface of the intermediate plate 522 adjacent to the cam 518. The guide groove 523 slidably receives a pin 524 which projects from one side of the cam 518.

A threaded shaft 525 is provided on the center of the outer surface of the intermediate plate 522. A nut portion on the base of the arm 526 is screwed to this threaded shaft 525.

The arm 526 extends horizontally towards the platen. The end of the arm 526 is slidingly guided by the guide member 527.

Another guide member 528 is provided on the upper surface of the end extremity of the arm 526.

The operation of this embodiment having the described construction will be explained hereinunder.

When the apparatus is in the non-recording state, the small-diameter portion 518*b* of the cam 518 contacts the thermal head 467 which is rotationally urged clockwise away from the platen by the force produced by the torsion coiled spring 521. In this state, the pin 526 is positioned at the counterclockwise end of the guide groove 523, so that the arm 526 is located on the base end of the threaded shaft 525. In this state, therefore, the guide member 528 is disposed in the vicinity of the thermal head 467.

Figure 120:
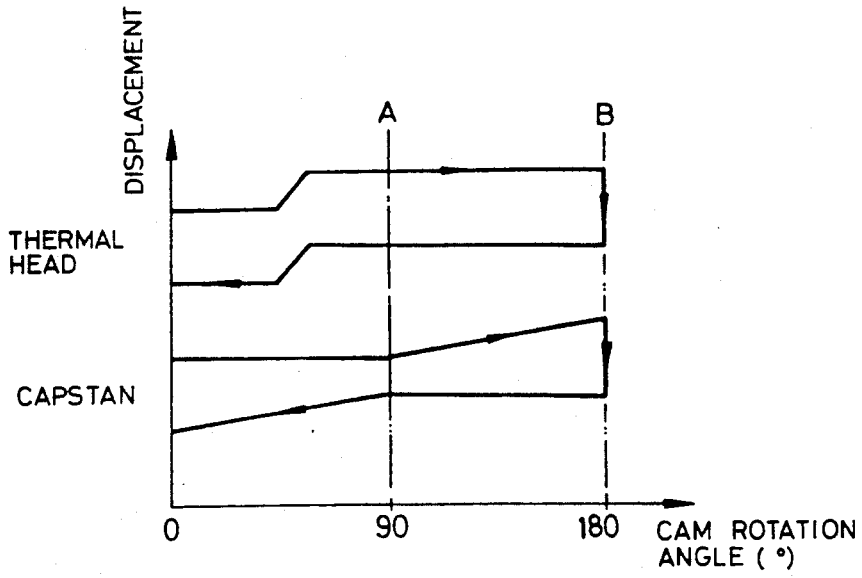
FIG. 120 is a timing chart illustrating the operation.
Figure 121:
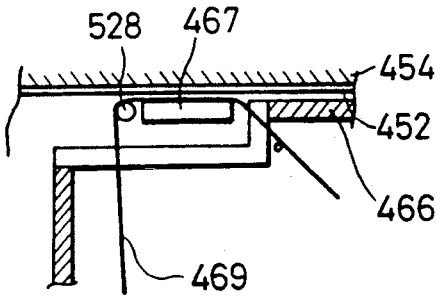
FIGS. 121 and 122 are illustrations of operation.
Figure 122:
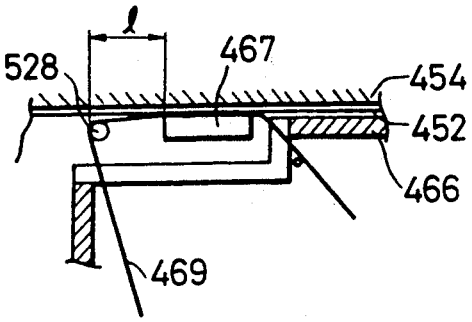

When it is desired to conduct the recording in the color tone of the second ink layer, the motor 515 is operated to cause the cam 518 to rotate clockwise through 90° and is then stopped at this position as indicated by letter A in FIG. 120. In consequence, the thermal head 467 is swung towards the platen so as to press the print paper 2 through the thermal transferable member 469.

Figure 116:
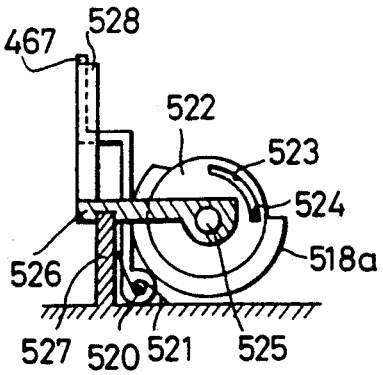
Figure 117:
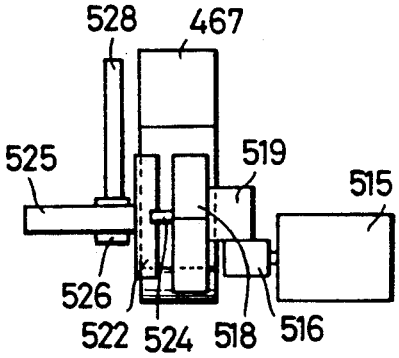
Figure 118:
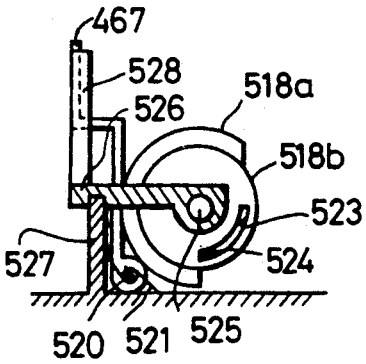
Figure 119:
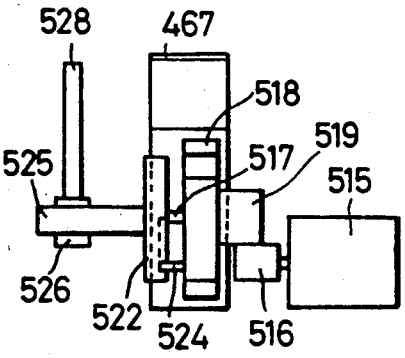

Meanwhile, the pin 524 is made to slide along the guide groove 523 so as to be positioned in the clockwise end of the guide groove 523 as shown in FIG. 116. This, however, does not cause the intermediate plate 522 to rotate, so that the threaded shaft 525 does not rotate. In consequence, the guide member 528 is positioned in the vicinity of the thermal head 467.

Electric power is supplied to the thermal head in accordance with the recording command so as to heat the thermal transferable member 469. In this case, the thermal transferable member is separated from the print paper 452 shortly after the heating, as soon as it leaves the guide member 528.

As a result, the melt of the second ink layer solely is transferred to the print paper 452, so that the recording is made in the color tone peculiar to the second ink layer.

Conversely, when it is desired to effect the recording in the color tone of the first ink layer, the cam 518 is further rotated through an additional 90° by the operation of the motor 515. Since the pin 524 has been held in contact with the clockwise end wall of the guide groove 523, the further rotation of the cam 518 causes the intermediate plate 522 to further rotate. In consequence, the threaded shaft 525 also is rotated, whereby the arm 528 screwed to the threaded shaft 525 is moved away from the intermediate plate 522.

As the motor is stopped at the angular position indicated by letter B in FIG. 120 after rotation through 180°, the guide member 528 also is stopped at a position which is spaced from the thermal head 467 by the predetermined distance l.

The thermal head 467 is energized in this state so as to heat the thermal transferable member 469. The thermal transferable member 469 is then separated from the print paper 452 after running the predetermined distance l from the thermal head 467. In consequence, the second layer and the first layer overlying the second layer are transferred to the print paper 452, thus completing recording in the color tone of the first ink layer.

It will be understood that this arrangement provides the same advantages as those offered by the first to third different embodiments described before.

Thus, this embodiment incorporates means for moving the guide member for the thermal transferable member between a position adjacent to the thermal head and the position remote from the thermal head, so as to cause a change in the timing of separation of the thermal transferable member after the recording, thus enabling the recording to be made in different colors.

A further embodiment of the invention will be described hereinunder with reference to FIGS. 123 to 127. This embodiment employs a recording thermal head movable together with the carriage and heating means for preserving heat. The heat-preserving heating means is selectively energized to generate heat in accordance with the color tones, so as to cause a substantial change in the length of time until the separation of a thermal transferable member having a plurality of transferable agent layers from the recording medium.

This arrangement allows selective use of a multiplicity of recording colors by selectively activating the heat-preserving heating means, though the distance between the recording thermal head and the position at which the thermal transferable member is separated from the recording medium is unchanged.

It is thus possible to attain, by selectively activating the heat-preserving heating means, an effect which is equivalent to the effect produced by the change in the position or timing of separation of the thermal transferable member, through the distance to be traveled by the thermal transferable member after the heating until the separation is not changed.

The detail of this embodiment will be described with reference to the drawings.

In this embodiment, the means for varying the timing of separation of the thermal transferable member from the recording medium is provided in a case which is detachably mounted on the printing apparatus and which accommodates the thermal transferable member. The mechanism of this embodiment will be described hereinunder with reference to FIGS. 123 to 125.

Figure 123:
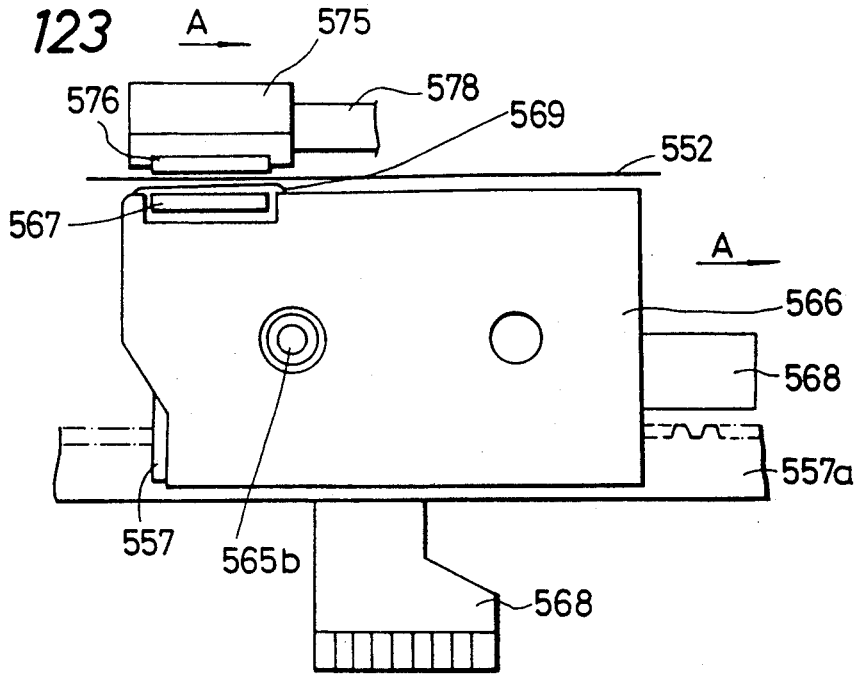
FIG. 123 is a plan view of an essential portion of a further embodiment of the present invention.
Figure 124:
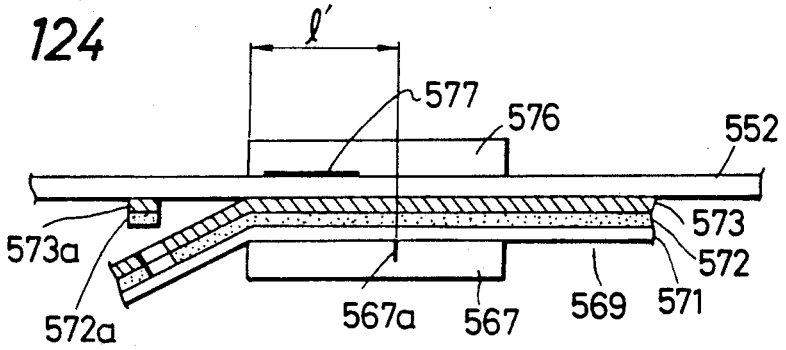
FIGS. 124 to 127 are illustrations of the transfer method.
Figure 125:
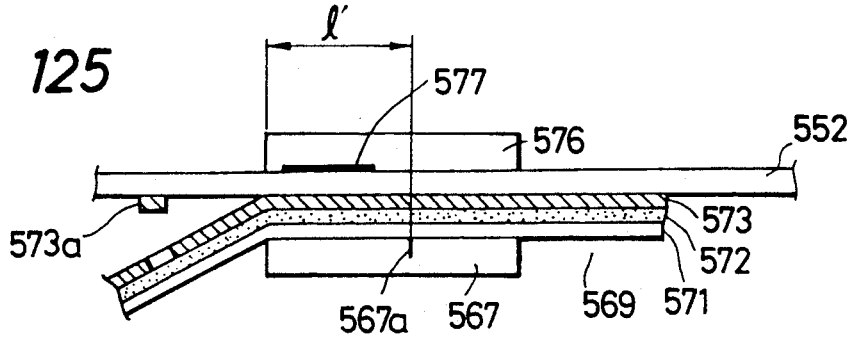

FIGS. 123 to 125 show a practical example of this embodiment which employs a platen 575 of a specific construction.

The platen 575 is provided with a heat-preserving heating means 576 integrated with the carriage 557 through a supporting member (not shown) and opposing the thermal head 567 across a print paper 552 as the recording medium interposed therebetween.

As will be seen from FIGS. 124 and 125, the heating means 576 is provided with a heat generating member 577. The area of the heat generating member 577 is large enough to cover a letter or a character.

The supply of electric power to this heat generating member is done through a flexible signal line 578.

The heating means 576 and the thermal head 567 are substantially equal in size. The distance l' between the heat generating member (heater portion) **567*a* on the thermal head 567 and the position where the thermal transferable member 569 is separated from the print paper 552, i.e., the position where the thermal transferable member 569 leaves the gap between the thermal head 567 and the heating means 576, is selected to be large enough to allow the thermal transferable member 569 to be sufficiently cooled when the same has been heated by the heat generating member 567*a*** alone.

The embodiment having the described construction operates in a manner which will be explained hereinunder.

The explanation will be first given as to the case where the recording is to be conducted in the color tone of the first ink layer 572.

In this case, the recording signal is supplied only to the heat generating member **567*a* of the thermal head 567**.

In this state, the carriage 557 is moved to the right and the take-up reel **565*b* takes up the thermal transferable member 569 through the operation of an intermediate gear (not shown) which meshes with a rack gear 557*a***.

The thermal transferable member is then separated from the print paper 552 after traveling the distance l' which is large enough to allow the molten portion to be cooled. In consequence, the melts **572*a*, 573*a* of the first and the second ink layers 572, 573 are left on the print paper 552, in such a manner that the melt 572*a* of the first ink layer 572 is visible, whereby the recording is done in the color tone peculiar to the first ink layer 572**.

Conversely, when it is desired to effect recording in the color tone of the second ink layer 573, electric current for the purpose of preservation of heat is applied to the heat generating member 577 after application of the heat to the heat generating member **567*a* of the thermal head for the purpose of recording. Therefore, the thermal transferable member, after being supplied with the recording heat energy, is supplied with the additional heat for the preservation of temperature by the heat generating member 577 during traveling the distance l before it is separated from the print paper 552**.

In consequence, only the melt **573*a* of the second ink layer 573 is transferred to the print paper 552, whereby the recording is made in the color tone of the second ink layer 573**.

As has been described, this embodiment incorporates a temperature preserving heating means adapted to be energized selectively, so that the necessity for the control of the heat generating energy to be supplied to a single heat generating member, which heretofore has been necessary in the conventional apparatus, can be dispensed with. This in turn eliminates the necessity for a complicated control system for realizing a complicated control software, thereby enabling the control circuit to be simplified.

It is possible to form the thermal head 567 and the heating means 576 from the same mass of the same material and to arrange them so as to correctly face each other across the thermal transferable member and the recording medium. This arrangement will develop the same temperature condition on both sides of the thermal transferable member so that any necessary compensation for a change in the thermal condition due to a change in the ambient air temperature can be conducted easily by a simplified control circuit.

Furthermore, it is possible to apply heat to the boundary between the first and the second ink layers from the same side as the recording medium, i.e., without causing the heat to penetrate the first ink layer.

Figure 126:
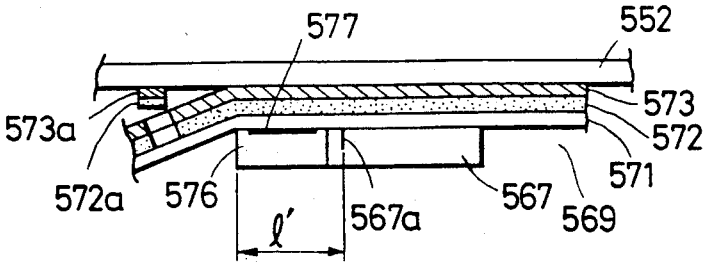
Figure 127:
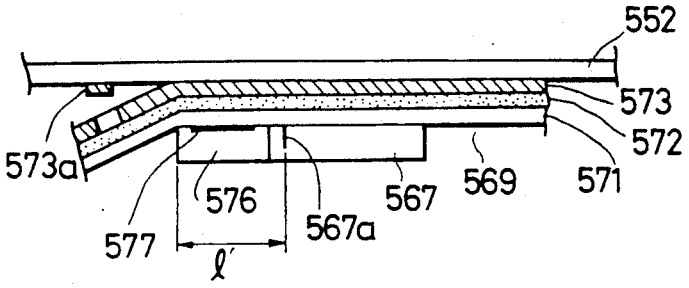

In the embodiment described above, the thermal head 567 and the heating means 576 are arranged to face each other across the print paper 552 and the thermal transferable member 569. This, however, is not exclusive and the arrangement may be such that the thermal head 567 and the heating means 576 are arranged in a side-by-side fashion as shown in FIGS. 126 and 127. Such an arrangement produces the same effect as that produced by the arrangement described before, by the selective energization of the heat generating member 577 of the heating means 576 being selectively activated.

In this case also, the thermal transferable member 596 is allowed to be separated from the print paper 552 after running the distance l' necessary for the cooling of the heated thermal transferable member so that the recording is conducted in the color tone of the first ink layer as shown in FIG. 126.

In contrast, by energizing the heat generating member 577 selectively, the recording is conducted in the color tone of the second ink layer 573 as shown in FIG. 127.

In this case, however, the heating means does not produce any effect for eliminating the influence of the change in the ambient temperature, because it is disposed in a side-by-side relation to the thermal head.

Although in the described embodiment the thermal transferable member has only two ink layers, i.e., the first and second ink layers, it is possible to make use of a thermal transferable member having three or more ink layers, in combination with suitable control means for controlling the levels of energy applied to the heat generating members or in combination with a multiplicity of heat generating members, thereby to conduct multi-color printing.

In the described embodiment, the thermal transferable member is a ribbon-type member. This, however, is not exclusive and the described embodiment can be modified to operate with a wide sheet-like thermal transferable member stored in the form of a roll. In such an occasion, a suitable case is used in place of the ribbon cassette.

Furthermore, the described embodiment may be modified such that the platen is moved along a stationary carriage, though in the described embodiment the carriage is moved along the platen which is stationary.

As will be understood from the foregoing description, this embodiment employs a heat-preserving heating means disposed in the vicinity of the thermal head and movable together with the carriage. The heating means is selectively activated in accordance with the color tone in which the recording is to be conducted. The selective activation of the heating means produces the same effect as that produced by a change in the position at which the thermal transferable member having a plurality of transfer agent layers is separated from the print paper, thereby ensuring that the recording is conducted in the desired different colors.

These advantageous effects can be attained with a simple construction which is easy to produce, contributing to a remarkable reduction in the production cost.

A further embodiment will be described hereinunder with reference to FIGS. 128 to 132.

This embodiment features a switching lever provided on the ribbon cassette and carrying the guide member for guiding the ink ribbon, i.e., the thermal transferable member.

In operation, the position of the switching lever is changed in accordance with the recording color to be selected so as to change the position at which the ink ribbon is separated from the recording medium, thereby enabling different recording colors to be used selectively.

Figure 128:
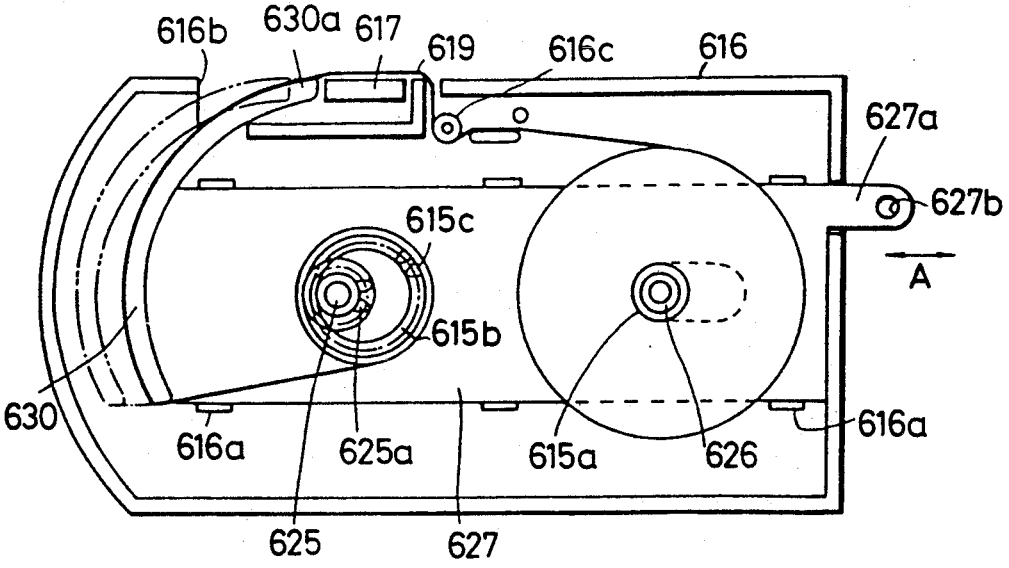
FIG. 128 is a plan view of an essential portion of a further embodiment of the present invention.
Figure 129:
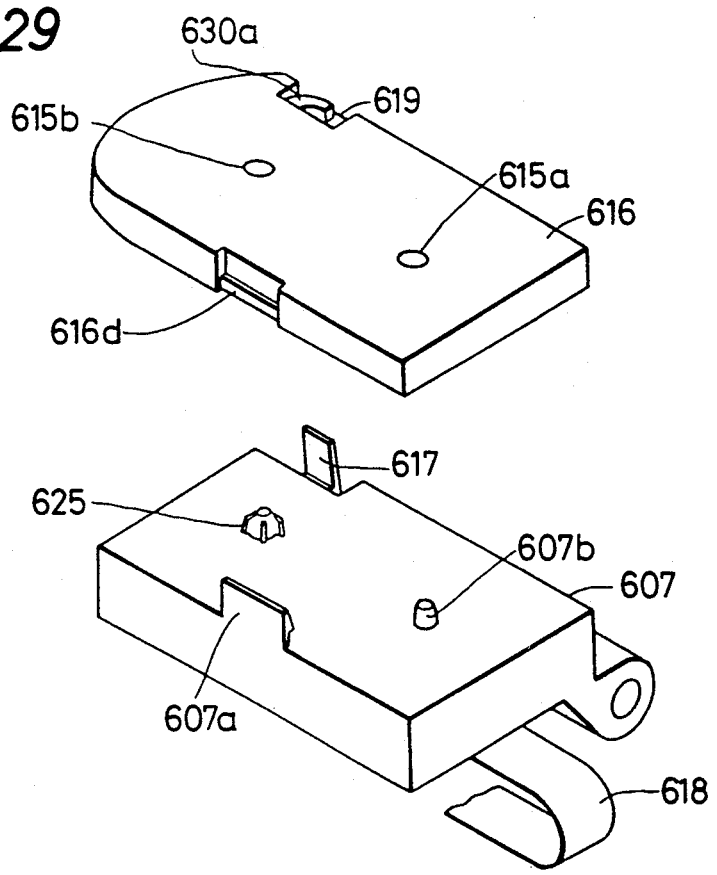
FIG. 129 is a perspective view of a ribbon cassette and a carriage.

FIG. 128 shows the detail of the ink ribbon cassette used in this embodiment.

Referring to FIG. 128, a reference numeral 625 denotes a drive shaft which is rotatably mounted on the carriage 607. The drive shaft 625 is provided on the outer peripheral surface thereof with a gear 625*a*.

The drive shaft 625 is adapted to be driven by the aforementioned rack gear 607*a* through an intermediate gear which is not shown.

A driven or idle shaft 626 also is rotatably mounted on the carriage. A supply reel 615*a* is mounted on the idle shaft 626 for free rotation thereon.

The aforementioned switching lever is denoted by a reference numeral 627. The switching lever 627 has an elongated flat sheet-like form.

A projection 617*a* is provided on one end of the switching lever 627. The projection 627*a* slidably extends through a hole in a side wall of the ribbon cassette 616 so as to be manipulated externally.

The projection 627*a* is provided on one end thereof with an aperture 627*b* which receives a shaft 628*a* projecting from an operation lever 628 (see FIG. 130) provided on the carriage 607.

The operation lever 628 is adapted to be driven by, for example, a solenoid (not shown) in accordance with the color changing command, so as to move reciprocatingly in the direction of the arrows A, i.e., in the directions parallel to the platen 604.

On the other hand, the switching lever 627 is adapted to be moved linearly to the left and right by means of a plurality of guide members 616*a* provided on the ribbon cassette 616. The switching lever 627 is provided with an elongated hole for receiving the idle shaft 626. The elongated hole 629 extends in the direction of the arrow A, and the idle shaft 626 carrying a take-up reel of a considerably large diameter is received in this hole 629.

The take-up reel 615*b* is provided with an internal gear 615*c* constituted by gear teeth formed on the inner peripheral surface thereof. The internal gear 615*c* meshes with the gear 625*a* on the drive shaft 625.

The inside diameter of the take-up reel 615*b* is substantially the same as the length of the elongated hole 629.

A guide member 630, which is shown in an arcuate form by way of example, is formed on the end of the switching lever 627 integrally therewith.

One end of the guide member 630 is received in an opening 616*b* formed in a portion of the ribbon cassette 616 adjacent to the platen 604 so as to be exposed to the outside through the opening 616*b*.

The thermal transferable member (ink ribbon) 619 supplied from the supply reel 615*a* is led around a guide pin 616*c* in the ribbon cassette and is extracted to be exposed through the aforementioned opening 616*b*. The thermal transferable member is then guided along the outer peripheral surface of the guide member 630 and is taken-up by the take-up reel 615*b*.

A thermal head 617 is disposed inside the thermal transferable member 619 at a position in the vicinity of the end 630*a* of the guide member 630.

A step 616*d* is provided on one longitudinal side of the ribbon cassette 616 so as to be engaged by a resilient engaging or latching member 607*a* which is formed on the carriage 607 to project therefrom.

The carriage 607 is provided with a drive shaft 626 and also with an idle shaft 607*b* adapted to fit in the supply reel 615*a*.

The operation of this embodiment having the described embodiment is as follows.

A description will be made first as to the case where the recording is conducted only in the color tone of the second ink layer 623. The operation in this case is as follows.

As the ribbon cassette 616 is mounted on the carriage 607, the shaft 628*a* on the operation lever 628 fits in the aperture 627*b* formed in the projection 627*a* of the switching lever 627.

In this case, the operation lever 628 is set at the position for recording by the second ink layer 623, and the shaft 628*a* is received in the aperture 627*b*.

In this state, the projection 627*a* has been fully extracted and the switching lever 627 is located at the right end of its stroke as viewed in FIG. 128.

Figure 131:
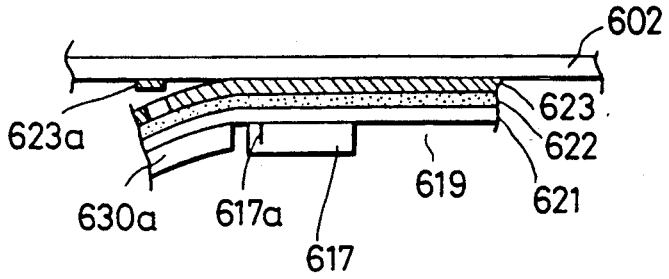
FIGS. 131 and 132 are illustrations of transfer recording method.

Therefore, the guide member 630 is in the right end of its stroke, with the end 630*a* thereof located at the position closest to the heat generating member (heater portion) 617*a* of the thermal head 617. This state is shown in FIG. 131.

Then, the energy is supplied to the heat generating member 617*a* in accordance with the recording command, while the carriage 607 runs to the right, so that heat energy is supplied to the heat generating member 617*a*. In this case, the thermal transferable member 619 is separated from the print paper 602 immediately after the application of the heat energy.

In consequence, only the melt of the second ink layer 623 is transferred to the print paper 602 as indicated at 623*a*, so that only the color tone of the second ink layer appears on the print paper 602.

The following operation is performed when it is desired to record in the color tone possessed by the first ink layer 622.

Figure 130:
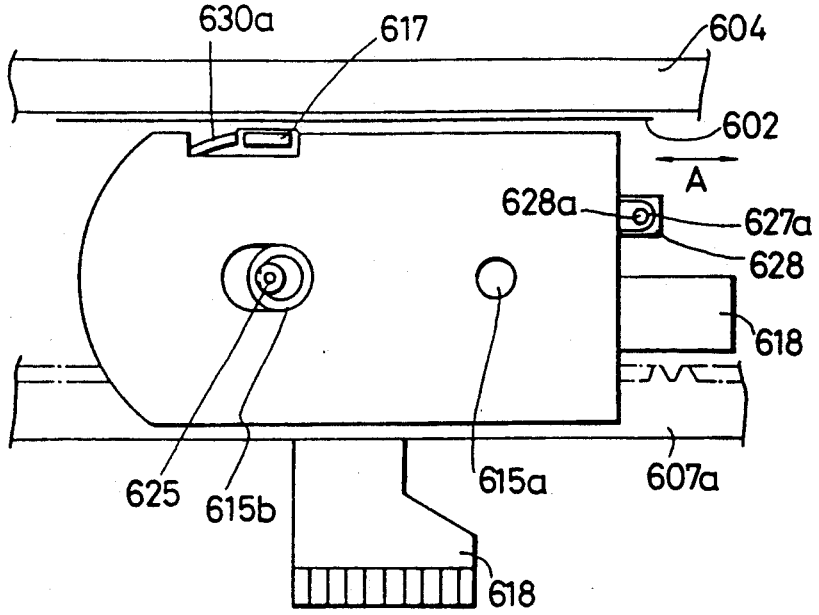
FIG. 130 is a plan view of the ribbon cassette in the mounted state.

When a recording command for recording in the color tone of the first ink layer 622 is given by the control section which is not shown, actuating means such as a solenoid (not shown) is operated to move the operation lever 628 to the left as viewed in FIG. 130.

As a result, the switching lever 627 is moved to the left as viewed in FIG. 128, accompanied by the movement of the take-up reel 615*b* in the same direction so that the gear 625*a* on the drive shaft 625 meshes with the internal gear 615*c* at the side opposite to that shown in FIG. 128.

Figure 132:
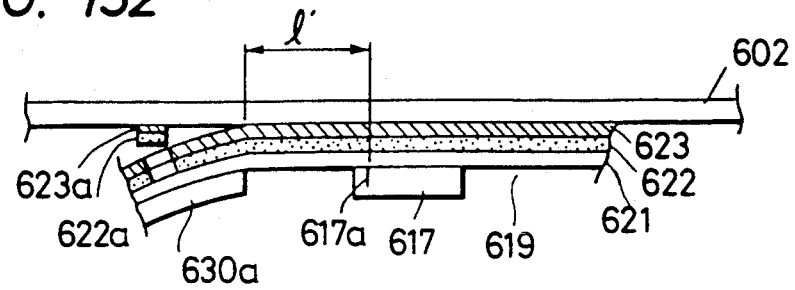

The movement of the switching lever 627 also causes the guide member 630 to be moved to the left as shown in FIG. 132.

In consequence, the end 630*a* of the guide member 630 is spaced from the heat generating member by a distance l'. Therefore, the thermal transferable member 619 is allowed to be separated from the print paper 602 only after traveling the distance l' from the position of the heat generating member 617*a*. That is, the timing of the separation of the thermal transferable member from the print paper 602 is delayed by a length of time corresponding to the distance l' of travel.

As a result, the melt 623*a* of the second ink layer 623 and the melt 622*a* of the first ink layer 622 are transferred to the print paper 602 such that the melt 622*a* of the first ink layer 622 overlies the melt 623*a* of the second ink layer 623, so that the color tone of the first ink layer 622 appears on the print paper 602, thus accomplishing recording in this color tone.

As will be understood from the foregoing description, in this embodiment, the timing of separation of the thermal transferable member from the print paper is varied simply by operating the switching lever, thereby to ensure that the recording is conducted in selected colors.

Although the thermal transferable member used in this embodiment has only two layers of the transferable materials, this is not exclusive and the arrangement may be such that the recording is conducted in multiple colors by using a thermal transferable member having two, three or more transferable layers in combination with the switching lever which is switchable over a plurality of stages.

It is to be noted also that the ribbon-type thermal transferable member used in the described embodiment is only illustrative and may be substituted by a wide sheet-like member stored in the form of a roll. In such an occasion, a suitable case is used in place of the ribbon cassette.

The use of inks as the transferable material also is illustrative and other types of materials such as heat-sublimatable substances and other chemical substances may be used equally well.

Furthermore, the described embodiment may be modified such that the platen is moved relative to the carriage which is kept stationary, though in the described embodiment the carriage is moved relative to the platen which is kept stationary.

As has been described, in this embodiment, a switching lever provided on the cassette is operated by a suitable operation means on the carriage such as an operation lever in accordance with the recording color to be selected, so that the position of the guide member integral with the switching lever is changed to vary the timing of separation of the thermal transferable member from the recording medium. It is thus possible to selectively obtain different recording colors without fail, by quite a simple construction of the apparatus.

A further embodiment will be described hereinunder with reference to FIGS. 133 to 142.

In this embodiment, the timing of separation of the thermal transferable member having a plurality of layers of transferable materials having different colors from the print paper is varied by a guide member which is provided on the cassette, and an operation member for operating this guide member also is provided on the cassette such as to be engaged by an engaging portion on the main body of the recording apparatus.

In operation, the carriage carrying the ink ribbon cassette is moved to the position where the operation member engages with the engaging portion, so that the guide member is selectively extracted from and retracted into the cassette, thereby changing the position and, hence, the timing at which the ink ribbon is separated from the print paper, thereby enabling the recording to be conducted selectively in different colors.

The detail of this embodiment will be described hereinunder with reference to the drawings.

Figure 133:
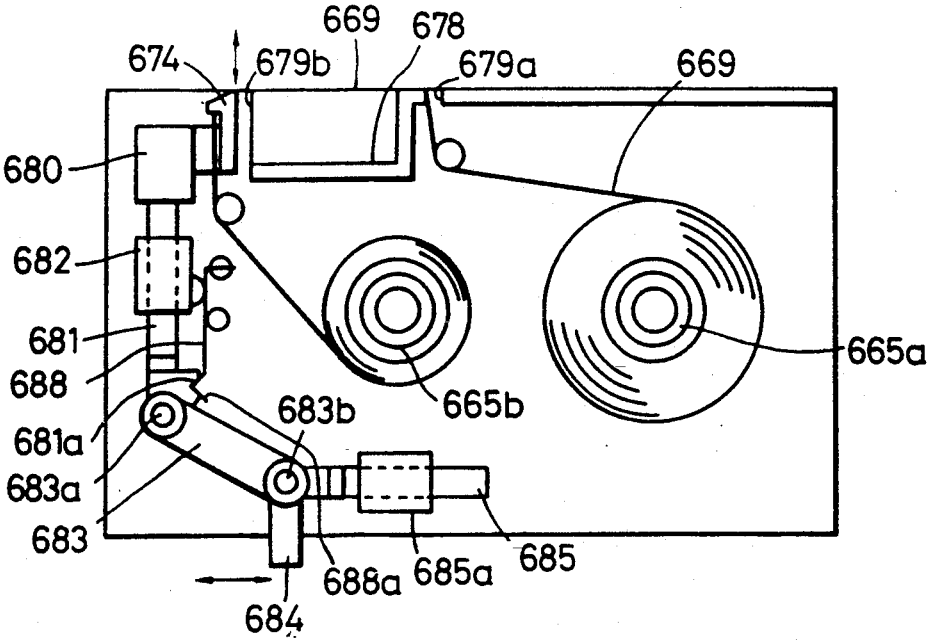
FIG. 133 is a plan view of a ribbon cassette in accordance with a further embodiment of the present invention.
Figure 134:
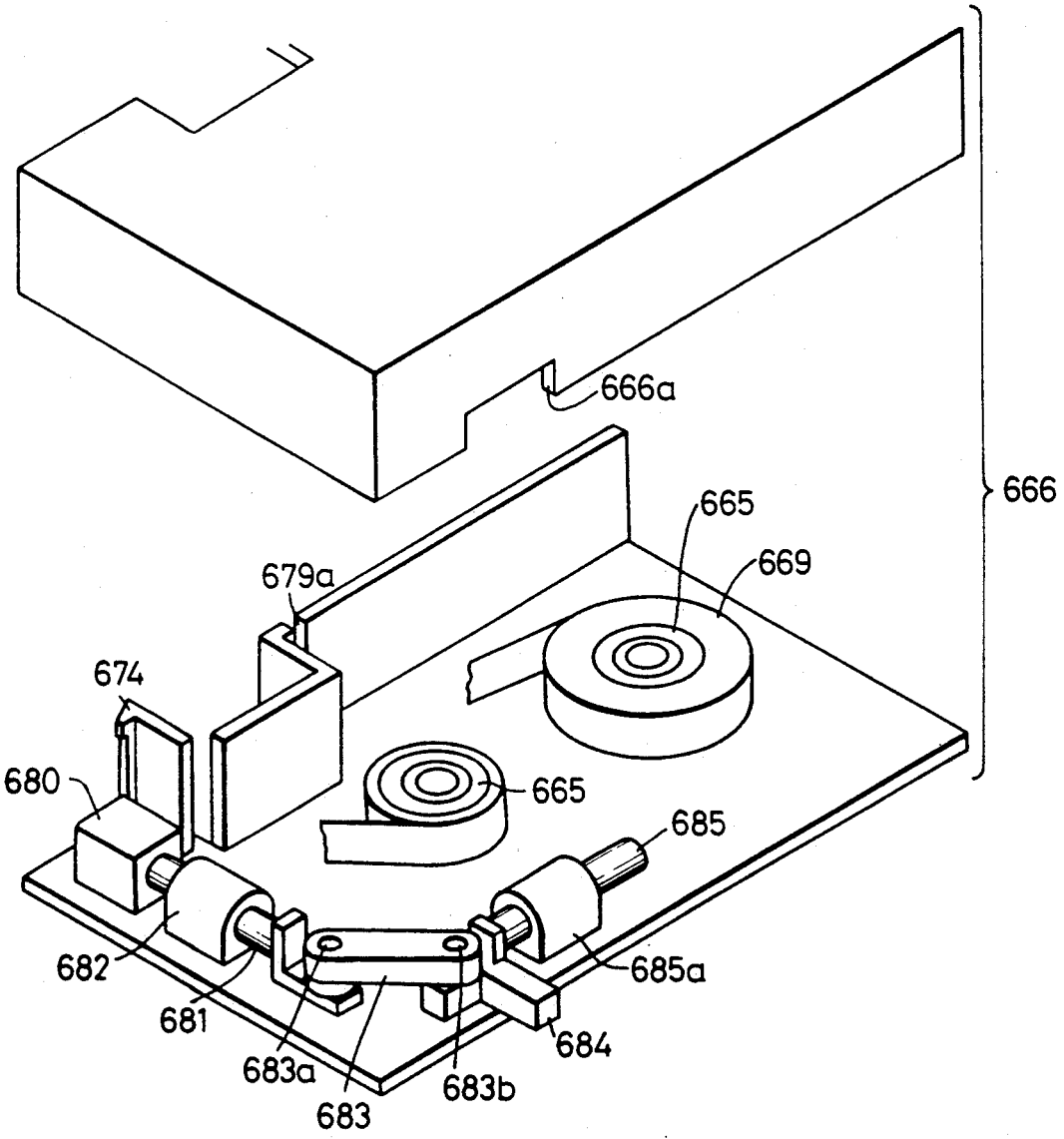
FIG. 134 is an exploded perspective view of the ribbon cassette shown in FIG. 134.
Figure 135:
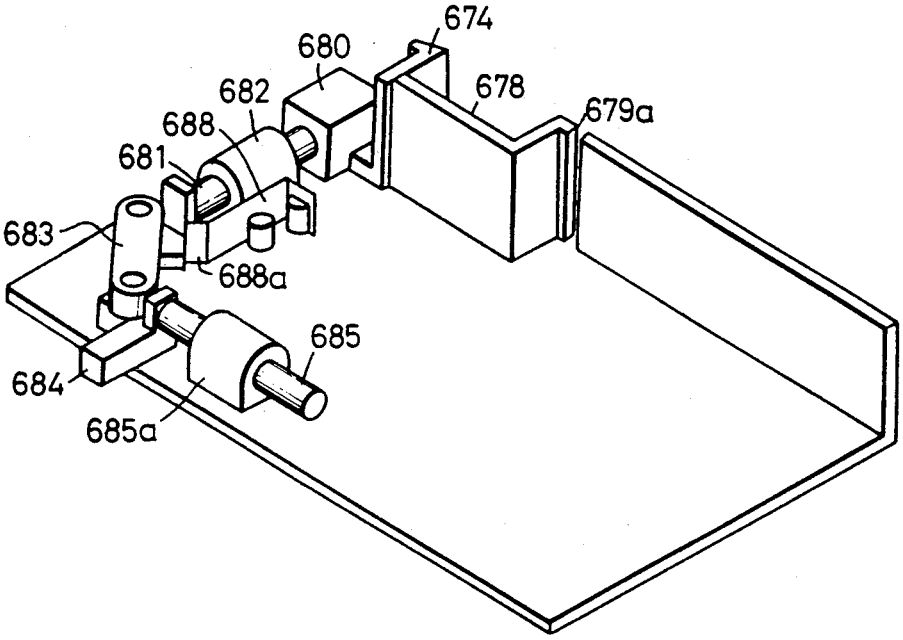
Figure 136:
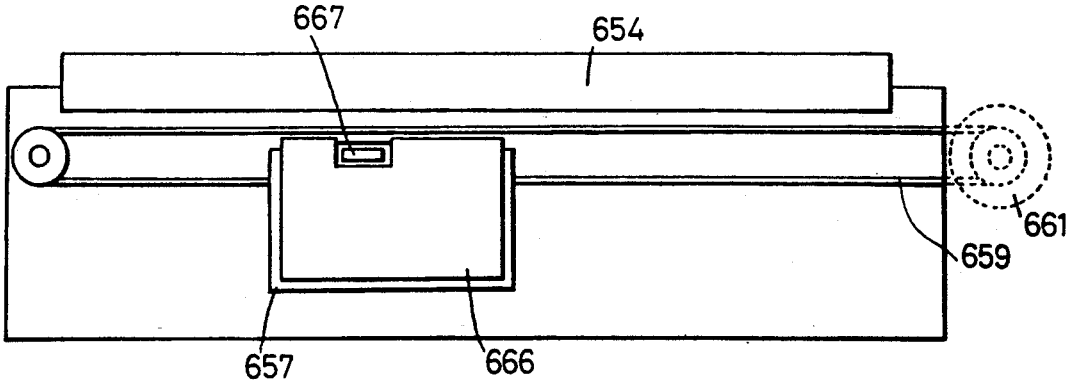
FIG. 136 is a plan view of an essential portion of the ribbon cassette.

FIGS. 133 to 135 show the detail of a ribbon cassette carrying out this embodiment of the invention. Referring to these Figures, a thermal transferable member 669 accommodated in a ribbon cassette 666 has one end fixed to and wound on the surface of a rotatable supply reel 665*a*. The other end of the thermal transferable member 669 is connected to and wound on a take-up reel 665*b* which also is rotatable. The thermal transferable member 669 is adapted to be driven in the direction of the arrow A as the reel 665*b* is rotated counterclockwise.

A cut-out 678 is formed in the left upper corner of the ribbon cassette 666. The thermal transferable member 669 is extracted from the ribbon cassette through one end of the cut-out 678 and retracted into the same through the other end of the cut-out 678. A thermal head 667 for applying heat energy to the thermal transferable member 669 is adapted to be positioned in the cut-out 678 behind the thermal transferable member 669.

A guide member 674 is disposed in the vicinity of the opening 679*b*. The guide member 674 has a flat tabular form with a width greater than that of the thermal transferable member 669 as shown in FIG. 134, and is integrated with a block 680.

The block 680 is fixed to the end of the shaft 681 which is slidably received in a bearing 682 provided on the cassette.

A link lever 683 is pivotally connected at its one end to the rear end of the shaft 681 through a pin 683. The other end of the link lever 683 is connected to an operation member 684 through a pin 683*b*.

The operation member 684 is provided integrally on one end of a shaft 685 which is orthogonal to the shaft 681. The shaft 685 is slidably received by a bearing 685*a*. The operation member 684 projects outward through an opening 666*a* formed in a portion of the case constituting the ink ribbon cassette 666. At the same time, a leaf spring 688 is disposed so as to extend along the shaft 681. A V-shaped bend 688 is formed on the free end of the shaft 681. The bend 688*a* fits in a V-shaped groove 681*a* formed in the rear end of the shaft 681.

The leaf spring 688 serves to hold the shaft 681 at the position shown in FIG. 133 so as to abut the rear end of the shaft 681 when the latter is moved forward in a manner explained later, thereby preventing the shaft 681 from being retracted.

On the other hand, engaging members 686, 687 engageable with the operation member 684 are provided on the main part of the recording apparatus, as shown in FIGS. 137 to 140. One of the engaging members (member 686) is positioned on the outer side of the home position, while the other engaging member 687 is located on the outer side of the return position. Both engaging members 686 and 687 project by amounts large enough to engage with the operation member 684.

The ink ribbon cassette having the described construction is detachably secured to the carriage 657. The take-up reel 665*b* is adapted to be driven by a driving device (not shown) so as to take-up the ink ribbon.

With the ribbon cassette having the described construction, the recording apparatus of this embodiment operates in a manner which will be explained hereinunder.

The description will be first made as to the case where the recording is conducted in a normal mode of operation, i.e., for recording data in a basic color which is used most frequently, e.g., black.

In such a case, the carriage 657 reciprocates so as to conduct the recording within a stroke range in which it contacts neither the left engaging member 686 nor the right engaging member 687.

Meanwhile, the V-shaped bend 688*a* of the leaf spring 688 fits in the notch 681*a* formed in the rear end of the shaft 681, so that the guide member 674 is disposed in the ribbon cassette so that the thermal head 667 alone presses the print paper, so that the recording is conducted by the second ink layer alone.

Figure 137:
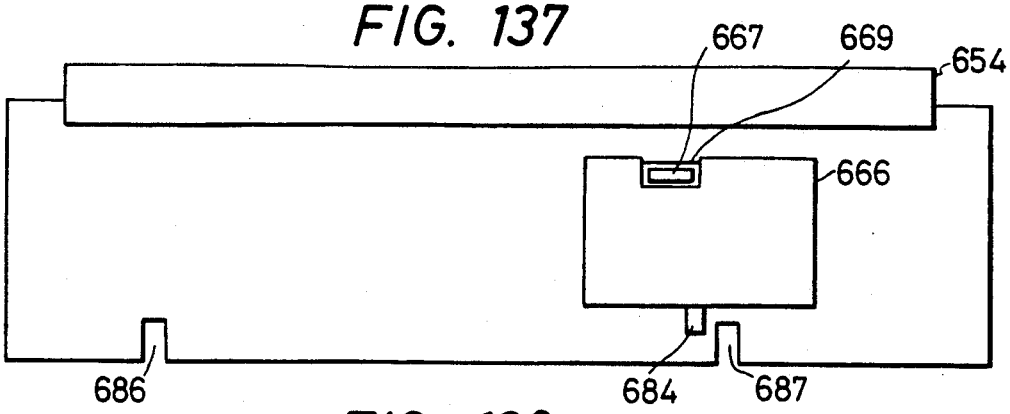
FIGS. 137 to 140 are illustrations of operation.
Figure 138:
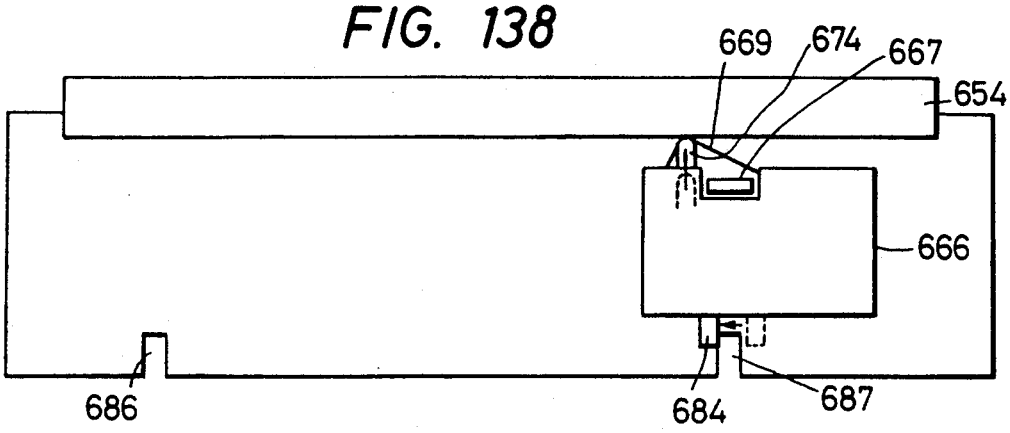

Conversely, when it is desired to conduct the recording in the color tone of the first ink layer 672, the carriage is moved beyond the return position shown in FIG. 137 in accordance with the command given by the controller which is not shown, so that the operation member 684 is allowed to engage with the engaging member 687, thereby urging the operation member to the left as viewed in the drawing.

In consequence, the shaft 681 is pressed through the link lever 683 so that the leaf spring 688 is elastically deformed to come off the groove 681*a*, thereby causing the guide member 674 to project from the cassette.

Figure 142:
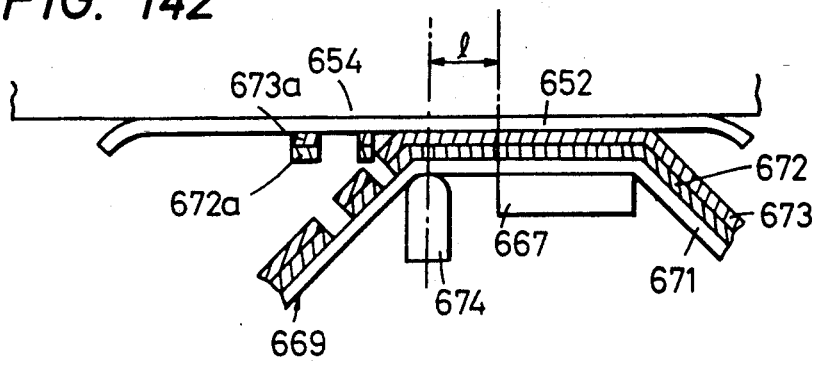

This state of the apparatus is shown in FIG. 142. In this case, since the thermal transferable member 669 is allowed to be separated from the print paper 652 only after it has cleared the guide member 674, the recording is conducted in the color tone of the first ink layer 672 as explained before.

Figure 139:
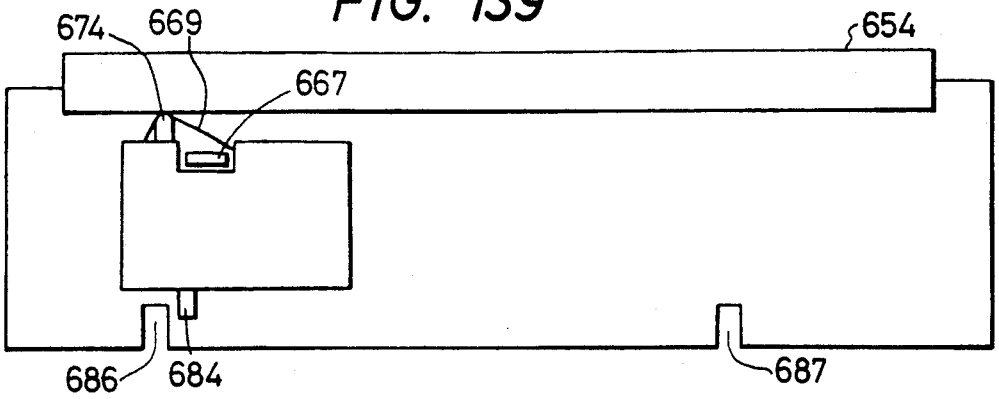
Figure 140:
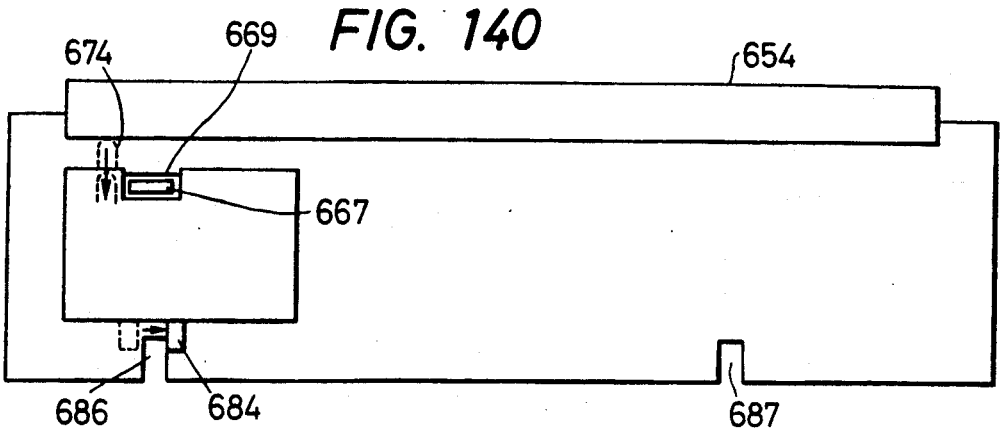
Figure 141:
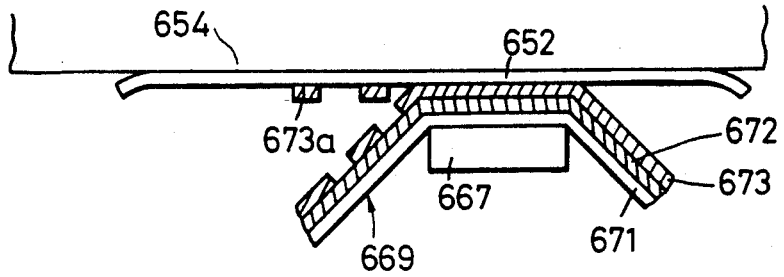
FIGS. 141 and 142 are illustrations of the recording method.

When it is desired to recover the original or the basic recording color again, the carriage is moved outward beyond the home position as shown in FIGS. 139 and 140. In consequence, the operation member 684 is engaged by the left engaging, member 686 so as to be pressed to the right so that the shaft 681 is pulled through the link lever 683 thereby to retract the guide member 674 into the ribbon cassette, whereby the apparatus becomes ready for the recording on the color tone of the second ink layer 673.

Although the thermal transferable member has been described as being a ribbon-type member, this is not exclusive and the thermal transferable member may be a wide sheet-type member prepared in the form of a roll. In such a case, a suitable case is used in place of the described ribbon cassette.

It is also to be understood that the use of inks as the transferable material also is illustrative and other types of materials such as heat-sublimatable substances and other chemical substances may be used equally well.

Furthermore, the described embodiment may be modified such that the platen is moved relative to the carriage which is kept stationary, though in the described embodiment the carriage is moved relative to the platen which is kept stationary.

As has been described, in this embodiment, the guide member which serves to vary the timing of separation of the thermal transferable member from the print paper is operated as a result of movement of the carriage, by means of engaging members which are provided on the main part of the recording apparatus. It is thus possible to change the timing of separation of the thermal transferable member from the print paper, simply by moving the carriage into engagement with a selected one of the engaging members.

Although two-color printing has been specifically described, it will be clear that this embodiment can be applied to printing in three or more colors, as well as to printing in the same color with different densities and printing in exactly the same color.

Thus, this embodiment of the invention provides an image recording apparatus capable of recording images in clear color tones, as well as an ink sheet cassette suitable for use in such an image recording apparatus.

A further embodiment will be described hereinunder with reference to FIGS. 143 to 156.

In this embodiment, a guide member for varying the timing of separation of the thermal transferable member from the recording medium is provided on the cassette and is operatively connected to the thermal head provided on a carriage which supports the cassette, so that the guide member is operated in relation to the movement of the thermal head. With this arrangement, it is possible to extract and retract the guide member into and out of the cassette by making use of the up/down operation of the thermal head, thereby changing the position and, hence, the timing at which the ink ribbon is separated from the print paper, thereby enabling the recording to be conducted in different color tones.

Figure 143:
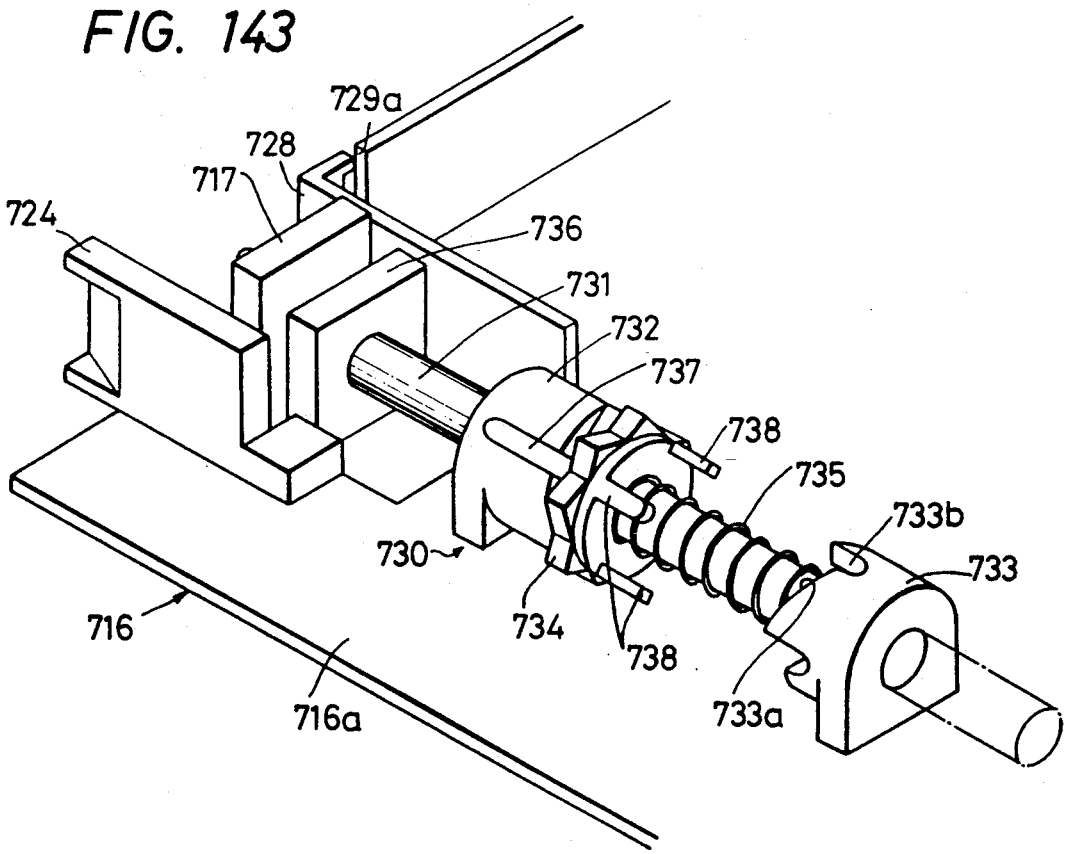
FIG. 143 is a perspective view of a switching mechanism.
Figure 144:
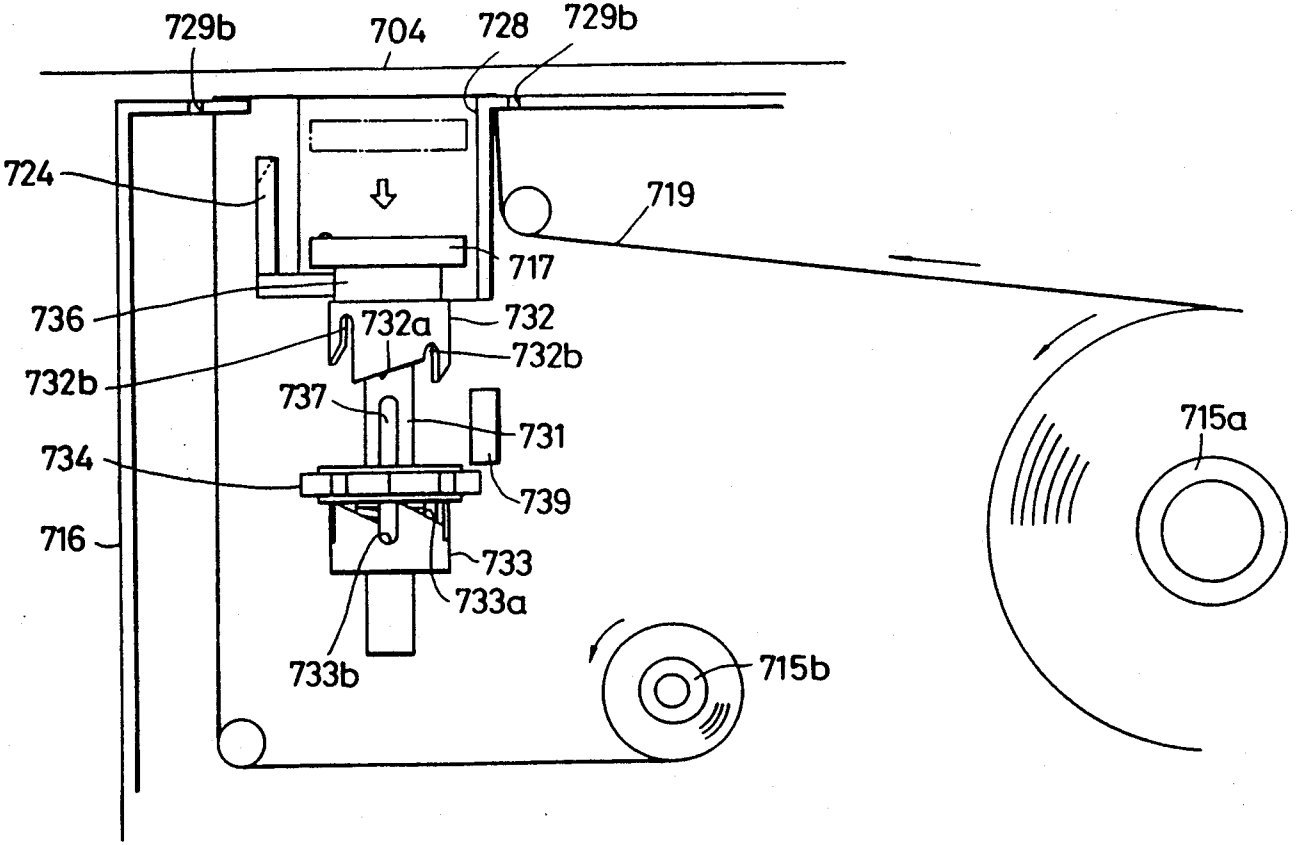
FIG. 144 is a plan view of an essential portion.
Figure 145:
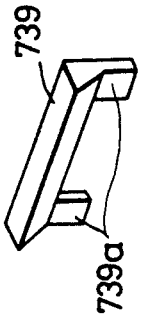
FIG. 145 is a perspective view of a detent.

FIGS. 143 to 145 show the detail of a ribbon cassette in accordance with the invention. Referring to these Figures, the ribbon cassette 716 accommodates a ribbon-type thermal transferable member 719 one end of which is wound on a rotatable supply reel 715*a* while the other end is wound on a take-up reel 715*b* which also is rotatable. The arrangement is such that the thermal transferable member 719 runs in the direction of the arrow A as the reel 715*b* is driven counterclockwise.

A cut-out 728 is formed in the left upper corner of the ribbon cassette 716 as viewed in these Figures. The thermal transferable member 719 is extracted out of the cassette through one end opening 729*a* of the cut out 728 and is retracted into the cassette 716 through the other end opening of the cut out 728. A thermal head 717 for applying heat energy to the thermal transferable member 719 is insertable into the cut out 728 so as to occupy a position behind the thermal transferable member 719.

A guide member 724 is disposed in the vicinity of the cut-out 729*b*. As will be seen from FIG. 145, the guide member 724 constitutes a portion of a switching mechanism 730.

The switching mechanism 730 is assembled on a shaft 731 which is disposed in the ribbon cassette 716 so as to extend orthogonally to the direction of running of the thermal transferable member.

Figures 146, 147, 148, 149, 150:
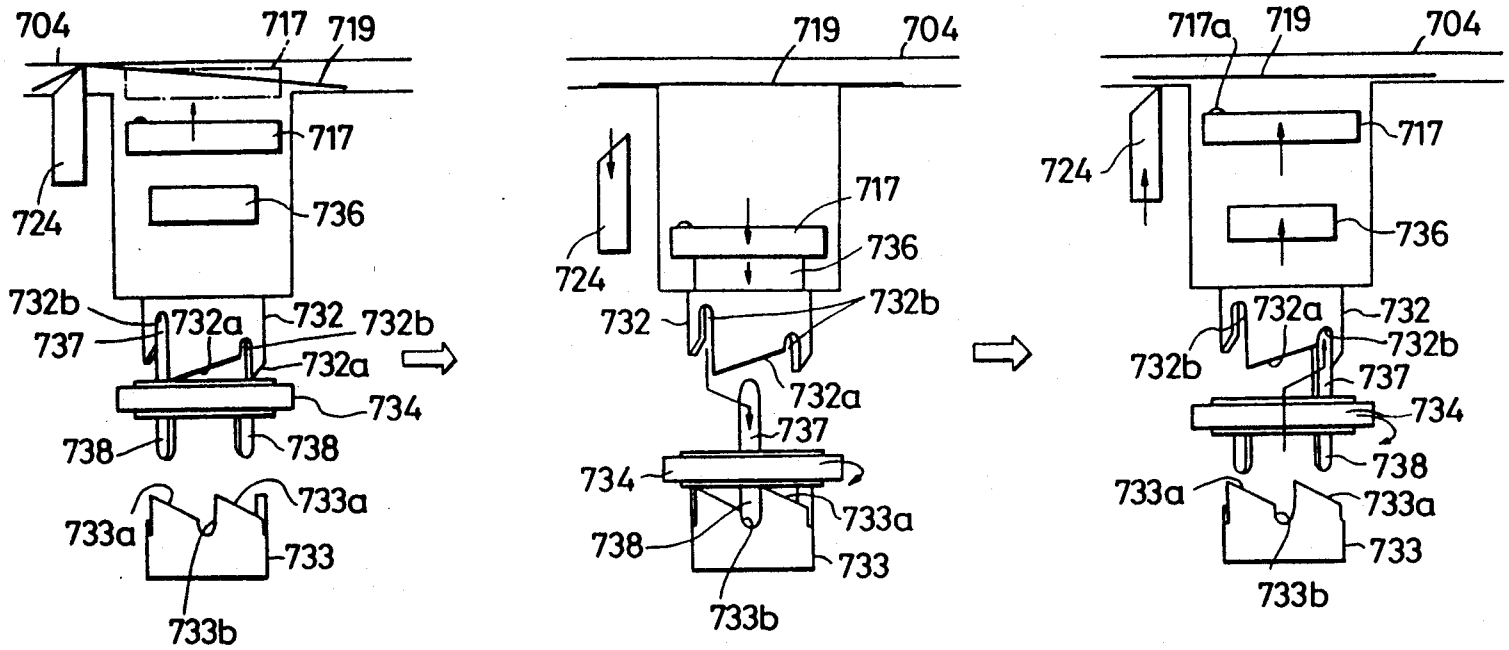
FIGS. 146 to 150 are illustrations of the switching operation.

The shaft 731 has both ends which are slidably guided by a pair of bearings 732, 733 fixed on a bottom plate 716*a* of the ribbon cassette 716. Both the bearings 732 and 733 are substantially the same in construction and are arranged in symmetry but the phases of cams and guide grooves on these bearings are 90° offset from each other. More specifically, as shown in FIG. 146, the end surface of one 732 of the bearings adjacent to the other 733 has cam surfaces 732*a* at a 90° interval in the circumferential direction, such that each cam surface 732*a* is deepened progressively towards the thermal transferable member 719. A guide groove 732*a* is formed so as to extend in the axial direction of the shaft 731 between each pair of adjacent cam surfaces 732*a*. The depth of the guide grooves 732*b* formed in the bearing 732 are so varied that deeper grooves and shallower grooves appear alternatingly at 90° intervals in the circumferential direction.

The other bearing 733 has later-mentioned similar guide grooves but the depth of these guide grooves is constant. The other bearing 733 also has cam surfaces 733*a* formed at 90° intervals in the circumferential direction on the surface thereof adjacent to the bearing 732.

The cam surfaces 733*a* on the bearing 733 are tapered in the direction opposite to the direction of taper of the cam surfaces 732*a* on the bearing 732. In addition, 90° phase difference is formed between the cam surfaces 733*a* on the bearing 733 and the cam surfaces 732*a* on the bearing 732. As stated before, the adjacent cam surfaces 733*a* are separated from each other by the respective guide grooves 733*b* which extend in the axial direction. Consequently, the phase of the guide grooves 733*b* in the bearing 733 is 90° offset from the guide grooves 732*b* in the bearing 732.

A detent gear 734 is integrally fixed to the mid portion of the shaft 731 intermediate the bearings 732 and 733. A spring 735 is wound around the shaft 731 so as to act between the detent gear 734 and the bearing 733.

In consequence, the shaft 731 is always urged towards the opening 728 by the force of the spring 735.

To the end of the shaft 731 is fixed a switching member 736 for rotation within the opening 728. The aforementioned guide member 724 is integrally fixed to the switching member 736.

A projection 737 and projections 738 adapted to be received in the guide grooves 732*b* and 733*b* are projected from both sides of the detent gear 734 so as to extend in opposite directions therefrom at 90° intervals in the circumferential direction. The sole projection 737 is positioned in alignment with one of the projections 738. The projection 737 has a length which is about two times as large as that of the projection 737. In the illustrated embodiment, there are four projections 738 at 90° intervals.

A detent 739 is fixed to the cassette in parallel with the shaft 731. As shown in FIG. 145, the detent 739 has a substantially triangular form and is fixed to the bottom plate 716*a* through both legs 739*a*.

The detent 739 has a cross-sectional shape with an apex angle which is more acute than the angle of the valley of the detent gear 734.

The length of the detent 739 is so selected that, when the detent gear 734 has been moved to the position closest to the bearings 732 and 733 in a manner which will be described later, it comes off the detent gear 734 so as to allow the detent gear 734 to rotate.

The operation of this embodiment having the described embodiment is as follows.

Since the principle of the multi-color recording is substantially the same as that in the preceding embodiments, the description will be focused mainly on the control of the timing of separation of the thermal transferable member.

When the apparatus is in the stand-by position preparing for the recording, the thermal head 717 is positioned in the opening 728 of the ribbon cassette 716 mounted on the carriage and is held in the neutral state.

In this state, the shaft 731 and the switching member 736 have been moved forward by the force of the spring 735, as shown in FIG. 146, so that the projection 737 is received in the shallower guide groove 732*b* of the bearing 732 (see FIG. 150).

In this state, the detent gear 734 is positioned substantially at the mid position between the bearings 732 and 733 so that the switching member 736 and the guide member 724 integral therewith are allowed to travel forwardly only a small distance, so that the guide member 724 is still positioned within the ribbon cassette 716.

Thus, the apparatus is turned into the stand-by state preparing for the recording operation.

The recording operation is then commenced. The operation mode for recording in the color tone of the second ink layer, which color being the one which is used most frequently, is attained by moving the thermal head 717 alone so as to press the thermal transferable member 719 onto the platen 704 through the print paper.

Then, the heater portion 717*a* is activated to generate heat, thereby conducting the recording. In this case, the thermal transferable member 719 is pulled towards the ribbon cassette so as to be separated shortly after it leaves the thermal head 717, so that the recording is done in the color tone of the second ink layer.

Figure 151:
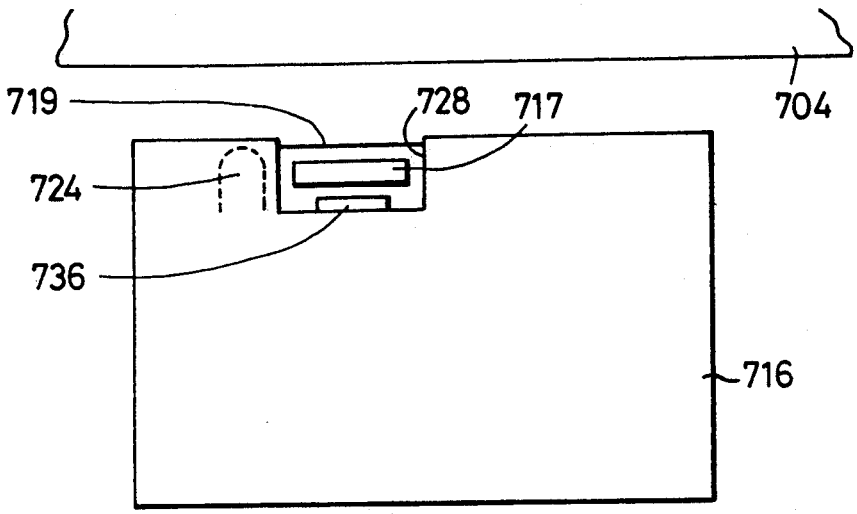
FIGS. 151 to 156 are plan views of the ribbon cassette explanatory of the switching operation.
Figure 152:
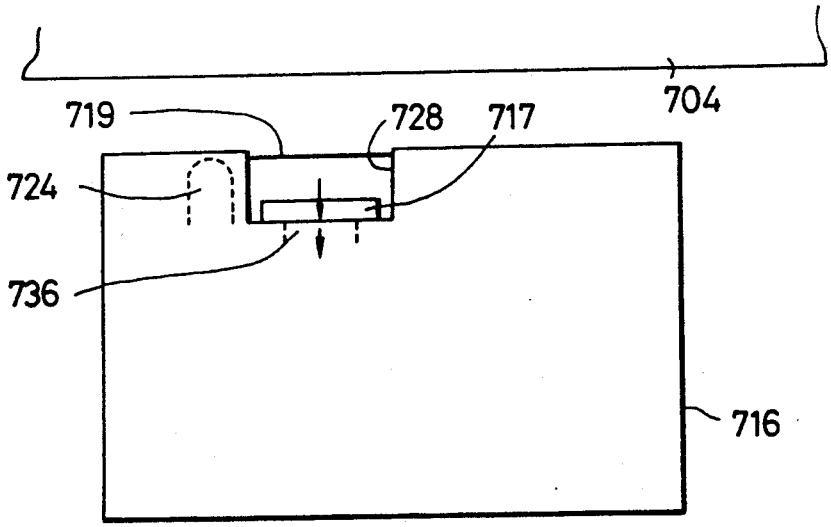
Figure 153:
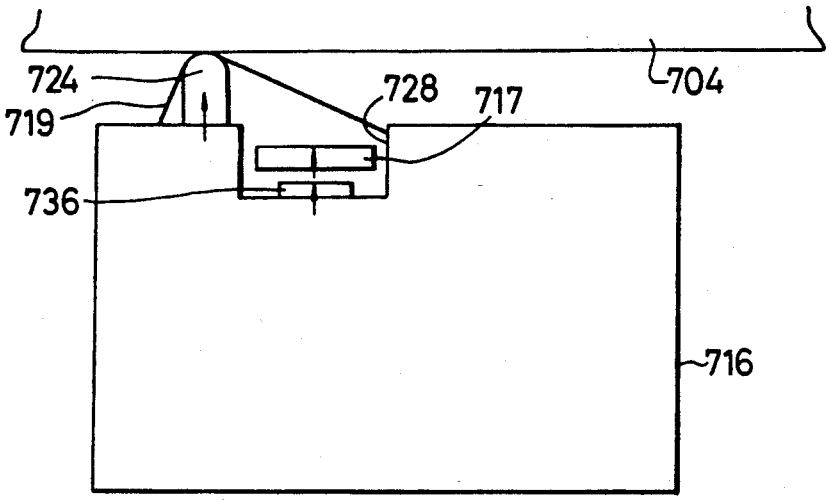
Figure 154:
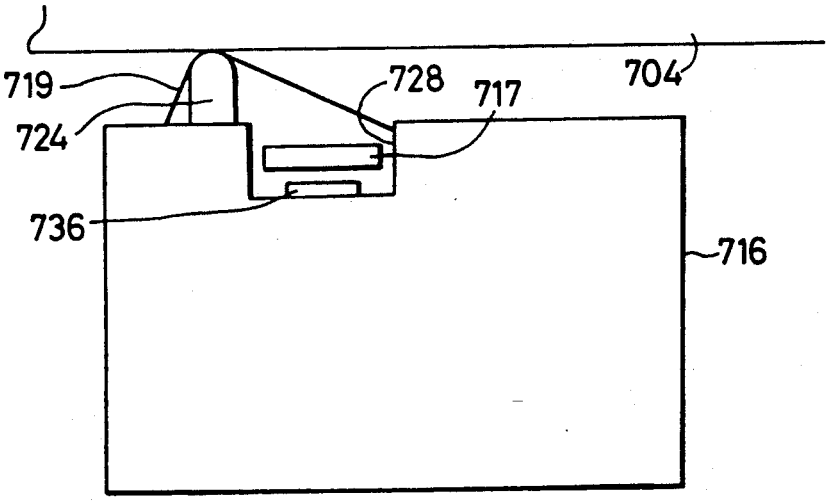

When it is desired to conduct the recording in the color tone of the first ink layer, head-up operation is conducted to move the thermal head 717 away from the platen 704 from the neutral position shown in FIGS. 150 and 151.

In consequence, the thermal head 717 contacts the switching member 736 so as to force it back together with the shaft 731 against the force of the spring 735. In consequence, the projection 737 comes off the shallow guide groove 732*b* and the projections 738 on the opposite side of the detent gear come into contact with the cam surface 732*a* of the bearing 733, so that the projections 738 slip along the cam surfaces 732*a* into the guide grooves 733*b*.

It will be seen that the movement of the projection 738 is conducted substantially at a 90° interval, so that the shaft 731 and the detent gear 734 are rotated through 90° in each operation.

After the completion of this operation, the thermal head 717 leaves the switching member 736.

In consequence, the shaft 731 is moved forward together with the switching member 736 by the resilient force of the spring 735 so that the projection 737 comes to fit in the adjacent deep guide groove 732.

In consequence, the shaft 731 and the switching member 736 are allowed to move a distance corresponding to the difference in the depth of the guide grooves, so that the guide member 724 also is moved forward so as to project from the ribbon cassette 716 towards the platen 704.

In this state, the thermal transferable member 719 is pulled towards the platen 704 by the guide member 724.

The operation described above is illustrated in FIGS. 152 to 154. As has been seen from FIG. 146, the thermal transferable member 719 is pressed onto the platen 704 by the guide member 724, at a position which is spaced by a predetermined distance from the thermal head 717, and is retracted into the ribbon cassette 716 after passing the guide member 724 which is spaced from the thermal head 717 by a predetermined distance.

In this case, therefore, the recording is conducted in the color tone of the first ink layer as explained before.

When it is desired to conduct the recording in the color tone of the second ink layer again after the completion of the recording in the color tone of the first ink layer, a head-up operation for raising the thermal head 717 is effected again so as to retract the switching member 736 and the shaft 731.

In consequence, the projection 737 comes off the deep guide groove 732 as shown in FIG. 148, and the projection 738 slides along the cam surface 733*a* into the guide groove 733*b*, so that the detent gear 734 makes a further 90° rotation.

Then, as the thermal head 717 is reset in this condition, the shaft 731 is moved forward by the force of the spring 735 so that the shaft 731 is moved ahead thereby bringing the projection 737 into engagement with the shallow groove 732, thereby retaining the guide member 724 at a position where it does not project from the cassette 716 as shown in FIG. 150.

Figure 155:
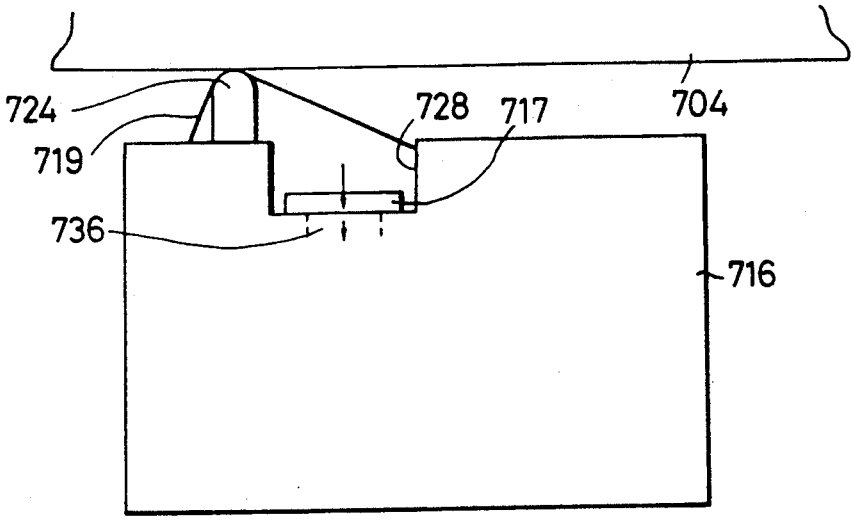
Figure 156:
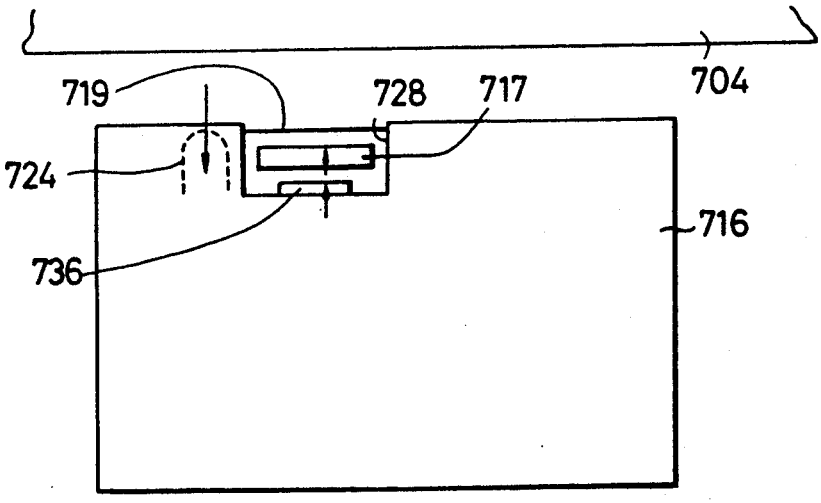

The above-described operation is illustrated in FIGS. 155 and 156. It will be understood that the recording is conducted again in the color tone of the second ink layer, as explained before.

The head-up and head-down operation for raising and lowering the thermal head 717 is conducted by rotating a suitable driving member such as a cam.

As has been described, in this embodiment of the invention, the guide member is projected and retracted from the cassette selectively in accordance with the movement of the thermal head, so as to vary the timing of separation of the thermal transferable member from the print paper, thereby conducting recording by the selective use of two recording colors.

As will be understood from the foregoing description, in the described embodiment of the invention, the mechanism for switching the position of a guide member which varies the separation timing is provided on the ribbon cassette, so that two-color recording is conducted simply by mounting the cassette.

In addition, the power for driving the switching mechanism is derived from the movement of the thermal head, so that necessity for any specific driving means is eliminated so as to simplify the construction.

We claim:

1. An image recording apparatus in which images are recorded on a recording medium by means of an ink sheet having a plurality of ink layers having different color tones on a substrate comprising:

a mounting portion for mounting said ink sheet;

recording means which is adapted to act on said ink sheet mounted on said mounting portion;

designating means for designating color tones of the images to be recorded on said recording medium;

means for discriminating a type of ink sheet mounted on said mounting portion; and control means for controlling, in accordance with the color tones designated by said designating means and in accordance with discrimination results of said discriminating means, a condition for separation of said ink sheet from said recording medium after an action of said recording means on said ink sheet.

2. An image record apparatus according to claim 1, wherein said ink sheet has at least a first ink layer and a second ink layer on said substrate, and a relationship between a magnitude of a first adhesion force between said second ink layer and said first ink layer and a magnitude of a second adhesion force between said substrate and said first ink layer is such that the magnitude of the first force is greater than the magnitude of the second force at high temperature and the relationship is reversed upon cooling such that the magnitude of the second force is greater than the magnitude of the first force.

3. An image recording apparatus according to claim 1, wherein ink layers of different said color tones are laminated on said substrate.

4. An image recording apparatus according to claim 1, wherein said control means is adapted for controlling a timing at which said ink sheet is separated from said recording medium.

5. An image recording apparatus according to claim 1, wherein said control means includes a member which is movable between a pressing position where it presses said ink sheet onto said recording medium and a retracted position where it is retracted from said pressing position.

6. An image recording apparatus according to claim 1, wherein said recording means includes a thermal head which is movable along said recording medium.

7. An image recording apparatus according to claim 1, wherein said recording means includes a thermal head which is provided with first and second heat generating members arranged in a direction relative to said ink sheet, and either one of said first and second heat generating members is selectively activated to generate heat in accordance with color tone data.

8. An image recording apparatus according to claim 1, wherein said recording means includes a thermal head which is provided with a main heat generating member and an auxiliary heat generating member, said heat generating members being adapted to be activated selectively either in a mode in which only the main heat generating member is activated or in another mode in which both the main and auxiliary heat generating members are activated.

9. An image recording apparatus according to claim 1, wherein said recording means includes a thermal head which varies a output temperature in accordance with color tone data.

10. An image recording apparatus according to claim 1, wherein said control means includes a member provided on a main part of said recording apparatus and movable between a pressing position where it presses said ink sheet onto said recording medium and a retracted position in which it has been retracted from said pressing position.

11. An image recording apparatus according to claim 1, wherein said ink sheet is accommodated in a cassette adapted to be detachably mounted on said mounting portion.

12. An image recording apparatus according to claim 1, wherein said ink sheet includes a correction ribbon and said control means is further adapted to control, in accordance with correction data, a condition of separation of said ink sheet from said recording medium after action of said recording means on said ink sheet.

13. An image recording apparatus according to claim 1, wherein both an ink sheet for recording and an ink sheet for a purpose of correction of recorded image are selectively mountable on said mounting portion.

14. An image recording apparatus according to claim 1, wherein said ink sheet comprises a two-colored ribbon and said mounting portion has two stages including a first stage for mounting a correction ribbon and a second stage for mounting said two-colored ribbon.

15. An image recording apparatus according to claim 1, wherein said control means is further adapted to control said recording means.

16. An image recording apparatus according to claim 1, wherein said control means includes a pressing member adapted to press said ink sheet onto the recording medium and said recording means is adapted to be moved up and down with respect to the recording medium in an interlocked relation with the movement of said pressing member.

17. An image recording apparatus according to claim 1, further comprising a driving power source and wherein said control means includes a pressing member for pressing an ink sheet onto the recording medium and said recording means is adapted to be moved up and down with respect to the recording medium by power derived from said driving power source which also drives said pressing member.

18. An image recording apparatus according to claim 1, wherein said control means varies a force with which said ink sheet is pressed onto said recording medium.

19. An image recording apparatus according to claim 1, wherein said control means is adapted to control a rate of generation of heat in said recording means.

20. An image recording apparatus according to claim 1, wherein said control means is provided downstream from a recording position where said ink sheet undergoes a recording operation as viewed in a direction of movement of said ink sheet.

21. An image recording apparatus according to claim 1, wherein said control means includes a slack take-up means for taking up any slack of said ink sheet which is caused when the timing of separation of said ink sheet from said recording medium is changed.

22. An image recording apparatus according to claim 1, wherein said control means is manually operable.

23. An image recording apparatus according to claim 1, wherein said designating means has a color tone change key and outputs a designating signal in response to actuation of said key.

24. An image recording apparatus according to claim 1, wherein said control means determines color of images to be recorded in accordance with a color designating signal outputted from said designating means.

25. An image recording apparatus according to claim 1, further comprising a carriage for carrying said recording means and wherein said control means controls a moving speed of said carriage in accordance with discrimination results of said discriminating means.

26. An image recording apparatus according to claim 1, wherein said recording means comprises a thermal head and said control means controls a heating condition of said thermal head in accordance with discrimination results of said discriminating means.

27. An image recording apparatus in which an image is recorded on a recording medium by means of an ink sheet having a plurality of ink layers having different color tones on a substrate, comprising:

a mounting portion for mounting said ink sheet;

recording means which is adapted to act on said ink sheet mounted on said mounting portion;

designating means for designating color tones of the image to be recorded on said recording medium;

control means for controlling, in accordance with the color tones designated by said designating means, a condition for separation of said ink sheet from said recording medium after an action of said recording means on said ink sheet, wherein said ink sheet is accommodated in a cassette adapted to be detachably mounted on said mounting portion, and said cassette has a member for pressing said ink sheet onto the recording medium.

28. An ink sheet cassette detachably mounted on an image recording apparatus for recording an image having a color tone in accordance with color tone information, said ink sheet cassette comprising:

an ink sheet having a plurality of ink layers having different colors on a substrate;

an ink sheet supply section for unwinding said ink sheet;

an ink sheet winding section for winding said ink sheet supplied from said ink sheet supply section;

a driving force receiving section for receiving a driving force for causing said ink sheet winding section to wind said ink sheet; and changing means which operates in accordance with color tones of the image to be recorded for changing a conveyance route from said ink sheet supply section to said ink sheet winding section so as to record images having different color tones by receiving the driving force from a body of said image recording apparatus.

29. An ink sheet cassette according to claim 28, wherein said ink sheet has at least a first ink layer and a second ink layer on said substrate, and a relationship between a magnitude of a first adhesion force between said second ink layer and said first ink layer and a magnitude of a second adhesion force between said substrate and said first ink layer is such that the magnitude of the first force is greater than the magnitude of the second force at high temperature and the relationship is reversed upon cooling such that the magnitude of the second force is greater than the magnitude of the first force.

* * * * *

UNITED STATES PATENT AND TRADEMARK OFFICE

CERTIFICATE OF CORRECTION

PATENT NO. : 5,175,563 Page 1 of 11

DATED : December 29, 1992

INVENTOR(S) : Hideo FUSHIMOTO, et al.

It is certified that error appears in the above-indentified patent and that said Letters Patent is hereby corrected as shown below:

On title page, item

[30] FOREIGN APPLICATION PRIORITY DATA:

"Mar. 24, 1986 [JP] Japan .....61-65081" (second occurrence) should be deleted.

AT [56] References Cited - FOREIGN PATENT DOCUMENTS:

After "60-173358 4/1985 Japan ." insert --61-137789 6/1986 Japan .--;

After "61-144377 9/1986 Japan ." insert --62-156994 7/1987 Japan .--.

COLUMN 2:

Line 59, "view" should read --views--.

COLUMN 3:

Line 27, "changing" should be deleted.

COLUMN 5:

Line 34, "has" should read --have--.

UNITED STATES PATENT AND TRADEMARK OFFICE

CERTIFICATE OF CORRECTION

PATENT NO. : 5,175,563 Page 2 of 11

DATED : December 29, 1992

INVENTOR(S) : Hideo FUSHIMOTO, et al.

It is certified that error appears in the above-indentified patent and that said Letters Patent is hereby corrected as shown below:

COLUMN 6:

Line 24, "beewax," should read --beeswax,--;

Line 56, "pint." should read --point.--.

COLUMN 8:

Line 14, "as" should read --of--.

COLUMN 10:

Line 50, "arrow 2B" should read --arrow B2--.

COLUMN 12:

Line 37, "been" should be deleted.

COLUMN 13:

Line 68, "roller 53c, 53d" should read --rollers 53c, 53d--.

COLUMN 17:

Line 33, "arrow 11," should read --arrow I1,--.

UNITED STATES PATENT AND TRADEMARK OFFICE

CERTIFICATE OF CORRECTION

PATENT NO. : 5,175,563 Page 3 of 11

DATED : December 29, 1992

INVENTOR(S) : Hideo FUSHIMOTO, et al.

It is certified that error appears in the above-indentified patent and that said Letters Patent is hereby corrected as shown below:

COLUMN 18:

Line 22, "lever" should read --lever 30--;

Line 43, "tracted" should be deleted;

Line 45, "arrow 11," should read --arrow I1,--.

COLUMN 20:

Line 46, "is ceased" should read --ceases--.

COLUMN 21:

Line 20, "ROM" should read --a ROM--.

COLUMN 24:

Line 19, "on" should read --to--.

COLUMN 25:

Line 18, "however" should read --however,--;

Line 27, "on" should read --in--.

UNITED STATES PATENT AND TRADEMARK OFFICE

CERTIFICATE OF CORRECTION

PATENT NO. : 5,175,563 Page 4 of 11

DATED : December 29, 1992

INVENTOR(S) : Hideo FUSHIMOTO, et al.

It is certified that error appears in the above-indentified patent and that said Letters Patent is hereby corrected as shown below:

COLUMN 26:

Line 52, "distance l" should read --distance m--;

Line 66, "basis" should read --basic--.

COLUMN 27:

Line 2, "or," should read --or--.

COLUMN 28:

Line 32, "100-1," should read --101-1,--; "paper 100-2," should read --paper 101-2,--; and "structure 100-3," should read --structure 101-3,--;

Line 33, "switch 100-4" should read --switch 101-4--;

Line 34, "keyboard 100-5." should read --keyboard 101-5.--;

Line 35, "100-6" should read --1-6--;

Line 37, "hood 100-3a." should read --hood 101-3a.--; and "switch 100-3a" should read --switch 1-6--;

UNITED STATES PATENT AND TRADEMARK OFFICE

CERTIFICATE OF CORRECTION

PATENT NO. : 5,175,563 Page 5 of 11

DATED : December 29, 1992

INVENTOR(S) : Hideo FUSHIMOTO, et al.

It is certified that error appears in the above-indentified patent and that said Letters Patent is hereby corrected as shown below:

Line 38, "hood 100-3a," should read --hood 101-3a,--.

COLUMN 29:

Line 33, "member" should read --member 130--.

COLUMN 30:

Line 13, "an" should read --and--;

Line 67, "angle θ′" should read --angle θ--.

COLUMN 32:

Line 21, "becomes" should read --comes--;

Line 51, "vi)" should read --iv)--.

COLUMN 33:

Line 1, "rest" should read --returned--;

Line 57, "ribbon 10" should read --ribbon 110--;

Line 65, "obtain" should read --obtained--.

UNITED STATES PATENT AND TRADEMARK OFFICE

CERTIFICATE OF CORRECTION

PATENT NO. : 5,175,563 Page 6 of 11

DATED : December 29, 1992

INVENTOR(S) : Hideo FUSHIMOTO, et al.

It is certified that error appears in the above-indentified patent and that said Letters Patent is hereby corrected as shown below:

COLUMN 34:

Line 39, "plate 42b" should read --plate 142b--.

Figure 37:
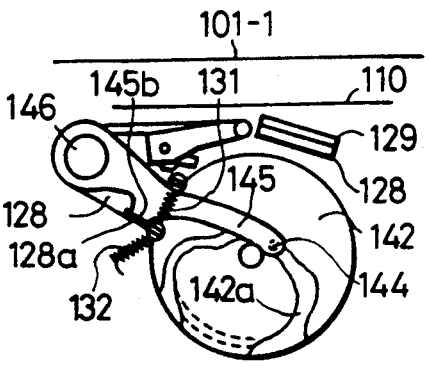
FIGS. 37 to 40 are illustrations of operation of a cam in the recording operation.
Figure 38:
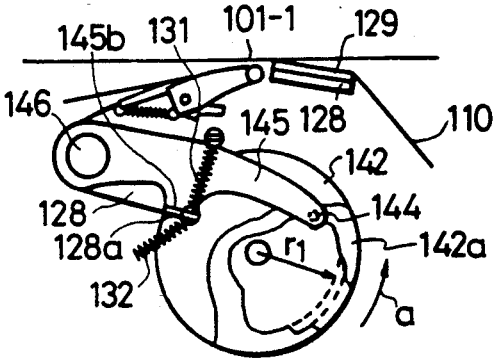
Figure 39:
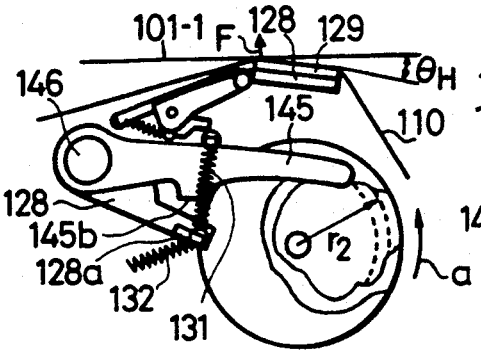

COLUMN 35:

Line 14, "in" should read --an--;

Line 41, "FIGS. 53" should read --FIG. 53--;

Line 56, "FIGS. 37" should read --FIGS. 38--.

COLUMN 36:

Line 7, "basis" should read --basic--;

Line 12, "carriage 14" should read --carriage 114--;

Line 37, "lever (0)" should read --level (0)--.

Figure 56:
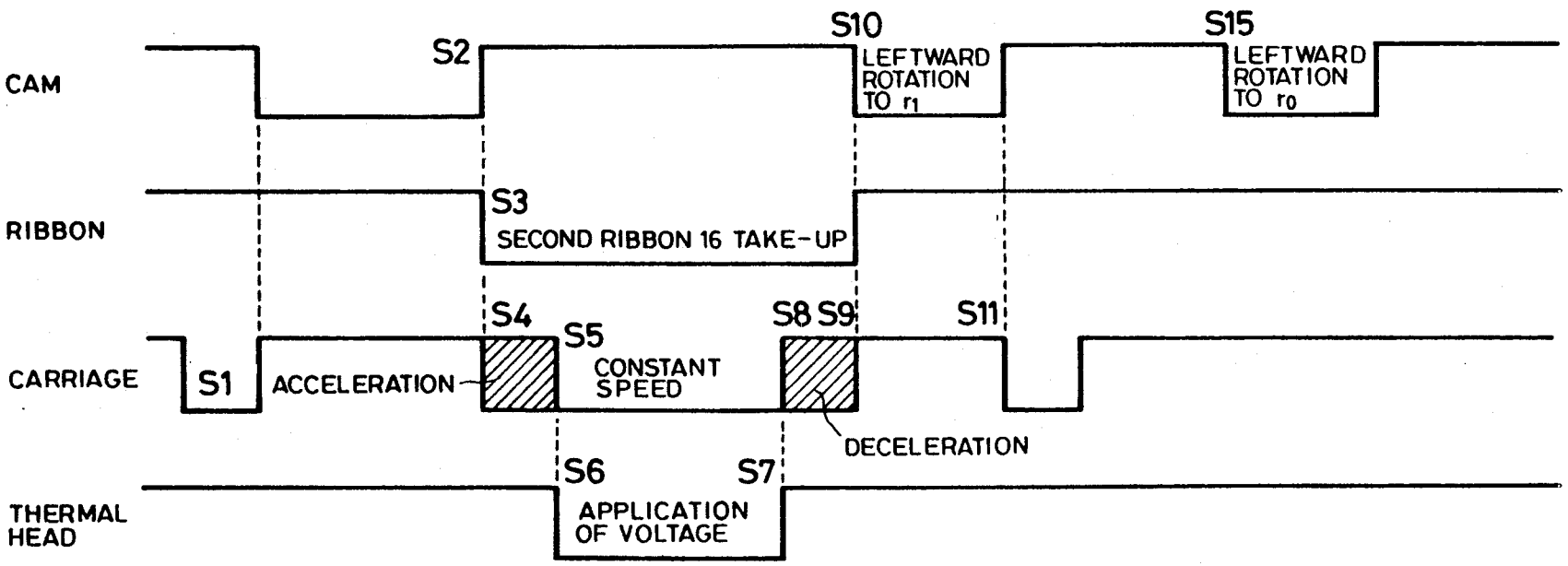

COLUMN 37:

Line 5, "FIG. 54" should read --FIG. 56--;

Line 67, "FIG. 59" should read --FIG. 58--.

UNITED STATES PATENT AND TRADEMARK OFFICE

CERTIFICATE OF CORRECTION

PATENT NO. : 5,175,563 Page 7 of 11

DATED : December 29, 1992

INVENTOR(S) : Hideo FUSHIMOTO, et al.

It is certified that error appears in the above-indentified patent and that said Letters Patent is hereby corrected as shown below:

COLUMN 38:

Line 16, "been" should be deleted.

COLUMN 40:

Line 35, "in which" should read --of--;

Line 57, "time c." should read --time C--;

Line 61, "maybe" should read --may be--.

COLUMN 41:

Line 11, "FIG. 67" should read --FIGS. 67--;

Line 44, "absence of an" should read --an absence of--;

Line 47, "H i" should read --H in--.

COLUMN 45:

Line 40, "tracting" should read --conveying--.

UNITED STATES PATENT AND TRADEMARK OFFICE

CERTIFICATE OF CORRECTION

PATENT NO. : 5,175,563 Page 8 of 11

DATED : December 29, 1992

INVENTOR(S) : Hideo FUSHIMOTO, et al.

It is certified that error appears in the above-indentified patent and that said Letters Patent is hereby corrected as shown below:

COLUMN 52:

Line 24, "layer 272" should read --layer 372--;

Line 63, "button 81" should read --button 381--.

COLUMN 53:

Line 3, "portions 376a and 376a" should read --portions 376a and 376b--;

Line 48, "in" should be deleted.

COLUMN 55:

Line 1, "operation" should read --operations--;

Line 2, "is" should read --are--;

Line 24, "where by" should read --whereby--.

COLUMN 57:

Line 19, "load" should read --loads--.

UNITED STATES PATENT AND TRADEMARK OFFICE

CERTIFICATE OF CORRECTION

PATENT NO. : 5,175,563 Page 9 of 11

DATED : December 29, 1992

INVENTOR(S) : Hideo FUSHIMOTO, et al.

It is certified that error appears in the above-indentified patent and that said Letters Patent is hereby corrected as shown below:

COLUMN 58:

Line 53, "carriage 467," should read --carriage 457,--;

Line 68, "arms" should read --cams--.

COLUMN 63:

Line 19, "large diameter" should read --large-diameter--;

Line 66, "370°" should read --270°--.

COLUMN 64:

Line 15, "platen 517 through the" should be deleted;

Line 16, "large diameter" should read --large-diameter--;

Line 28, "cam 517." should read --cam 518.--;

Line 60, "paper 2" should read --paper 452--.

COLUMN 67:

Line 38, "member 596" should read --member 569--.

UNITED STATES PATENT AND TRADEMARK OFFICE

CERTIFICATE OF CORRECTION

PATENT NO. : 5,175,563 Page 10 of 11

DATED : December 29, 1992

INVENTOR(S) : Hideo FUSHIMOTO, et al.

It is certified that error appears in the above-indentified patent and that said Letters Patent is hereby corrected as shown below:

COLUMN 69:

Line 33, "embodiment" should read --arrangement--.

COLUMN 71:

Line 50, "pin 683." should read --pin 683a.--;

Line 60, "V-shaped bend 688" should read --V-shaped bend 688a--.

COLUMN 72:

Line 55, "engaging," should read --engaging--;

Line 59, "on" should read --in--.

COLUMN 73:

Line 54, "cut out" should read --cut-out--;

Line 56, "cut out" should read --cut-out--;

Line 58, "cut out" should read --cut-out--;

Line 62, "from FIG. 145," should be deleted.

UNITED STATES PATENT AND TRADEMARK OFFICE

CERTIFICATE OF CORRECTION

PATENT NO. : 5,175,563 Page 11 of 11

DATED : December 29, 1992

INVENTOR(S) : Hideo FUSHIMOTO, et al.

It is certified that error appears in the above-indentified patent and that said Letters Patent is hereby corrected as shown below:

COLUMN 74:

Line 12, "groove 732a" should read --groove 732b--;

Line 54, "projection 737." should read --projection 738.--.

COLUMN 75:

Line 2, "embodiment" should read --arrangement--.

COLUMN 77:

Line 6, "record" should read --recording--;

Line 52, "a" should read --an--

Column 78:

Line 44, "the" should read --a--

Line 54, "color" should read --color tones--

Signed and Sealed this

Third Day of May, 1994

Bruce Lehman

*Attest:*

BRUCE LEHMAN

*Attesting Officer*

*Commissioner of Patents and Trademarks*